US007438027B1

(12) United States Patent
Hinderks

(10) Patent No.: US 7,438,027 B1
(45) Date of Patent: Oct. 21, 2008

(54) FLUID TRANSFER IN RECIPROCATING DEVICES

(76) Inventor: Mitja V. Hinderks, 619 Levering Ave., Los Angeles, CA (US) 90024

( * ) Notice: Subject to any disclaimer, the term of this patent is extended or adjusted under 35 U.S.C. 154(b) by 0 days.

(21) Appl. No.: 08/477,703

(22) Filed: Jun. 7, 1995

Related U.S. Application Data

(60) Division of application No. 08/441,117, filed on May 15, 1995, now abandoned, which is a continuation of application No. 08/287,429, filed on Aug. 9, 1994, now abandoned, which is a continuation of application No. 08/136,729, filed on Oct. 14, 1993, now abandoned, which is a continuation of application No. 07/982,424, filed on Nov. 27, 1992, now abandoned, which is a continuation of application No. 07/543,405, filed on Jun. 26, 1990, now abandoned, which is a continuation-in-part of application No. 07/237,761, filed on Aug. 29, 1988, now abandoned, which is a continuation-in-part of application No. 06/928,659, filed on Nov. 5, 1986, now abandoned, which is a continuation of application No. 06/804,332, filed on Dec. 5, 1985, now abandoned, which is a continuation of application No. 06/407,823, filed on Aug. 13, 1982, now abandoned, which is a continuation-in-part of application No. 05/737,099, filed on Oct. 29, 1976, now abandoned, which is a continuation of application No. 05/473,797, filed on May 28, 1974, now abandoned, which is a continuation-in-part of application No. 05/270,029, filed on Jul. 10, 1972, now abandoned.

(30) Foreign Application Priority Data

| | | |
|---|---|---|
| Jul. 8, 1971 | (GB) | 32228 |
| Apr. 10, 1972 | (GB) | 16450 |
| May 5, 1972 | (GB) | 21149 |
| May 18, 1972 | (GB) | 23485 |

(51) Int. Cl.
*F02B 75/32* (2006.01)

(52) U.S. Cl. ..... 123/43 R; 123/45 R; 123/197.1; 123/198 E; 74/22 R; 74/57

(58) Field of Classification Search ..... 123/73 AV, 123/43 R, 43 A, 43 B, 44 C, 44 D, 47 R, 123/58.5, 73 F, 73 FA, 668, 61 R, 25 C, 47 A; 91/196, 210
See application file for complete search history.

(56) References Cited

U.S. PATENT DOCUMENTS 680,465 A * 8/1901 Reynolds ..... 123/193.6

(Continued)

FOREIGN PATENT DOCUMENTS

DE 3607421 9/1987

(Continued)

*Primary Examiner*—Noah Kamen

(57) ABSTRACT

The disclosure relates to fluid working devices including reciprocating internal combustion engines and pumps. A number of arrangements for pistons and cylinders of unconventional configuration are described, many intended for use in IC engines operating without cooling. Included are toroidal combustion or working chambers, some with fluid flow through the core of the toroid, pistons reciprocating between pairs of working chambers, fluid processing volumes partly surrounding portions of the cylinder, tensile valve actuation, tensile links between piston and crankshaft, energy absorbing piston—crank links, crankshafts supported on gas bearings, cylinders rotating in housings, injectors having components reciprocate or rotate during fuel delivery. In some embodiments pistons may rotate while reciprocating. High temperature exhaust emissions systems are described, including those containing filamentary material, as are procedures for reducing emissions during cold start by means of valves at reaction volume exit.

181 Claims, 47 Drawing Sheets

U.S. PATENT DOCUMENTS

| | | | | | |
|---|---|---|---|---|---|
| 1,205,895 | A | * | 11/1916 | Hoyt | 123/197.1 |
| 1,293,766 | A | * | 2/1919 | Hammond | 123/73 AU |
| 1,620,100 | A | * | 3/1927 | Hoxton | 188/273 |
| 1,755,578 | A | * | 4/1930 | Goldsborough | 123/668 |
| 1,853,892 | A | * | 4/1932 | Boden | 123/198 E |
| 2,218,522 | A | * | 10/1940 | Butler | 123/25 C |
| 2,394,199 | A | * | 2/1946 | Myers | 123/41.3 |
| 2,918,045 | A | * | 12/1959 | Brown | 123/73 FA |
| 3,112,810 | A | * | 12/1963 | Nallinger | 123/198 E |
| 3,195,530 | A | * | 7/1965 | Heidner | 123/198 R |
| 3,276,539 | A | * | 10/1966 | Dear et al. | 181/204 |
| 3,340,855 | A | * | 9/1967 | Brown | 123/193.1 |
| 3,457,573 | A | * | 7/1969 | Patyna et al. | 411/395 |
| 3,503,716 | A | * | 3/1970 | Berger | 60/284 |
| 3,534,828 | A | * | 10/1970 | Harvey et al. | 123/198 E |
| 3,592,516 | A | * | 7/1971 | Standhardt | 123/193.1 |
| 4,341,826 | A | * | 7/1982 | Prewo et al. | 123/668 |
| 4,386,587 | A | | 6/1983 | Simko | |
| 4,796,572 | A | | 1/1989 | Heydrich | |
| 4,913,100 | A | * | 4/1990 | Eickmann | 123/61 R |
| 5,562,079 | A | | 10/1996 | Gray | |

FOREIGN PATENT DOCUMENTS

| | | | | | |
|---|---|---|---|---|---|
| DE | 3842802 | | | 6/1990 | |
| GB | 1338712 | | * | 11/1973 | 123/668 |
| JP | 62082236 | A | * | 4/1987 | |
| JP | 63235648 | A | * | 9/1988 | |

* cited by examiner

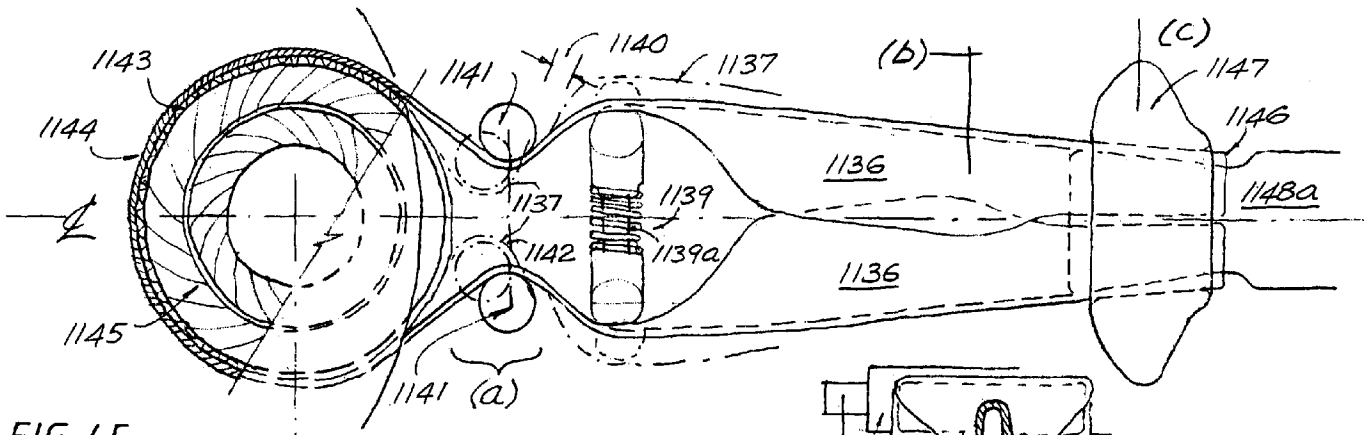
FIG. 45
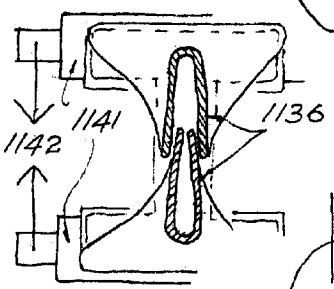
FIG. 47
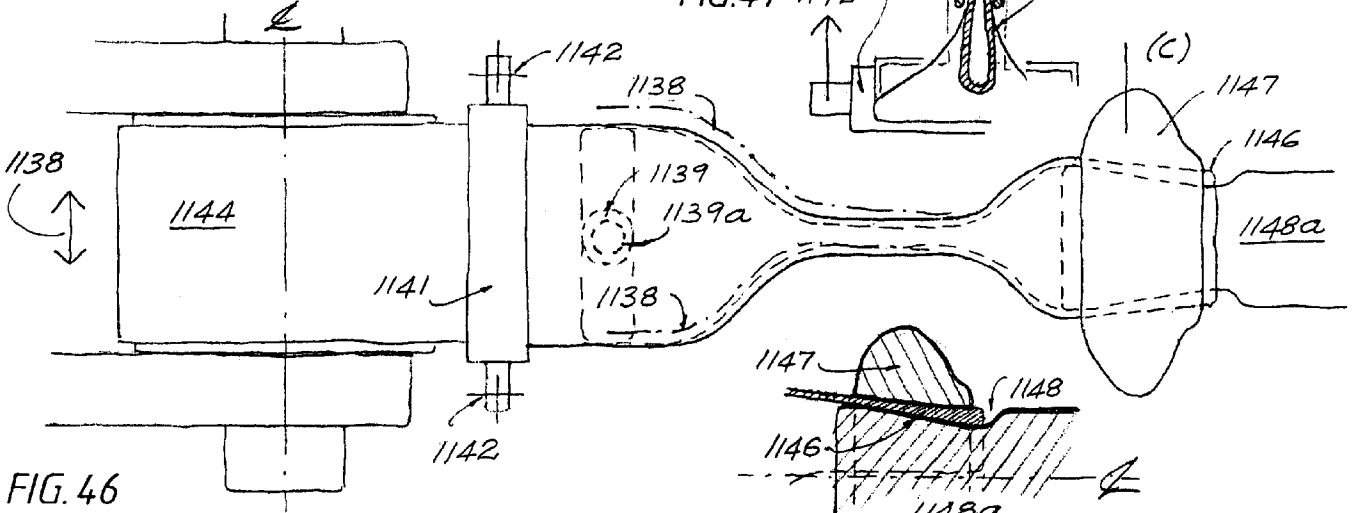
FIG. 46
FIG. 48

1228
1229
1201

1232
1230
1233
1231
1234
1235

1230

1247
1243
1245
1244
1248
1246
1249

1327
1251
1252
1253
1244
1249
1243
1327

1327
1244
1251
1249
1253
1243
1252
1245
A
1327
1244a
1328

1310
1311
1308
1309

1283
1299
1300
1284
R1
R2
R3

1297
1296
1293
1294
1288
1302
1282
1273
1285
1298
1295
1304
1303
1301

1244
1254
1243
P4
P5
P6
P7
1255

1287
1291
1286
1289
1290
1292

FIG. 113
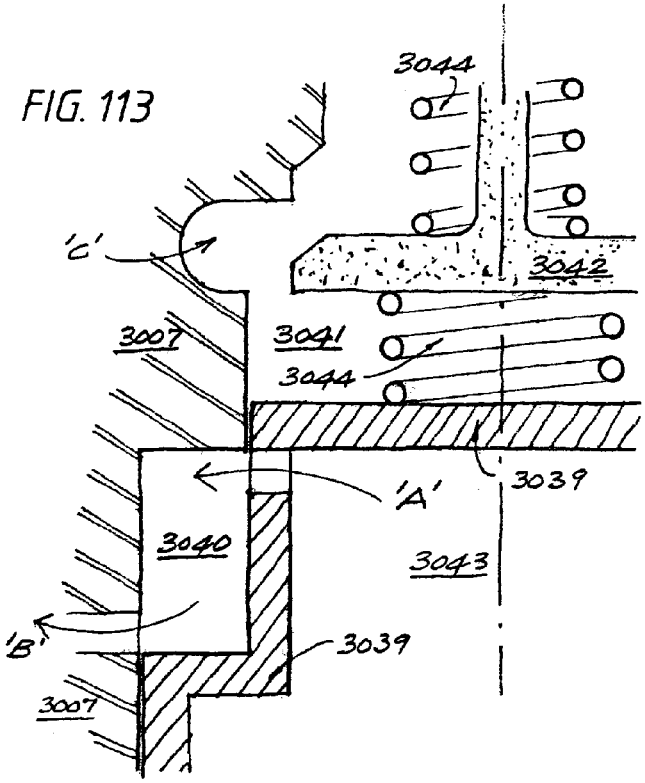
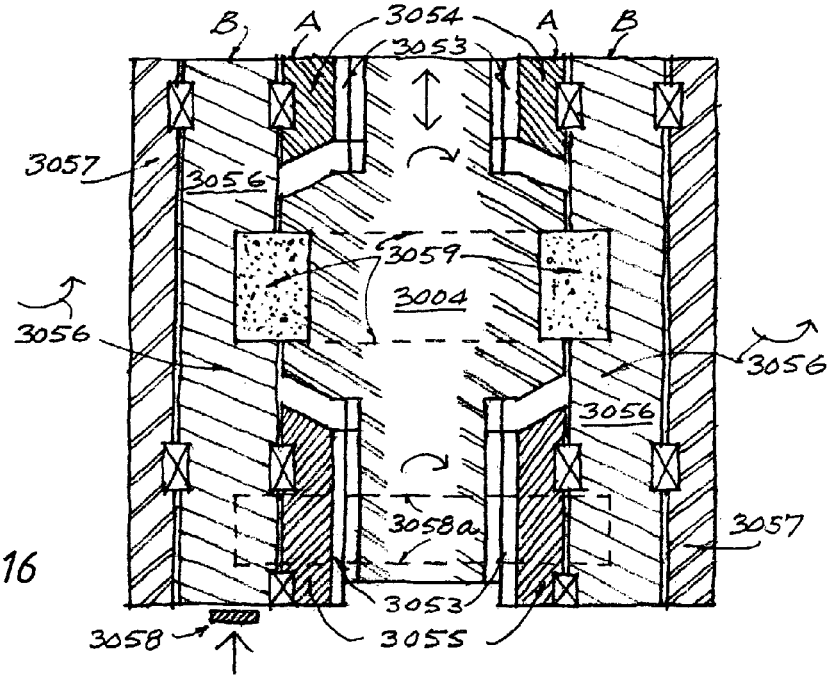
FIG. 116

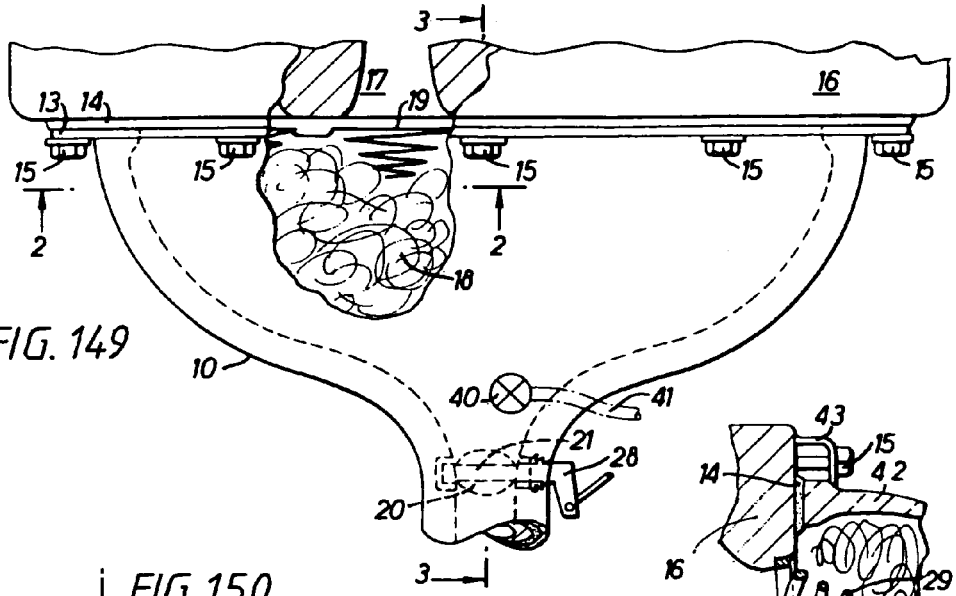
FIG. 149
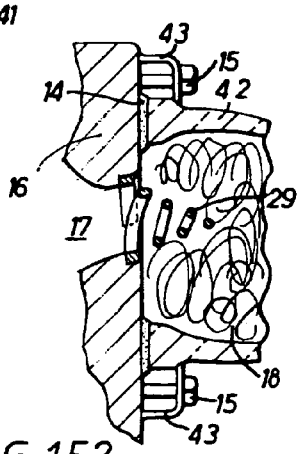
FIG. 152
FIG. 150
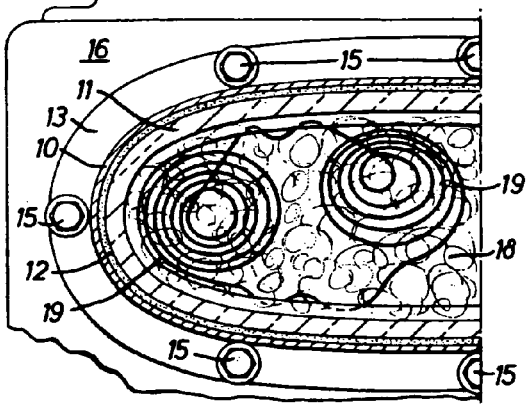
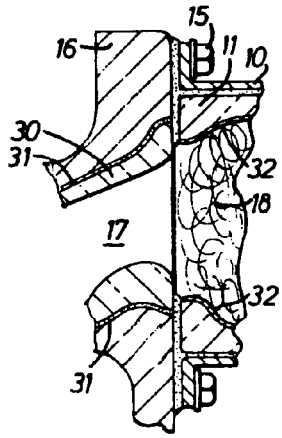
FIG. 153
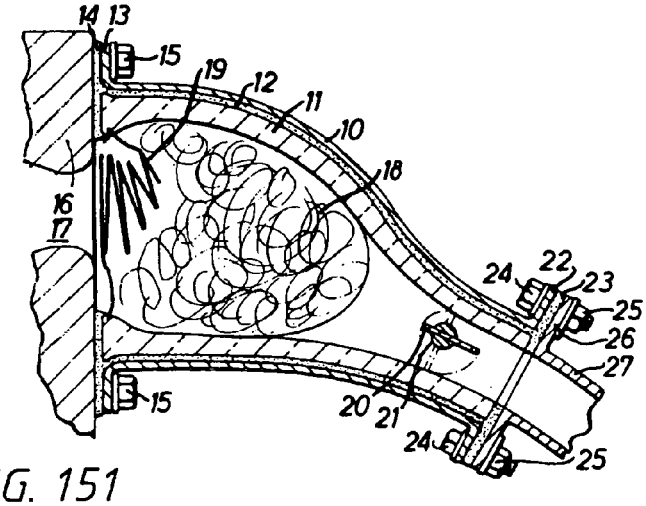
FIG. 151

FIG. 154
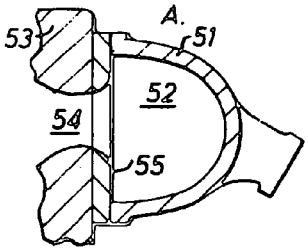
FIG. 155
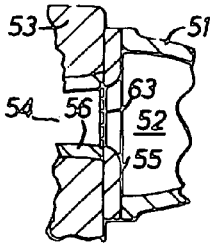
FIG. 156
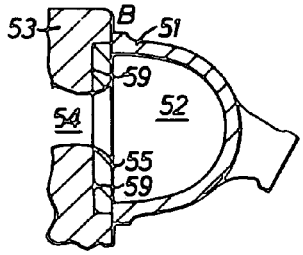
FIG. 157
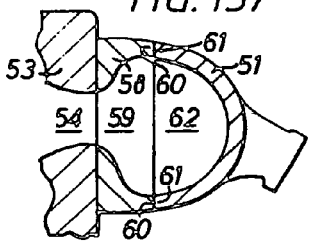
FIG. 158
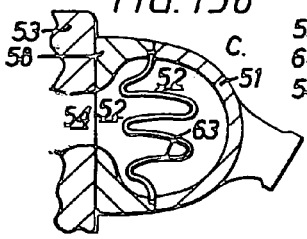
FIG. 159
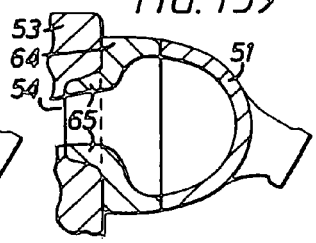
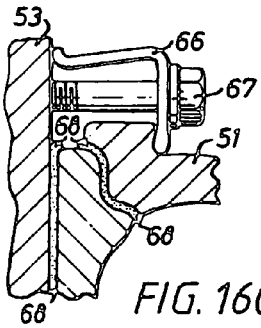
FIG. 160
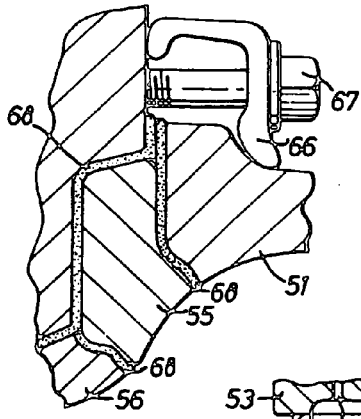
FIG. 161
FIG. 163
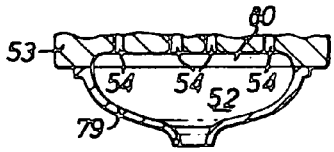
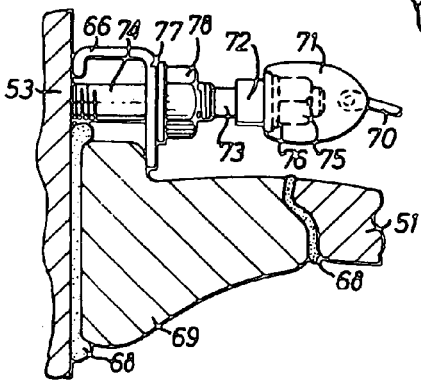
FIG. 162
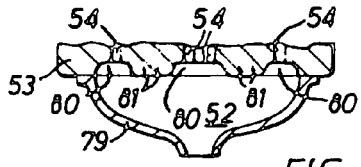
FIG. 164

116
117
118
118
116
115

123
122
124
125
127
126

128
129

114

130
131
132

133

134

137
138
136
141

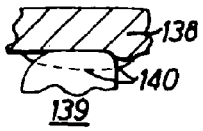
FIG. 215
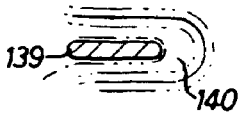
FIG. 216
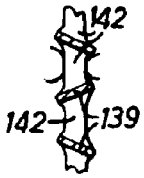
FIG. 217
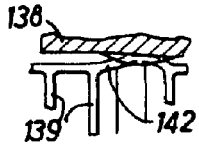
FIG. 218
FIG. 219
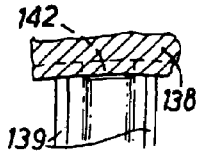
FIG. 220
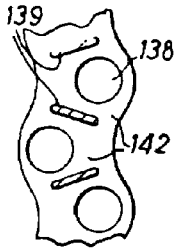
FIG. 221
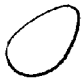
FIG. 222
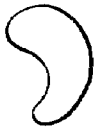
FIG. 223
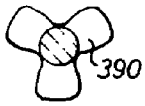
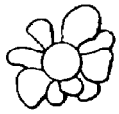
FIG. 224
FIG. 225
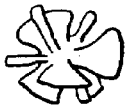
FIG. 226
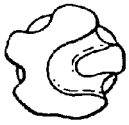
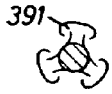
FIG. 227
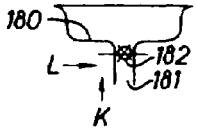
FIG. 231
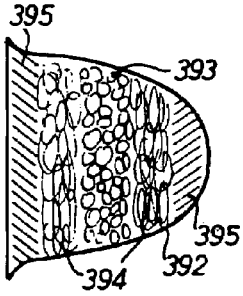
FIG. 228
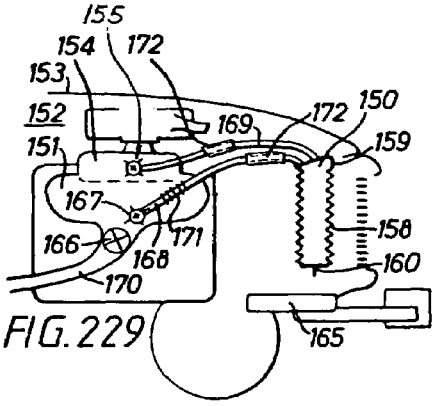
FIG. 229
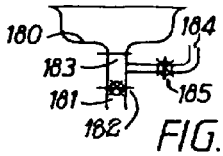
FIG. 232
FIG. 230
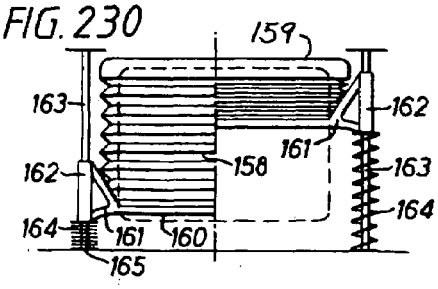
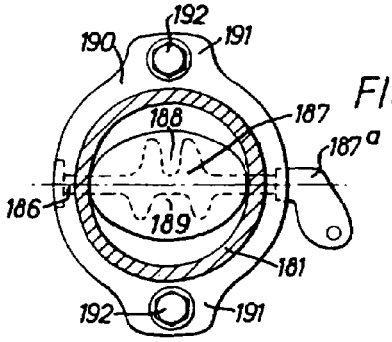
FIG. 233

FIG. 236
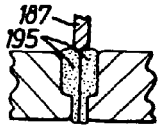
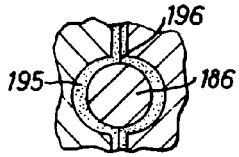
FIG. 237
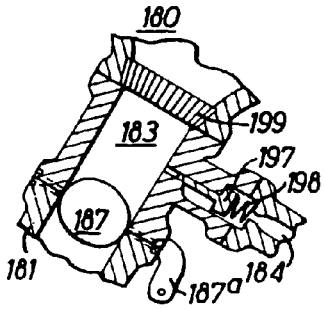
FIG. 238
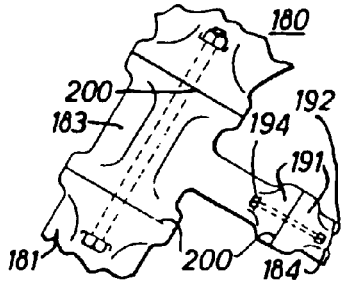
FIG. 239
FIG. 235
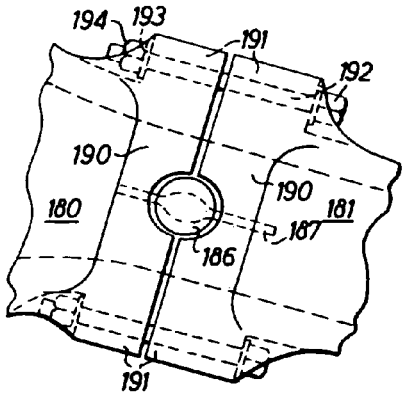
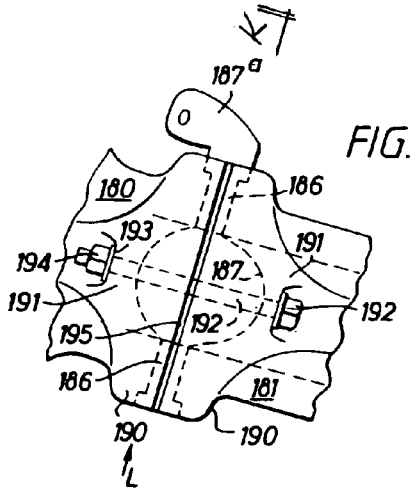
FIG. 234
FIG. 240
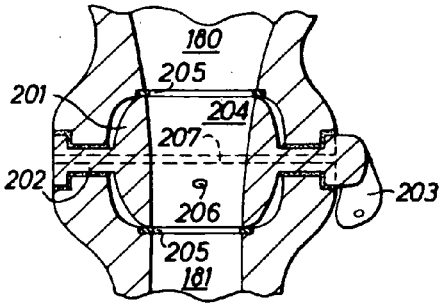
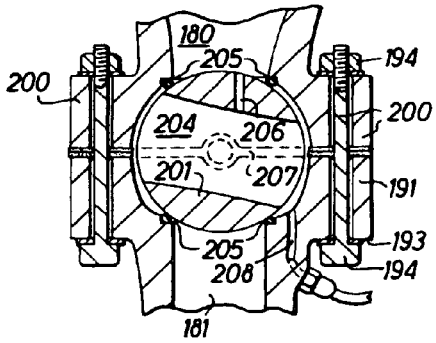
FIG. 241

FIG. 242
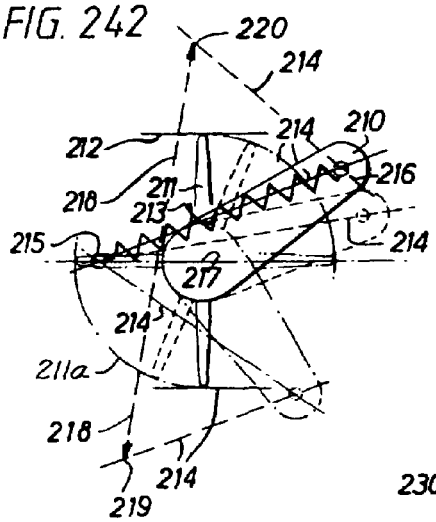
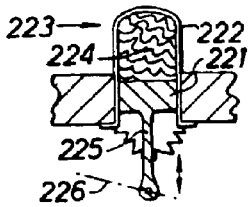
FIG. 243
FIG. 244
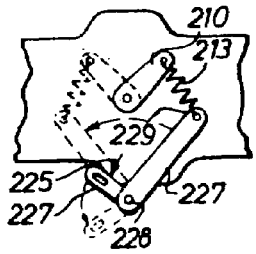
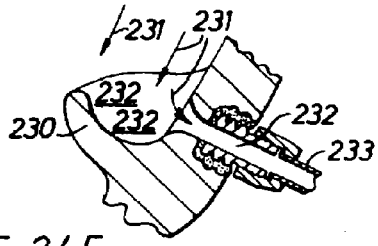
FIG. 245
FIG. 246
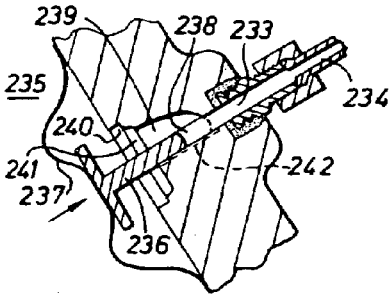
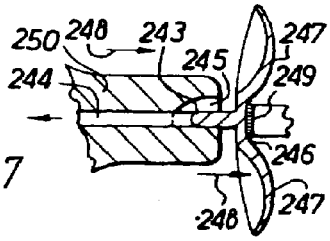
FIG. 247
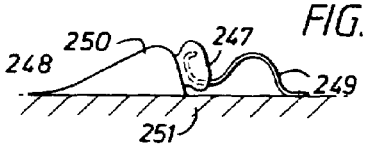
FIG. 248
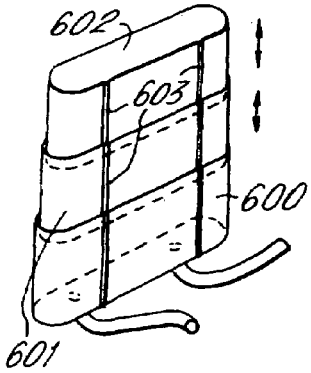
FIG. 251
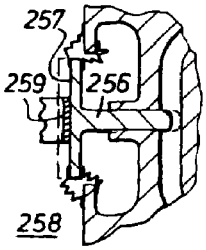
FIG. 250
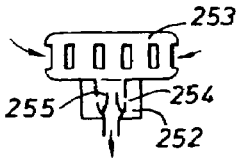
FIG. 249

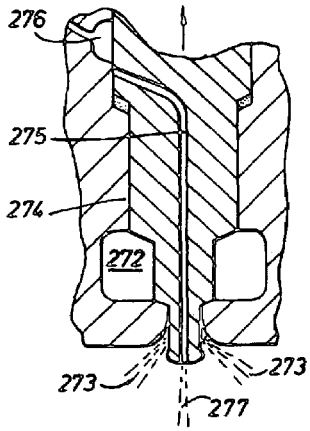
FIG. 252
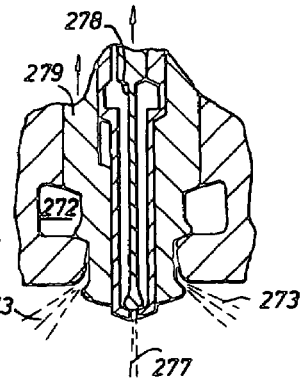
FIG. 253
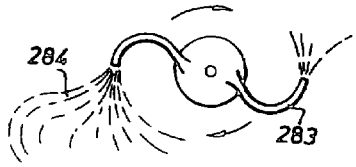
FIG. 255
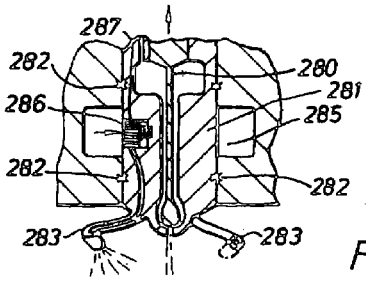
FIG. 254
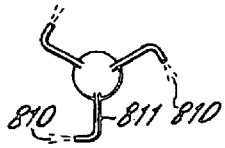
FIG. 258
FIG. 256
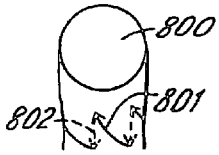
FIG. 257
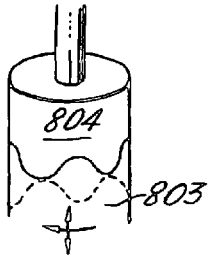
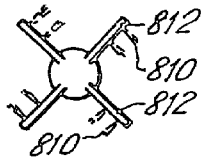
FIG. 259
FIG. 260
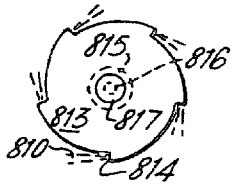
FIG. 261
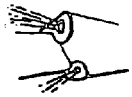
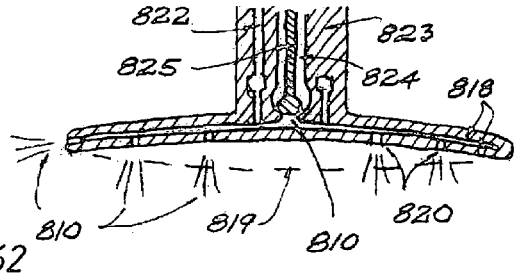
FIG. 262

FIG. 263
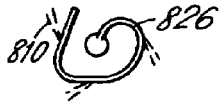
FIG. 264
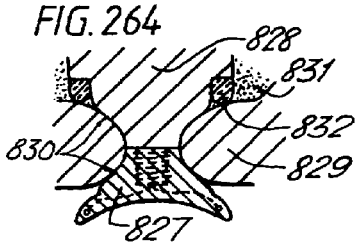
FIG. 265
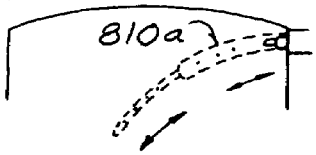
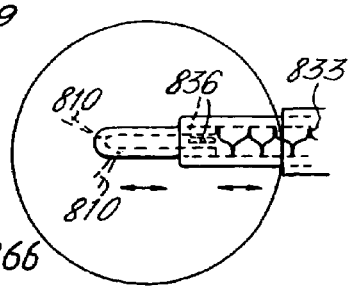
FIG. 266
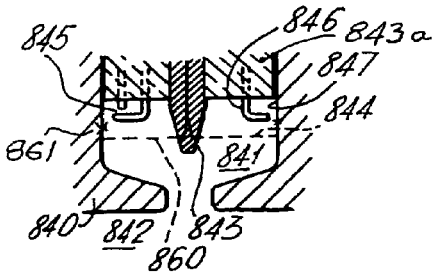
FIG. 267
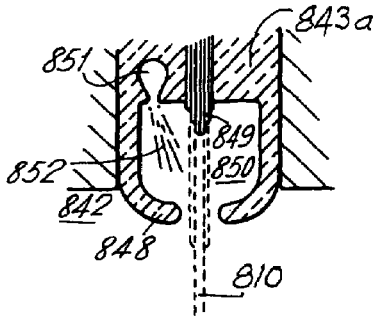
FIG. 268
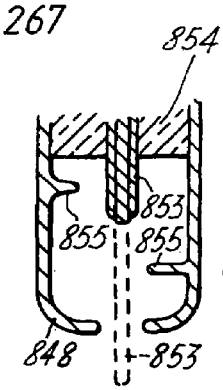
FIG. 269
FIG. 270
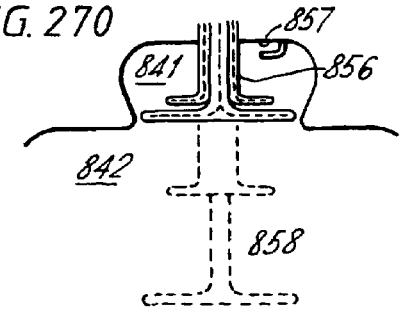
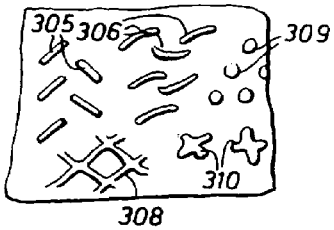
FIG. 272
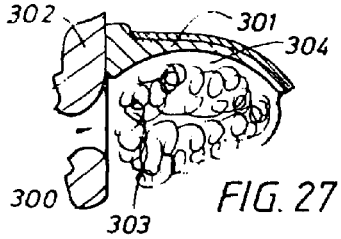
FIG. 271

FIG. 273
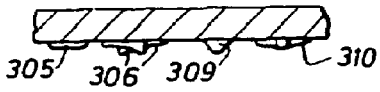
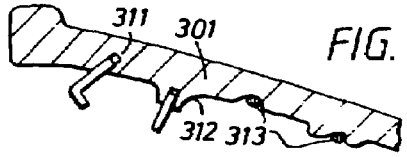
FIG. 274
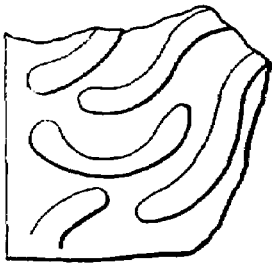
FIG. 275
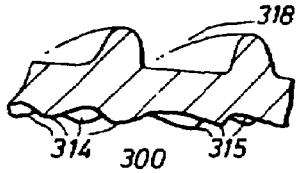
FIG. 276
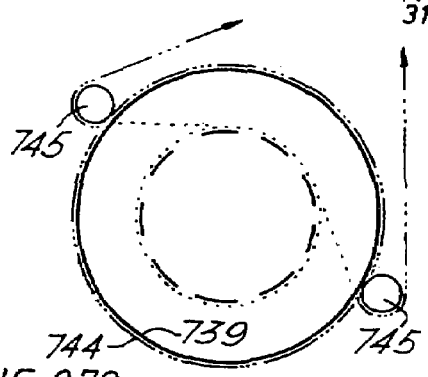
FIG. 279
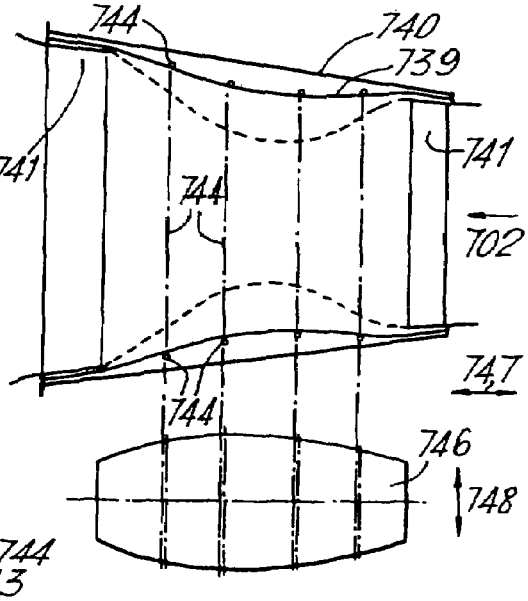
FIG. 278
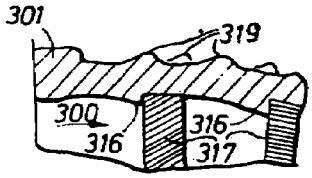
FIG. 277
FIG. 280
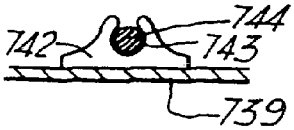
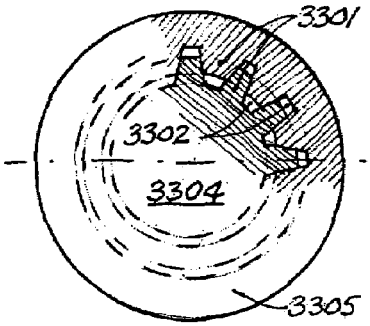
FIG. 281
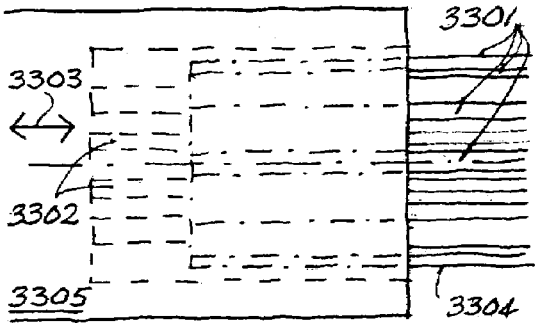
FIG. 282

FLUID TRANSFER IN RECIPROCATING DEVICES

CROSS-REFERENCE TO RELATED APPLICATIONS

This application is a Divisional of Ser. No. 08/441,117 15 May 1995, now abandoned, which is a Continuation of Ser. No. 08/287,429 9 Aug. 1994, now abandoned, which is a Continuation of Ser. No. 08/136,729 14 Oct. 1993, now abandoned, which is a Continuation of Ser. No. 07/982,424 27 Nov. 1992, now abandoned, which is a Continuation of Ser. No. 07,543,405 26 Jun. 1990, now abandoned, which is a Continuation-in-part of Ser. No. 07/237,761 29 Aug. 1988, now abandoned, which is a Continuation-in-part of Ser. No. 06/928,659 5 Nov. 1986, now abandoned, which is a Continuation of Ser. No. 06/804,332 5 Dec. 1985, now abandoned, which is a Continuation of Ser. No. 06/407,823 13 Aug. 1982, now abandoned, which is a Continuation-in-part of Ser. No. 05/737,099 29 Oct. 1976, now abandoned, which is a Continuation of Ser. No. 05/473,797 28 May 1974, now abandoned, which is a Continuation-in-part of Ser. No. 05/270,029 10 Jul. 1972, now abandoned,

FOREIGN APPLICATIONS

| | | |
|---|---|---|
| United Kingdom | 23485 | 18 May 1972 |
| United Kingdom | 21149 | 5 May 1972 |
| United Kingdom | 16450 | 10 Apr. 1972 |
| United Kingdom | 32228 | 8 Jul. 1971 |

TECHNICAL FIELD

The disclosure relates to combustion engines, pumps, exhaust emissions control devices, as well as their components and ancillary equipment.

BACKGROUND

Many have considered it desirable to build engines running at higher temperatures. Efficiency would improve, since it is dependent on the difference in temperature between ambient air (which is constant) and that at combustion. The resulting hotter exhaust gases will generally be easier to cleanse. If the cooling system can be eliminated, so can its cost, mass, bulk and unreliability. Un-cooled engines can be thermally, acoustically and vibrationally insulated to virtually any degree, making them more environmentally and socially acceptable. Of the calorific value of the fuel, a greater amount will be spent on pushing a piston, but nearly all the remainder will now be in the hot exhaust gas, where it is recoverable. With the new engines, temperature equilibria would be so high that the main piston and cylinder components would likely have to be of ceramic material.

To the knowledge of the applicant, un-cooled engines are not in production today. Manufacturers and researchers tried to build what they called "adiabatic" semi-un-cooled engines in the late 1980's and early 1990's. Publications indicate the work nearly all involved substituting ceramic materials for metals in key combustion chamber components. For example, ceramic caps were placed on metal pistons; ceramic liners placed in metal engine blocks; a zirconia poppet valve was substituted for an identically shaped metal valve. The work was not very successful for a number of reasons, including problems with differential thermal expansion of ceramic and metal components abutting each other. Engine designs were essentially unchanged.

Early internal combustion (IC) engine designers like Gottfried Daimler and Rudolf Diesel adapted the mid-18th century metal piston-and-cylinder technology developed for steam engines. Today's metal IC engines reflect three constraints; the materials characteristics of metals; the need for cooling and therefore the engine block, etc; and commercial practice determining the most viable ways of manufacturing and assembling metal components.

The applicant felt that any viable commercial embodiment of the un-cooled ceramic engine would look very different from today's units, because all the old constraints were no longer relevant, and new constraints would apply. This disclosure is the result of his attempt to adapt and modify the traditional design of the piston and cylinder engine, so that new embodiments could be viably built un-cooled and out of ceramic material. Because exhaust emissions control is so important today, new arrangements for cleansing high temperature exhaust gases were devised, and are disclosed herein.

In today's typical engine, roughly one third of the calorific value of the burnt fuel is put to work driving the piston, one third is dissipated via the cooling system and general radiation by the engine components and one third is carried away by the exhaust gases. The latest large diesels for trucks and marine applications have efficiencies in the 40% range, but the average for all engines now operating is close to 30%. These figures are for efficiencies on the piston crown, for new engines, in the optimum operating mode. Real-world efficiencies at the output shaft for all engines in the field, under all operating conditions, are far, far lower. Current large engines, as used in ships and electricity generating stations, often have some form of compounding, which entails using a device (say a turbine) to derive further work from the hot exhaust gases.

In un-cooled engines, the combustion process takes place at higher temperatures, leading to efficiency increases of anywhere between 0 and 20%, dependant on design and construction details.

A conservative projection could be 10%, enough to make to make a substantial difference to the oil needs and political situation of a country such as the USA. In compounded un-cooled engines greater efficiencies can be expected, since the exhaust energy conversion devices have a greater portion of the fuel's calorific value to work with—somewhere between 50 and 60% could be in the hot exhaust gas. Turbines or steam engines may be used to extract work from the hot gas; optionally the gas heat can be converted into electrical energy.

Clarifications

By "un-cooled" is meant engines or pumps having no mechanism for transfer of heat from combustion or working volume to ambient air. Such mechanism typically comprises a water jacket, pump, radiator and fan, or comprises a fan directing air over metal cooling fins or surfaces. Un-cooled engines may have some form of charge cooling, wherein the temperature of the charge is reduced before it enters the combustion or working chamber.

The features described herein illustrate by way of example the many ways un-cooled engines and exhaust gas reaction volumes may be constructed. Any type of piston or valve may be used in an un-cooled engine and the engine portions may be assembled in any manner.

The features of the un-cooled engine have been described mainly in relation to internal combustion engines, although they are suited to and may be applied to any type of combustion engine, including for example Stirling and steam engines. The features relating to heat exchangers may be embodied in any type of engine, including conventionally cooled engines.

Where appropriate, features described herein may be applied to pumps. The word "engine" is used in its widest possible meaning and, where appropriate, is meant to include pump and/or compressor.

It is emphasized that the various features and embodiments of the invention may be used in any appropriate combination or arrangement. Where diagrams or embodiments are described, these are always by way of example and/or illustration of the principles of the invention. Further, it is considered that any of the separate features of this complete disclosure comprise independent inventions.

In the following text and recital of claims, "filamentary material" shall be defined as portions of interconnected material which allow the passage of gases therethrough and induce turbulence and mixing by changing the directions of travel of portions of gas relative to one another, the inter-connection being integral, continuous, intermeshing, inter-fitting or abutting, this definition applying to the material within the reactor as a whole as well as to particular portions of it.

By "ceramic" is meant baked, fired or pressed non-metallic material that is generally mineral, ie ceramic in the widest sense, encompassing materials such as glass, glass ceramic, shrunken or recrystallized glass or ceramic, etc., and refers to the base or matrix material, irrespective of whether other materials are present as additives or reinforcement.

By "elastomeric", "compressible", "elastic", "variable volume", "flexible", "bending" and all other expressions indicating dimensional change is meant a measurable change that is designed for, not a relatively small dimensional change caused by temperature variation or the imposition of loads on solid or structural bodies.

By "ring valve" is meant a movable ring-shaped element normally approximately flush with a surrounding and a core surface. When the valve is actuated, it projects from any plane of the surrounding and core surface, causing fluid to flow past both the outer and the inner circumferences of the ring.

In the following text, abbreviations are used, including: rpm and rps for "revolutions per minute" and "revolutions per second" respectively, BDC/TDC for "bottom dead center/top dead center", IC for "internal combustion".

SUMMARY

The invention is summarized in the claims.

BRIEF DESCRIPTION OF THE DRAWINGS

FIGS. 45 to 48 show details of a tensile link embodiment.

FIG. 71 shows a method of reducing piston blow-by.

FIG. 72 to 74 show bearing construction details.

FIGS. 75 and 76 show schematically engines having twin separate exhaust systems.

FIG. 113 illustrates a two-stage toroidal combustion chamber engine.

FIGS. 116 to 118 show engines with a differential function.

FIG. 149 is a diagrammatic plan view of an exhaust gas reactor assembly.

FIG. 150 is a cross-sectional view taken on the line 2-2 of FIG. 149.

FIG. 151 is a cross section view taken on the line 3-3 of FIG. 149

FIG. 152 is a cross section view, similar to FIG. 151, but showing a modified construction.

FIG. 153 is a cross sectional view, also similar to FIG. 151, but showing a further modified construction.

FIG. 154 to 159 show diagrammatically in vertical cross-section various arrangements of inter-members.

FIGS. 160 to 162 show in cross-section various fixing details.

FIGS. 163 and 164 show diagrammatically in sectional plan view two examples wherein reaction volumes project into space normally occupied by the engine.

FIGS. 186 to 194 describe wire looped construction.

FIGS. 195 to 199 describe wire strand and associated features.

FIGS. 200 to 208 describe various slab-like sheet configurations.

FIGS. 209 to 213 describe sheet used in three dimensional forms.

FIGS. 214 to 220 describe details of fixing filamentary matter to reactor housing.

FIGS. 221 to 228 illustrate pellet-like filamentary material.

FIGS. 229 and 230 show an embodiment of exhaust gas reservoir.

FIGS. 231 and 232 show diagrammatically valve, gas routing and component arrangements.

FIGS. 233 to 237 show an embodiment of butterfly valve in the situation of FIG. 231.

FIGS. 238 and 239 show an embodiment of butterfly valve in the situation of FIG. 232.

FIGS. 240 and 241 show an embodiment of ball valve in the situation of FIG. 232.

FIGS. 242 to 244 describe examples of valve actuating means.

FIGS. 245 to 250 describe means of controlling exhaust gas re-circulation (EGR) and air supply.

FIG. 251 illustrates an embodiment of fluid reservoir of variable volume.

FIGS. 252 to 255 show embodiments of composite injectors supplying multiple substances.

FIGS. 256 and 257 show schematically injectors capable of motion in three dimensions.

FIGS. 258 to 270 show embodiments of movable injectors and/or their locations.

FIG. 271 illustrates the principle of reduced resistance to gas flow adjacent reactor housing.

FIGS. 272 to 277 describe reactor wall construction embodying depressions or projections.

FIGS. 278 to 280 show a variable diameter inlet throat.

FIGS. 281 and 282 show a splined telescopic drive shaft

SELECTED EMBODIMENTS

Figure 1:
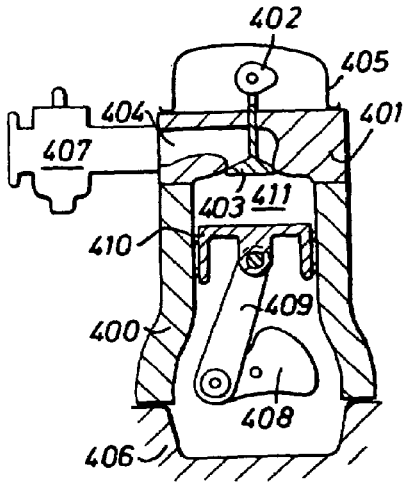
FIGS. 1 to 3 show schematically a configuration and details of an un-cooled engine.

It is considered perhaps the most important advantage of the invention that it offers an exceptional scope for fuel conservation. The principles of the invention relate to methods of saving substantial energy, by means of deriving further mechanical work from the combustion of a given 7 amount of fuel and/or by means of the provision of energy storage in accumulators, so as to compensate for the stop/go nature of most vehicle operation. One such method is to raise the ambient temperature in an exhaust emissions reactor to substantially over the 950° to 1200° entigrade (C) range, thereby further assisting the desired processes of reaction, and to substantially increase the temperature in the combustion volume, thereby increasing the thermal efficiency of the engine. Another method involves the extraction of heat from the area of, or adjacent to at least the rear of an exhaust emissions reactor to provide further work. Further, the invention may be used in association with means of converting the flow of exhaust gas into mechanical energy.

In a conventional internal combustion engine (IC Engine), the rapid burning of the combustion charge in the confined space of the combustion volume produces expansion and heat. The expansion drives the piston and consequently engine while the heat product of the cycle is almost wholly unused—in fact considered undesirable since efforts are made to dissipate it as effectively as possible, by means of conduction through cylinder walls and head to cooling system Other heat is collected by the lubrication system to be often dissipated by oil radiators, sump cooling fins, etc.

A very rough approximation of the potential energy saving follows. Actual saving will vary widely, depending on engine size, state of tune and application. Let it be assumed that in a particular water-cooled engine the energy produced by the combustion or fuel is distributed as 32% going to useful work on the piston, 36% dissipated away by cooling water and general radiation, and 32% carried away by the exhaust gases. If the heat loss to water jacket and general radiation can be eliminated, about 10% to 15% will be theoretically converted to useful work on the piston, bringing the percentage of total energy converted to work up by 10% (allowing for losses due to increase of specific heat and dissociation at higher temperatures) to about 42%, corresponding to an engine power increase of around 30%. With the elimination of cooling system mechanical losses, a further increase on the original figure, of about 4%-6% can be expected, bringing the total power increase to say between 33% and 36%. Since water heat loss and general radiation was eliminated with 10% out of 42% total energy converted to work, almost all the remaining heat, say 30% can only be carried away by the exhaust gases, bring this figure from 32% to 62%, an increase of 95%. These figures suggest that the provision of an un-cooled engine would involve efficiency and power increases of somewhere between 28% and 45%, and increase heat carried away by exhaust gases by 60%-100%. Allowing for various factors, this would entail an increase of exhaust gas temperatures in the port from between 650° C. and 1000° C. to somewhere between 1000° C. and 1400° C., with temperatures within an emissions reactor in the region of 1100° C. To 1500° C. Average combustion volume surface temperature (typically adjacent cooling systems) would rise from those in conventional engines, at say between 150° C. and 250° C. currently, to between 750° C. and 1250° C. An un-cooled engine could not therefore be constructed entirely in conventional metals, and alternatives are described below. It must be borne in mind that a projected power increase of 33% to 36% without increase in fuel consumption (none is required) must be considered a very valuable saving considering today's energy climate. Recent calculations indicate that un-cooled engines could provide even greater efficiency gains than those given here. Allowing for margins of error, an even 20% fuel saving—a given power is necessary for a certain engine function, so fuel consumption would be saved rather than power increased—would make critical difference to the oil needs and political situation of a country such as the U.S.A.

In order to both raise exhaust gas reactor temperatures to assist the desired exhaust gas reactions, and to raise the ambient temperatures in the combustion volume in order to increase thermodynamic efficiency, it is proposed to eliminate conventional cooling in an engine desired for continuous running, that is to eliminate heat dispersed from combustion chamber walls by means of liquid pumped through engine block jackets to a heat exchanger, or by means of cooling fins and usual associated air blower. It is intended to construct the engine to operate continuously in an un-cooled state, so that it might be used to power for example, generating plant, light cars and trucks, heavy goods vehicles, locomotives, marine vessels including supertankers, etc. To this end, the un-cooled engine preferably uses the internal combustion cycles although the principle of the invention may also be applied for example to engines operating on the Rankine or Stirling cycles.

The un-cooled engine may consist of components constructed of any material suited to the environment found in the engine location in which the component is used. In a selected embodiment, heat loss is eliminated by omission of cooling and construction of engine/cylinder components at least partly of materials having heat insulation properties, such as ceramic. Types of the latter material are among the few able to withstand the ambient temperatures found in certain sections of the un-cooled engine, such as the exhaust port area. Ceramics are generally harder and more abrasion resistant than metals, and may be stronger, especially if reinforced. It is feasible, according to today's technology, that virtually all the components of an IC engine may be made of ceramic, including such items as main bearings, connecting rods, etc. The un-cooled engine may have a housing or casing made of insulating material, further limiting heat loss through radiation.

Figure 2:
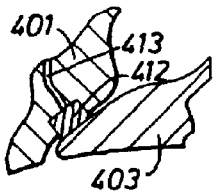
Figure 3:
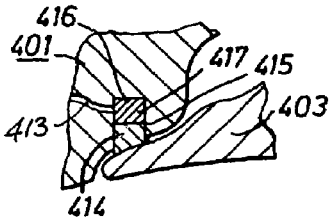

In a basic embodiment, the moving parts are of metal of a construction and type conforming to current practice, with the possible exception of the exhaust valve. FIG. 1 shows by way of example a schematic cross-section of an un-cooled engine, having a ceramic engine block 400, a ceramic cylinder head 401, camshaft 402, valve 403, port 404, cam cover 405, sump cover 406, fuel delivery device 407, crankshaft 408, connecting rod 409, piston 410 and combustion volume 411. All moving parts are metal, except the ceramic exhaust port. A seating detail at the port is shown in FIG. 2, where valve 403 seats against compressible seal 412, optionally lubricated by passage 413, in cylinder block 401. FIG. 3 shows an alternative detail, where valve 403 seats against ring 414 slidably mounted in groove 415 containing, between ring and groove floor 416, a compressible cushion 417, lubricated by optional passage 413, the cushion forcing the ring slightly outward when valve is lifted. If necessary the compressible material may be bonded to groove floor and/or ring member, to better prevent the latter leaving the groove. The compressible member may be constructed out of ceramic fiber and serves as a shock absorber at valve closure, ceramic not being as ductile and resistant to certain types of mechanical shock as metal. The piston can be of a heat resistant alloy such as nickel-chrome, having ceramic piston rings. Finning at the bottom of the piston (not shown) can give some cooling to the crank volume, which may be part cooled through the sump. The piston could equally be manufactured of ceramic or other suitable non-metal. Lubrication would be by any suitable substance, including those mentioned elsewhere. If lubrication were such as to easily pick up particles of say ceramic, which would damage softer metal bearing surfaces, then metal piston rings might be used to ensure that wear produces powder of the softer material, metal. Such an engine would be considerably lighter than conventional units, especially if construction used light, high alumina content ceramics. Considering also the elimination of cooling mechanics plus fluid, the overall large weight reduction would further contribute to fuel savings, where the un-cooled engine is used in vehicles. The construction of engine blocks at least partly in insulating material would greatly assist in the reduction of noise and vibration, thereby providing additional social benefit. Gaskets between ceramic components may be of ceramic such as asbestos mat.

Ceramic engine/cylinder block construction leads to the introduction of several beneficial features. Passages and chambers to transmit substances such as fuel, air, steam, water, etc., may be incorporated within the block(s), perhaps to embody the principles outlined elsewhere herein, in a manner to ensure the transmission of substances at the desired temperature and/or pressure, according to distance of passage from combustion volume. Similarly, electrical circuits can be incorporated in the body of the block, since ceramic can be an electrical insulator. Such circuits may connect to electrodes or points, say of carbon, in the cylinder head, to produce a spark without the need for conventional plug. High voltages may be employed to give larger sparks, say arcing through substantial dimensions of the combustion volume, without fear of these large sparks shorting against the block. Such circuits could be incorporated by pouring molten metal into passages already formed in the manufactured ceramic block.

Figure 4:
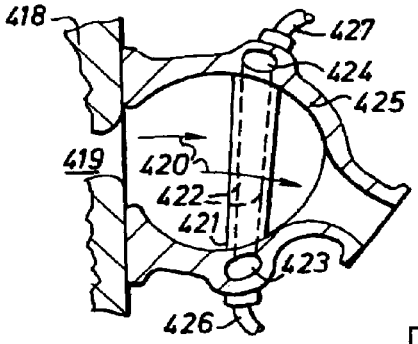
FIG. 4 shows the deployment of heat exchange means within a reactor.

An exhaust gas reactor assembly mounted to or within an internal combustion engine may have incorporated within or adjacent to the reaction volume (whether associated with conventional or un-cooled engines) a heat exchanger, so that the heat of the exhaust gases may be used to heat the working fluid of an alternative engine cycle, either expending work on another engine or on the original (which thereby becomes a composite engine), or to heat fluid communicating with an electrical generator or an accumulator. FIG. 4 shows diagrammatically such a configuration, where an engine 418 having exhaust ports 419 discharges exhaust gases 420 past finned members 421, having hollow passages shown dotted 422 communicating with lower linking passage 423 and upper linking passage 424 formed in reactor housing 425 and having access to, respectively, fluid entry means 426 and fluid exit means 427. Such heat exchangers could be made of a material having high conductivity, including ceramics such as silicon carbide or perhaps silicon nitride or metals such as the nickel alloys, which may be such as to have catalytic effect. The heat exchanger may effectively constitute filamentary material, as described later. Alternatively, the heat exchangers may be placed elsewhere in the exhaust system of an engine, including just downstream of a reactor assembly.

Figure 5:
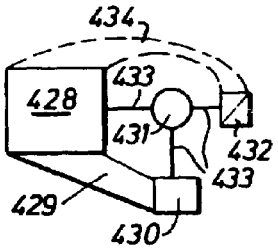
FIG. 5 illustrates the interconnection of two engines.

The heat exchanger may be part of an engine cycle putting work into an accumulator, a second engine and/or the first engine. It may pool work with the first engine by means of mechanical linkage, or by the partial integration of the two engine cycles to produce work on common components, such as piston or crankshaft, the latter embodiment constituting a composite engine. If the heat exchanger were part of a separate mechanical power unit, then the latter could be coupled to the first unit by direct drive. If the latter is used in an automotive application, the power requirements of the stop/start nature of operation may not always conform with the more constant outputs the regular supply of exhaust heat and possible working fluid pressure will provide from the second power unit. Therefore the second unit may be connected to both the first unit and an accumulator by means of a differential, as illustrated diagrammatically in FIG. 5, where 428 is the first engine, 429 the reactor/heat exchanger assembly, 430 the second engine, 431 the differential and 432 the accumulator. Drive shafts are provided at 433, and the accumulator may optionally be linked by passage 434 to first engine 428. The accumulator may comprise a fan compressing fluid, such as air, to be stored in an associated reservoir, in which case the bleed off of fluid to first engine 428 under certain operating modes (such as acceleration) may result in improved performance or fuel economy.

Figure 6:
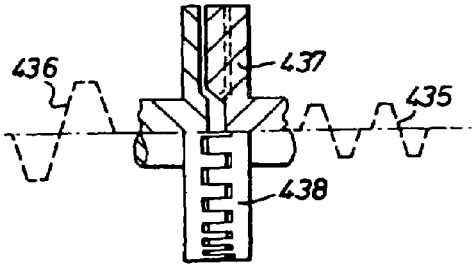
FIGS. 6 to 8 illustrate linkage of crankshaft sections.
Figure 7:
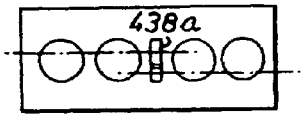
Figure 8:
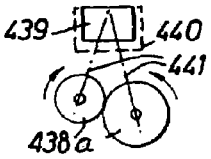
Figure 9:
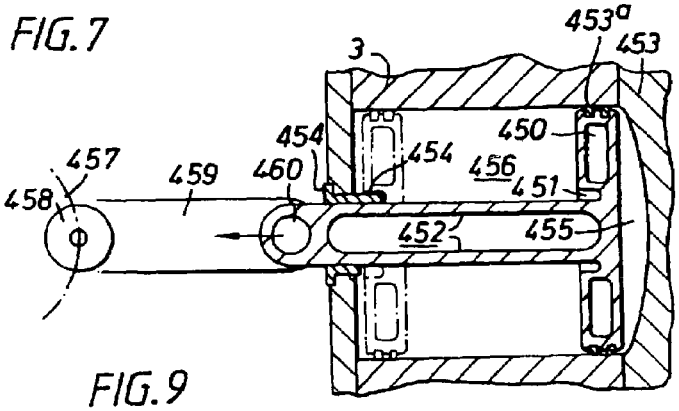
FIG. 9 illustrates schematically a configuration of composite engine.
Figure 10:
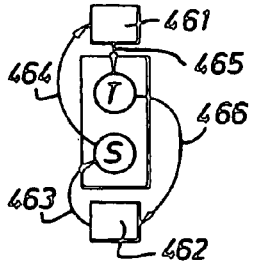
FIGS. 10 and 11 show diagrammatically how two engine cycles may be operative in one engine.
Figure 11:
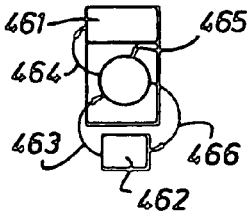

The heat exchanger may be used to heat fluid including air, other gases, water to steam, steam or superheated steam. These fluids may be used as outlined elsewhere, ie to provide addition to the charge substantially during operation of the first engine, or it may be used to power a second engine, perhaps coupled to the first engine as above, or it might be applied to operate the exhaust and/or compression strokes of the first engine, thereby embodying a composite engine, or it may be employed to operate some pistons of a composite engine having other pistons operating on the internal combustion cycle. In the latter case the pistons may operate on the same crankshaft, which in a selected embodiment is divided by, say, a multiple dog-toothed clutch, to reduce inter-reaction of vibration between crankshaft sections. By way of example, FIG. 6 shows diagrammatically an arrangement whereby crankshaft section 435, driven by four IC operative pistons, is connected to crankshaft section 436, driven by alternatively two steam cycle or Stirling cycle operative pistons, by means of a multiple toothed dog clutch shown in cross-section at 437 and in elevation at 438. If the two operating cycles employed are such that optimum efficiency occurs for each at differing revolution rates, then the crankshaft sections may be connected by gears 438*a* of suitable ratio, as shown in diagrammatic plan FIG. 7 and section FIG. 8, where 439 is the IC powered piston and, shown dotted outline, alternate powered piston 440, with 441 axes from gudgeon pin centers to crankshaft centers. If the fluid is required to act on the piston common to an IC engine system, such a piston is preferably of T-shaped configuration, as shown diagrammatically in section FIG. 9, where a piston having hollow head 450 reinforced by flanges 451 is attached to hollow stem 452, and is slidably mounted in a cylinder 453 by means of piston rings 453*a* and bearing 454 notched to accommodate piston flanges. The piston separates IC operative combustion volume 455 and alternate combustion and/or expansion volume 456. Piston stem communicates to crankshaft 457 via big end bearing 458, connecting rod 459 and gudgeon pin 460 according to known practice. The fluid of the alternate system may be further cooled (heat will have been given up if expansion has taken place) by passing through a heat exchanger, say taking heat from fluid to assist conversion of such heat into electrical energy or mechanical energy. By way of example, a layout suitable for the employment of the Stirling hot gas principles in an alternate cycle is shown in FIG. 10, where S and T are chambers having pistons linked by common crankshaft, the reactor/heat exchanger assembly shown at 461, and the heat disposal exchanger mentioned above at 462. Cold gas enters chamber S along path 463 to be compressed and travel under pressure via path 464 to reactor 461 where it is heated to then travel via path 465 to chamber T, where it provides work on expansion, then traveling at low pressure via path 466 to cooler 462, to thence repeat the cycle. Here one piston and chamber effects only compression while another only expansion. In an alternative system illustrated in FIG. 11 each piston/chamber assembly operates alternatively on compression and on expansion, considering only the alternative engine cycle.

Figure 12:
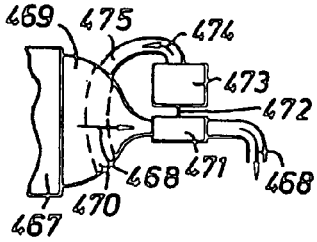
FIG. 12 illustrates schematically a heat exchanger associated with a reactor and a turbine engine assembly.

The heat exchanger may comprise part of a turbine engine cycle as shown diagrammatically by way of example in FIG. 12. An IC engine 467 has exhaust gas 468 passing through reactor 469 across heat exchanger 470 to drive fan 471, which is linked by shaft 472 to drive turbine compressor 473, to pass compressed turbine working fluid 474 via passages 475 through reactor heat exchangers 470, allowing heating of turbine working fluid to occur. A fan associated with the reactor may drive a compressor used for any suitable purpose, including the provision of a compressed fluid to an accumulator and the provision of boost to engine inlet charge.

Figure 13:
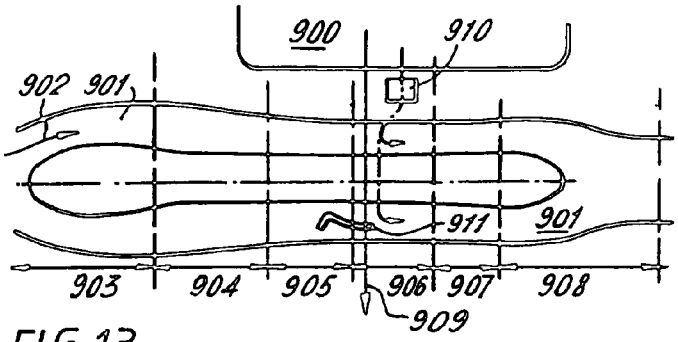
FIG. 13 shows schematically heat exchangers associated with turbine assemblies.

FIG. 13 shows a schematic arrangement for a gas turbine engine mounted in association with an internal combustion engine 900, in such a manner that the exhaust gas from engine 900 provides the means of heating the gases of turbine engine 901, wherein working gas passes in direction of arrow 902 through intake 903, low compression stage 904, high compression stage 905, heating stage 906, turbine stage 907 and exhaust stage 908. Exhaust gas in alternative embodiments either flows through heat exchangers in stage 906, being optionally compressed beforehand by separate compressor 910. A combination of both systems may be used, as may supplementary fuel combustion system in stage 906, as shown at 911. Such combinations of internal combustion reciprocating engine and turbine engine are suitable for aircraft, railed vehicles and large trucks, for example, where exhaust through 908 may be used to provide extra motive power. The schematic arrangement of FIG. 13 may be used to provide a combined steam turbine and internal combustion engine.

Figure 14:
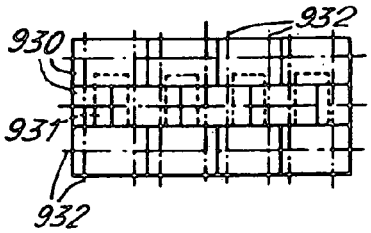
FIGS. 14 to 17 show further configurations and details of un-cooled engines.
Figure 15:
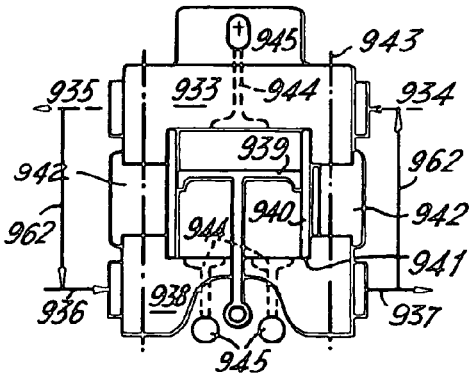
Figure 17:
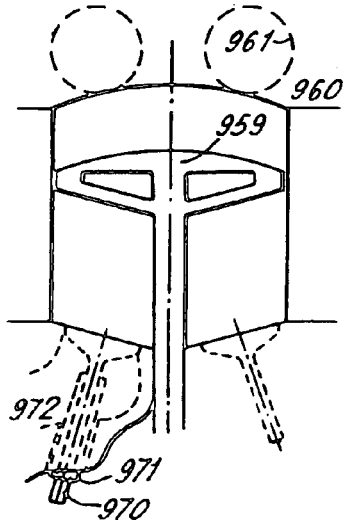
Figure 16:
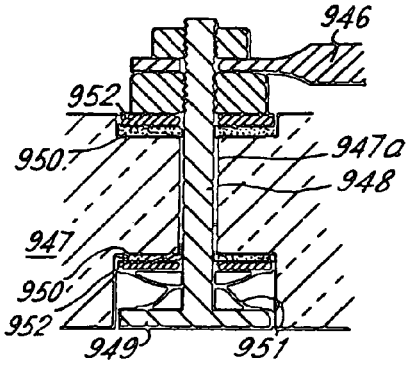

An un-cooled engine may be construed in any manner. If components such as ceramic are used, they will probably be relatively more difficult and expensive to produce in large pieces than in smaller ones. For this reason, the engine is preferably made up of smaller units which are assembled during construction of the engine. Diagrammatic elevation FIG. 14 shows, by way of example, an engine composed of multiple pieces 930, built up round combustion chambers shown dotted 931 and held together by means of bolts 932 in tension. FIG. 15 shows an embodiment of engine having double head construction, with upper head 933 admitting inlet charge at port 934 and expelling exhaust at port 935 (both gas flows shown dotted) for internal combustion, and with lower head 938 having inlet port 936 and outlet port 937 for steam cycle (fluid flows shown solid). In assembly, the engine is built up about piston 939 and combustion chamber wall 940 of sleeve-like configuration, having seals or gaskets at 941, by means of spacer or alignment blocks 942 and tension bolts 943. Poppet valves 944 and cam assemblies 945 are provided to regulate fluid flows. Heat transfer 962 (in the form of steam condenser) may take place between ports 937 and 934, and between ports 935 and 936 (say in the form of steam heater or water boiler). The two head construction may also be used in engines with both sides of piston operative in the internal combustion mode. FIG. 16 shows a means of fixing a mechanical assembly 946 to a block or engine portion 947 of insulating material such as ceramic. A bolt 948 having load distributor head 949 is passed through a hole 947 and spaced from it by a compressible interlayer 950, of say fibrous ceramic. If the bolt has greater coefficient of expansion than the block portion 947, then a strong spring 951 and washer 952 may be provided to keep contact between assembly 946 and block 947 at constant pressure with differential expansion of bolt and block. FIG. 17 shows a combustion chamber/piston assembly similar to that of FIG. 15, but having a hollow mushroom-shaped piston head 959 reciprocating between domed heads, the upper head 960 having ball valves 961 similar to those described elsewhere.

The problems of likely differential expansion between metals of conventional engine construction and the insulating materials (such as ceramic) can easily be overcome by intelligent detailing and design. For example, FIG. 17 shows a metal poppet valve 970 mounted in a metal guide 971. Between it and ceramic block 972 is disposed a thin sleeve of compressible and slightly stretchable material, such as fibrous ceramic. The guide with sleeve is fitted to the block when the latter is at very much higher temperature than the guide. When temperatures equalize to ambient, a tight fit will ensue. When the engine is warm, the relatively greater coefficient of expansion of the metal will ensure that the guide is an even tighter fit in the block. By using this and other techniques, an engine can be constructed of partly metal, partly ceramic and partly insulating material.

Figure 18:
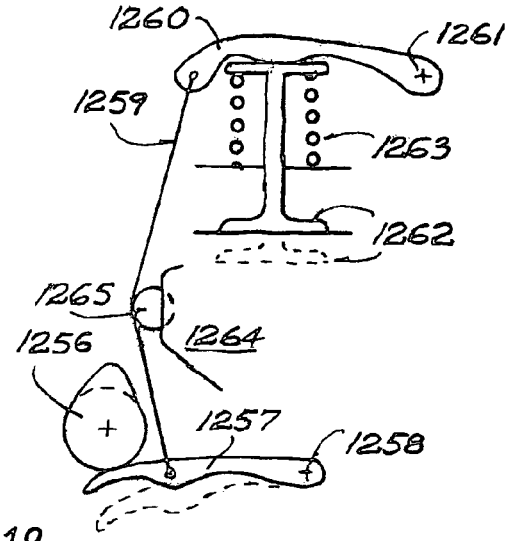
FIGS. 18 and 19 show pull-wire valve actuation methods.
Figure 19:
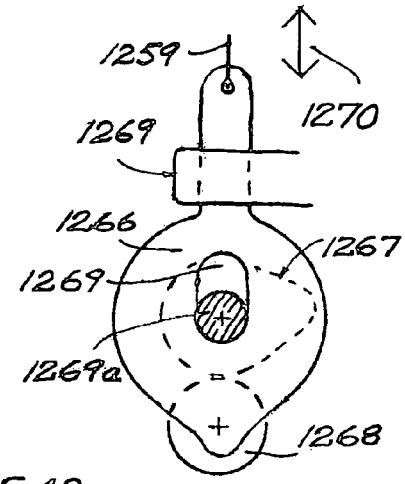

An important concept involves the substitution of conventional engine elements generally in compression by tensile elements. For example, a push rod is replaced by a "pull wire." The arrangement is illustrated diagrammatically in FIG. 18, with camshaft 1256 actuating rocker arm 1257 fixed at pivot 1258 which, via tensile member 1259, activates rocker 1260 anchored at pivot 1261, which in turn activates valve 1262 and spring 1263. It is clear that the use of tensile members permits greater freedom in location of cam and valve mechanism, since the line of force need no longer be a straight path. By way of example, tensile element 1259 is shown routed clear of another engine element 1264 by means of wheel, roller or bearing 1265. The rocker arrangement of FIG. 18 can be eliminated, as shown in FIG. 19, by attaching the tensile member 1259 to a movable cage 1266 surrounding the cam 1267, the cage having a cam follower 1268 (shown by way of example as a roller bearing) and slot 1269 moveable on a fixed cylindrical guide 1269*a*, for defining follower movement relative to cam in the direction indicated by arrow 1270.

Figure 20:
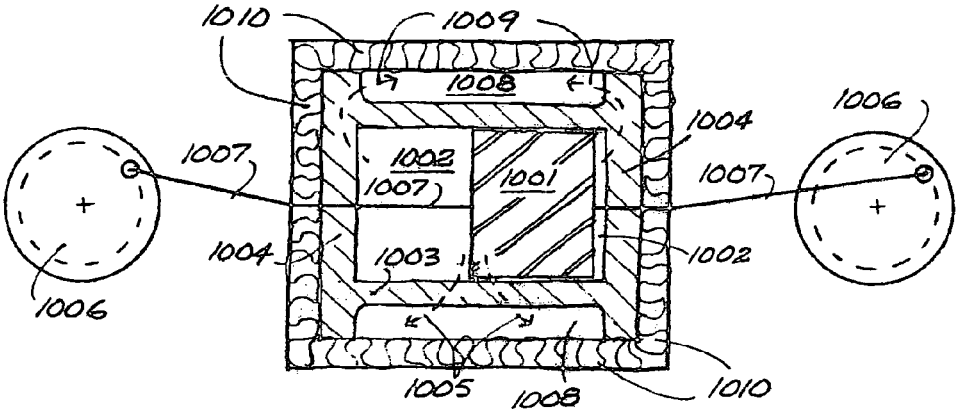
FIGS. 20 to 22 show schematic layouts of tensile link engines.

A selected embodiment of the engine is illustrated schematically in FIG. 20. It consists of a piston 1001 reciprocating between two combustion chambers 1002 at each end of a cylinder 1003 closed by two heads 1004, with a crankshaft 1006 outboard each head, the piston being connected by tensile members 1007 to both crankshafts. Optionally, the crankshaft will also function as a camshaft, actuating valves and optionally providing fuel delivery. The liquid elements for the charge may be delivered to the combustion chambers under pressures and temperatures higher than normal in conventional engines. The cylinder is at least partially surrounded by an exhaust gas processing volume 1008, with exhaust gas being conducted to the volume by alternate paths 1005 and 1009. Intake to the combustion chamber is via the crankcase. Surrounding the engine is a heavily thermally insulated casing 1010, here functioning as structure enclosing volume 1008. This configuration is suitable for four and two stroke embodiments, consuming fuel ranging from gasoline and similar lightweight fuels through diesel and heavier oil fuels to coal and other slurries or powders. Any engine lubrication and/or bearing system may be employed, but optionally either gas or roller needle bearings are used, perhaps with water or other liquids, in the case of water preferably when the components are of ceramic material, as described later. The crank assembly is preferably so designed that any air bearings at least partially operate at a pressure equivalent to the charge pressure of forced induction, in the case of turbo-charged, supercharged or force-aspirated engines. In the case of two stroke engines, the preferred arrangement is to exhaust gases via ports about the center of the cylinder. In the two cycle form illustrated schematically in FIG. 21, pressurized air is ducted via crankcase 1275 and valve 1276, actuated optionally by combined crankshaft/camshaft 1277, to combustion chamber 1288 (fuel injection system not shown), displacing exhaust gas which exits the chamber via ports 1289 to circumferential exhaust gas processing volume 1290. A heavily thermally insulating casing 1010 extends around the engine of FIG. 20, and is shown around the crankcases and engine of FIG. 21. In another example of either a two- or four-stroke engine, FIG. 22, the schematically shown piston/cylinder module 1271 is linked to a single crankshaft 1272 by tensile elements 1273 routed about guides/bearings/rollers and/or wheels 1274.

Figure 21:
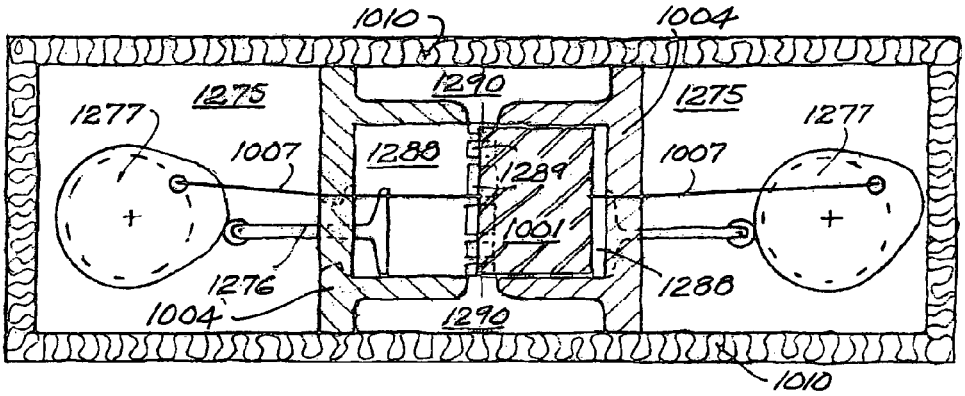
Figure 22:
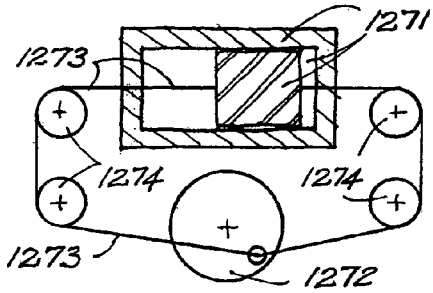
Figure 23:
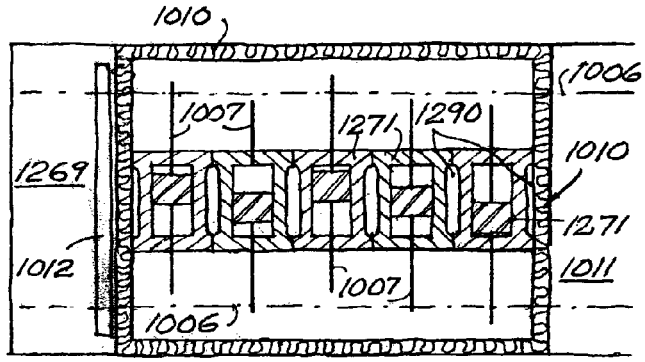
FIGS. 23 to 32 show schematic layouts of multi-cylinder tensile link engines.
Figure 24:
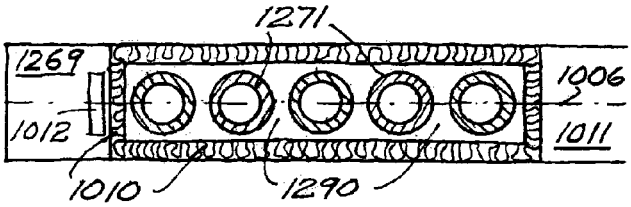
Figure 25:
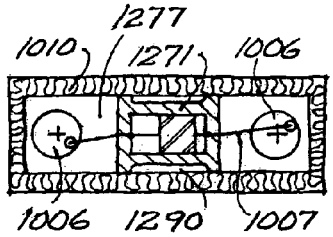
Figure 26:
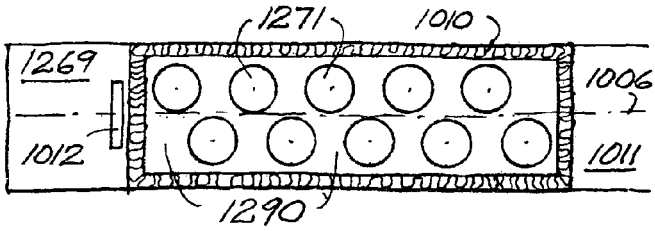
Figure 27:
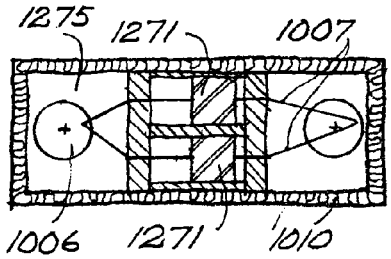
Figure 28:
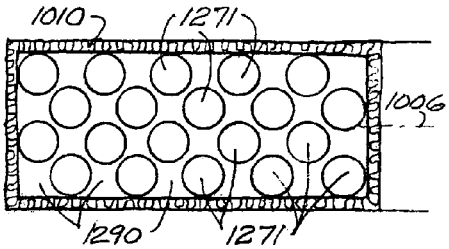
Figure 29:
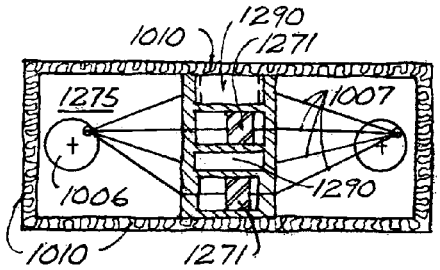
Figure 30:
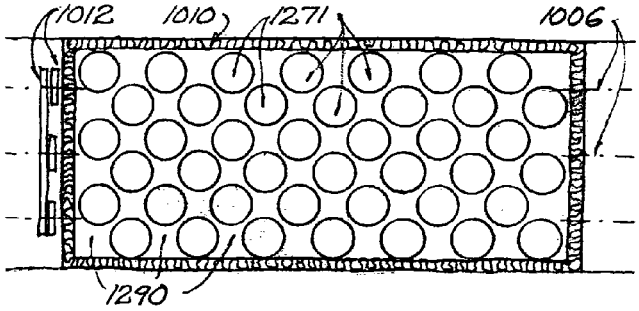
Figure 31:
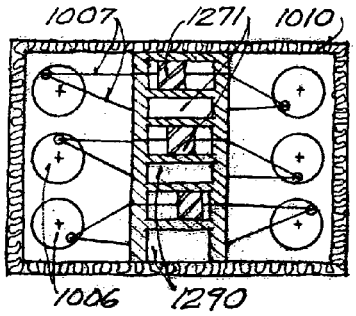
Figure 32:
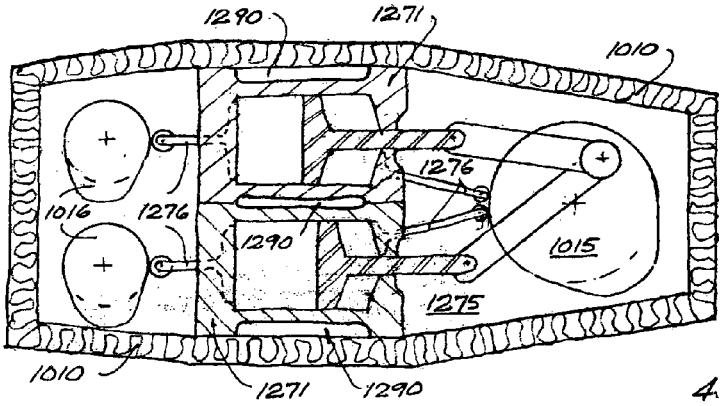

The layout described above may be arranged in multiple cylinder form in a flat configuration, as is shown in plan FIG. 23, longitudinal section FIG. 24 and cross section FIG. 25, where five piston/cylinder modules 1271 with ten combustion chambers are arranged about two crankshafts 1006 in two crankcases 1277, connected at one end to the transmission 1011 and optionally mechanically linked by it, and at the other end driving ancillary systems 1269 (such as a turbocharger) with the crankshafts optionally mechanically linked by system 1012. The space surrounding the cylinders can be used as an exhaust processing volume 1290, as shown in FIG. 21. FIGS. 23 through 25 have been dimensioned in terms of unit d, in this case and being both the bore and the stroke of the piston. As previously, in following FIGS. 26 through 32, there are indicated schematically twin combustion chamber piston/cylinder modules at 1271, optionally thermally insulated engine casings at 1010, crankshafts or their axes at 1006, mechanical linkages for multiple crankshafts at 1012, spaces for ancillary systems or transmissions at 1275. In an alternative configuration, shown in schematic longitudinal section FIG. 26 and cross-section 27, a double row ten cylinder engine is shown. Obviously, any number of rows and cylinders can be combined between two crankshafts, since it is only necessary to lengthen the tensile elements. In FIGS. 28 and 29, a schematic cross-section of a four row engine of eighteen cylinders and thirty-six combustion chambers is shown, where tensile members 1013 and 1014 are of unequal length. (In the embodiment of FIG. 29, the outer pistons would normally have a shorter stroke than the inner pistons.) Either separate camshafts or more elaborate valve/fuel activation linkages are required, to provide valve actuation or fuel delivery for engines having three or more rows of cylinders and two crankshafts. Alternatively, more than two crankshafts can be employed, as shown diagrammatically in cross-section FIG. 31 and longitudinal section FIG. 30, in the case of a six row forty-two cylinder, eighty-four combustion chamber engine. It will be noted that these configurations are most practical if the engines are un-cooled or adiabatic. If the tensile members are replaced by connecting rods, a single crankshaft may be used, as shown diagrammatically in FIG. 32 for a two row engine, having twin-combustion-chamber cylinder modules 1271, a single combined crank/camshaft 1015 and two camshafts 1016, various valve actuation rods 1276. FIGS. 23 through 32 are all schematic and do not show valve guides and springs, fuel delivery and exhaust systems, etc.

Figure 33:
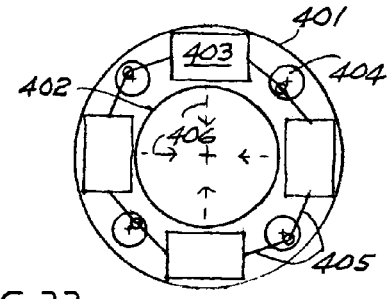
FIGS. 33 and 34 show schematically multiple crankshaft tensile link "ring" engines.
Figure 34:
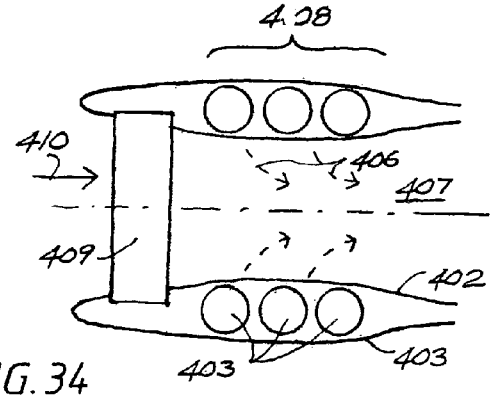

The basic cylinder modules may be combined to form a "ring" engine with the interior space optionally used for a turbine or ram jet engine to form a compound engine having a single revolving system. Schematic sections FIGS. 33 and 34 show three rings between outer casing 401 and inner casing 402, each of four piston/cylinder modules linked by common crankshafts 404 and tensile members 405, with hot exhaust gases 406 providing at least partial energy for the ramjet or turbine 407, either directly or via heat exchangers (not shown). Ambient air flow is shown at 410. The work from the reciprocating portion of the engine—shown at zone 408—may be used conventionally, may power the compressor of the turbine portion or may, as shown schematically at 409, drive a fan, propeller or Archimedes screw to provide thrust, either through air or water.

A general design objective is to arrive at engines having greater power to weight ratios, power to bulk ratios and efficiencies than equivalent contemporary units. This is achieved by three principal means: 1 the rearrangement of the reciprocating engine components into a more compact and simple configuration, 2 the drastic reduction of reciprocating masses, and therefore the reduction of size and mass of key structural components, 3 the virtual elimination of heat loss from the system (thereby increasing temperatures during combustion and therefore efficiency.)

The above piston and cylinder configuration and the tensile link between the crank and piston concepts are interrelated, and together provide significant advantages. Substitution of the heavy connecting rod and its bearing at the piston by the much lighter tensile member entails that the crank can be pulled, rather than pushed. With two combustion chambers acting on one piston, less loads are transferred through the crank, permitting lighter construction. This is especially true in the case of two-stroke engines, where virtually only net work and therefore loads are transferred to the crank. (Part of the work of expansion is transferred through the piston to provide most of the work of compression.) If the tensile link is used, the desirable slack will generally cause the piston to "float" toward the end of the first chamber's expansion stroke, a transition ensuing after combustion expansion, causing the piston to pull one crankshaft and subsequently being pulled by the other crankshaft, to effect final compression of the second chamber. A significant portion of the loads of piston deceleration will be taken up by the compressing charge and will not be transferred to the crankshaft, permitting lighter construction. Because of the constant line of the tensile member between heads, the piston is much less subject to side loads and torque, simplifying piston bearing and seal design. The arrangement of the exhaust processing volume adjacent to the cylinder eliminates heat loss from the cylinder walls to outside the system. If the volume is properly insulated, exhaust temperatures will more closely approach mean combustion chamber gas temperatures, reducing thermal stress on the cylinder. Likewise the piston has two opposing work faces, and consequently will have shallower temperature gradients than conventional pistons. In the two stroke embodiment, cold charge enters the hot maximum compression end of the combustion volume thereby cooling it, while hot exhaust gases exit the cold minimum compression end thereby heating it, tending to even out the temperature gradients of the combustion chamber surfaces. Because these arrangements substantially reduce thermal gradients, and consequently stresses, it will be easier to manufacture the components in a wider variety of ceramic materials, which generally have less tolerance to thermal shock than metals.

It is generally understood that engine efficiency increases in rough proportion to the difference between charge temperature and combustion temperature, and to a lesser degree with increase in compression ratio, and that power to bulk and power to mass ratios increase proportionately to engine speed—provided that these increases are not partially absorbed by higher friction and pumping losses, and that combustion efficiency is constant within the speed range considered. It is an objective of these designs to provide an environment where combustion temperatures, compression ratios and engine speeds higher than in present units can be successfully and efficiently employed. The higher combustion temperatures will tend to produce hotter exhaust gases, leading to improved emissions control and usually a greater heat sink for waste heat recovery systems, which will therefore produce more work, and generally lead to greater system efficiencies. All the above would suggest that, in the case of high performance engines, carburetor or manifold injected fuel delivery should be discarded in favor of direct injection into either cylinder or pre-combustion chamber, so providing more controllable combustion and reducing the risk of predetonation.

The more efficient engines of the future will probably be force aspirated, usually by turbo- or supercharging, and most two stroke designs require some form of forced aspiration. Accepting that work must be expended into compressing the charge (the efficiencies gained by improved aspiration more than offsetting the work required), the present designs seek to use any such compressed environment to provide some portion of the work required for gas bearings, which is one reason aspiration can be via the crankshaft. Both the sliding interface between tensile member and head and the interface between piston and cylinder will preferably employ some form of gas bearing, probably a combination of high-pressure blow-by and/or water-generated steam bearing, described later. This means that oil pumping losses (plus the bulk, weight, cost and unreliability of such equipment) can all be eliminated, as can the heat dissipation of the conventional lubrication system. For practical purposes, friction losses can be eliminated, since the friction produced by gas turbulence in bearing clearances of a few microns' depth is negligible in relation to loads carried. Preferably inter-cooling is eliminated also. The consequent loss of mass of charge is offset by the higher charge temperature differential, but most importantly the pumping losses, waste heat dissipation, complexity, bulk, weight and cost of inter-cooling systems are eliminated.

As noted earlier, among important engine design objectives are simplicity and viable cost. So far we have an engine in which coolant and lubricant pumping losses, as well as friction losses, have been virtually eliminated. These are substantial on modern engines, especially in high performance diesels, so this would suggest a proportionate increase in efficiency resulting from the elimination of these losses. There has also been virtually no heat loss whatsoever, assuming both crankcase and exhaust volume housing have theoretical maximum insulation. Heat dissipation through the head is of course transferred back to the charge. Since the difference between ambient and combustion charge temperature has been increased, there should be a proportional increase in efficiency. If it is desirable to increase combustion temperatures still further (the only physical limit being the structural performance of the combustion chamber materials at a given temperature), the compression ratio can be increased, providing yet a further increase in efficiency. Because some of the heat is produced by combustion, increasing the compression ratio will have a proportionally greater effect on absolute pressure compared to absolute temperature. Additionally, water in some form may be introduced to the combustion process, which will have the effect of reducing temperature and increasing pressure, as described in more detail elsewhere. Due to either increased temperatures and/or pressures, efficiencies will be higher with the new engines.

An important feature of the present engine designs is the significant reduction of reciprocating masses, firstly by the elimination of the usually heavy connecting rod and its piston bearing assembly, secondly by the substitution of steels by ceramic materials of between 30% and 40% of the weight of steel, thirdly by the reduction of most of the rocker and push rod mechanisms of conventional engines. It is estimated that reciprocating masses could be reduced to end up weighing as little as 10% to 20% of conventional practice. Ignoring valve actuation, let it be assumed that a 75% reduction is achieved on the piston/crank system. If the stresses caused by the reciprocating masses increase roughly as the square of the increase in engine speed, then reducing the reciprocating masses by 75% will either permit double present engine speeds with the same stress limits, or a four-fold reduction in stress limits. The strength of construction of an engine (and therefore its weight) is directly proportional to the required stress tolerance. In other words, the new engine designs permit lighter construction with consequent weight savings and vehicle system efficiency, and/or higher engine speeds. Excluding mechanical (friction and pumping) losses and assuming combustion efficiency is constant, power to bulk and weight ratios increase proportionately to engine speed, as noted earlier. However, in these designs there are virtually no mechanical losses, so in many cases the only practical limit to higher speed is the maintenance of combustion efficiency (reciprocating stresses being drastically reduced).

The current state of the art appears to indicate that, with force aspirated engines, efficient combustion can be maintained up to around 200 rps (12 000 rpm) for gasoline engines and around 100 rps (6 000 rpm) for direct injection or diesel engines. The limiting factors tend to be the time taken for combustion to be initiated and, once initiated, to be properly completed and, in the case of direct injection engines, by the time taken to distribute the fuel throughout the combustion chamber. Both of the first two processes can be hastened by increased pressure, putting the constituents of combustion in closer proximity to each other, and by increased temperature. Therefore, if compression ratios are increased or water is added to provide combustion pressures higher than those prevalent now, then a corresponding increase in usable engine speed is likely. The combustion delay time may also be reduced or eliminated by delivering the liquid parts of the charge into the combustion chamber at greatly elevated temperatures and pressures, so that they vaporize immediately on entering the chamber. Then the kinetic energy imparted to the mass of droplets during injection would have to be such that it would carry the fuel in a largely gaseous state to the desired regions of the chamber. In this mode the injection process could have some of the features of stratified charge, or plasma ignition in main combustion volumes.

In comparison with a solid connecting rod, the effect of the tensile crank design (in some embodiments) will be to delay the piston at each end of the cylinder and hasten its passage between the ends, as described below. This delay at each end also implies that engine speed can be raised, relative to conventional engines, for given combustion parameters. Taking into account piston delay, increased compression ratios and combustion chamber temperatures, the delivery of fuel under high temperature and pressure, one might suppose that engine speed limits for a given efficiency of combustion could perhaps double. With additional new injector designs and layouts, speed limits in direct injected engines might increase up to three or four fold, that is diesel speed limits might be in the 200 to 300 rps range. Today, most diesels run at far lower than theoretical maximum speeds, the limiting factor being the stresses caused by reciprocating mass. With the new engines this presents virtually no problem, so all diesels could run at similar speeds, closer to theoretical maxima. In large engines, such as for marine applications, speeds could increase from around 18 rps to over 150 rps.

For some reason, three dimensional camshaft movement has not been generally introduced into today's engines. This seems difficult to understand, since the cost of imparting axial motion to a camshaft is small and the benefits are great. These include providing variable valve lift and dwell, providing an optional and variable secondary opening to the combustion chamber for charge bleed off (providing a variable effective compression ratio engine, or a means of improving two stroke charge purity if hot exhaust gases are adjacent the opening), providing variable ignition timing, providing variable fuel delivery actuation. In the case of engines with a large speed range, the variation in optimum settings for valve lift, dwell, ignition timing, etc, becomes greater, suggesting that three dimensional camshaft movement could be desirable in the new engine designs. In those designs where it is proposed to integrate camshaft with crankshaft, it would be feasible to provide the crankshaft with three dimensional actuation if tensile members are used, and relatively easy to embody with gas main bearings.

Figure 35:
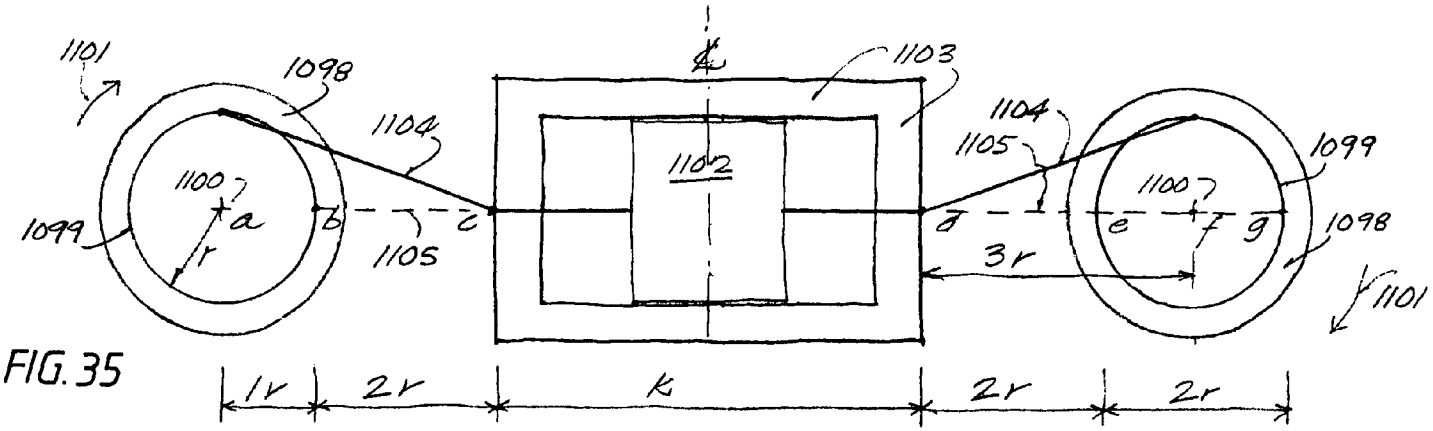
FIGS. 35 to 38 illustrate possible varying lengths of tensile links.

The issue of the tensile link between piston and crank is more complex than is immediately apparent. In the twin crankshaft layout described previously, it is not possible to maintain a constant length between piston and crank, if the cranks are to rotate synchronously. Diagrammatical FIG. 35 shows centers 1100 of equal and synchronized crankshafts 1098 with throw of radius "r" describing path 1099 rotating in the same direction 1101, shows piston 1102 and head/cylinder module 1103 of constant dimension k, solid line 1104 representing tensile member when the piston is in the middle of the cylinder, and dotted line 1105 the tensile members when the piston is at the end of the cylinder. In the latter position it will be seen that, if crank centers are placed 3r length on piston axis outboard of module, the total tensile length between crankshafts is 2r+4r+k=6r+k. When the piston is in the center, the tensile member dimension is hypotenuse of right angle triangle base a-c plus hypotenuse of right angle triangle base d-f plus k. Since the bases total 6r and since the hypotenuses must be longer than the bases, it follows that the distance between the cranks is longest when the piston is in the middle of the cylinder. Since the components need always to be linked, the length of the tensile member is that required to accommodate the piston in or around the middle of the cylinder, meaning that there will be slack in the tensile system when the piston is towards the ends of the cylinder (or the tensile system has to be elastomeric). This slack is an important feature of the design of tensile crank link engines and is described in more detail later.

Figure 36:
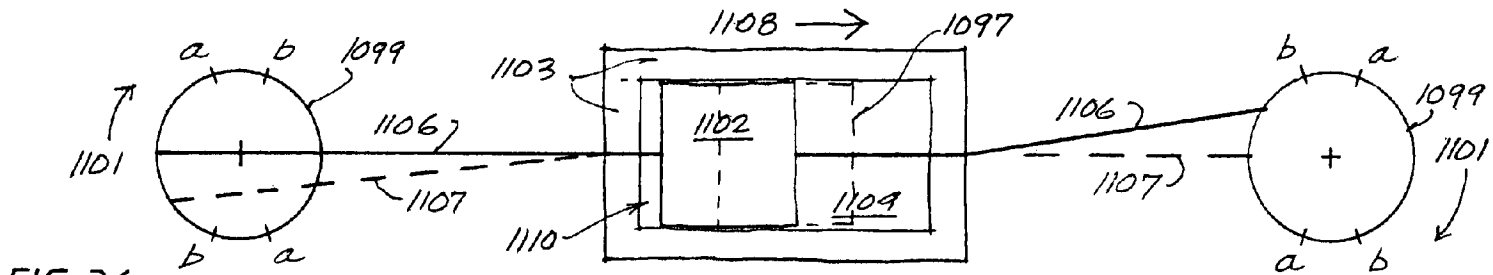

So far symmetrical situations have been considered—the same parameters apply to both of the combustion chambers of the piston. If the rotation of the cranks is not synchronous, then asymmetrical conditions maybe obtained, as shown schematically in FIG. 36, where tensile members are shown in alternative configurations 1106, 1107. The piston 1102 is shown dotted at 1097 when it is in the center of the cylinder. Two optional tensile configurations "a" "a" and "b" "b" are shown when the piston is in the center of the cylinder traveling in direction 1108 compressing the fluids in chamber 1109. When the optionally linked cranks have traveled through 180°, tensile parameters have changed with respect to the identical piston now in compression relationship for combustion chamber 1110. (Obviously the cranks will complete revolution if the tensile members have the required amount of slack.) In order to better understand the principles of tensile crank design only symmetrical layouts will be considered from here on.

Figure 37B:
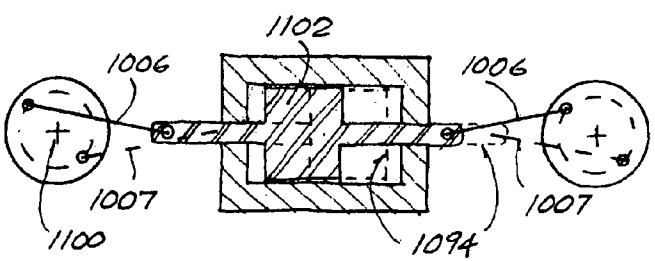
Figure 37A:
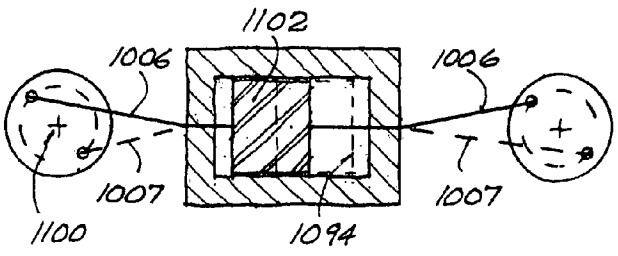
Figure 38:
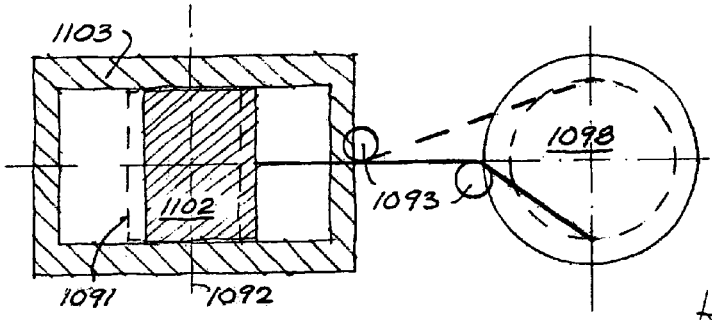

The tensile link may be wholly of some flexible material 1106, or may partly comprise a rod 1096, as shown schematically in FIGS. 37A and 37B. In both examples an equal portion of the tensile element is parallel to piston 1102 movement; in one case it is fixed relative to crank centers 1100, in the other it reciprocates and is relative to the piston. The tensile links are shown at 1006 in a first position relative to the piston, and at 1007 when the piston is shown in dashed position 1094. Here the cranks are shown turning in the same direction and the free portions of the tensile element are angled at 180° or less to one another. Not shown, but equally possible, is to have the cranks turn in opposite directions to one another, thereby maintaining the free tensile portions at a more or less constant 180° to one another. In FIG. 38 an arrangement for differential pivots 1093 for each half of the cycle is shown, which will cause the piston 1102 to be off cylinder assembly 1103 center at 1092 in position 1091 when the crank(s) 1098 is/are 90° off BDC/TDC, so permitting differential piston speeds during cycle phases. For example, such an arrangement could be used to cause the piston to move faster during the main portion of the compression stroke compared with during the main portion of the expansion stroke or vice-versa.

Figure 39A:
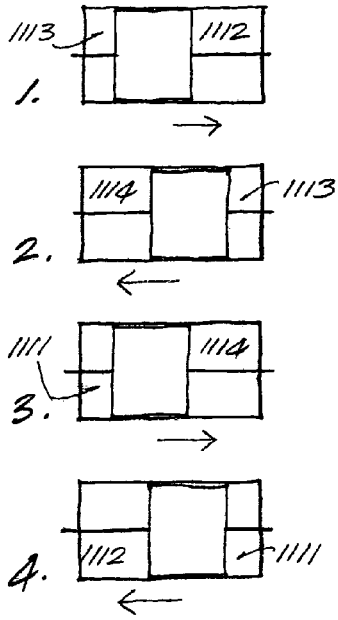
FIGS. 39A and B illustrate two- and four-stroke operation.
Figure 39B:
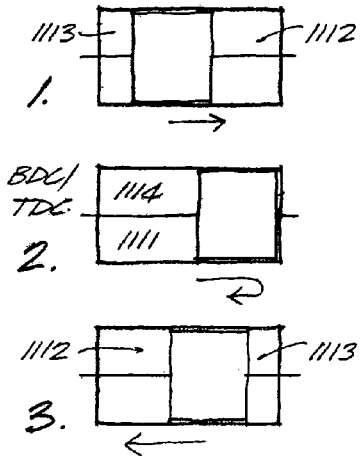

FIGS. 39A and 39B show how the basic configuration of a piston 1102 having a combustion chamber at each end and reciprocating in a cylinder assembly 1103 can be used for four stroke and two stroke engines respectively. The intake phase is shown at 1111, compression at 1112, expansion at 1113, exhaust at 1114. Direction of piston travel is indicated by the arrow below each numbered portion of the Figure. In the case of the two cycle engine, only net loads are transferred to crank; in the case of the four cycle alternately net and gross loads are taken up, suggesting that for a given number of cylinders the two stroke will be smoother running. The base configuration of FIG. 20 improves two stroke smoothness over conventional systems more than that of four cycle engines.

Figure 40:
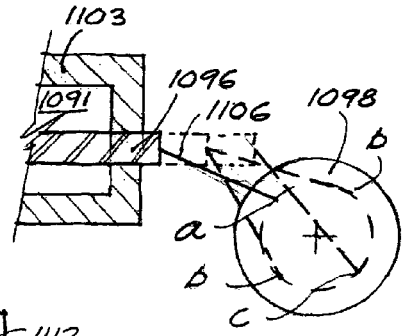
FIG. 40 illustrates an offset crankshaft axis.
Figure 96:
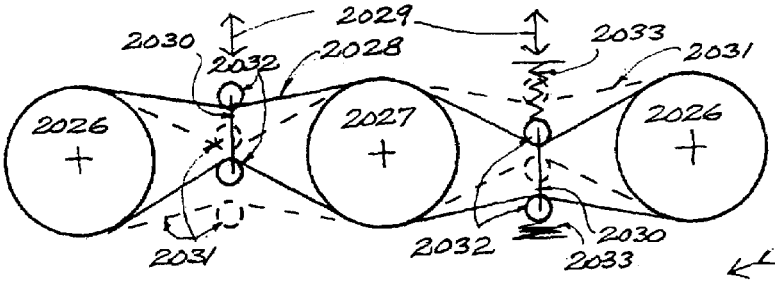
FIGS. 96 and 97 show ways of compensating for differential movement of twin crankshafts.
Figure 97:
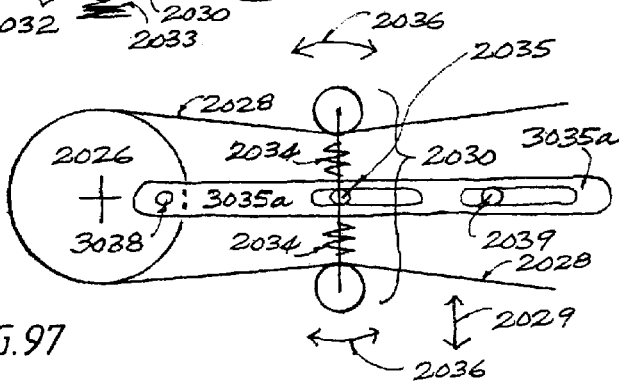

Referring back to FIG. 35, it is assumed that when the cranks turn through the 90° relative to BDC/TDC, the piston is in the center of the cylinder and the tensile halves have equal slack. Considering one combustion chamber, by enlarging crank movement radius, the slack toward TDC will be decreased and the slack at BDC increased by a slightly greater amount. Reducing the crank radius to less than that of piston movement reverses the process—there is more slack at TDC and less at BDC. It is also obvious, FIG. 35, that the greater the distance from head to crank center in proportion to crank radius, the less slack is required in the system. In some embodiments, it may be preferable to have little or no slack at TDC, since the piston as it approaches TDC may need to be pulled there by the crank to complete the compression and subsequently, as expansion takes place, the loads must be transferred as quickly as possible to the same crank. On the other hand, toward BDC all the useful work of expansion will have been completed, so a taut tensile member may not be required. In practice, to enable the tensile member to be taut at TDC, the crank movement diameter will have to be around 5/4 to 8/7 of piston movement, depending on design details. The presence of slack towards the ends of piston travel could cause it to spend more time there, allowing more time for combustion to develop and/or for fluid transfer to take place. The ratio can be reduced for equivalent crank centers, by employing the configuration of off an offset crankshaft 1098 shown schematically and exaggeratedly in FIG. 40, which may be suitable for low power applications where axial loads at the head do not present a particular problem. The piston rod 1096 is shown in part of the cylinder assembly 1103 when combustion chamber 1091 is at maximum expansion and the piston (not shown) is at BDC, with tensile link 1106 connected to the crankpin at "a". The link is shown dashed in alternative positions, with the crankpin at "b" when the piston is approximately at the center of its travel range, and at "c" when it is at TDC. (In those applications where the cranks may not rotate synchronously, differential rotation could be absorbed by using final drive devices such as illustrated in FIGS. 96 and 97.)

Optionally, the engine may be so designed as to permit increased compression ratio with increase in speed. For start up and low to moderate speed, the arrangement described above is employed: the piston is pulled by a crank to a "designed" compression ratio position, and on expansion the piston in turn pulls that same crank. Before the piston has been pulled to complete compression, it has been slowed down because its kinetic energy and the work done on it in the other combustion chamber by the last stages of expansion is less than that required to complete compression. (During this slowing down period, the slack may be transferred from one free tensile half to the other; except for transition phases one tensile half is always taut and the other slack.) However, as the engine speeds up the kinetic energy of the piston becomes greater, to the point when at the designed compression ratio the work effected in and by the piston has equaled the work required for compression. As the piston speeds up further, the work on it and by it exceeds that required for the "designed" compression ratio. Since the piston is not restrained other than by the compressed gas (the link to the crank towards which it is traveling has the slack, the link with which it is pulling the other crank is taut), it will compress the gas beyond the "designed" ratio. As piston speeds increase and compression ratio climbs, more kinetic energy is required, which is derived from the extra work obtained by burning a fixed mass of fluid at higher pressure and temperature. One of the prime benefits of increased compression ratio with increased engine speed would be the shorter required combustion time, due both to increased pressure and the increased temperature resulting from higher pressures. Temperature and compression ratio do not increase proportionately, since the temperature is the result of pressure and combustion combined.

In some embodiments, the deceleration of the piston should be controlled relative to variation of engine speed, to ensure that all slack is taken up in the relevant free tensile half close to TDC, and that the excess of crank rotational speed over speed of tensile half movement is small as tautness is attained, to as far as possible eliminate shock loads on the tensile member. In the case of variable compression ratio designs, it is also desirable that tautness is attained at an angle of crank rotation before the loads of expansion can begin to be efficiently transferred to the crank. This control can be provided in the first place by designing the mass of the reciprocating parts to suit the desired engine speed range, and by varying the timing and quantity of fuel delivered around TDC. Optionally water, water-methanol mixtures or similar substances can be introduced, to provide sudden increases in pressure at critical periods and/or to control too-rapid temperature rise. It is assumed that in some engines it will be desirable to have the greatest possible engine speed because power to weight ratio is important (eg aircraft applications), so the objective of the variable compression concept is not so much to increase efficiency (in some embodiments it might decrease), as to facilitate proper combustion in short time intervals. An interesting feature of the variable compression engine is that, once the "design" compression ratio has been exceeded, the masses of the reciprocating parts (other than valve and fuel systems) exert no loads on the crank. Therefore the traditional limitation to engine speeds in medium and large diesels is completely removed. As has been shown, the tensile crank design reduced reciprocating mass, as did the substitution of ceramics for steels, enabling much lighter engine construction to be employed. In two-stroke engines, the variable compression concept removes reciprocating mass loads altogether at higher speeds.

Figure 41:
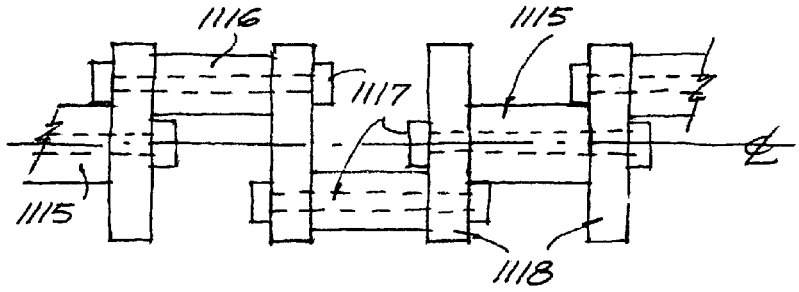
FIGS. 41 to 44 show details of crankshaft construction.
Figure 42:
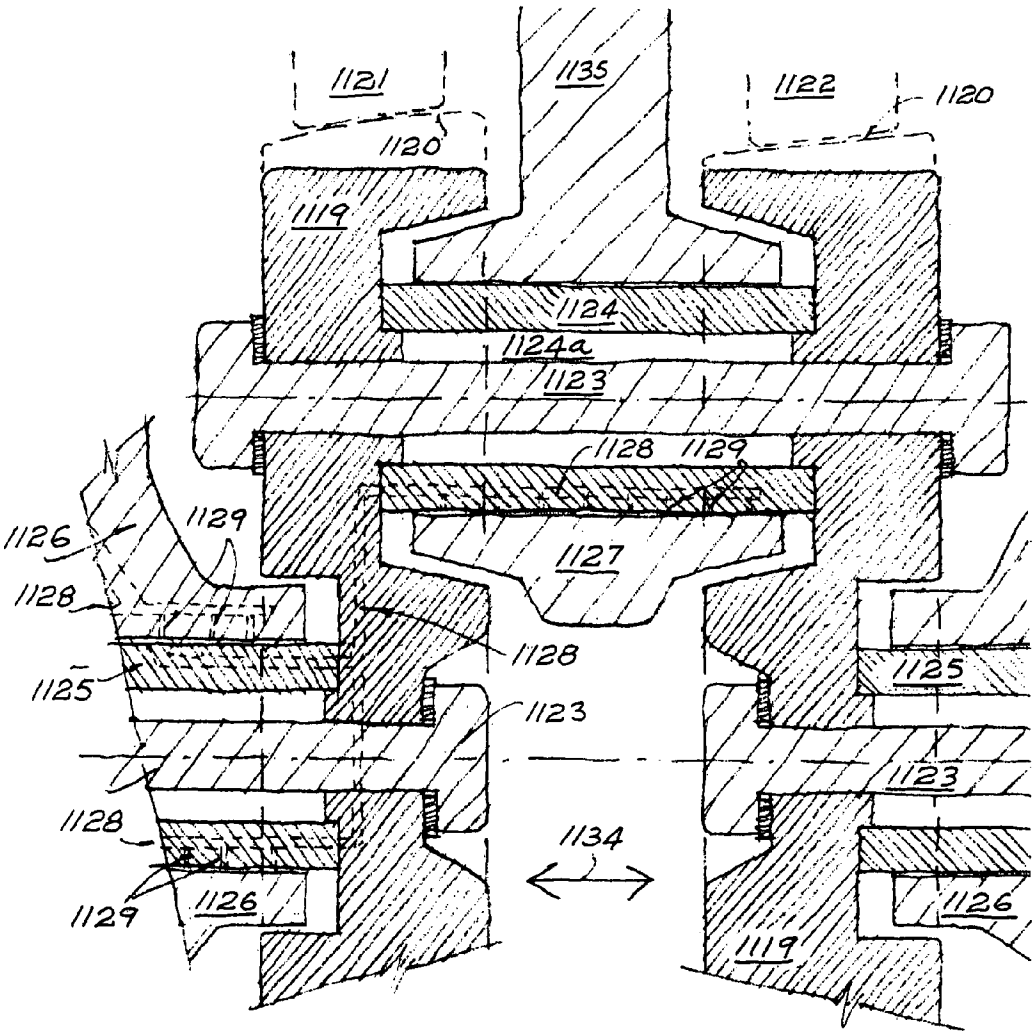
Figure 43:
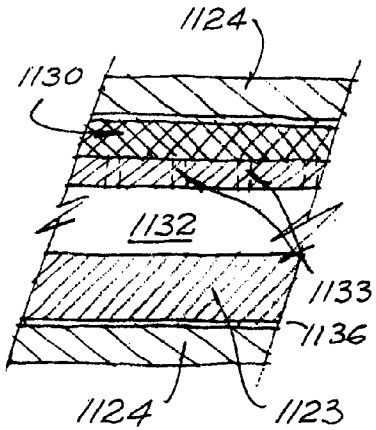
Figure 44:
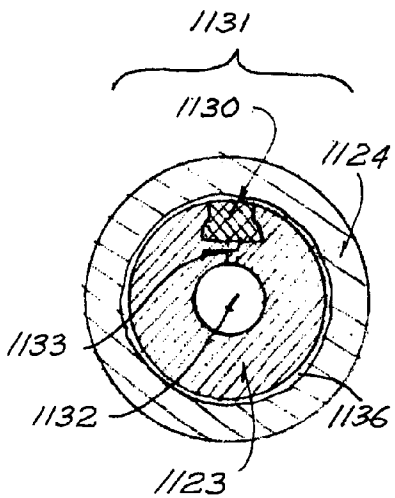

The crankshaft itself may be manufactured along conventional lines and may be of any material, including ceramic. Non-conventional configurations may also be used, including the built-up configurations shown schematically in FIG. 41, wherein center bearing tubes 115 and big end bearing tubes 1116 are mounted in compression by axial tensile fasteners 1117 between discs 1118 which act as crank throws. These discs may be so formed as to both permit maximum bearing size and to allow the circumferential area to act as a cam, as shown in cross-section by way of example in FIG. 42, where two shaped discs 1119 having precisely machined surface cam profiles 1120 for valve cam follower 1121 actuation and fuel delivery cam follower 1122 actuation. The discs are interconnected by tensile fastener 1123 and inner crank bearing cylinder shell 1124 having precisely machined ends, each disc being similarly fastened to an inner main bearing cylinder shell 1125. Outer main bearing cylinder shells 1126 are attached to engine structure. Outer crank bearing (big end bearing) cylinder shells 1127 are attached to crank connecting rod or tensile member 1135. The present layout is shown having gas bearings where the largest bearing areas are desirable, but of course roller or needle bearings may also be employed. The technology of both gas and needle roller bearings in ceramic and other bearings is well understood and not itself a novel feature. If the gas bearings required greater than ambient gas pressure, then gas passages 1128 communicating with a central gas reservoir may duct gases to apertures 1129 at the bearing surfaces. In an alternative arrangement suited to ceramic materials and high crankcase temperatures (say around 450° K and over), the passages may contain water under pressure, which on leaving the apertures will instantly turn to steam, so providing gas under pressure in the relatively close tolerance (sometimes 1-3 microns) of the gas bearing. Optionally, the centers 1124*a* of the inner bearing shell cylinders 1124 may be filled with water to provide, together with likely counterbalances, some kind of flywheel effect. In crankshafts having few throws, the gas or liquid may be pulsed, to provide maximum pressures at moments of greatest loading. Instead of the apertures, a combination of apertures and wicks may be provided, as shown diagrammatically in longitudinal and cross-section in FIGS. 43 and 44, where 1123 and 1124 are respectively the inner and outer bearing shells, and 1136 the space between them for bearing fluid. A wick 1130 is disposed at maximum loading area 1131, to more evenly distribute the liquid delivered under pressure via passages 1132 and apertures 1133. In arrangements described elsewhere, the slack in the tensile element may optionally be taken up by a fluid spring, so that tautening of the tensile element causes fluid to be delivered to the bearings. The crank of FIG. 42 is shown having lateral or axial motion, permitting the cam followers to be actuated to varying degree by the progressively shaped cam profile, as the crankshaft is moved in direction 1134. Here it is assumed that the link between piston and crank 1135 is not laterally movable, entailing larger inner bearing cylinders or shells than outer ones. Water lubrication is cited as an example; in fact any suitable liquid under pressure may be used, whether or not it changes to a gaseous phase in the bearing gap.

A way of linking crank to a piston and rod assembly is by a tensile link, pre-loaded to always absorb slack in the system, using for example spring steel. FIGS. 45 to 48 show such a spring steel link 1136 in tension under load, biased to open to position shown at 1137 when all load is removed. FIG. 45 is a sectional elevation, FIG. 46 a plan view, FIG. 47 a detail section taken at (b), FIG. 48 a detail section of the components at (c). U-shaped cross-sections of the tensile link (shown in FIG. 47) permit bending and therefore lateral movement of the crankshaft as shown schematically at 1138. The flatter cross-section at the spring 1139 or fluid reservoir at 1139*a* permits bending to take up slack, as shown schematically at 1140. Five spring actions are indicated here: the biased spring steel of component 1136, the spring 1139, the reservoir 1139*a*, the device at (a), the mat at 1143, although in fact only one is needed. The device shown at (a) is a shock absorber consisting of two rollers 1141 linked by stiff springs 1142. A compressible mat is shown at 1143, between spring steel loop 1144 and outer bearing shell 1145. FIG. 48 shows an enlarged section of the joint between the tensile member and the end 1148A of the rod of a piston/rod assembly, where the wedge-shaped split ends 1146 of one tensile half are seated in a shallow conical depression 1148 in the rod end, and located by collar 1147. The fluid reservoir 1139*a* is indicated schematically only, its volume not necessarily being to scale. Variation in stiffness of springing will affect the acceleration and deceleration of the piston during transfer of slack from one tensile half to the other.

Figure 49:
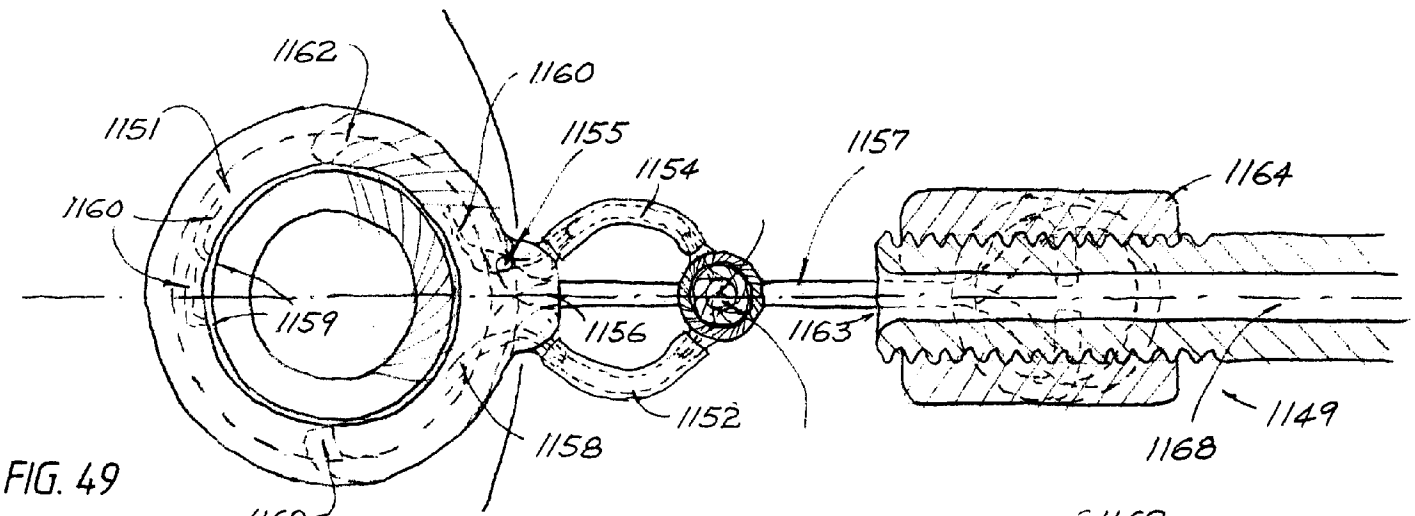
FIGS. 49 to 58 show details of alternative tensile link embodiments.
Figure 50:
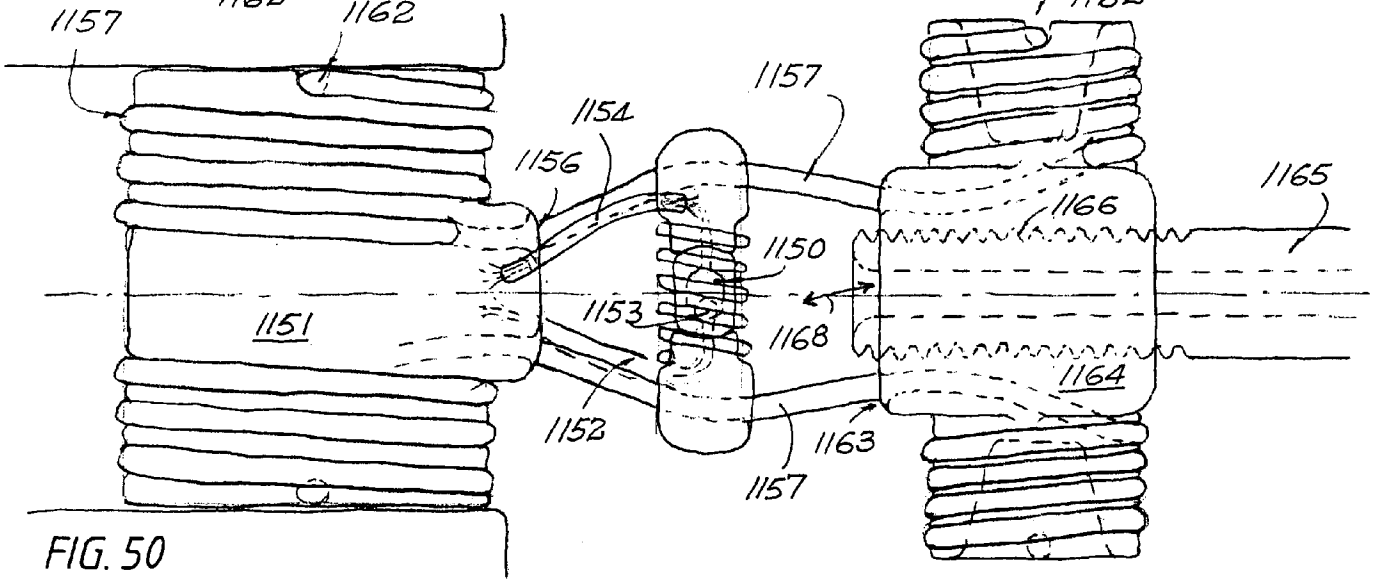
Figure 51:
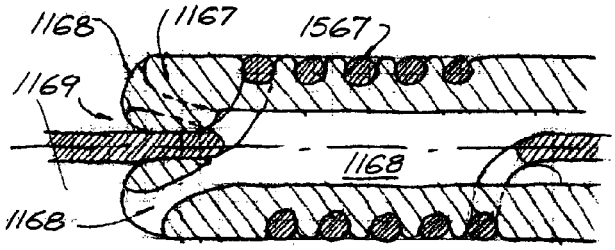

Another method of linking the crank to the piston is by a flexible tensile element such as cable, rope, yarn, etc. One design is shown in FIGS. 49 and 50, here with a hammerhead rod/piston assembly 1149. A compressible fluid reservoir 1150 is linked to outer bearing shell 1151 from fluid supply reservoir 1158 by fluid supply line 1152 with non-return valve 1153 and by fluid return line 1154 with non-return valve 1155, to deliver fluid to bearing at 1159 via passages 1160. Twin tensile cables 1157 pass through a bell mouth 1156 to be wrapped round the shell, with ends 1162 press or adhesive mounted. Similarly, the cables are attached through bell mouths 1163 about the detachable hammerhead 1164. They may pass through the piston/rod assembly (not shown). The hollow rod 1165 has openings permitting the passage of charge at 1168, which is moved within the hollow space by the rapid reciprocal motion of the piston/rod assembly. The head is attached to the rod by screw threads 1166. FIG. 51 shows a single cable mounted to a constant diameter rod tip 1167 of a rod/piston assembly, where the cable enters through a split bell mouth 1169, passes through the rod to be wound about it then re-enters the rod to pass through to the other end. The rod tip has a passage for gas 1168.

Figure 52:
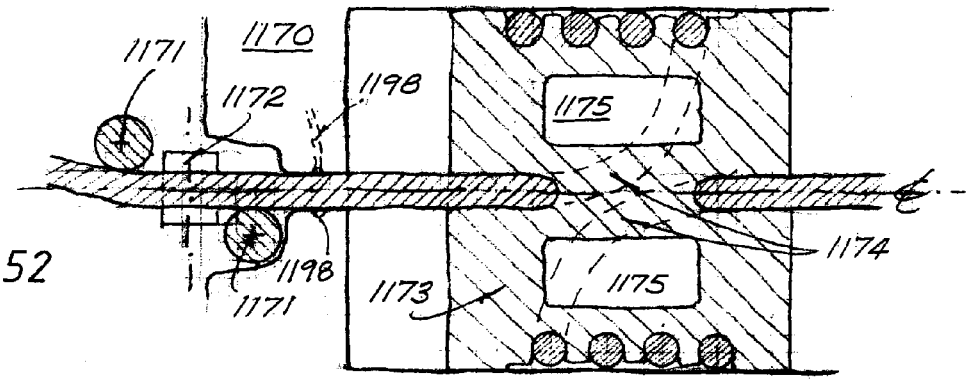
Figure 53:
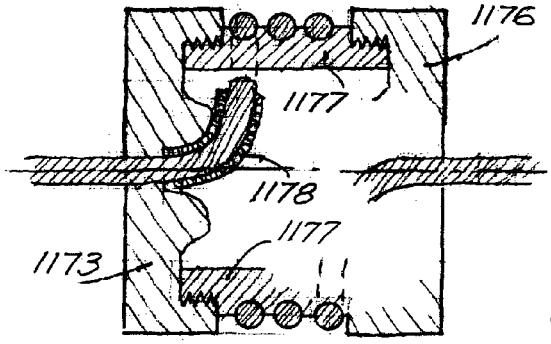
Figure 55:
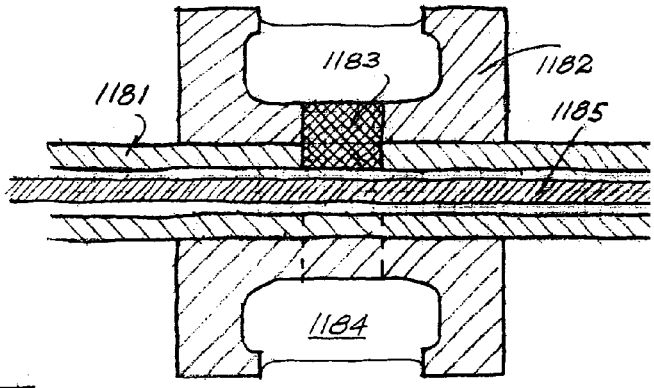
Figure 54:
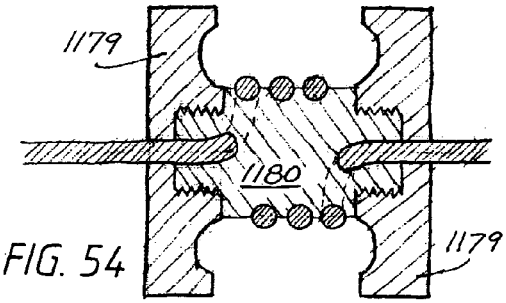
Figure 56:
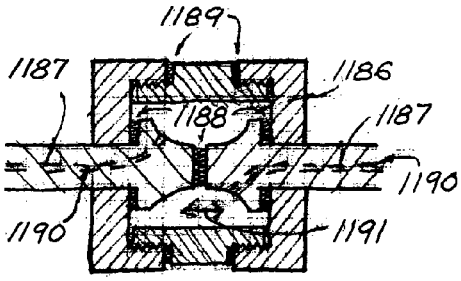
Figure 57:
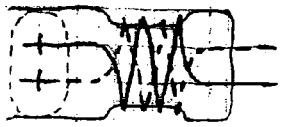
Figure 58:
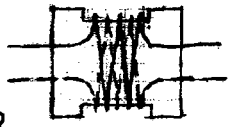

There are many methods of attaching the piston to the tensile elements. For example, FIG. 52 shows a single cable passing through the cylinder head 1170, guided by asymmetrical crank revolution roller guides 1171 and crank lateral movement roller guides 1172. The cable is passed through cast-in passages 1174 provided in the integral piston 1173, wrapped about the circumference and then passed through the piston again. Optional voids 1175 have been provided in this piston. FIG. 53 shows a similar arrangement in a tri-component piston, where the piston crowns 1176 are screw threaded to each other by means of a central cylinder or drum 1177 round which the cable is wrapped. A compressible sleeve 1178 is provided to project the cable against abrasion and to act as a shock absorber. FIG. 54 shows an open skirted three-component piston, where the crowns 1179 are screw threaded to each other by means of smaller central cylinder 1180. FIG. 55 shows an open skirted piston/rod assembly, where the rod 1181 is hollow and continuous, the piston 1182 having reinforcing flanges 1184. The piston is press fitted to the rod and attached either by the tightness of the fit (achievable by inserting the cooled rod in the heated piston) and/or by plugging a volume bisected by the component joint line as at 1183, or by a combination of both. The hollow rod may house a continuous tensile member 1185. FIG. 56 shows a tri-component closed-skirted piston assembly 1186 assembled about two independent rods 1187. Compressible material is provided at 1188 to provide small movement of the piston on the rod for shock absorbing purposes and at 1189 to provide a thread lock. Hollow passages 1190 may communicate with the interior of the piston, to carry fluid, preferably gas, through the piston in direction 1191 for cooling or other purposes. FIGS. 57 and 58 show arrangements equivalent to those of FIGS. 51 and 53, except that twin cables are provided.

Figure 59:
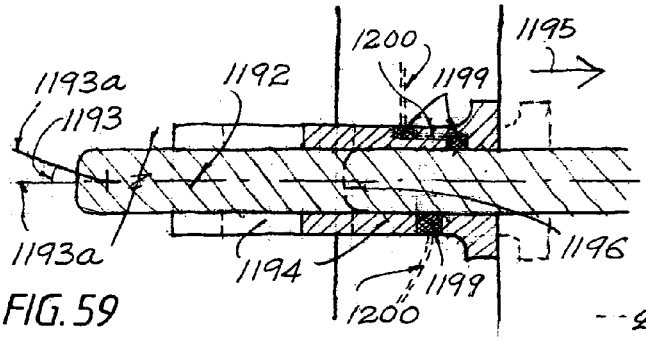
FIGS. 59 and 60 show an interface between tensile link and cylinder head.
Figure 60:
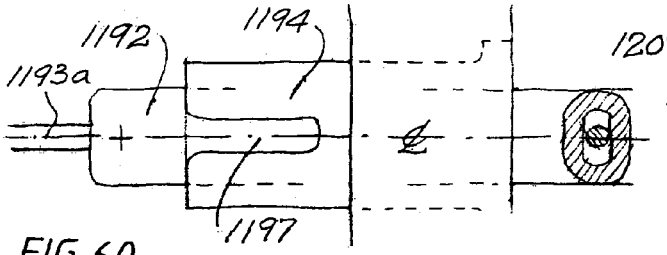

The tensile member may pass through the head in a number of ways. In rod/piston assemblies, bearing surface must be provided near where the rod passes through the head, to take up the angled loads caused by crank rotation. In the case of cable assemblies, these can be taken up by rollers, as for example in FIG. 52. FIG. 59 shows the rod 1192, which is reinforced during extreme crank angles 1193 by a sleeve 1194, and which may be movable in direction 1195 and may provide fuel delivery. Normal piston/rod movement range is shown dotted at 1196. The sleeve has a cutout 1197, shown in plan view in FIG. 60, to accommodate crank link 1193*a* movement range. Where the tensile member has to take lateral crank rotational loads, bearing may be by high pressure gases. This will naturally tend to be caused by blow-by, and if bearing tolerances are small, this blow-by loss may be very moderate and worth the bearing work it provides. Additionally or alternatively, bearing may be by water or other liquids or gases as described earlier, by direct supply 1198 as in FIG. 52 or via wicks 1199 as shown in various alternative arrangements in FIG. 59, supplied by passages 1200.

Figure 61:
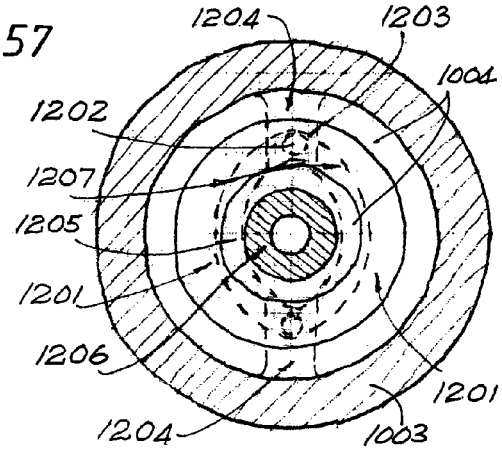
FIGS. 61 to 64 show arrangements of ring valves.
Figure 62:
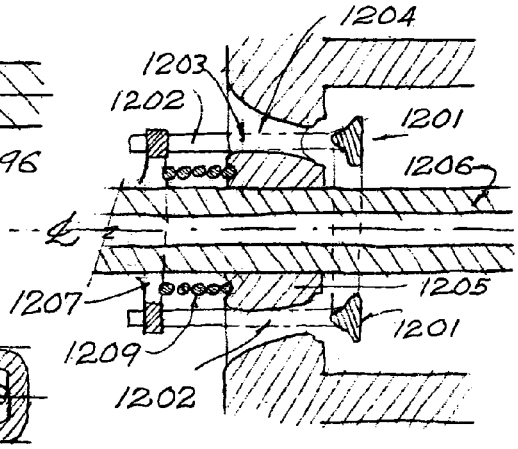
Figure 63:
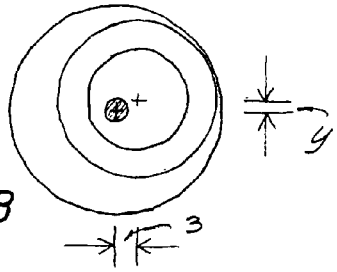
Figure 64:
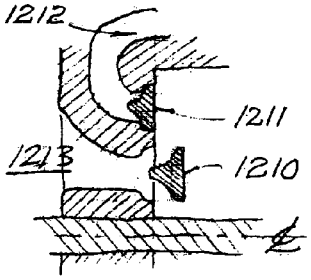

The head may be designed in any manner, including to house conventional poppet valve(s). The central tensile member reduces the possible diameter of the valves, unless four valves are used about a central rod/cable and optionally concentric fuel delivery. A less costly and more efficient arrangement might be the provision of ring valves, where a ring valve of median diameter x will provide around double the clearance of poppet valve of diameter x at a given lift. FIG. 61 designates an internal head plan view and FIG. 62 a head cross section. The figures show a single central ring valve 1201 with twin stems 1202 in guides 1203 provided in bridges 1204 supporting the central portion of the head 1205, in turn supporting the tensile member shown at 1206. The twin stems are linked by means of a split collar construction (not shown) to a collar with twin projections 1207 carrying a main stem (not shown) to a cam (not shown) and providing spring 1209 support. FIG. 63 shows a similar arrangement, but with the valve stem and tensile centers offset by dimensions y and z, measured from cylinder axis, to more easily permit direct crank/cam valve actuation. The offset may be in one dimension only. FIG. 64 shows inner 1210 and outer 1211 ring valves. The outer valve communicates with a charge or exhaust processing volume 1212, separate from another volume outboard of the head at 1213.

In the "lubrication" of such components as valve stems, the tensile members, and the support members 1194 of FIG. 59, substances may be used which, when carried to the combustion chamber, affect the combustion process. Fluids which may be used include water, fuel, water-methanol mixtures, hydrogen, in either liquid or gaseous state. By "lubrication" is meant the provision of low friction bearing means, including liquid films, gas bearings, etc. Fluid may be delivered to the chamber at the appropriate time by the imparting of pressure to a fluid reservoir (the pressure optionally releasing a valve), causing fluid to leave an orifice communicating with the reservoir. This is essentially the direct fuel injection system in use today, and may also be employed in the new engines.

Figures 65, 66, 67, 68, 69, 70:
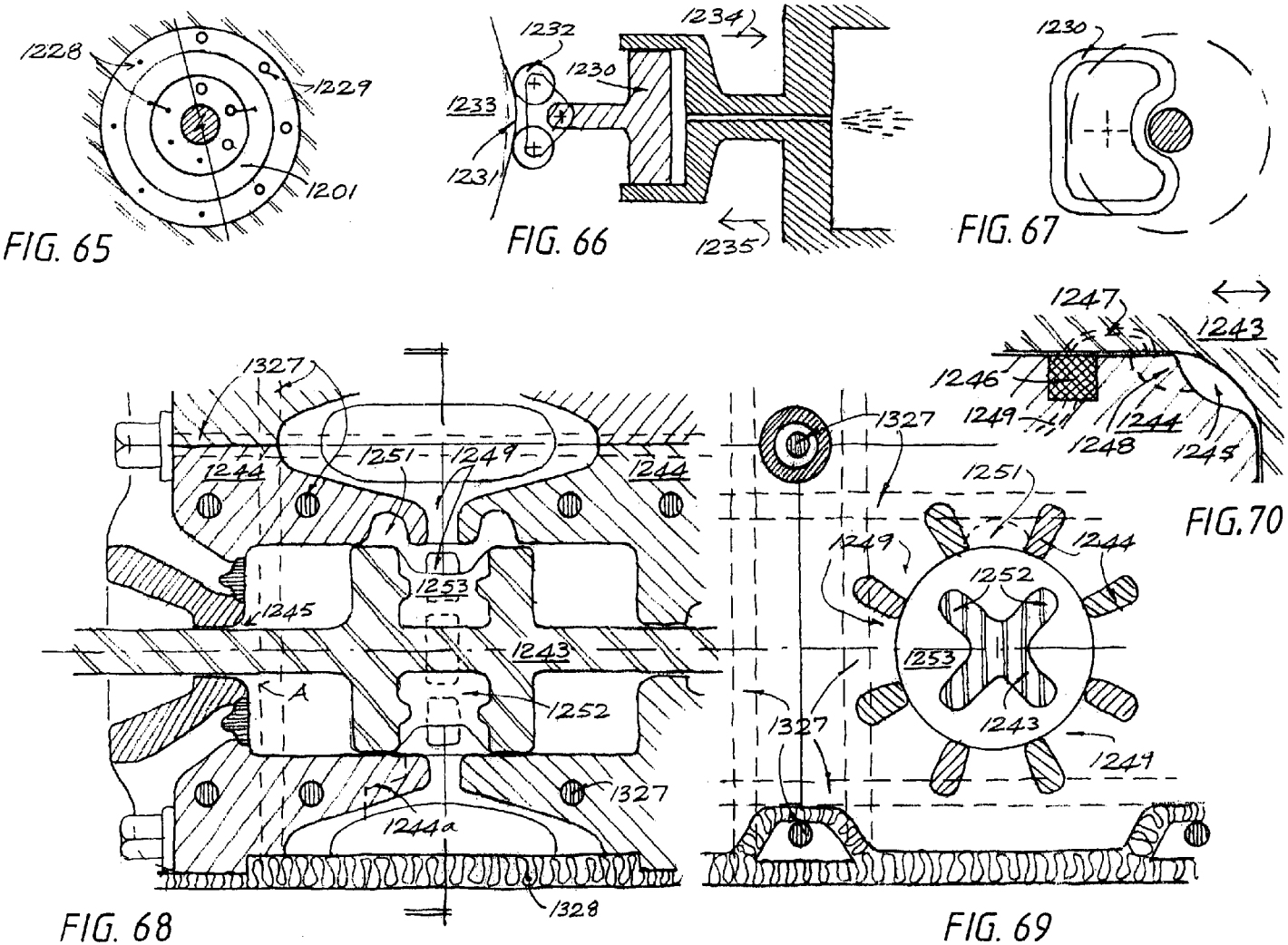
FIGS. 65 to 67 show methods of fluid delivery.
FIGS. 68 to 70 show a piston and cylinder assembly.

FIG. 65 shows schematically an interior plan view of the cylinder head having a central ring valve 1201, showing ways in which fuel jet orifices 1228 and/or pre-combustion chambers 1229 may be arranged. This distributed fuel delivery will increase the speed limit at which efficient combustion can be achieved. FIGS. 66 and 67 show, in section and plan section, how the plunger mechanism 1230 activating fuel delivery (in turn activated by cam 1231) is greatly enlarged and of kidney shape (to clear tensile member movement). The cam follower 1232 is of a design to permit continuous and variable loading including under high loads. As pressure in the combustion chamber increases, it is transferred to the fluid via the orifices, and from the fluid to a combined camshaft/crankshaft 1233. The loads on the crank during high combustion chamber pressures are in the direction 1234, which can be partially offset by the loads transferred to the crank/cam in the direction 1235 by the fluid, thus reducing maximum crank bearing loads.

FIGS. 68 and 69 show, in longitudinal- and cross-section respectively, an optimized piston 1243 reciprocating in a twin "cup" 1244 assembly, each "cup" having an integral half-cylinder and head configuration. A clearance space 1245 when located at area A is shown enlarged in FIG. 70, when the piston is at TDC. The piston has stiffening flanges 1252. The clearance space 1245 is discontinuous, ie not annular, although optionally it may be so. Such very small clearance spaces are primarily for variable compression engines. Here a pressure wave during fuel supply causes fuel to be forced through wick 1246 via tensile member depression or passage 1247 into a pre-combustion chamber 1248 and thence to clearance space. (It is obvious that the fuel at wick 1246 can be used to provide some degree of lubrication between the rod portion of piston 1243 and "cup" 1244.) The two halves 1244 of the cylinder assembly have their joint about the exhaust ports 1249, where combustion chamber pressures are low, and are interlocked as shown at 1244*a* to provide accurate location. The arrangement shown has the optional feature of providing for charge purification by residual exhaust gas bleed off. In operation, after the piston has masked the exhaust port, these remaining exhaust gases in the compressing charge being hottest, will rise to the top of the volume and fill the specially provided depressions 1251. As the piston moves up the cylinder, the depressions communicate with the piston void 1253, in turn communicating with the exhaust port.

Figures 71, 72, 73, 74, 75:
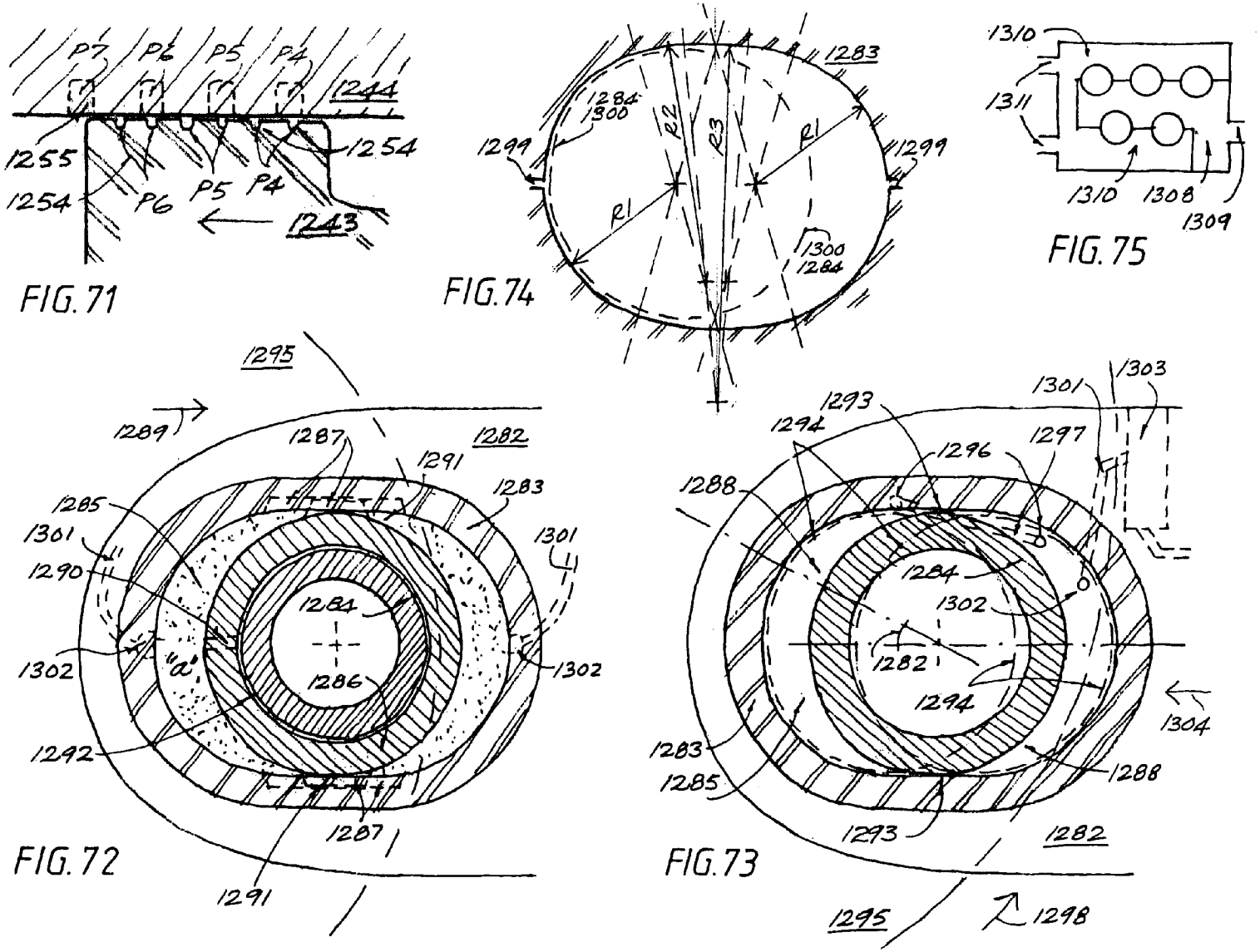

Blow-by occurs in all engines; it is the tubular column of gas that travels from the high-pressure combustion volume between piston and cylinder walls to a lower-pressure area below the piston. Experiments (by Timoney in Dublin in the 80's among others) have shown that a free piston, traveling at speed in a horizontal cylinder between two combustion chambers, does not make contact with the cylinder walls. It is supported by the high pressure gas blow-by, effectively a gas bearing. This is only possible in a case where there are negligible side loads on the piston, as above and with most of the embodiments disclosed herein. In conventional engines, the piston side loads are so great that piston rings and oil lubrication are required. In engine designs where piston blow-by speed needs to be minimized, special piston grooves 1254 can be provided as shown in FIG. 71, wherein the piston 1243 is traveling in direction of arrow during compression. Correspondingly spaced depressions 1255 are provided in the cylinder 1244 wall, which if disposed uppermost will tend to be filled with inert exhaust gas rather than usable charge. It can be seen that, as the piston moves up the cylinder to compress the charge, that the pressure in the grooves will always be close to, but a little less than, the charge pressure at that time. Various pressure levels are shown by P1, P2, etc. It is known that the smaller the pressure differential between two gas reservoirs, the slower the rate of gas travel per unit mass between them Therefore the rate of possible gas travel in piston/cylinder clearance space 1255 (the blow-by) will be reduced.

As an alternative to making the tensile link flexible and so accommodate slack, the slack may be taken up in the bearing(s), so permitting the tensile member to be rigid. If movement in the bearing can be restricted to one dimension, and if the slack-accommodating bearing is such as to always permit transfer of load, then the tensile member may be designed to also function in compression. If the link can transfer both tensile and compressible loads, then two links may share the work of each expansion, reducing the total load carried by a single link, as well by each bearing and by a crank throw at any one time, so permitting lighter construction throughout. In addition, a much smoother running engine should result, since the crankshafts are subjected to much more evenly distributed loads. In the example which follows, the bearing between crank and tensile link is considered. However, any or all of the features described may be equally applied to a bearing between tensile link and the rod of a piston/rod assembly.

FIGS. 72 and 73 show in diagrammatic cross-section two versions of a "stretched circle" bearing which permits take up of slack, where a tensile/compressive link 1282 is integrally attached to non-circular outer bearing shell 1283. Between outer shell and inner bearing 1284 shell is a compressible substance 1285, with FIG. 72 showing an intermediate shell 1286 to contain the compressible substance. The intermediate shell may be free to revolve or may be located relative to outer shell by guides, shown schematically at 1287. Any kind of compressible material may be enclosed at 1285, including elastic ceramic fiber assemblies, polymers, springs, etc. In selected embodiments, fluids are used, preferably gases. When a load is applied in direction 1289 the gap between shells at "a" will tend to reduce. If an aperture is provided at 1290 and clearance space at 1291 is minimized, then fluid under pressure will be forced through the gap into main bearing clearance space 1292, providing bearing support. In the case of gas bearings, pressure can be made proportional to load by such means. If in FIG. 73 the compressible material is a gas and the clearance spaces are kept to a minimum at 1293, then gas pressure on working bearing faces is more or less continuously proportional to load. If it is desired to shift bearing shells rapidly in relationship to each other (the range of possible movement is shown dotted at 1294), then it is possible to provide a phased pressure relief to provide rapid shell movement. In FIG. 73 for example, the crank web disc 1295 is provided with apertures 1296 linked by passage 1297 so that as the disc turns in direction 1298, the relative angle to link 1282 changes to permit both the apertures to simultaneously communicate with volume 1288, permitting rapid gas transfer from one side of the volume to the other. As the crank continues to turn, the relative angle of 1282 changes to mask one of the apertures, and so shut off transfer of gas via the passageway. FIG. 74 shows the layout of the variable radii of the interior surface of an outer gas bearing shell, provided with pressurized gas via apertures 1299, so as to permit progressively larger clearance gaps at the perimeter of contact area, as the inner bearing shell 1300 approaches the midpoint of its relative movement range. It is clear that differing interior profiles of the mid section of shell 1283 will cause varying travel speeds of inner shell 1284 between end positions, and so rates of acceleration and deceleration will be governed by varying shell profiles. The pressure in the gas bearings may be made directly proportional to the pressure in the combustion chamber (and therefore also partly proportional to the loads on the link) by means of small passages 1301 communicating with the chamber, providing gas access to the highly loaded bearing areas via apertures 1302, either on both sides of the volume (FIG. 72) or on one side only (FIG. 73). The passage from the combustion chamber may be interrupted by a filter or one-way valve mechanism shown schematically at 1303. A one-way pressure relief valve would permit only high pressure gases to pass in direction 1304, permitting gas bearing pressure to be higher than the combustion chamber pressure during portion of the cycle.

Figure 77:
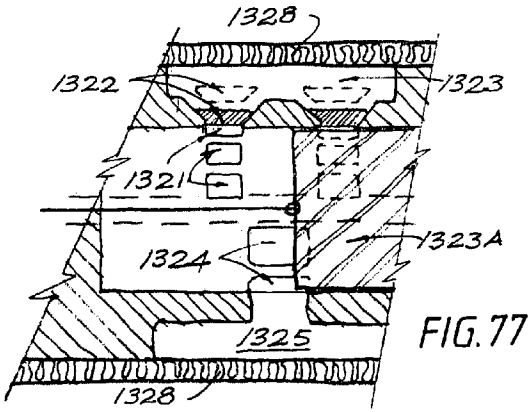
FIGS. 77 to 80 show details of a twin exhaust system engine.
Figure 79:
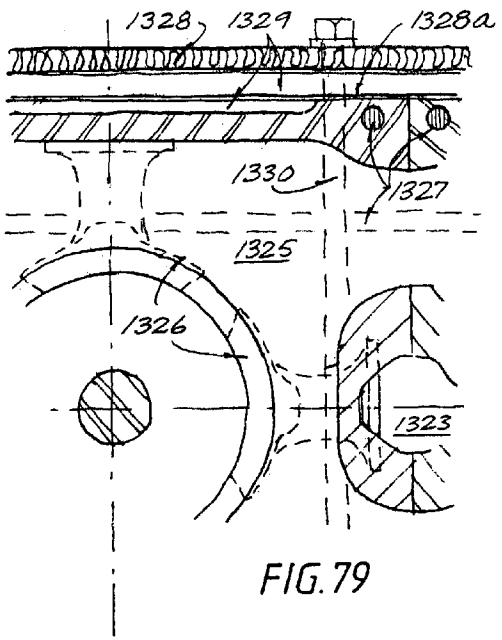
Figure 76:
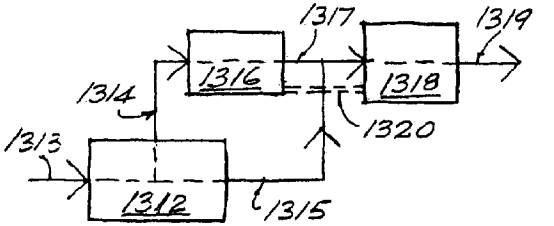
Figure 80:
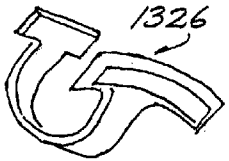
Figure 78:
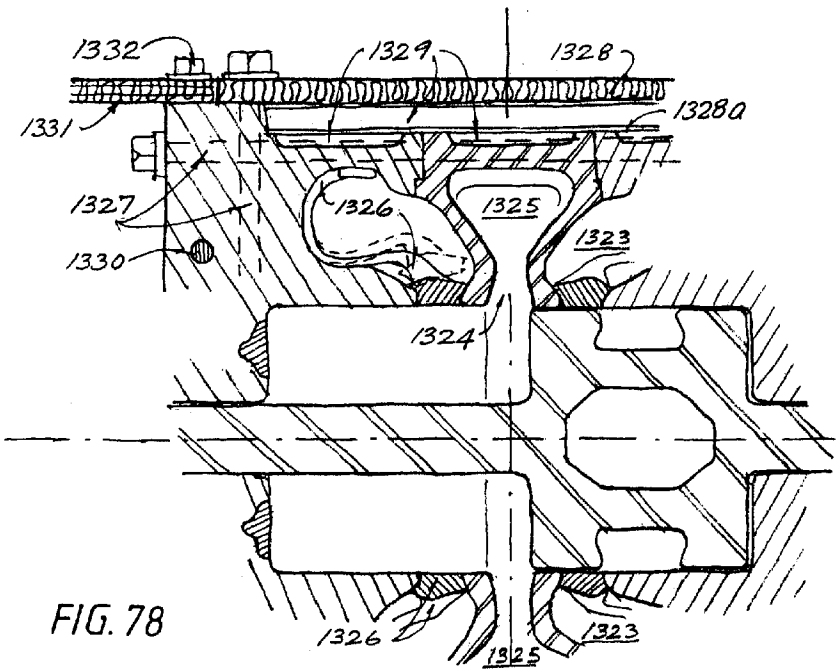

In, for example, the case of compound engines, it may be desirable to use exhaust gas at high temperature and pressure to power a turbine, and to have a requirement for exhaust pressures to be low to facilitate two stroke combustion chamber scavenging. In such cases more than one exhaust processing volume may be incorporated in an engine. FIG. 75 shows a schematic cross-section of a five cylinder engine with a high pressure, high temperature exhaust volume at 1308 with exit at 1309, surrounded by a low pressure, low temperature volume at 1310 with twin exits at 1311. FIG. 76 shows a schematic layout of a compound system with a reciprocating engine 1312 having ambient air intake 1313, high pressure exhaust 1314 and low pressure exhaust 1315. High pressure exhaust is conducted to a high performance turbine 1316 to exit at 1317, at a pressure approximately matching that of low pressure exhaust 1315 with which it is mixed, and be conducted through low temperature turbine 1318 to emerge at 1319 as close to ambient pressure as possible. Optionally the turbines might be linked by shaft 1320. FIG. 77 shows a cross-section of the engine of FIG. 75, where high pressure exhaust ports 1321, closable by non-return valves 1322, communicate with high temperature and pressure exhaust reservoir 1323. The piston 1323A when at BDC/TDC unmasks ports 1324, communicating with low temperature and pressure exhaust reservoir 1325. Thermally insulating structure 1328 encloses both volumes 1323 and 1328. FIGS. 78 to 80 show a cylinder module made up of three elements, plus piston/rod assembly, valves, etc, and incorporating two exhaust processing volumes. The high pressure volume has four shaped snap-in non-return spring loaded valves 1326. FIG. 78 is a long section and FIG. 79 a cross section through the cylinder, while FIG. 80 shows one valve 1326. The modules are assembled via tensile fasteners 1327, which also attach an evacuated thermally insulating cover 1328, separated from structural elements by trapped air space 1329. An intermediate thermally insulating partition is shown at **1328*a*. Modules are attached to each other via tensile fasteners 1327, with crank cover 1331 attached last at 1332. A similar construction, including tensile fasteners 1327, is shown also in FIGS. 68 and 69. On the expansion stroke, the gases are at sufficiently high pressure to open the non-return valves 1326. As the piston exposes the low pressure system via the central port 1324, the pressure in the chamber drops sufficiently to cause the spring loaded valves 1326** to close. On the compression stroke pressures will be much lower and insufficient to re-open the valves.

Combustion loads, and consequently bearing loads, can be high. If gas bearings are used and gas blow-by is to be minimized, then the bearings may be partially sealed by an oil film. Since gas bearings are generally not operative at low speeds, this oil film may then serve to lubricate the bearing shells. Of course, gas pressure will cause oil loss, but in the basic configuration of FIG. 21, this will be burned as fuel.

Regarding some of the stresses which may occur in the cylinder and head elements under high combustion chamber pressures, it is apparent that the tensile stress requirements of the components can be reduced if they are at least partly pre-stressed in compression when the engine is assembled. The forces of expansion will first have to counterbalance those loads before stressing materials to their design tensile limits. Calculations have shown that there are presently a range of commercially available ceramic materials having sufficient strength to be used to build the components of the invention, allowing for typical engineering safety margins.

There are a number of alternative ways of designing to compensate for peak loads. For example, a fairly strong spring action in the tensile link can act as an energy sink during beginning of expansion, returning work at the low end of expansion. In another example, the entire rod/piston assembly can be pre-stressed in compression by a central link. If air passages and movement about the pre-tensioning element is provided, then metal bolts could be contained within high-temperature ceramic piston/rod assemblies.

Constructions are described in their basic embodiments, without consideration of possible refinements. For example, single chamber multiple fuel delivery points may be activated sequentially to induce controlled turbulence. The "stretched circle" bearing may be replaced by an elastomeric device in the tensile/compressive link or its bearing.

The various constructional details described can be combined in any way, to produce engines for a wide variety of applications. For example, where the highest power to bulk or mass is not required, a four-stroke engine with a relatively low speed may be used, which if naturally aspirated may have variable valve lift and timing. Where a lack of vibration is important (eg generating engines in research or science environments), a two-stroke engine having "elastic" tensile/compressive crank link may be employed, where work is continually done by each piston on both cranks, providing an exceptionally smooth supply of power. If crankcase size is limited, the "stretched circle" gas crank bearing with compressive/tensile link may be used. With these designs, dimensional variations can be accommodated in the bearing, so permitting crank throw diameter to equal or even be less than the stroke. Where high speed engines of fixed compression ratio are required, then a higher level of turbo charge pressure will speed up the combustion processes to match engine speed, and will increase permissible engine speed before piston take off. The higher the engine speed (and therefore the power to bulk and weight ratios) required, the greater the logic of going to two stroke engines. Again, the smaller the stroke, the higher the engine speed for a given piston velocity and piston take-off point. Most engines will be direct injected (the high temperatures will tend to cause pre-detonation or knocking in carburetor or indirect injection engines), so will be able to use virtually any fuel.

Certain of the features described is this disclosure are less appropriate to larger long-life engines, and more suited to smaller or shorter life units. Such units would include those used for mopeds, chain saws, highway sign power generation, standby emergency power, outboard or inboard small marine craft. Here the use of tensile yarn, etc, is feasible.

The variable valve actuation capability has many useful applications, apart from increasing volumetric efficiency throughout a wide speed range in naturally-aspirated engines. In two-stroke engines, which are often force-aspirated, variation of inlet valve actuation may be used to compensate for the reduced charge-to-exhaust pressure differential required at lower speeds. In all middle to high compression ratio engines, inlet valve variation may be used to lower effective compression ratios during cold start or idle. In engines where there would otherwise be too much energy remaining in the exhaust gases, the variation of inlet actuation may be used to cause some of the charge to be bled back to an intake gas reservoir, so reducing effective compression ratios, but maintaining expansion compression ratios.

Hopefully the foregoing has shown by way of example that the various features described can be combined in any way to produce a complete new generation of more efficient internal combustion and compound engines.

Potentially important advantages of the new engines concern packaging. As pointed out previously, the engines should vibrate less than conventional units. They should be much more silent, due to the insulation that can be provided, and due to the fact that a principal sound generator—the exhaust system—can now be in the interior of the engine. As can be seen from FIGS. 23 to 25, the units can be rectangular and, because no air circulation is required, placed in locations previously not feasible. For example, in automobiles and light trucks, they can be installed under seats, or within double skin floors.

Figure 82:
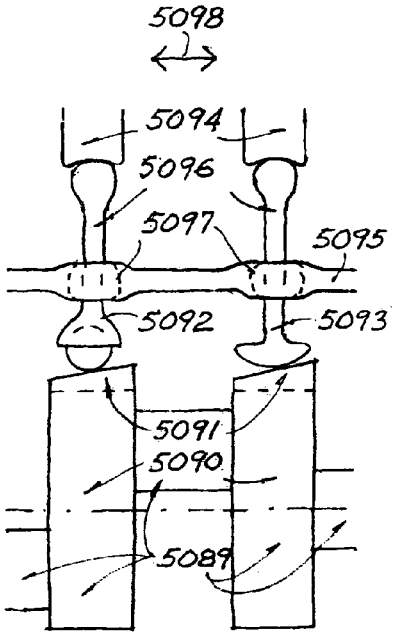
FIGS. 81 to 83 show schematically a variable lift combined crank and cam-shaft.
Figure 83:
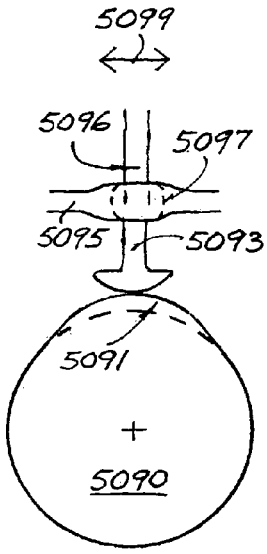
Figure 81:
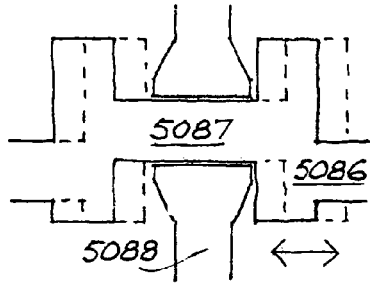

As shown elsewhere, crankshafts may also function as camshafts. Lateral movement may easily be incorporated in a gas bearing design, as shown schematically in FIG. 81, wherein the crank and/or cam shaft 5086 and its inner main bearing shell 5087 moves laterally inside fixed outer main bearing shell 5088. If the diameters of the bearing shells are uniform, then the clearance gap will also be constant, thus maintaining constant gas bearing performance, whatever the position of the crank and/or cam shaft. If for some reason it is impractical to move the shaft laterally, the same variable effects can be achieved by interposing a movable yoke, as illustrated schematically in plan FIG. 82 and cross-section FIG. 83. Here the crank and/or cam shaft 5089 is fixed, but nevertheless incorporates cams 5090 with variable profiles 5091. Ball ended and cup ended followers, 5092 and 5093 respectively, link the cam to appropriate reciprocating mechanisms 5094. A yoke 5095 is attached to the follower stems 5096, preferably by some kind of olive shaped elastomeric washer 5097. When the yoke is moved laterally in direction 5098, the degree of reciprocating motion in 5094 will be varied. Similarly, if the yoke is moved in the other dimension 5099, the timing of reciprocating motion relative to cam and/or crank angle will be varied.

Figure 85:
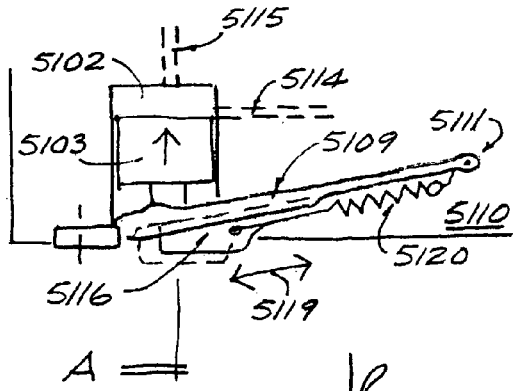
FIGS. 84 to 86 show methods of varying bearing fluid pressure.
Figure 84:
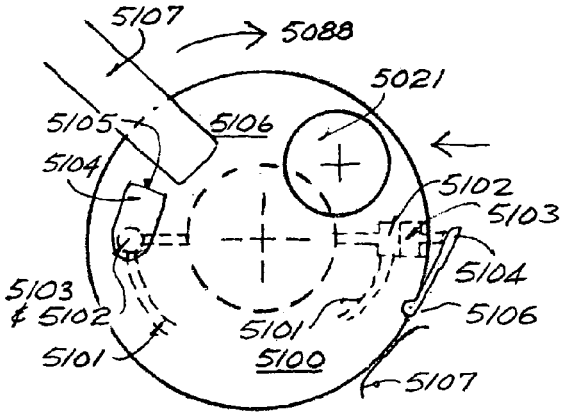
Figure 86:
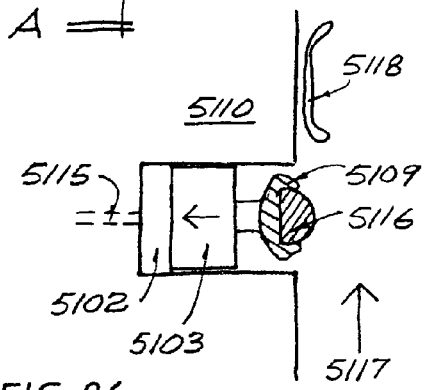

As has been disclosed elsewhere, cam and/or crank shafts may be supported in variable pressure gas bearings, with gas in the bearing either provided as a gas, or as a liquid conducted under pressure to the clearance space, which then changes state in the lower pressure/higher temperature environment of the clearance space. These fluid pressures may be varied during rotation by what can best be described as moving profile cams, which provide pumping action within the revolving body. In schematic cam/crank section FIG. 84, two different arrangements are shown in a crank disc web 5100 with a big end bearing at 5021, having interior passages 5101 supplying bearing fluid being interrupted by reservoirs 5102, closed by movable plungers 5103. The plungers are linked to the free ends of movable pedals 5104, pivoted at disc surface 5105 and at disc perimeter plane 5106. Fixed cam followers 5107 are positioned, so that when the shaft turns in direction 5108, the pedals and therefore plungers are depressed when passing under the followers, causing a pressure wave in the bearing fluid. Such pedal and plunger arrangement can also be adapted to provide engine fuel delivery, where a revolving cam actuates a fixed pedal (not illustrated). If it is desirable that fluid pressure should vary not only with crank rotational angle but also with rotational speed, arrangements broadly similar to that shown schematically in sectional plan FIG. 85 and the cross-section at "A" shown in FIG. 86 can be employed. Here a pedal 5109 pivoted at 5111 is mounted on the circumferential face of a crank web disc 5110, which also has a reservoir 5103 housing a movable plunger 5103 and connected to fluid supply 5114 and delivery 5115 passages. On the external surface of the pedal a weighted shoe 5116 is slidably mounted. During rotational movement 5117 the shoe will pass under fixed cam follower 5118, causing the pedal to be depressed and creating a pressure wave in the bearing fluid. The radial motion 5119 of the shaped shoe on the surface of the pedal is restrained by spring 5120. A stop retraining the movement of the plunger is shown schematically at 5021. As rotational speed increases centrifugal force on the shoe will cause the spring to be extended and shoe to move radially outward on the inclined pedal plane, causing the head of the shoe to project further from the disc surface, and increasing plunger motion during each pass under the follower. By such radial movement varied proportionally to centrifugal force, fluid pressure may be varied proportionately to crank revolution speed.

Any or all of the embodiments described in this disclosure may be used in any combination with each other, and the invention incorporated in any type of engine, in turn incorporated in any type of mechanism or vehicle. For example, in order to illustrate the principles, the cams and followers have generally been shown as solid, but these may be of any materials or construction, including hollow, built-up, of pressed sheet, formed tube, etc, appropriate to any scale of engine, for example from model airplane or lawn mower to giant marine internal combustion engines.

The engines and engine features disclosed above can be further simplified by the incorporating the features and details described below.

Figure 87:
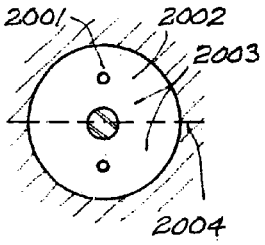
FIGS. 87 to 89 illustrate the basic features of toroidal combustion chambers.
Figure 88:
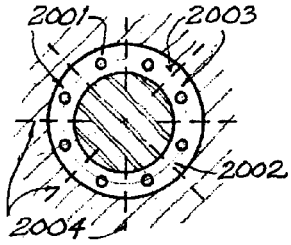
Figure 89D:
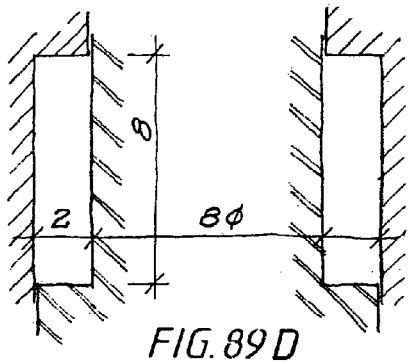
Figure 89A:
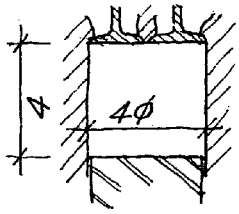
Figure 89B:
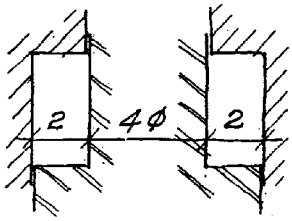
Figure 89C:
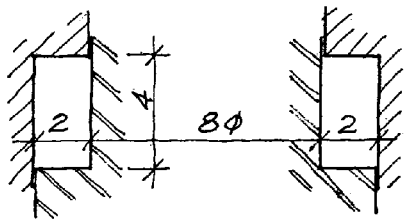

Rather than consider the combustion volume a hollow-cored stub cylinder, it may be perceived as toroidal or doughnut shaped. FIGS. 87 and 88 show, by way of example, cross-sections through such combustion chambers, looking toward the cylinder head. If multiple fuel delivery points 2001 are provided in each toroid 2002, then the toroid may be considered a series of abutting chambers 2003, with notional boundaries say at 2004. It can be seen that, taking this approach, the total combustion volume can be made as large as desired in a single cylinder application, especially as a feature of the engines of the invention is the drastic reduction of reciprocating masses as a design constraint. The components can be virtually of any size. It is intended that even very large engines, such as for marine and railway applications, could be made in single cylinder configurations. Advantages of the toroidal shape are the relative reduction of both surface area and seal length per unit volume, and a potential reduction of stroke (and therefore piston speed) per unit volume. Table 1 shows how these and other parameters vary with combustion chamber geometry, taking chambers A, B, C, D of FIG. 89 as examples. In the diagram, the numbers represent any unit of length, the symbol d stands for diameter, and engine A depicts a conventional combustion chamber with inlet and exhaust poppet valves. It is assumed that engines B, C, D are the valveless configurations disclosed elsewhere. All engines are assumed to have 16:1 compression ratio. In some expressions herein, compression ratio is abbreviated as CR.

TABLE 1

VARIATION of PARAMETERS with COMBUSTION CHAMBER GEOMETRY

| Engine Type (See FIG. 89) | A | B | C | D |
|---|---|---|---|---|
| Volume: Units cubed | 50.3 | 150.8 | 251.3 | 502.6 |
| Piston Speed (Ave) at 100 rps: Units ps | 800 | 800 | 800 | 800 |
| Piston Speed per Unit Volume: Ratio | 15.9 | 5.3 | 3.2 | 3.2 |
| Stroke per CR of 16 to 1: Ratio | 0.25 | 0.25 | 0.25 | 0.5 |
| Stroke per Unit Volume: Ratio | 0.079 | 0.027 | 0.016 | 0.016 |
| Chamber Surface (excl. Piston): Units sq | 62.9 | 138.2 | 213.6 | 364.4 |
| Surface per Unit cubed (volume): Units sq | 1.26 | 0.92 | 0.85 | 0.73 |
| Seal Lineage: Units | 23.9 | 37.7 | 62.8 | 62.8 |
| Seal Lineage per Volume: Unit | 0.475 | 0.25 | 0.25 | 0.125 |

Figure 90:
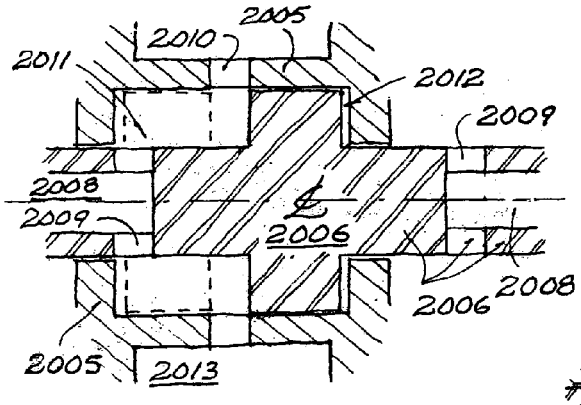
FIGS. 90 to 95 show schematic layouts of working chambers and reciprocating components.
Figure 91:
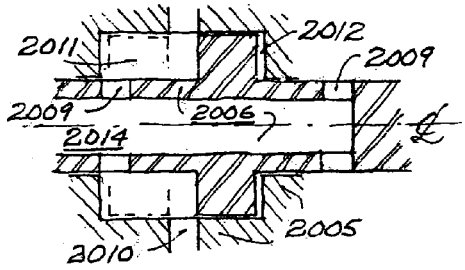
Figure 92:
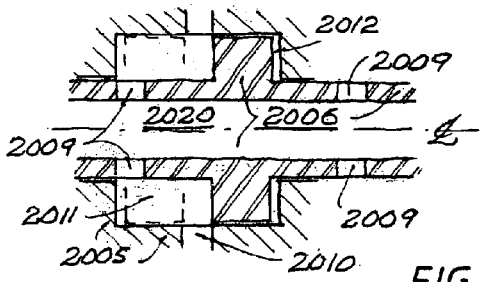
Figure 93:
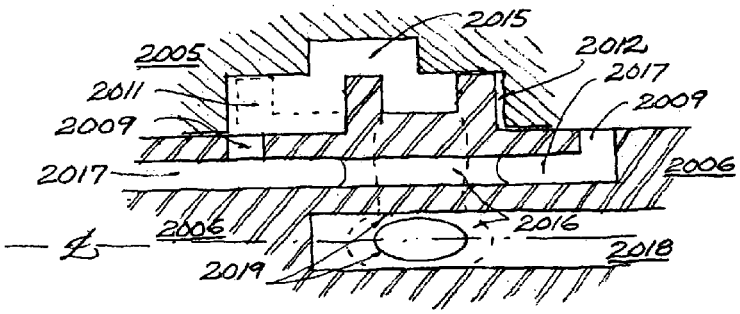

It is possible to achieve further simplification by eliminating actuated valves. The interior of the piston/rod assembly can be used for many possible functions, including as a conduit for engine gases, either charge or exhaust or both. Because the piston/rod assembly reciprocates, it is possible to arrange for cross-flow porting. FIG. 90 shows schematically such an arrangement, wherein the integral reciprocating piston/rod assembly 2006 moves inside cylindrical housing 2005, shown here with toroidal combustion space 2011 at maximum expansion and toroidal combustion space 2012 at maximum compression (the piston is at top/bottom dead center). The rods are hollow, containing inlet or exhaust conduits 2008, one of which is shown communicating via exposed ports 2009 with the combustion chamber 2011 and, via exposed ports 2010, with gas handling volume 2013. It is clear that, in this example of a two-stroke engine, a gas flow is induced across the section of the toroidal chamber. The flow might be in either direction. In the schematic examples of the other valveless engines shown in FIGS. 91, 92 and 93, the exhaust and inlet "ends" of the combustion chamber are also interchangeable. FIG. 91 shows how inner ports 2009 all communicate with one end 2014 of the reciprocating assembly 2006. FIG. 92 shows how the inner ports 2009 for both toroidal combustion chambers 2011, 2012 are served from both ends of, and are linked by, a central passage 2020. FIG. 93 shows how the reciprocating piston/rod assembly 2006 can act as a conduit for both inlet and exhaust gas, by for example use of a transfer port at 2015. The ports 2009 communicate with a tubular shaped processing volume 2017, which is separated from the other cylindrically shaped engine gas processing volume 2018, which in turn communicates with the transfer ports 2015 by means of openings 2019 and enclosed passages 2016, here shown shaped or tapered for noise reduction purposes.

Figure 94:
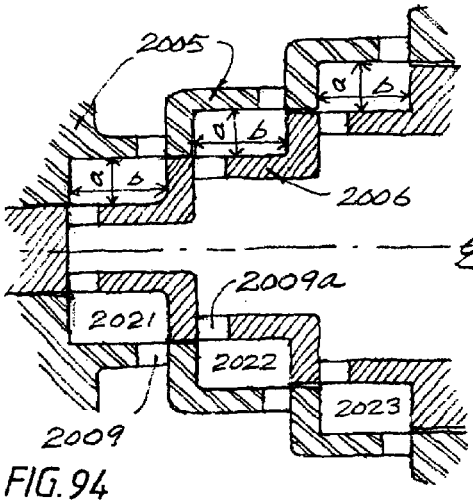
Figure 95:
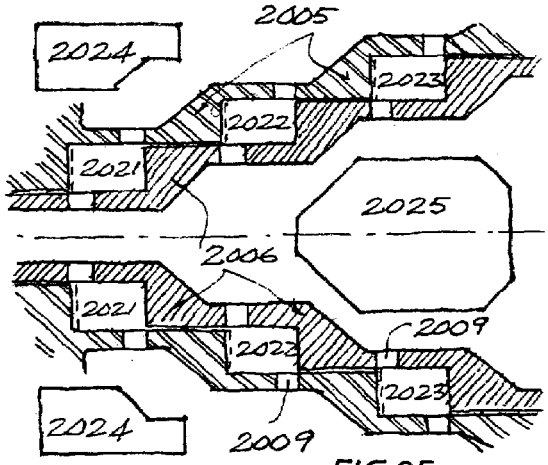

The valveless embodiments easily permit the introduction of another feature (embodiable with greater complexity in valved engines): multiple varied diameter toroidal combustion chambers which are simultaneously in compression and subsequently expansion, and which are shown schematically in FIG. 94. Each of the toroidal combustion chambers 2021, 2022, 2023 has the same cross section, but have different diameters. Dimension "b" represents stroke plus clearance space, while dimension "a" represents toroid external diameter minus internal diameter. Instead of the three chambers shown, it would be possible to have a single toroid (cross-section b×3a) of equivalent capacity. However, its clearance space cross-section would be (b−cr)×3a, while the cross-section of the clearance space of each of the toroids shown would be (b−cr)×a; each would have clearance cross-sectional aspect ratio three times less steep than the single toroid. The stepped configurations of the two components also make it easier to design bearing surfaces of the required rigidity. The arrangement shown in FIG. 94 permits the two ports 2009 and 2009*a* to be matched up to each other about midpoint of piston travel, for a relatively brief period relative to porting at bottom dead center (since the piston is traveling at maximum speed). This might be for the purpose of providing extra air to the exhaust, or to cool it. FIG. 95 shows an arrangement where there is no such overlap or port to port alignment. Both FIGS. 94 and 95 are schematic and show only those combustion chambers on one "side" of the piston, that is those chambers that are synchronously all at top or bottom dead center. It is obvious from previous disclosures that additional combustion chamber(s) may be incorporated on the other "side" of the piston.

Such varying diameter coaxial toroidal combustion chambers permit the incorporation of charge processing and other systems within overall engine dimensions, as shown diagrammatically in FIG. 95, where 2024 and 2025 are coaxial ancillary systems. Such systems might comprise a supercharger, blower, or impeller, turbocharger, starter, generator, turbine or other linked engine system. Alternatively the volumes shown at 2024, 2025 might be occupied by systems not directly connected with the engine, such as a liquid or gas pump, rocket motor, ram jet induction or exhaust assembly. Obviously, the fixed and moving components can be transposed. For example, in FIGS. 94 and 95 (which show the synchronous combustion at maximum expansion), component 2006 could be fixed and component 2005 moving. Such an application might be a liquid pumping engine mounted coaxially with or on the pipe carrying the liquid. Generally all the diagrams of this section have been simplified, with fuel delivery, lubrication systems not shown.

It will be apparent that the engine configurations disclosed herein tend to reduce the effective masses of the reciprocating parts, and therefore the stresses that such parts can generate. Engines of a given capacity will tend to have larger and fewer pistons than at present. If only one piston is involved, the variable length piston-to-crank links (of a twin crank layout) can be changed to fixed length links, if differential crank speeds can be tolerated. (During each revolution one crank has fractionally to slow down or speed up relative to the other to accommodate fixed length links. Obviously, the greater the tensile link length in relation to crank throw, the closer to synchronous the cranks' motion will be.) In certain applications crank speed variation could be tolerated, for example in an engine powering twin pumps or twin low speed marine screws, if the screws have relatively low mass. In other applications constant final drive cycle speeds for each portion of one cycle are required. Various mechanisms can be constructed to convert irregular cycle speed to constant cycle speed. By way of example, FIG. 96 shows two crankshafts 2026 connected to a single piston in a cylinder (not shown). They are linked to a final drive 2027 by endless belt, chain or pulley 2028. To compensate for speed variations in the cranks, a movable in direction 2029 carrier and/or variable length tensioner 2030 shortens or lengthens the power transfer distance to the constant cycle speed final drive 2027. The range of movement is indicated by the alternate position of the belt and tensioning rollers 2032, shown dotted as at 2031. The movement of the carrier may be dampened, as shown at 2033, and need not be reciprocal. It could additionally or alternatively be elliptical, circular, etc. The carrier and/or tensioner may float, positioned by the forces generated in the endless pulley/chain/belt, or it may be controlled by a system of guides and linkages. In schematic partial elevation FIG. 97, the spring 2034 loaded tensioner assembly 2030 is mounted about a shaft 2035 (permitting roller 2032 movement in direction 2036), which in turn is slidably mounted in a slotted carrier strut 3035*a*, which is mounted at one end 2038 on the crankshaft 2026, and slidably mounted at the other end on a fulcrum 2039 fixedly mounted (so ensuring that the roller assembly can also move in direction 2029).

A further simplification can be achieved by eliminating the described crankshaft and the fixed or variable length link altogether, instead imparting spin to the piston/rod assembly, which then could become the "crankshaft" (actually, the drive shaft). The spin is achieved by the incorporation of guides, ramps, cams, etc. in such a manner that the reciprocation actuated by combustion is converted into a twisting motion, so that the piston/rod assembly reciprocates and rotates simultaneously. As can be seen from the examples described below, it is generally easier to arrange matters so that several reciprocal cycles are required to complete one piston/rod revolution. In the case of engines operating more effectively at high speed, the lowering of drive shaft rpm relative to frequency of reciprocation motion (the difference could be an order of magnitude, ie tenfold) will enable such engines to be used in a wider range of applications. (The new engines will reciprocate much faster than the units they could replace, but installed transmissions, propellers are suited to today's low speeds. The conversion of fast reciprocation to slower rotation implies the new engines could easily be fitted in existing applications.) By varying the reduction ratio, different applications for the same base engine are possible. It is intended that the cam system can be removable and interchangeable in some applications, and that in other applications there should be two or more cam systems incorporated with one engine, each one of which can be exclusively and selectively engaged, so that such an engine will also function as a variable speed transmission. The cam system, which must at least partly comprise two surfaces which bear on each other at some time (direct contact bearing is not necessary if an air bearing system is used), can also be used to fulfill some other function such as pump or compressor, either to process inlet and/or exhaust gases of the engine, or some other fluid such as oil, water, air, etc. The cam system may be incorporated in the combustion chamber(s). For example a toroidal chamber may have part of a surface of sine wave type section. In such case the cam system can comprise a series of separate but communicating combustion chambers arranged to form a sinusoidal toroid.

It will have been noted that the engine of the invention comprises two principal components, the piston/rod assembly and the housing. In the embodiments described earlier, either one is fixed and the other moves. In the case of an engine with the cam system, one component will simultaneously rotate and reciprocate in relation to the other. If the housing is mounted in such a way that it may revolve only, then two independently rotating shafts may deliver power from a single engine. Such an engine could simultaneously function as a differential and be used to power a vehicle, or contra-rotating aircraft or marine drives such as propellers, screws, impellers, etc.

Figure 98:
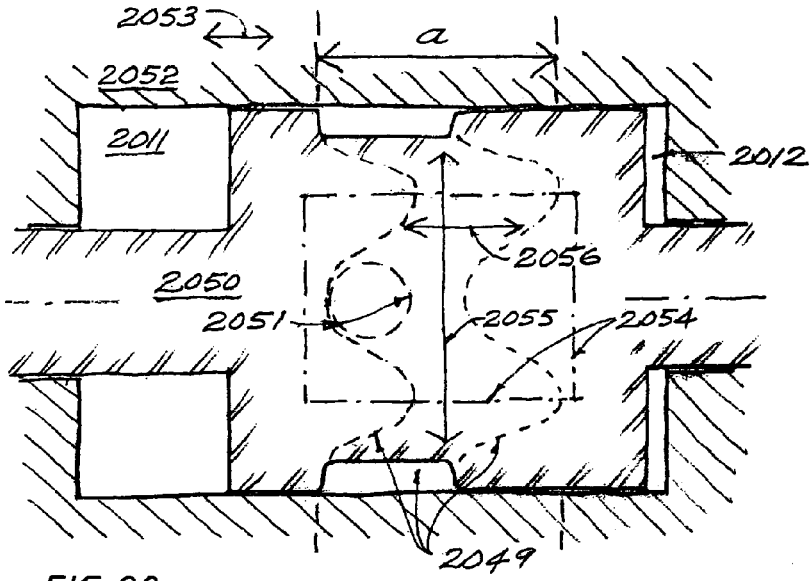
FIGS. 98 to 102 illustrate the principles of imparting different motions to a reciprocating component.
Figure 99:
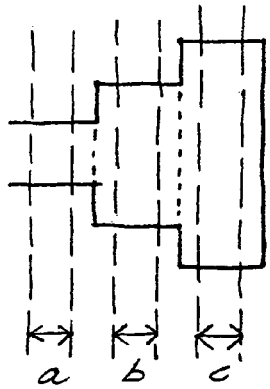
Figure 101:
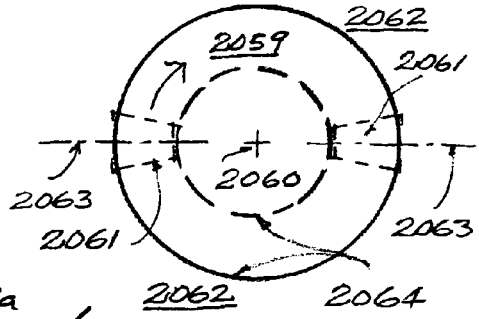
Figure 100:
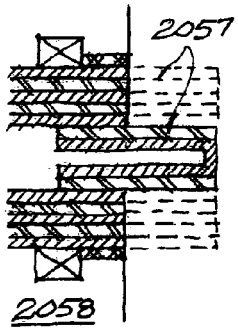

FIG. 98 illustrates the fundamental principles of one such cam system A circumferential sine shaped trench 2049 surrounds the midpoint of a piston/rod assembly 2050. In the trench is a guide 2051 fixed to the housing 2052, in such a way that all reciprocating motion is partially converted to rotational motion. Dimension a indicates the broad location of the circumferential band in which the cam system operates. Essentially the cam and trench system is a face system, in which the faces are aligned toward directions 2053. When the cam system is referred to as sine shaped it is for convenience; in fact the shape may be of any zig-zag type configuration. There are certain optimum profiles for each application, shown here within square 2054 which schematically describes one reciprocating cycle. FIG. 99 shows the profile of an engine of the type disclosed in FIGS. 94 and 95, which has three cam systems, operating within bands a, b, c. The cam profile for one reciprocal cycle is identical for each band, but a different number of profiles or cycles are deployed in series within each circumferential band. The systems described each have a female and a male element (corresponding to trench 2049 and guide 2051 in FIG. 28). In the three cam systems of FIG. 99, the male elements are wholly or partly retractable, and only those of one band are engaged at any one time. Because loads are alternately transferred from one face to the other, the trench profile need not correspond exactly to the travel path of the piston relative to the housing. As one cam system is disengaged and another engaged, the ratio of rotation relative to reciprocation changes, effectively making the device schematically shown in FIG. 99 a three-speed variable transmission. The trench might have a clear path 2055 (shown in FIG. 98), where a small guide will permit piston rotation without reciprocation, and/or a path 2056 which will permit piston reciprocation without rotation. FIG. 100 shows schematically a guide of varying size, which may be wholly or partly retractable. It consists of a series of sliding tubes 2057 biased to a retracted position in a housing 2058 and where some hydraulic or other action projects each tube sequentially, those of smallest diameter before those of larger (with retraction effected in reverse sequence). If the smallest form of such a guide is able to describe a clear path in the trench, the arrangement of FIG. 99 can be accomplished by having the smallest form of each of the guides of all three cam systems extended, with selective and/or progressive enlargement of the guides of only one cam system to effect rotation. It is intended that cam systems that have an adjustable portion (eg a retractable guide) may also be used to function as clutches. Without engagement, the engine would only reciprocate; with cam system engagement rotation commences. In the case of guides which are rollers, it may be preferable to have them tapered, with correspondingly inclined cam faces. FIG. 101 shows a schematic cross-section through a piston 2059 having axis of rotation at 2060. Two rollers 2061 are fixedly mounted to housing 2062 and rotate about axes 2063 when engaged in channel 2064.

Figure 102:
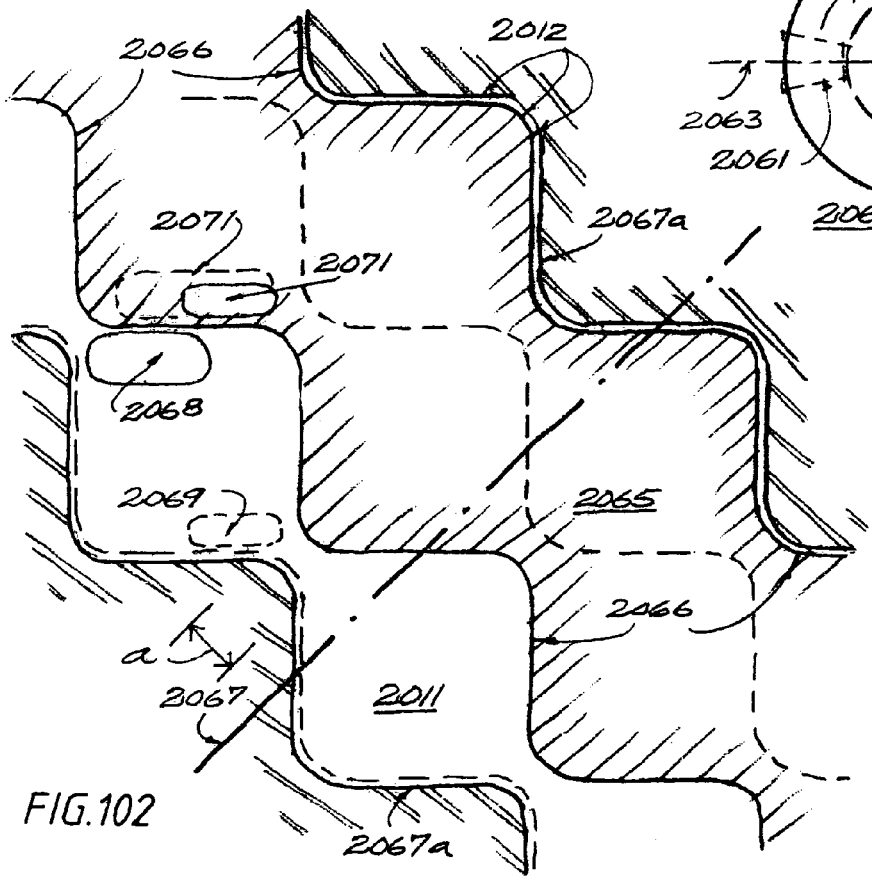

FIG. 102 shows schematically a portion of a cam system circumferential band (corresponding to the boxed portion 2054 in FIG. 98, but showing a different cam system), wherein the male element or guide 2065 is continuous and has sine wave shaped faces 2066. Axis of rotation is shown at 2067. Trench working faces are shown at 2067*a*, with system shown solid line in one top/bottom dead center position and dotted line in the other top/bottom dead center position. Kinetic energy will drive the system across bridge at a. Such cam systems can be used as pumps or compressors. For example, there could be an inlet port at 2068 and outlet port at 2069 and a transfer port 2070 and transfer chamber at 2071, in the case of a compressor. One side of the guide could compress engine charge, the other side could pump exhaust gas, in the case of two-stroke engines, or any other combination of work could be done by the cam system. It is obvious that the cam system could also define at least one toroidal combustion chamber. In the case of FIG. 102, two toroidal combustion chambers could be incorporated, with volume 2012 in compression, 2011 in expansion. Such combustion chambers are described more fully later. If the interior of a piston/rod assembly which both rotates and reciprocates is used to deliver charge, the design of the interior of the piston/rod and the layout of the ports can be used to spin, slew or swirl the charge into the chamber, if charge movement during ignition is desired.

It is preferable in many applications that the function of the cam system be combined with some kind of pumping or compressing work. Because the cam faces directly or indirectly transfer most of the work that is produced by combustion, it is better (for wear reasons) that no direct contact takes place. The pumping fluid would function as a bearing and heat transfer mechanism. It is possible, in the case of multiple cam systems, to link the actuation of the guides to completion of all or part of the one reciprocating cycle, actuation simultaneously projecting one and withdrawing one guide.

Figure 103:
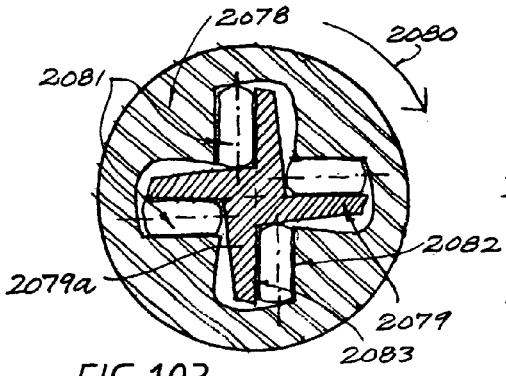
FIGS. 103 to 108 show devices for converting multiple motion to rotating motion.
Figure 104:
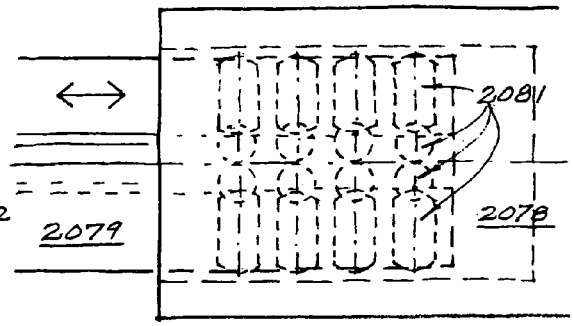

For certain applications, including many pumps and/or compressors, rotary motion is not required. It is both simple and obvious to connect the end of the reciprocating piston/rod assembly to a pumping or compressing device. However, in many applications it will be preferred for engine final drive to have exclusively rotary motion, requiring a special link between the final drive and any reciprocating plus rotary movement of the piston/rod assembly (effectively the "crankshaft", actually the drive shaft). This can be accomplished by a coupling incorporating either a sliding bearing, such as in a splined propeller shaft, or an assembly incorporating roller, ball, needle or taper bearings. By way of example, FIG. 281 shows in cross-section and FIG. 282 in elevation a schematic of vehicle-type co-axial nested male 3304 and female 3305 drive shafts capable of reciprocating relative to each other, wherein rotational motion is transmitted via splines 3301 slidably mounted in corresponding grooves 3302. Range of reciprocal motion is indicated at 3303. As another example, FIG. 103 shows in cross-section and FIG. 104 in elevation a schematic of a coupling between a piston/rod assembly 2078 and a final drive shaft 2079, for applications where loads are transferred in one rotational direction only 2080. Roller bearing races 2081 link planes 2082 inside the piston rod and on the shaft 2083. The connection between the two systems could be anywhere, including inside the piston segment of a piston/rod assembly.

Alternatively, the drive may be effected by a bellows type of device, which has rotational stiffness and axial flexibility. Such a bellows device could be of any suitable material, including a spring steel, plastic, ceramic, etc. The bellows device could be one of two broad groups, the closed or sealed type which has an internal variable volume and which might fulfill the additional function of pump or compressor, or the open type, which could be considered a series of hinge pairs linked end to end. In many cases energy will be required to deform the bellows. In single piston/twin opposite combustion chamber configurations, it will be preferable if the bellows systems are so deployed that they are in their natural or unloaded position when the piston is in the mid-point of its travel, that bellows deformation and energy absorption occurs as the piston travel to top/bottom dead center, with stored energy again given up to the piston/rod assembly as it moves toward its mid-point. It is obvious that the energy absorption capability and progression designed into the bellows unit can be used to effect or regulate numerous engine parameters, including variable compression ratio, engine speed, piston acceleration and deceleration, piston breakaway, etc.

Figure 105:
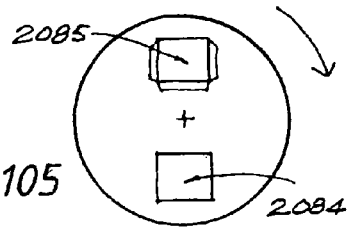
Figure 106:
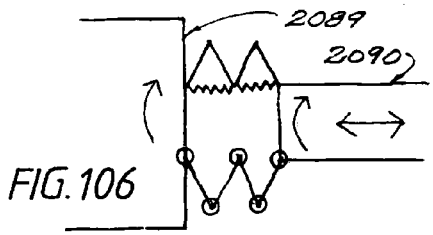
Figure 107:
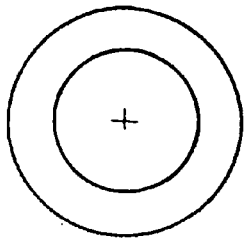
Figure 108:
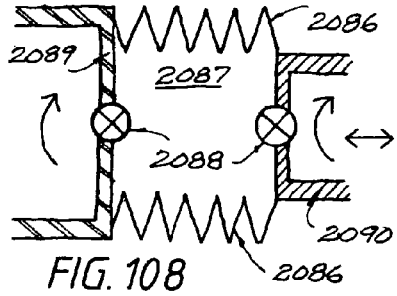

If an energy absorption function needs to be incorporated in an alternative drive system, such as concentric splined shafts, then this can be achieved by simple devices, such as a concentric coil spring. The final drive connection could simultaneously function as the main spring or energy storage device affecting the movement of the piston/rod assembly. FIG. 105 shows in axial cross-section and FIG. 106 in longitudinal cross-section a discontinuous bellows system. To illustrate different embodiments, two different types of bellows are shown. (Normally only one type would be employed in one system.) At 2084 the bellows is effectively a series of rigid hinges, while at 2085 the same structure defines sealed volumes enclosed by side subsidiary bellows. In similar FIGS. 107 and 108, a continuous bellows 2086 is shown, defining pumping volume 2087, having non-return valves 2088 permitting gas movement between volume defined by final drive 2089 and volume defined by reciprocating and rotating piston rod 2090.

Earlier, in FIG. 102, a toroidal and roughly sinusoidal combustion chamber was schematically referred to. There were two such chambers, separated by what was effectively a flange of approximately sinusoidal configuration, mounted on a reciprocating element. The height of the flange (the dimension parallel to the axis of reciprocation) was shown constant. The shape of the flange (and of the heads of the combustion chambers) was not properly sinusoidal; rather the profile approximated a series of straight lines at 90° to each other, linked by radius curves. In the case of a reciprocating body turning at constant speed (a desirable objective in the case of engines), a single point on that body will more closely follow a series of sine waves, retreating its path every 360°.

Figure 109:
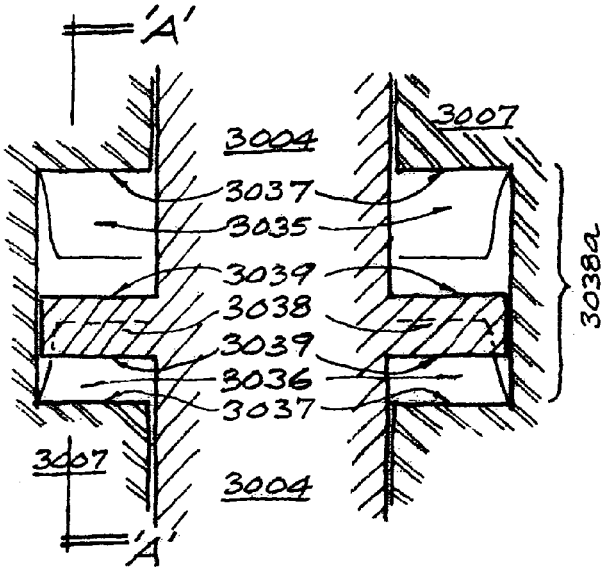
FIGS. 109 to 112 illustrate the principles of sinusoidal toroidal combustion chambers.

Considering one of the inventions in one of its most simplified forms as in FIG. 109, we have an upper 3035 and a lower 3036 toroidal combustion chamber in an integral housing system 3007, in which a reciprocating element 3004 also rotates. The extreme surface 3037 of each chamber has a similar folded sinusoidal configuration, as sketched in FIG. 110, so arranged that the variation of vertical distance between the two surfaces is the maximum possible. The reciprocating element has a projecting flange 3038 reciprocating in a depression 3038*a* in the cylinder. The flange is the reciprocating element's working part (it effects compression and transmits expansion forces). The upper and lower surfaces 3039 of the flange are also shaped as in FIG. 110, but arranged so that the thickness of the flange is always constant. Because the reciprocating motion is of constant dimension, so the height (distance from peak to valley) of the sine (or similarly shaped) wave will be constant, but the pitch (distance from peak to peak) of the wave will vary, from a maximum at the outer radius of the toroidal combustion chamber, to a minimum at the inner radius. Taking a partial curved cross-section through the two combustion chambers at "A", the path of the reciprocating and rotating flange is sketched in FIG. 111, with sine wave height to pitch ratio 1:3 and wherein it is assumed that all four sinusoidal surfaces are identical. The path of a fixed point in/on the flange is indicated at several successive positions marked, a, b, etc. The positions of the flange surfaces at corresponding times are indicated 3039*a*, 3039*b*, etc. (The intervals correspond to constant units of rotation.) As can be seen, if all four surfaces are identical the engine would not work (eg the clearance problem in area B). Usually, in any one combustion chamber, the upper surface of that chamber will have to have a different surface from the lower surface of that chamber. Almost any different combination is possible, but often it will involve an upper limit on the theoretically possible compression ratio, since the upper and lower surfaces do not match. At the height/pitch ratio of the sine wave of FIG. 112 (1:3), a compression ratio of around 7.5:1 is practicable. If the outermost surface of each chamber retained its sinusoidal form, then a workable form of Section "A" would be as shown schematically in FIG. 112. In this case, essentially the flange's valleys would stay more or less sinusoidal, but the peaks would have a sharp apex. If the design compression ratio were less than the theoretical maximum, then it would be possible under constant speed operation for the flange apexes to make no contact with surfaces 3037.

Concentric toroidal combustion chambers were mentioned earlier, where it was envisaged that they would all be combustion chambers. In fact one or more could be used to compress charge, especially if compression ratios are limited in toroidal combustion chambers. FIG. 113 illustrates in schematic half section one such embodiment, whose principals are adaptable to both rotating and non-rotating reciprocating elements—here 3039. A toroidal combustion chamber is shown at 3040 (fully expanded), with compressed charge at "A" moving to displace exhaust at "B." The charge is compressed in chamber 3041 (which may be toroidal or conventional), into which it is conducted via valve 3042, with valve (here poppet type) optionally actuated by some combination of pressure and counterbalance springs 3044. At the end of the compression stroke in chamber 3041, compressed gas enters gas reservoir 3043 via clearance space at "C" and port at "A."

Figures 110, 111:
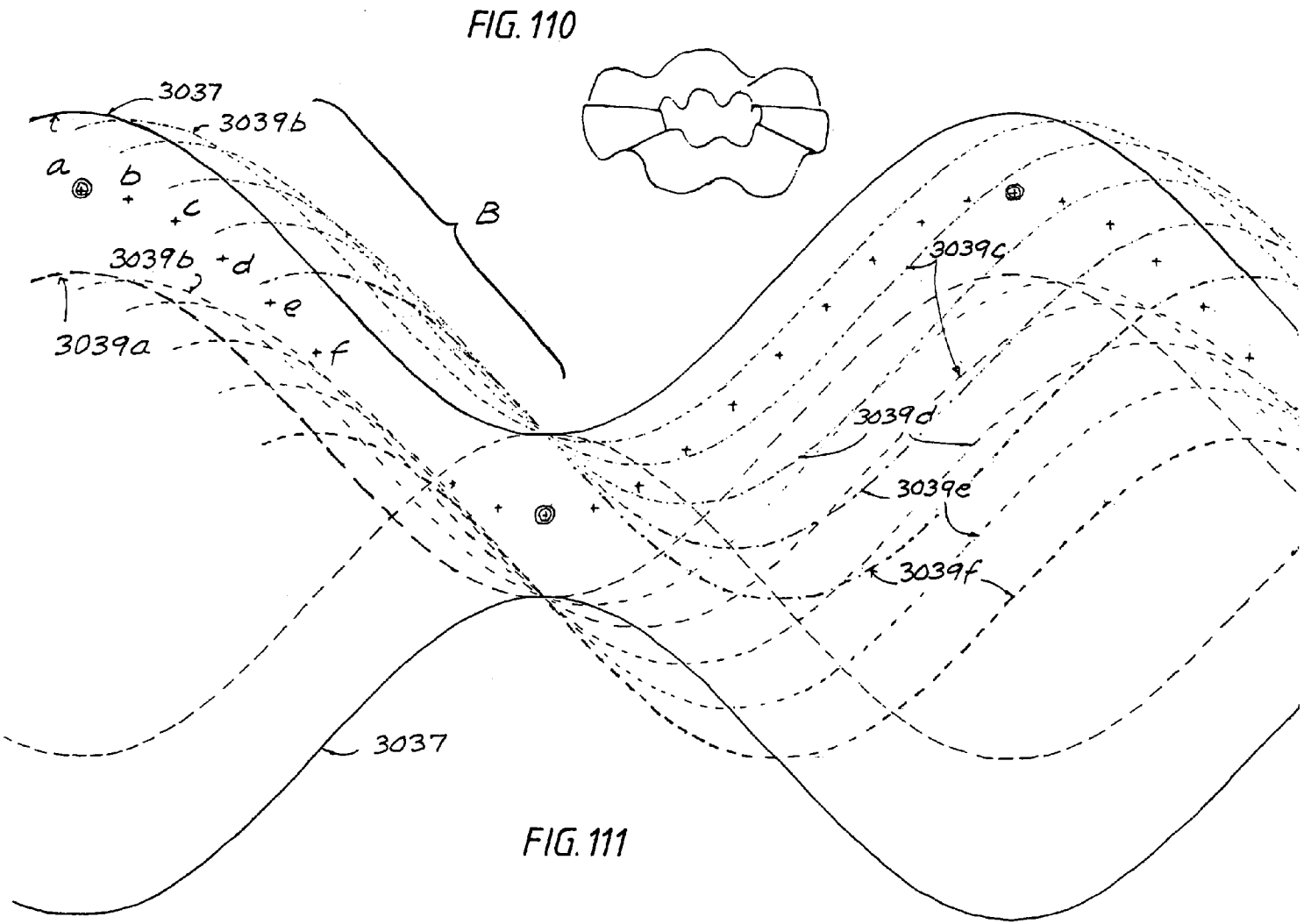

An alternative approach to the "clearance" problem indicated schematically at area B in FIG. 111, would be to separate surfaces 3037 from each other, while not increasing flange thickness and therefore separation of surfaces 3039. Such an arrangement is shown schematically in FIG. 114. Effectively, this would mean that a point on the flange would no longer describe a sine wave, even though all the surfaces had sine wave shaped cross-sections. The combined rotational and reciprocal motion of the flange 3038 would cause a point on the flange to describe an almost linear, shallowly-curved, "S" shaped path between the apexes of reciprocal motion, with sharp changes of direction at these apexes. Compared with a conventional engine, there would be either relatively shorter periods at extremes of pressure or variable rotational speed within one revolution of the flange.

Figure 112:
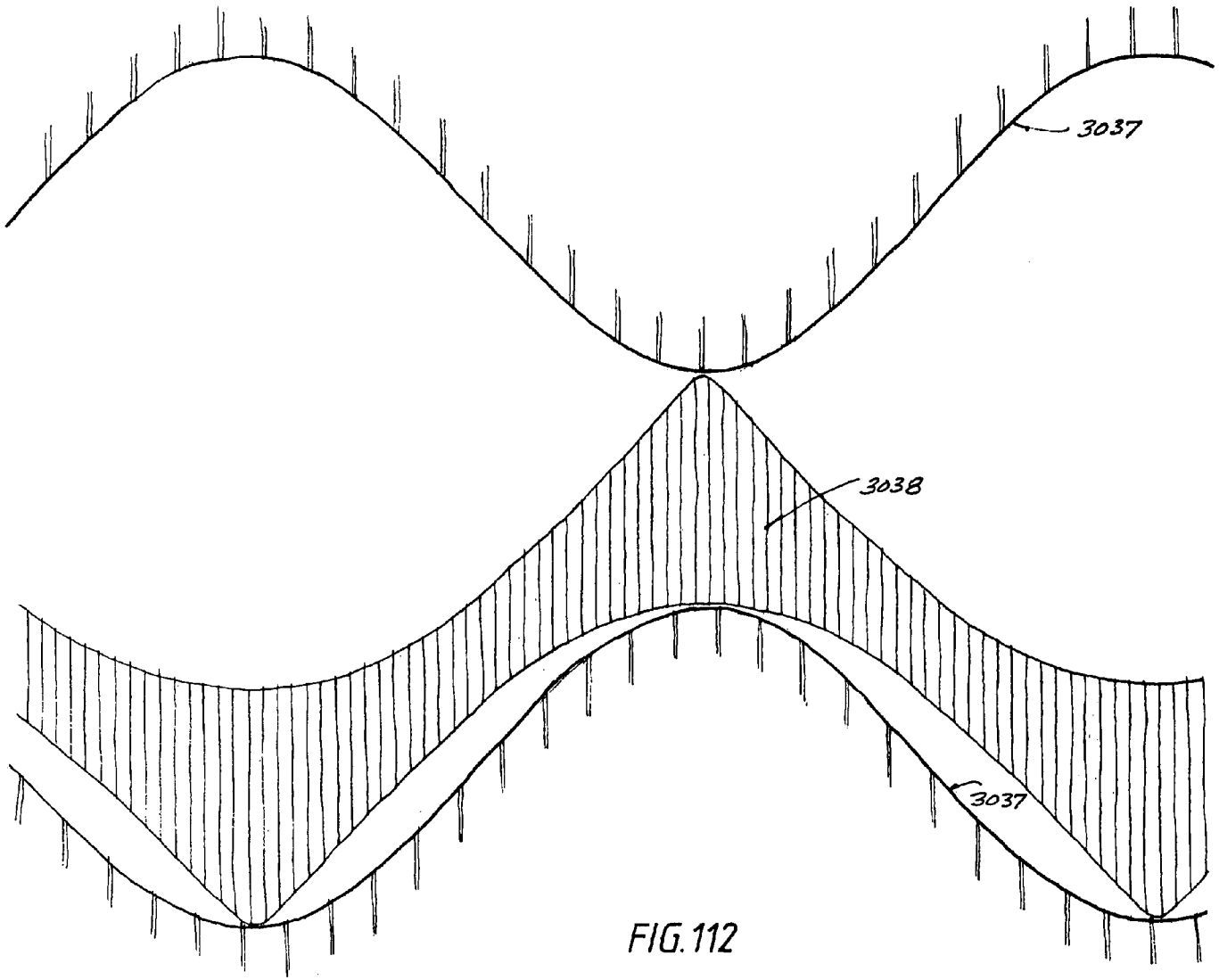

A point on the flange of FIG. 112 will describe a sine wave shaped path, this being possible by the creation of clearance space, thereby keeping surfaces 3037 sine wave shaped and making surfaces of the flange irregular. It is obvious that the same effect could have been achieved by doing the opposite—keeping the flange surfaces sine wave shaped and making surfaces 3037 irregular. Alternatively, a point on the flange could describe a sine wave shaped path, with both the flange surfaces and surfaces 3037 irregular. In this context, irregular means not sine wave shaped.

Figure 114:
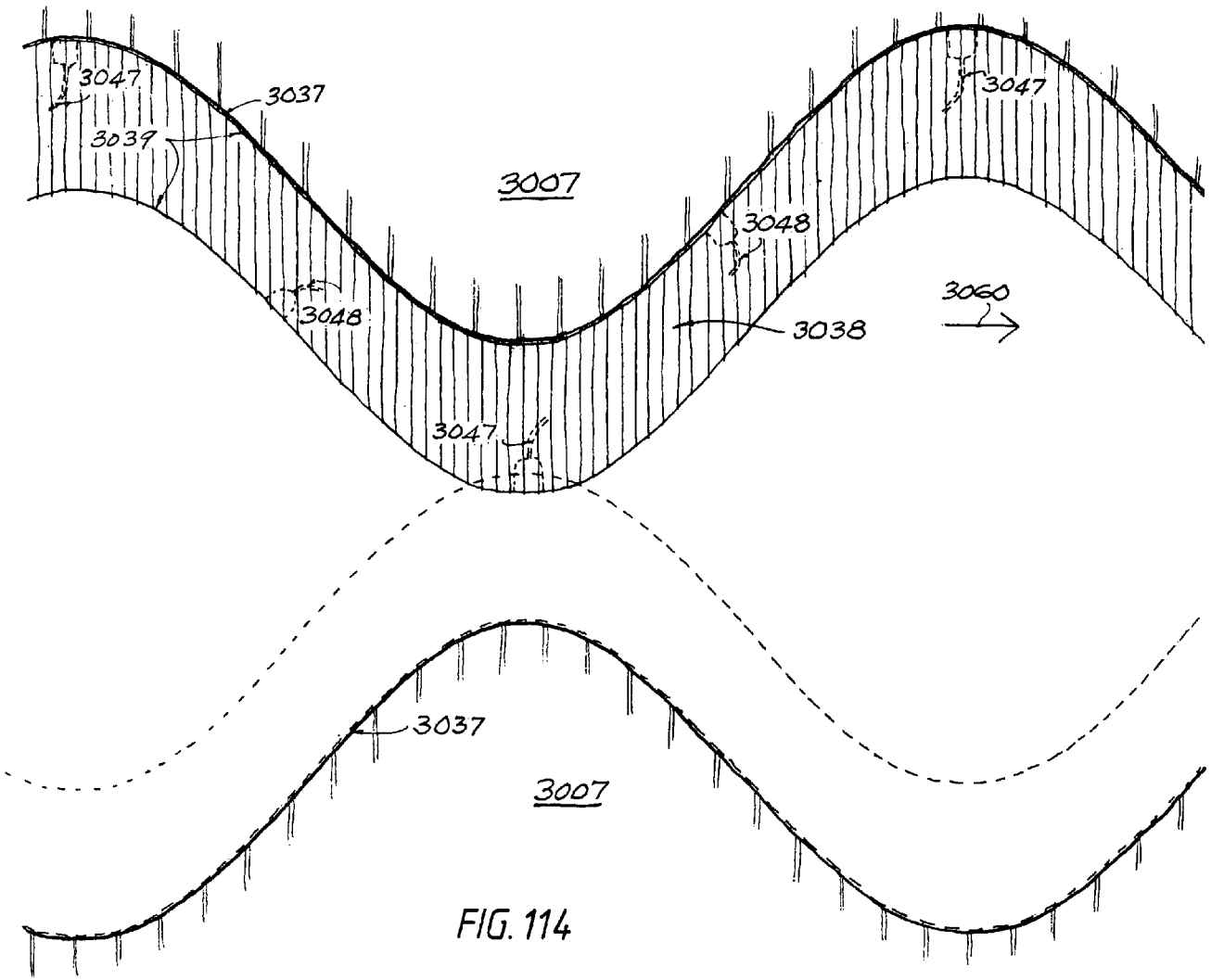
FIGS. 114 and 115 show part profiles of sinusoidal toroidal combustion chambers.

If the two combustion chambers on each side of a flange are to have a common port system (exhaust or inlet) then the flange will have to be thicker relative to the stroke than is shown in FIGS. 112 and 114. A thickened flange is shown schematically in FIG. 115, wherein the combustion chambers 3035, 3036 have the same surface shapes shown in FIG. 112. Here a common port system 3045 is located at the outer circumference of the toroidal combustion chambers, with another port system 3046 particular to one chamber located at the inner circumference of the toroid. Obviously, chamber 3035 can have an identical port system to 3046 (not shown). If only the flange moves, then port(s) 3045 can be in the fixed components, and port(s) 3046 in the moving flange component(s). The curves of FIGS. 111, 112 and 114 are notional and could be said to represent a cross-section taken on a curved plane at constant radius, midway between the outer and inner radius of the toroid, so ports shown in FIG. 115 could be considered projection on this plane, with the outer ports actually larger, the inner smaller. In practice, combustion chamber shapes are likely to be a combination of the principles of FIGS. 112 and 114.

Combined (ie both reciprocal and rotational) motion of the "moving" component 3038/3004 relative to the "fixed" component housing 3007 is assumed to be initiated by a starter motor. The shape of surfaces 3037 and 3039 are effective guides to force combined motion, the broadly reciprocal motion caused by combustion being partly translated into rotational motion. Component 3038/3004, having mass, will have both angular momentum and linear momentum. At each cycle, the linear moment is substantially absorbed by the work of charge compression, but the angular momentum is retained by component 3038/3004. Even if the direction of the work of expansion is considered to be parallel to the axis of rotation, angular momentum will cause a point on 3038 to describe a wave shaped path, similar to the shapes of surfaces 3037 and 3039 in the figures. This means that, by adjusting the quantity and distribution of mass in component 3038/3004, and by adjusting the quantity, distribution and/or timing of the combustion, it will be possible under certain operating conditions to so arrange matters, that the surfaces need never touch. The natural frequency of motion of component 3038/3004 under those conditions will be such that, during a complete combustion cycle, the surfaces 3037 always (just) clear surfaces 3039. It is desirable for them not to touch for mechanical reasons. Because a sinusoidal/toroidal combustion chamber is divided into zones, each zone can correspond to one cycle of the sine or other wave of the surface shapes. The zones of one chamber could be regarded as a series of abutting synchronous combustion chambers, so elimination of surface contact during part of the cycle would permit equalization of gas pressures within the zones and greater mixing of gases.

Figure 115:
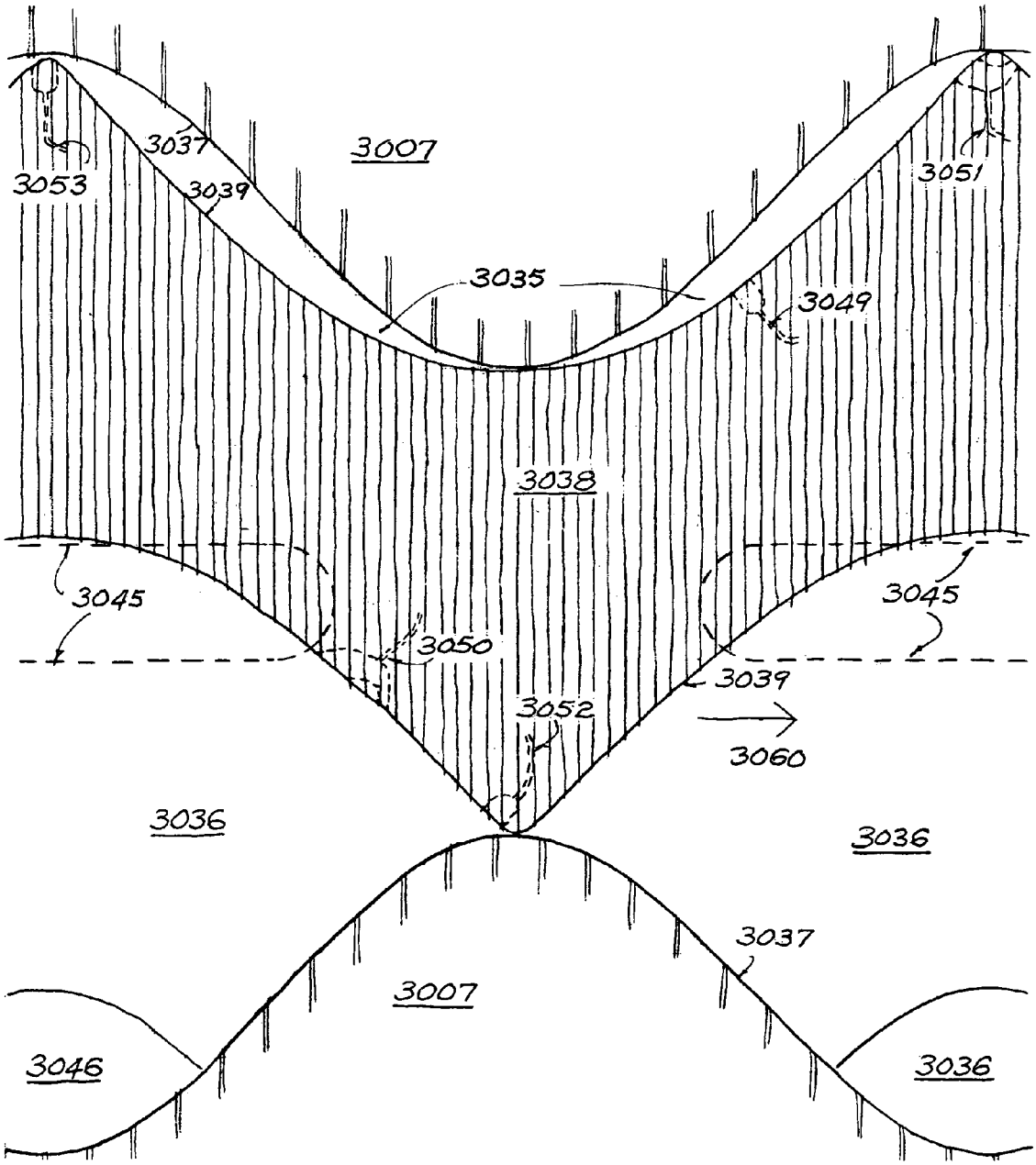

If such non-contact of surfaces is desired or for other reasons, the combustion process may be tuned by selective placement of the fuel delivery point(s). FIG. 114, wherein 3060 shows direction of rotation of component 3038/3004, illustrates conventional-type deployment of fuel delivery points 3047, here located on the reciprocating component, each a pre-combustion chamber communicating with a fuel delivery capillary tube, wherein the direction of fuel movement into the main chambers will be roughly parallel to the axis of rotation. Alternative fuel delivery points are also shown in FIG. 114 at 3048, where the direction of fuel movement is at a substantial angle, in at least one plane, to the axis of rotation. Theoretically, gas expansion in the main chamber is omni-directional, but in practice the arrangement of 3048 will impart somewhat more rotational movement to component 3038/3004 than the arrangement of 3047, for otherwise equal combustion parameters. FIG. 115 shows component 3038/3004 with fuel delivery at two locations per combustion zone. Sequential or differential delivery of fuel in the two locations can be used to regulate the natural movement of 3038/3004. Any number of fuel delivery points per zone may be used. 3049 shows a pre-combustion chamber having a single opening to the main chamber near the mid-point of the sine or other wave, while 3050 shows a similarly located pre-combustion chamber with two openings into the chamber, one larger than the other, and so shaped to give fuel delivery both parallel and angled to the axis of rotation. 3051 shows a similar double-opening pre-combustion chamber with only angled fuel delivery, located at or near the apex of the wave. 3052 and 3053 show single opening chambers at or near the wave apex, with fuel delivery respectively angled to and parallel to the axis of rotation.

Any type and combination of fuel delivery locations and directions can be provided in one combustion zone, not necessarily in every zone of one combustion chamber. (In these schematic illustrations, the actual fuel delivery mechanism is not shown.) Any system of fuel delivery can be used, including conventional injectors. The fuel delivery points are shown located in reciprocating component 3038/3004, but fuel delivery points can additionally or alternatively be in the housing 3007.

The housing 3007 has been described as fixed. As mentioned earlier, it need not be fixed but can be mounted on bearings inside another housing or enclosure and be free to rotate without reciprocating. FIG. 116 illustrates schematically such an arrangement, the indicated rectangles bisected by diagonals representing bearings. A twin toroidal combustion chamber system is represented schematically at 3059. Either because the chambers are sinusoidal and/or because there is a guide system (as shown schematically at 3058*a*), the combustion process causes component 3004 to both reciprocate and rotate clockwise at a given speed, relative to housing 3056. Component 3004 is linked by splines 3053 to components 3054 and 3055, which are so mounted that they are free to rotate but not reciprocate. They will turn in the same direction—clockwise—and speed as component 3004. The housing 3056 is mounted in an enclosure 3057 so that it is free to rotate but not reciprocate. In practice, if the resistances are balanced, as components 3004 plus 3054 and 3055 turn at, say, 2 000 rpm relative to housing 3056, they will also be turning at around 1 000 rpm clockwise relative to enclosure 3057, while housing will be turning at around the same speed counter-clockwise relative to the enclosure 3057. Therefore 3054 and 3056 are effectively counter-rotating shafts and A and B can be used as power take-off points or areas (via gears or friction materials). Such an assembly is suitable, for example, in applications such as marine or aircraft having contra-rotating screws or propellers. The speeds of the shafts can be varied relative to enclosure 3057 (but not necessarily relative to each other), by imposition of a resistance indicated schematically by brake pad 3058. In this arrangement, component 3055 could be used as a link to another engine system, such as a turbocharger.

Figure 117:
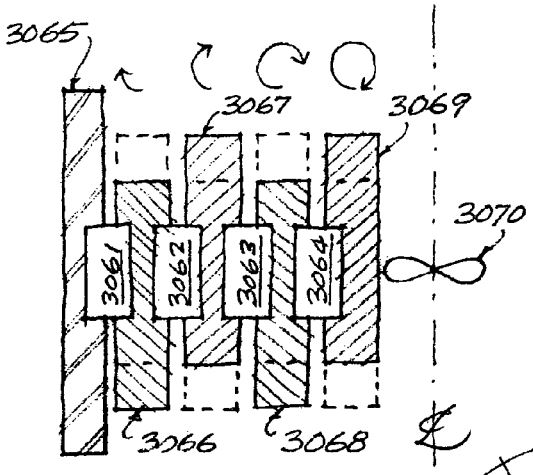

A system of concentric co-rotating components may be constructed. FIG. 117 indicates one such schematically, where the apparatus is shown only on one side of a center line. Sets of pairs of toroidal combustion chambers of equal cross-section are shown at 3061 through 3064, each set of chambers having progressively smaller radii. Due to combustion chamber design and/or guide systems (not shown), the combustion process causes each of components 3065 through 3069 to both reciprocate and rotate relative to its neighbor. Housing 3065 is fixed, the other components all rotate in the same direction relative to housing 3065, and the reciprocating motions are controlled and synchronized through a system of guides, so that components 3066 and 3068 reach one apex of reciprocation at the same time as components 3067 and 3069 reach the other apex of reciprocation. The ratio of reciprocation to revolution need not be the same for each combustion system Let that of 3061 be 14:1, of 3062 be 11:1, of 3063 be 8:1 and of 3064 be 5:1. If the reciprocations are synchronous, say at 10,000 reciprocations per minute, then component 3066 will revolve at 714.3 rpm, component 3067 at 1 623.4 rpm, component 3068 at 2 873.4 r.p.m, and component 3069 at 4 873.4 rpm, all relative to the housing 3065. Here, component 3069 drives a coaxial turbine system 3070.

Figure 118:
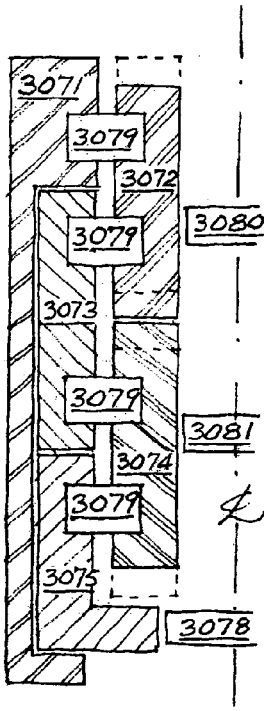

A different system of co-rotating components is shown in FIG. 118, similarly to FIG. 117. There are four identical systems of toroidal combustion chambers 3079, all sets having the same reciprocation to revolution ratio. Within a fixed housing 3071 are mounted two components 3073 and 3075, only free to rotate. Concentrically mounted within 3073 and 3075 are another two components 3072 and 3074, able to both rotate and reciprocate, so controlled and synchronized by guides that they simultaneously reach the apexes of reciprocation furthest from each other and simultaneously reach the apexes of reciprocation nearest each other. If component 3072 rotates at 5 000 rpm relative to fixed housing 3071, and all the moving components rotate in the same direction, then components 3073, 3074 and 3075 will turn relative to housing 3071 at speeds of 10 000 rpm, 15 000 rpm and 20 000 rpm respectively. Component 3075 could drive an element 3078, such as a turbine of a coaxial engine system, with components 3072, 3074 driving (say, via splines) other elements 3080, 3081 of the complex engine at differing speeds. The schematics of FIGS. 117 and 118 are suited to large high performance and/or high efficiency engines, such as might be used for aircraft propulsion, large marine craft, large scale electric power generation, etc.

It has been indicated above that, by careful component design and regulation of the combustion process, the natural frequency of motion of the reciprocating/revolving component can be such as to enable the wave-like working surfaces of sinusoidal combustion chambers to clear each other. Such design and regulation will be easier to achieve in steady-state engines (for example, as used in marine propulsion and generator sets) than in variable-state engines (as used in automobiles and motorcycles). In either case, provision should be made for the natural frequency of motion of the moving component to be varied or disturbed (collision of combustion chamber surfaces should obviously be avoided), even if such variation only occurs infrequently. In engines with regular (ie non-sinusoidal) toroidal combustion chambers, it has been disclosed how reciprocating motion can be translated into combined motion by guide systems. The same kind of guide systems can be used to limit the movement (to just prevent surface contact) of sinusoidal toroidal combustion chambers. For the latter, guide systems can be lighter or fewer than for regular toroidal chambers, where rotational motion is effected by the guides only.

Figure 119:
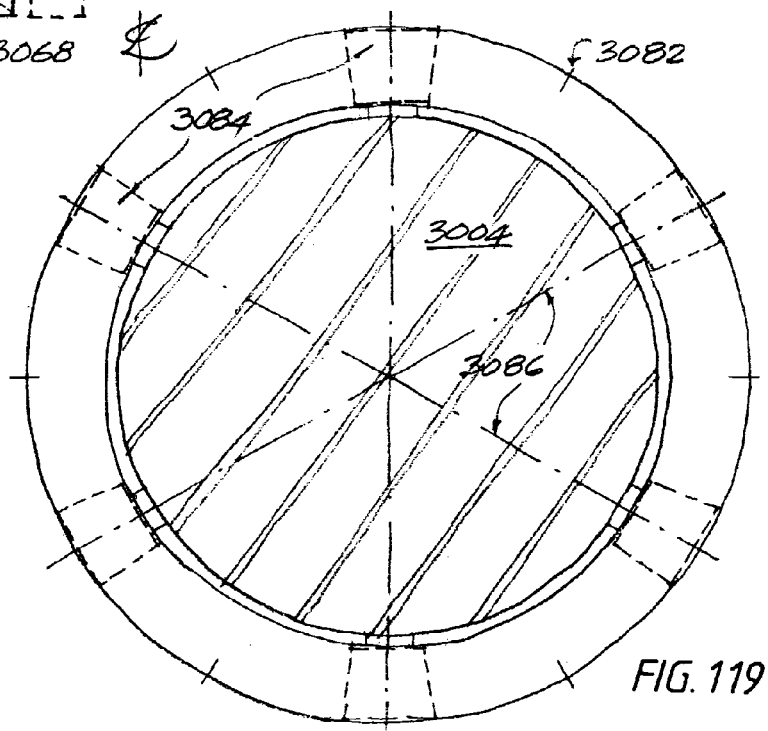
FIGS. 119 to 124 show details of sinusoidal toroidal engines.
Figure 120:
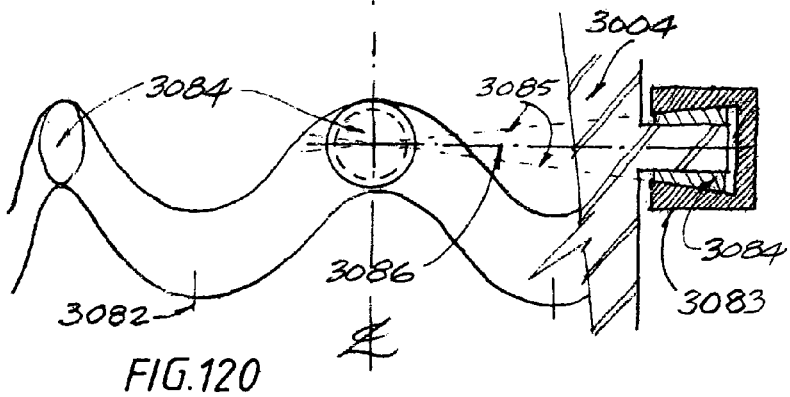

A basic mechanical guide system comprises a roller or series of opposed rollers running on endless sinusoidal tracks or in endless sinusoidal groove(s). FIGS. 119 and 120 show a typical arrangement, with 119 being a schematic plan view and 120 the corresponding part elevation, part section, of a six roller system located in a groove (endless) having six waves. The rollers 3084 are shown at one apex of reciprocation, with the opposite apex indicated at 3082. The groove housing 3083 is fixedly mounted, while the rollers 3084 are mounted on the reciprocating/rotating component 3004. It will be obvious that the height of the outer perimeter of the groove will have to be greater than the height of the inner perimeter of the groove because the roller has to be cone-shaped, the lines 3085 extending the profile of the cone to intersect the intercept of the axis of rotation of component 3004 and the axes of rotation 3086 of the rollers (one portion of the roller—all of the roller rotating at one speed—has to travel further along the outer perimeter of the groove than another portion of the roller travelling along the inner perimeter; therefore the roller has to have a progressively varying diameter).

Figure 121:
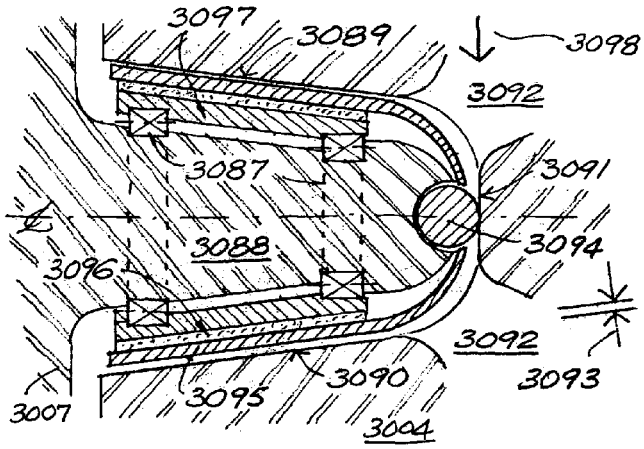

FIG. 121 shows a roller in a groove, with the roller mounted by roller bearings 3087 on a shaft 3088 which is attached to the housing 3007, while the groove is located in or mounted on a moving component 3004. The groove consists here of three operating parts: an upper track 3089, a lower track 3090 and an optional end track 3091. For better transfer of loads and stresses, the links between these three parts are rounded, and may have optional ventilation holes as at 3092. Obviously, only one side of the roller should be in contact with the groove at any one time, so there has to be some kind of clearance gap 3093. There may be play in the other bearings in the engine system, so the roller has at its end a ball bearing 3094, to prevent the roller from drifting into the groove and so closing the clearance gap. The roller and axle assembly is here retractable from and insertable into the groove under some conditions, perhaps during relative motion between the two, so the roller has a rounded frontal aspect. The working portion of the roller comprises a hard and strong engineering material forming the outer casing 3095 (in contact with the groove) mounted on a thin elastomeric intermediate layer 3096, in turn mounted on an inner shell 3097 of engineering material, in turn mounted on the roller bearings 3087. In operation, a load (indicated schematically at 3098) on the roller will cause the shaft 3088 to deflect somewhat, causing the axis of the shaft to become misaligned relative to the track 3089. This misalignment is taken up and absorbed by deformation of the elastomeric material 3096.

Figure 122:
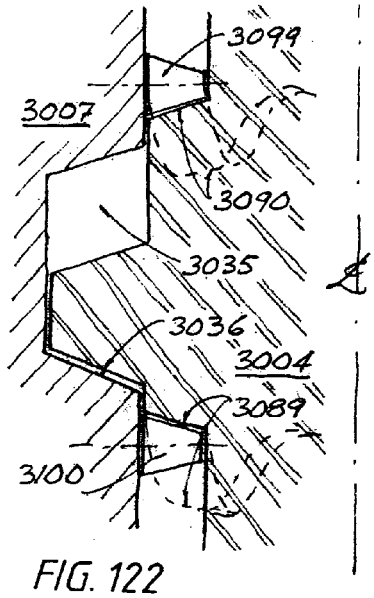
Figure 123:
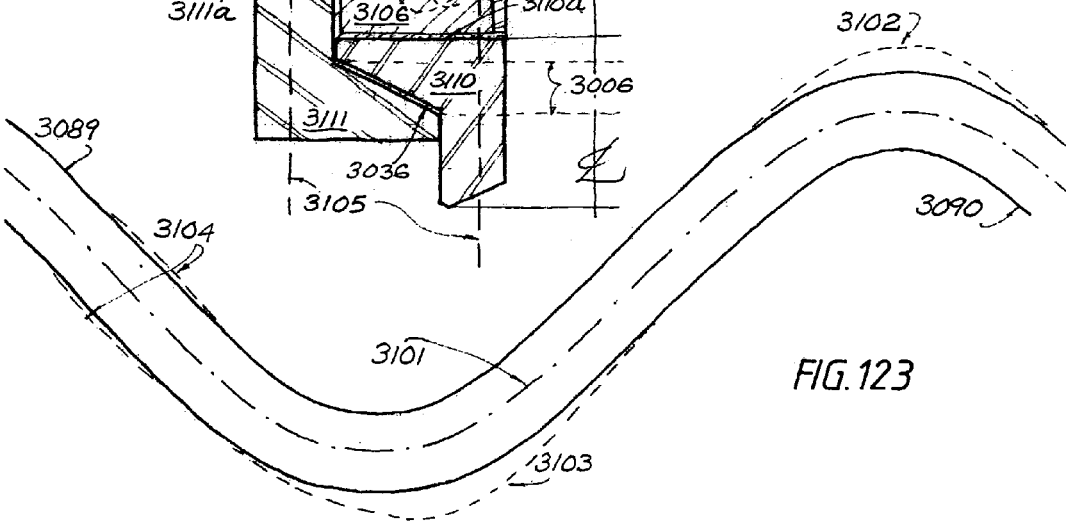

It will be obvious that the principles described above can also be embodied by wide separation of the tracks and/or provision of a second set of rollers. FIG. 122 shows component 3004 moving within housing 3007, both defining twin toroidal combustion chambers 3035 and 3036. Two sets of rollers are shown at 3099 and 3100, with the tracks corresponding functionally with those of FIG. 121 shown at 3089 and 3090. The relationship of the upper track 3089 to the lower track is assumed to be constant, that is, that the roller during its path along and up and down the groove always maintains the same clearance gap. This condition need not apply. Irrespective of whether the tracks are deployed as in FIG. 121 or FIG. 122, the relationship of the upper to the lower track may be such that there is a varying clearance gap during one complete combustion cycle, or wave of the groove. FIG. 123 shows schematically an elevation taken along the curve of part of a perimeter of a groove, with the line of axis of rotation of the roller shown chain-dotted at 3101. The positions of the upper and lower tracks set out for a constant clearance gap are shown in solid line at 3089 and 3090. Possible positions of the tracks consistent with variable clearance gap are shown dotted. The most useful applications for tracks permitting varying clearance gaps are for engines with variable compression ratios, as disclosed elsewhere herein. In FIG. 123, one track ensures that about the apex of reciprocation a minimum designed compression ratio is reached, while in that region the second track grows more distant from the first, to enable a moving component (such as piston/rod assembly 3004) under certain conditions to travel beyond its designed compression ratio. A symmetrical track separation is shown at 3102, and an asymmetrical track separation at 3103. Variable clearance gap may be desirable for reasons other than variable compression ratio, and 3104 shows track separation permitting greater range of component 1 movement around the mid-point of reciprocation. Of course, once there is track separation, the path of the axis of roller rotation can no longer be predicted to always follow line 3101.

Figure 124:
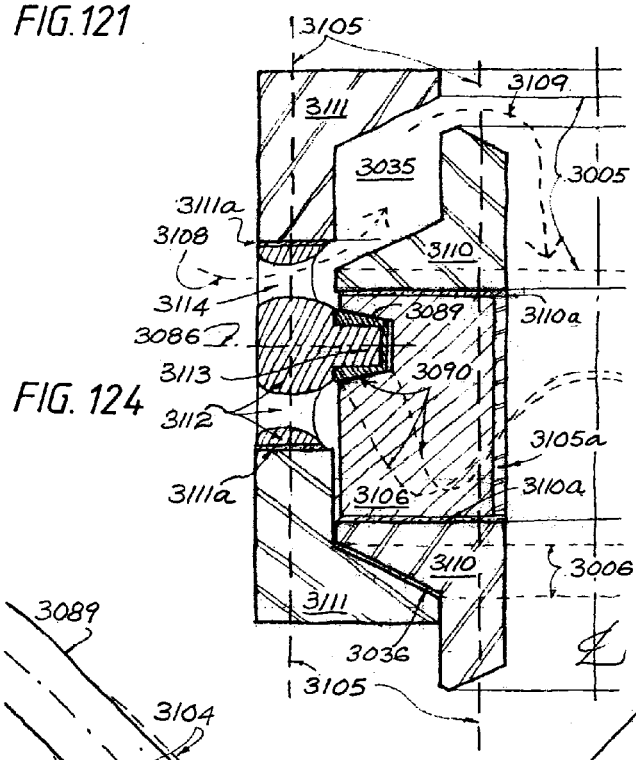

The "groove" could be wholly or partly backless (that is, have no end track), permitting gas to pass across the space between upper and lower tracks. Thus the guide system could be located about or within a gas flow associated with combustion. In certain engines it could be in the exhaust flow but generally (because the exhaust gas would tend to pollute the working surfaces and mechanical parts of the guide system), it would be in the charge gas flow. FIG. 124 shows schematically a half cross-section of an engine with twin toroidal combustion chambers 3035 and 3036, with the components defining the chambers separated from each other and spaced by the guide components, with both the moving components and the housing components assembled by means of, and pre-stressed by, tensile members 3105 such as bolts. Here the components enclosing the combustion volumes are of ceramic material, wile the guide components are of metal, possibly castings. A single toroidal metal component 3106 containing an endless sinusoidal groove separates identical (but inverted) toroidal components 3110. Charge flow is indicated at 3108, exhaust flow at 3109. Identical toroidal housing components 3111 (inverted relative to each other) are separated by a series of metal components 3112 arranged circumferentially, each having a shaft and roller assembly 3113. Components 3112 have a series of holes 3114 through which charge air passes. Only the curvature of lower track 3090 is indicated, for simplification that of upper track 3089 is omitted. Compressible insulating material is shown at 3110*a* and 3111*a*, ceramic insulation at 3106*a*.

Figure 126:
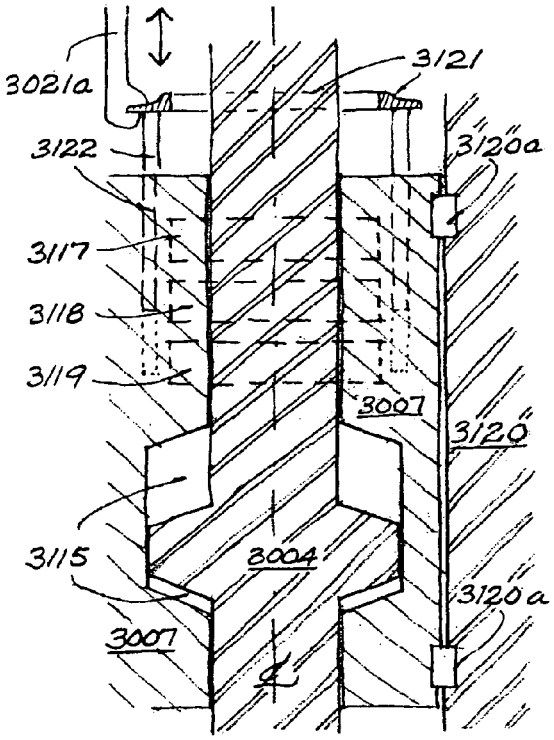
FIGS. 126 to 128 show methods for varying ratio of one motion to another.
Figure 125:
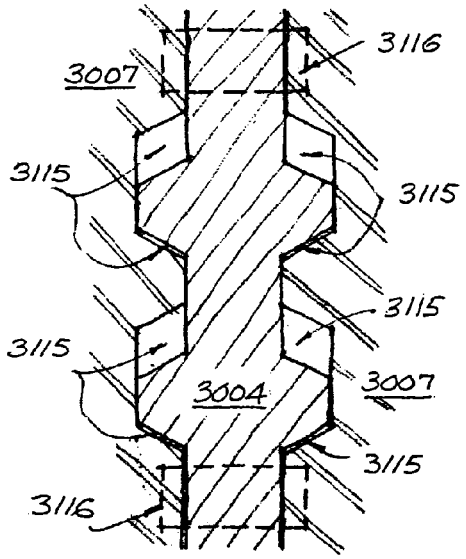
FIG. 125 shows schematically multiple pairs of toroidal combustion chambers.
Figure 127:
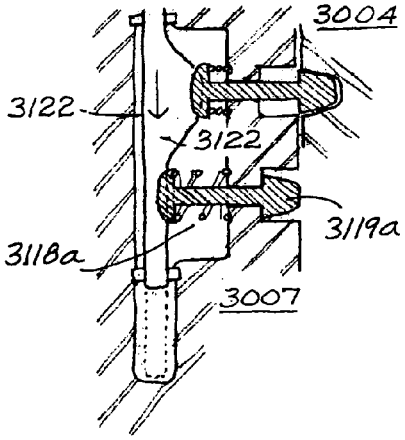

Other layouts of guide systems relative to combustion chambers are possible. FIG. 125 shows schematically a more powerful engine having four identical combustion chambers 3115 and two identical complete guide assemblies 3116, each having upper and lower tracks. The guides have the same number of reciprocations per revolution, and the engine has to be very carefully assembled, so that the guides are perfectly synchronous with each other and/or the roller assemblies have to be of the type having elastomeric interlayers. FIG. 126 and detail FIG. 127 show schematically a twin combustion chamber 3115 engine, wherein component 3004 turns clockwise relative to housing 3007, which is mounted on bearings 3120*a* and itself turns counterclockwise relative to enclosure 3120. Three separate complete twin-track toroidal guide systems are located at 3117, 3118, 3119. The sine or other waves in each guide system have the same amplitude but differing pitch, so that each system has a different ratio of reciprocation to rotation. Only one system is engagable at any one time, by means of extensible/retractable roller assemblies. Selection of which guide system is engaged is made by movement of ring 3121 (turning at same speed as housing 3007) by means of actuator(s) 3021*a*. The ring is connected to a series of slidable shafts or elements 3122, which actuate the extension or retraction of the roller assemblies. Preferably the roller assemblies are spring-loaded to the retracted position. Such retractment/engagement devices are known, but the principle is illustrated schematically for a two-speed system in FIG. 127, where shaft 3122 has a plate-like section for engagement with a portion of a retractable roller assembly. Sinusoidal tracks may be engagable with non-rotating or solid elements, retractable or fixed.

Figure 128:
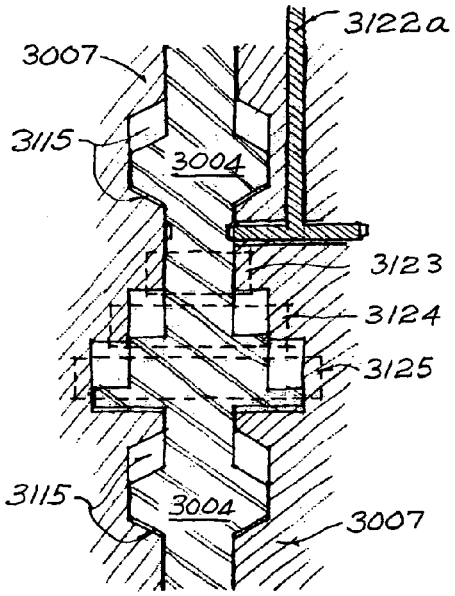

The system of FIG. 126 is effectively a machine which combines the functions of internal combustion engine, variable stepped transmission and differential. A clutch function could be located at the interface of the two rotating elements and any power take-off points. (See also FIG. 16). FIG. 128 illustrates schematically a machine which combines the functions of internal combustion engine and stepped variable transmission only. Two sets of twin combustion chambers 3115 (four chambers in all) are separated by a power take-off point 3122*a*, in the form of a toothed wheel and shaft, and the transmission system. This comprises three separate guide systems 3123, 3124, 3125, each having upper and lower tracks. The sinusoidal or similar wave systems in each guide system have the same amplitude, pitch and curve—they are identical. Because the guide systems are of progressively increasing size, they will have progressively increasing number of cycles, or reciprocations per rotation. As with the system of FIG. 126 only one guide system is engagable at any one time. In this arrangement, guide system 3125 represents low gear, 3124 intermediate gear, and 3123 high gear. In another version of this engine/transmission system, the pitches and curves of the guide systems are similar but not identical, each being tuned to combustion and operating characteristics at a particular gear ratio. In variable compression ratio engines, the amplitudes of the guides may also be varied.

Multiple concentric combustion chambers of non-uniform size were disclosed earlier herein. They present no theoretical problems of assembly because, as in FIGS. 94 and 95, an integral component 2006 can move and fit within component 2005. It would be useful to have more than two combustion chambers of identical size and configuration, but there would be problems of assembly (especially of the moving component), as can be seen by studying FIG. 125. Advantages of being able to combine more than two identical chambers in one engine include the ability to manufacture a range of engines using one set or module of combustion chamber parts.

Figure 129:
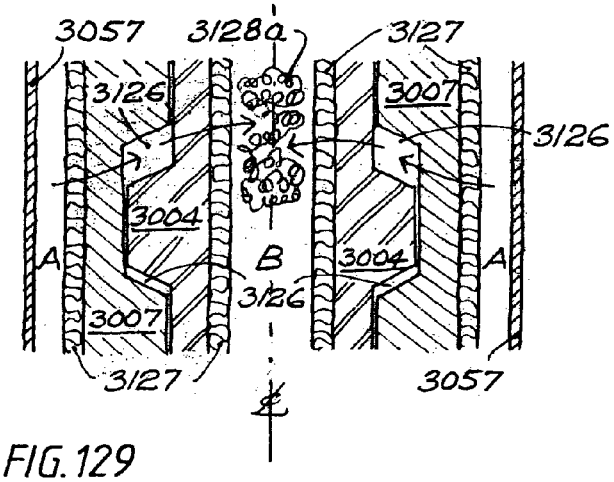
FIGS. 129 to 132 show alternative gas flow arrangements.
Figure 130:
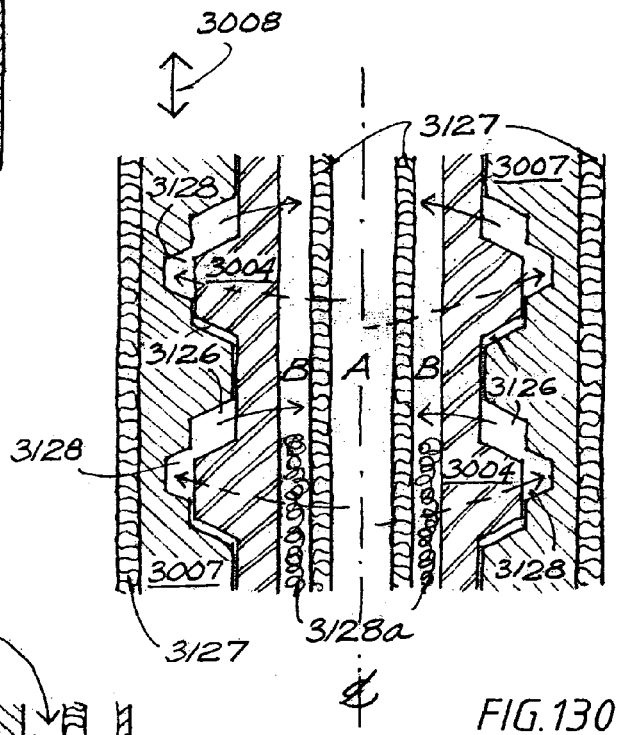
Figure 131:
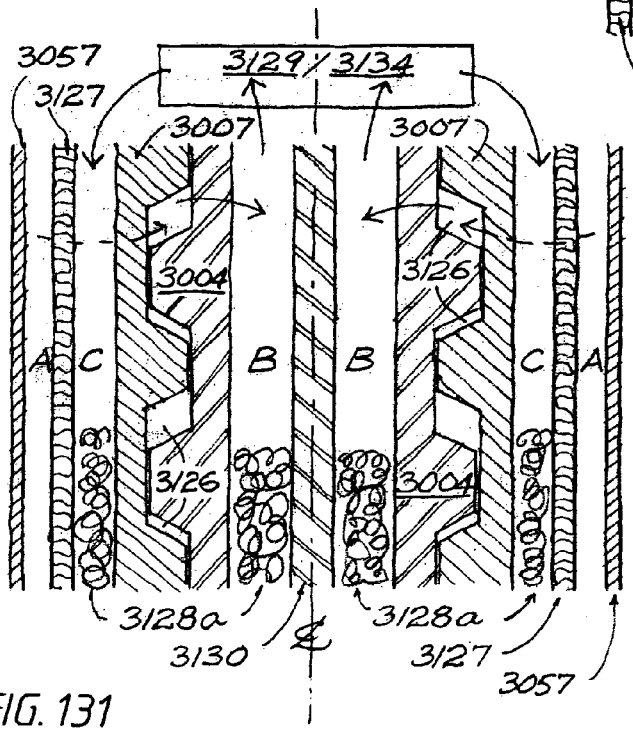
Figure 132:
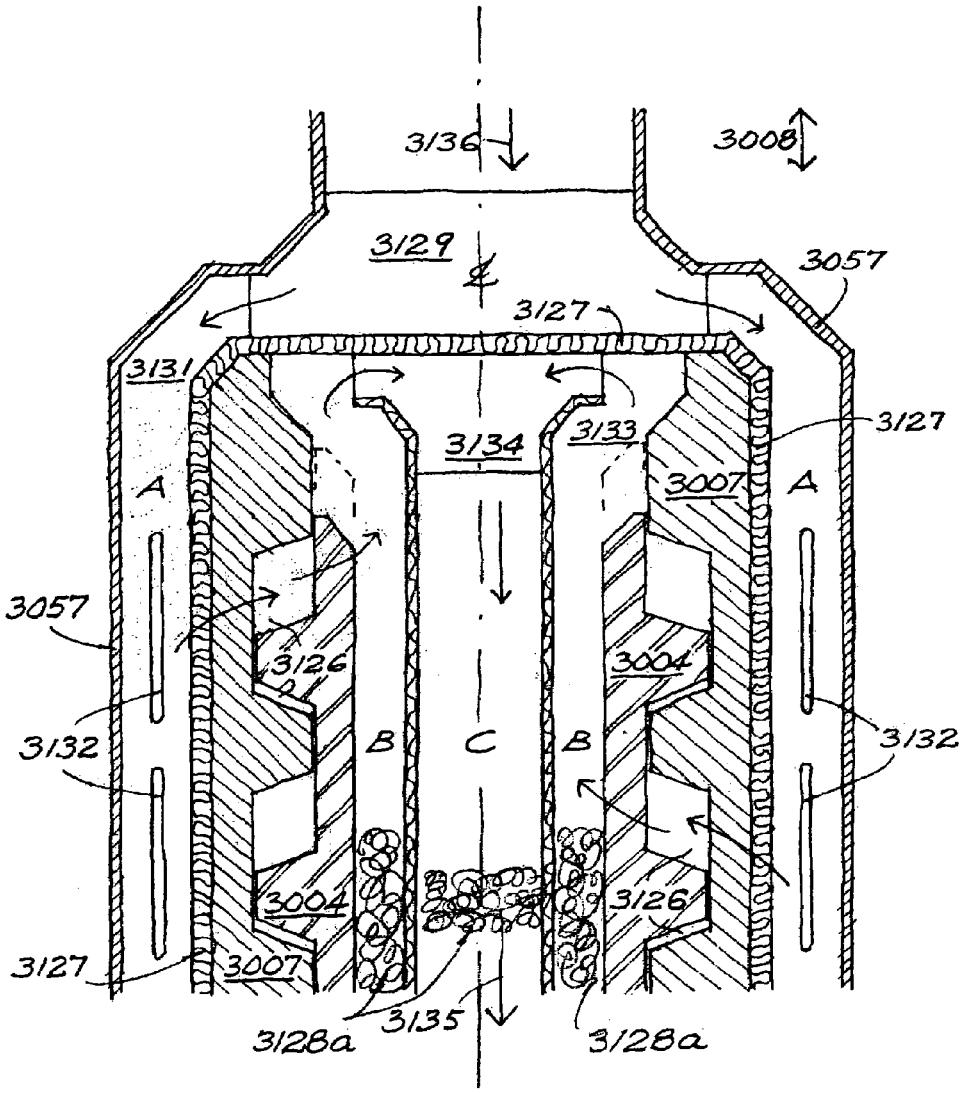

If one is going to use one combustion chamber module to make engines of varying power and swept volume, then the gas passage(s) within the module (if any) should be so sized as to accommodate the gas flows of the largest engines likely to use that module. FIGS. 129 to 132 illustrate schematically various possible gas flow layouts, wherein 3126 indicates a multiplicity of equal sized toroidal combustion chambers, 3004 the moving component reciprocating in direction 3008, with 3007 the "fixed" housing (which, in all these embodiments, could also rotate), and 3057 an enclosure or casing. "A" represents charge air volume, "B" high temperature and pressure exhaust, "C" lower temperature/pressure exhaust. Filamentary material is shown at 3128*a*. Porting is not shown, but can be as described elsewhere in this disclosure. Solid arrows describe gas flows through ports, dotted arrows show gas flow to and/or from transfer ports, or flows via passage or plenums as described elsewhere herein. Thermal insulation is indicated (schematically, like all other components) at 3127. In FIG. 129, thermal insulation separates charge flow from hot components, charge flows into the combustion chamber, exhaust flows from it into a central exhaust gas reservoir. Obviously, the flows could be reversed, volumes A and B transposed, insulation moved to the interface of component 3004 and the central (now charge) gas reservoir or plenum FIG. 130 shows a system having transfer ports, indicated schematically at 3128. Here again, the flows could be reversed, volumes transposed, insulation repositioned. FIG. 131 shows a layout where exhaust gas flows adjacent to the structural component of 3004 and 3007 are used to reduce heat flows (ie thermal gradients) across these components, with the center of the engine occupied by a mechanical system 3130. If 3130 were a fuel delivery system, this could serve to maintain liquid fuel under pressure at temperatures greater than boiling. A compressor and/or turbine system is indicated schematically at 3129/3134. In FIGS. 129, 131 and 132, casing 3057 comprises part of the structure defining volume A, while in FIG. 131 thermal insulation 3127 is part of the structure defining volume C.

A selected embodiment is indicated in FIG. 132. Here, ambient air enters a compressor 3129 at 3136, high pressure charge is delivered via plenum or annulus 3131 to tubular volume A, in which heat exchangers 3132 are located for purposes of after-cooling. Optionally water under pressure circulates in the heat exchangers, to be used for compounding (as described later) and/or to provide bearing pressure as disclosed earlier. Hot exhaust from tubular volume B goes via plenum or annulus 3133 to turbine 3134, which is mechanically linked to the compressor 3129. On leaving the turbine, the lower temperature exhaust flows through tubular volume C to exit at 3135. If the number of equal concentric toroidal chambers at 3126 is relatively large, then the engine will or might have a torpedo-like or tubular shape. This, together with the uni-directional gas flows indicated at 3136 and 3135, will make such engines suited for particular applications, as in aircraft or certain marine craft. Obviously, additional compounding can extract further work from the lower temperature exhaust gas, at or after 3135. In certain embodiments, the separate insulation 3127 need not be employed, especially if the gas flows are large per unit volume and/or the structural components used in 3004 and 3007 have moderate to good insulating properties.

Figure 133:
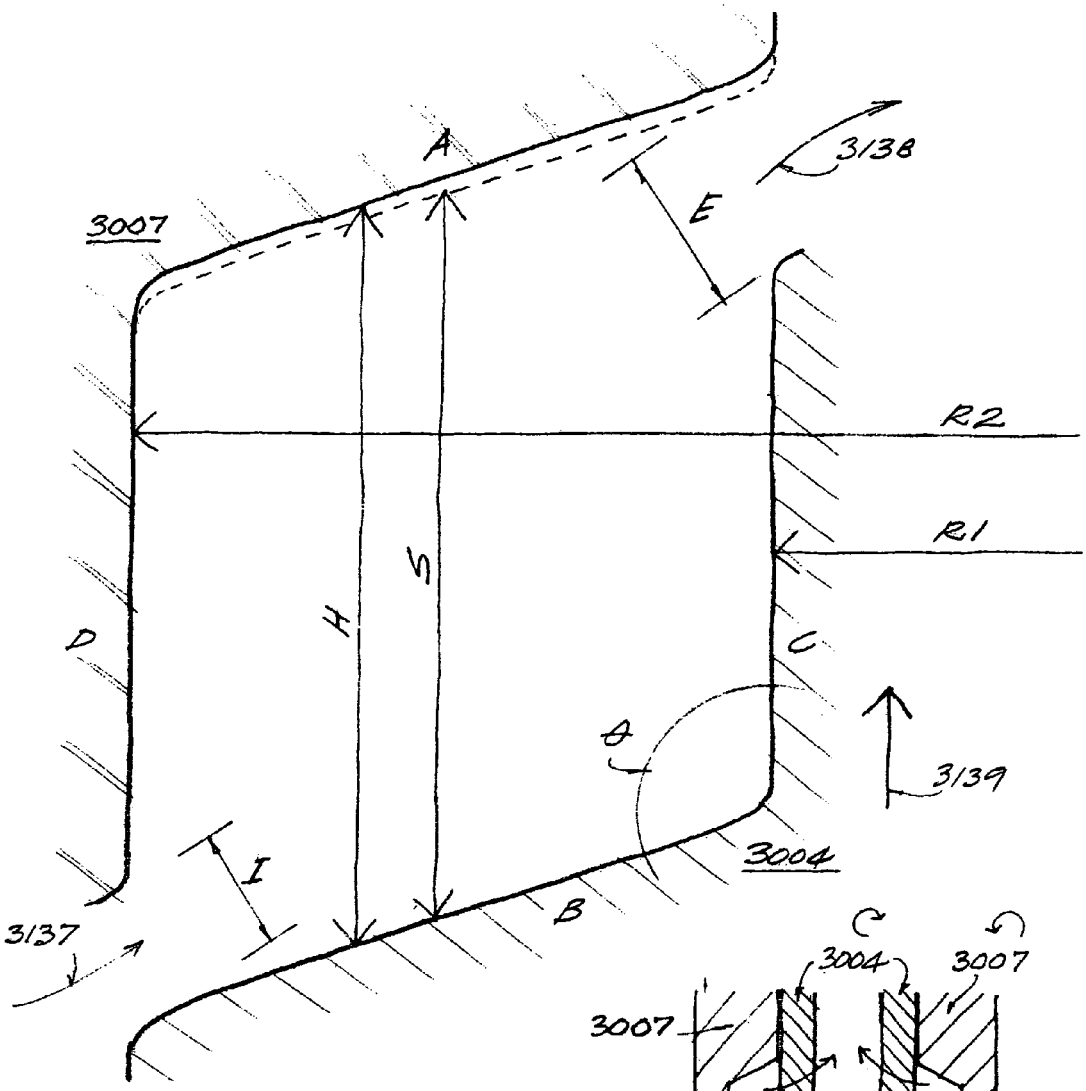
FIG. 133 shows a combustion chamber profile.

A schematic profile of a half cross-section of the toroidal form of a preferred combustion chamber is shown in FIG. 133. It is drawn with the ratio of height H to outer radius R2 minus inner radius R1 equal to 6:5. Here the maximum inlet port opening is shown at 3137, the maximum exhaust port opening at 3238, with dimensions I and E being 0.183×H and 0.267×H respectively. If the motion of 3004 relative to 3007 is represented by the sine curve, then the port/valve openings, measured in crank angle from top dead center, are: exhaust opens 114.7°, inlet opens 126.9°, inlet closes 233.1°, exhaust closes 245.3°. If the ratio of (R2−R1) to R1 is 1:2.5, the ratio of maximum inlet port area to maximum exhaust port area is 1:1.04. Dimension S represents the stroke. The working surfaces A and B are angled relative to cylinder walls C and D as shown, and the intercepts of the surfaces are rounded as shown, so that the gas flows across the combustion volume are as smooth as possible, and so that stresses are reduced and more evenly distributed in monolithic components 3004 and 3007. The object of the smooth gas flows is to optimize two-stroke scavenging and minimize residual exhaust gas left in the charge after the ports close. The chamber is shown at maximum volume; component 3004 will move in direction 3139 to effect compression.

Figure 137:
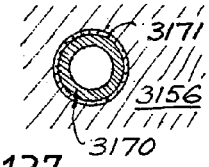
FIGS. 135 to 145 show construction details of modular and other engines.
Figure 136:
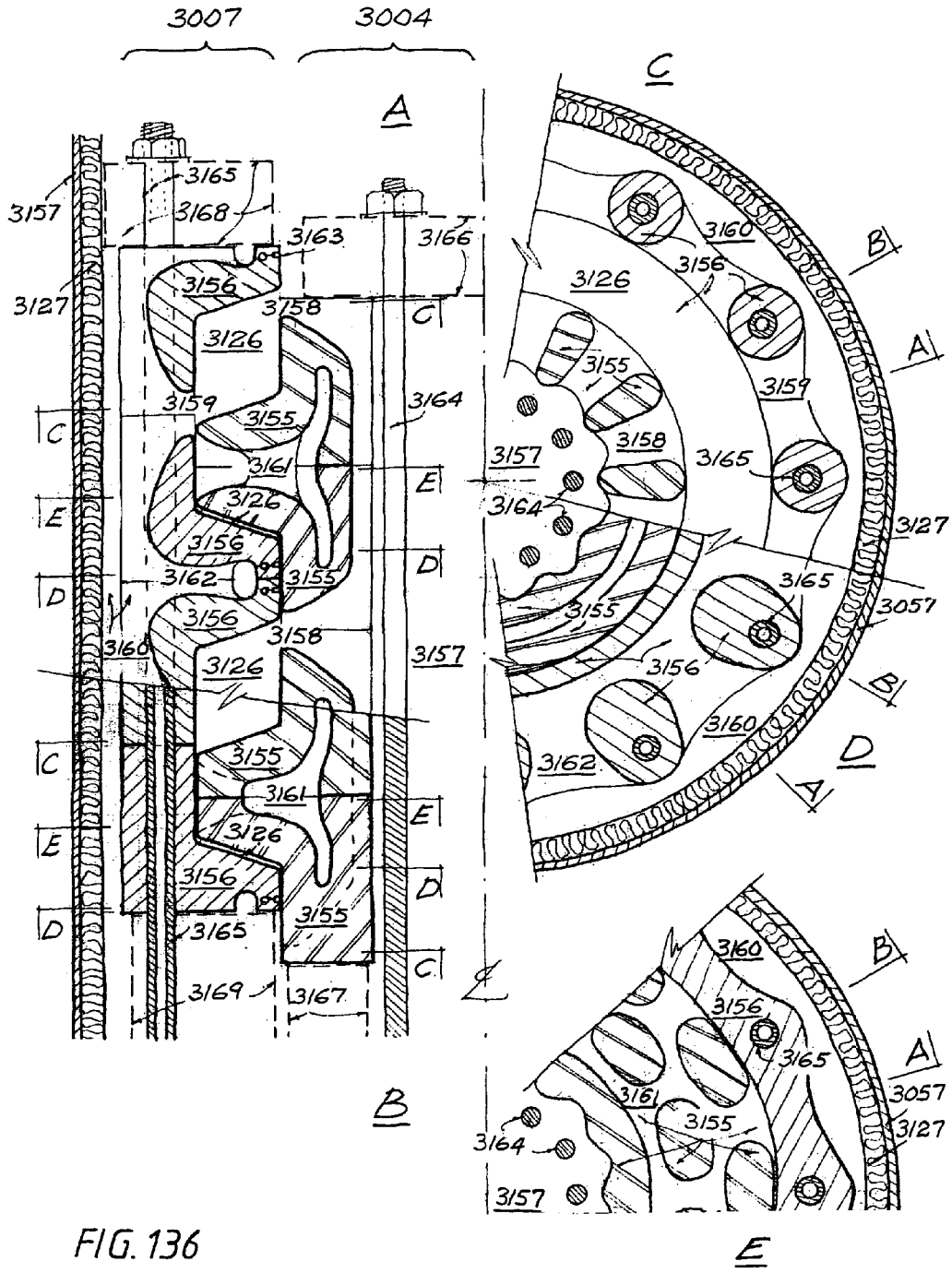

FIG. 136 shows by way of example an engine assembly whose combustion chambers are of modular construction, wherein details A and B are half vertical sections along the different radii indicated in details C, D and E, which are cross sections through the planes indicated in the vertical sections. Component 3004 reciprocates relative to component 3007 and is shown at bottom dead center. Details C, D and E are shown with components 3004 and 3007 in different positions relative to each other, when the appropriate detail lines shown on the vertical sections A and B are in approximate alignment with each other. Identical ceramic reciprocating components are shown at 3155, with identical ceramic "housing" components shown at 3156. Charge circulates through volume 3157 and enters combustion chambers 3126 via inlet ports 3158, exits via exhaust ports 3159. Exhaust gas circulates through tubular volume 3160 and is spaced from outer enclosure 3057 by thermal insulation 3127, which functions as structure enclosing volume 3160. Exhaust gas circulates to some degree within spaces 3161, 3162. Since these communicate with the main exhaust gas circulation volume 3160, they serve to reduce thermal gradients in selected portions of the combustion chamber components. A gas bearing supplied by super-heated liquid is shown, schematically, at 3163. The respective components are assembled and fastened (preferably pre-loaded in compression) by means of tensile fasteners 3164 and 3165. Fasteners 3164 are located within the relatively cool charge flow volume and so are of conventional design, while fasteners 3165 are adjacent hot components 3156 (separating hot combustion chamber and hot exhaust volumes) and so are of tubular design, the interior of the tube communicating with cooler volumes (say those containing charge air), this circulation of cooler gases through the interior of the fasteners serving to maintain their temperatures below the temperatures of components 3156. Loads are distributed along the rims or extremities of components 3155 and 3156 by means of load distributor elements 3166, 3167, 3168, 3169 which, in selected embodiments, have additional other function(s) including possibly guide system, bearing and/or sealing components. They may also function as fuel delivery system or tribology system components. The matter of tribology and bearings as well as sealing is described elsewhere in the disclosure. FIG. 137 shows a cross-section detail of an optional alternative to fastener 3165, wherein hollow tensile member 3170 does not fit tightly within component(s) 3156 but is separated from them by an insulating and/or elastomeric interlayer 3171, which could be of any suitable material, including ceramic wool. The engine illustrated in FIG. 136 has four identical combustion chambers. It is obvious that other engines using components 3155 and 3156 can be constructed, including ones having two combustion chambers and, if volumes 3157 and 3160 are sufficiently large, engines with six or even more combustion chambers. Alternatively, components 3157 and 3160 can be used in other engines with four combustion chambers, for example, wherein heat exchanges are located within volume 3160 and the enclosure 3057 is therefore of larger diameter. When constructing different engines using standard components 3155 and 3156, it is probable that other components such as the fasteners, enclosures, etc will differ and be particular to each engine design. The combustion chambers illustrated in FIG. 136 and elsewhere generally show an angle between wall and head/crown (angle Θ in FIG. 412) of around 110° to 120°. In fact, the chambers could be designed with Θ any suitable angle, including 90°.

Figure 138A:
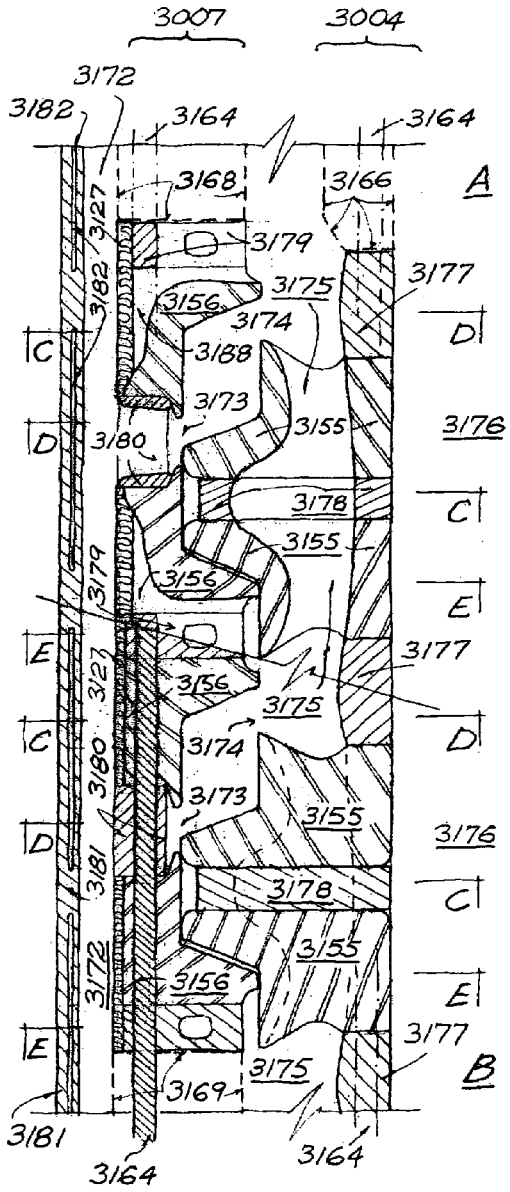
Figure 139A:
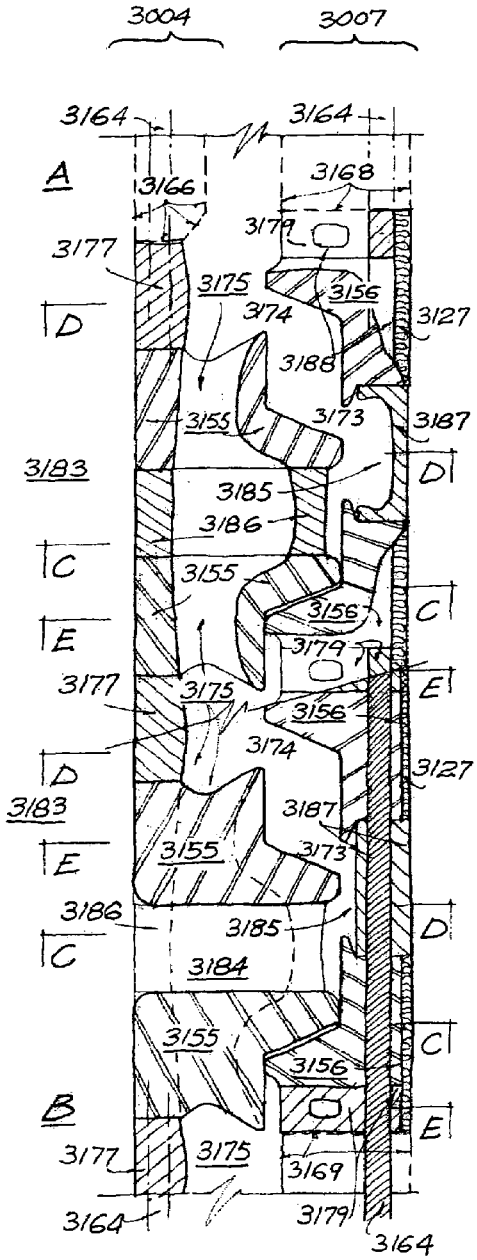
Figures 138B, 139B:
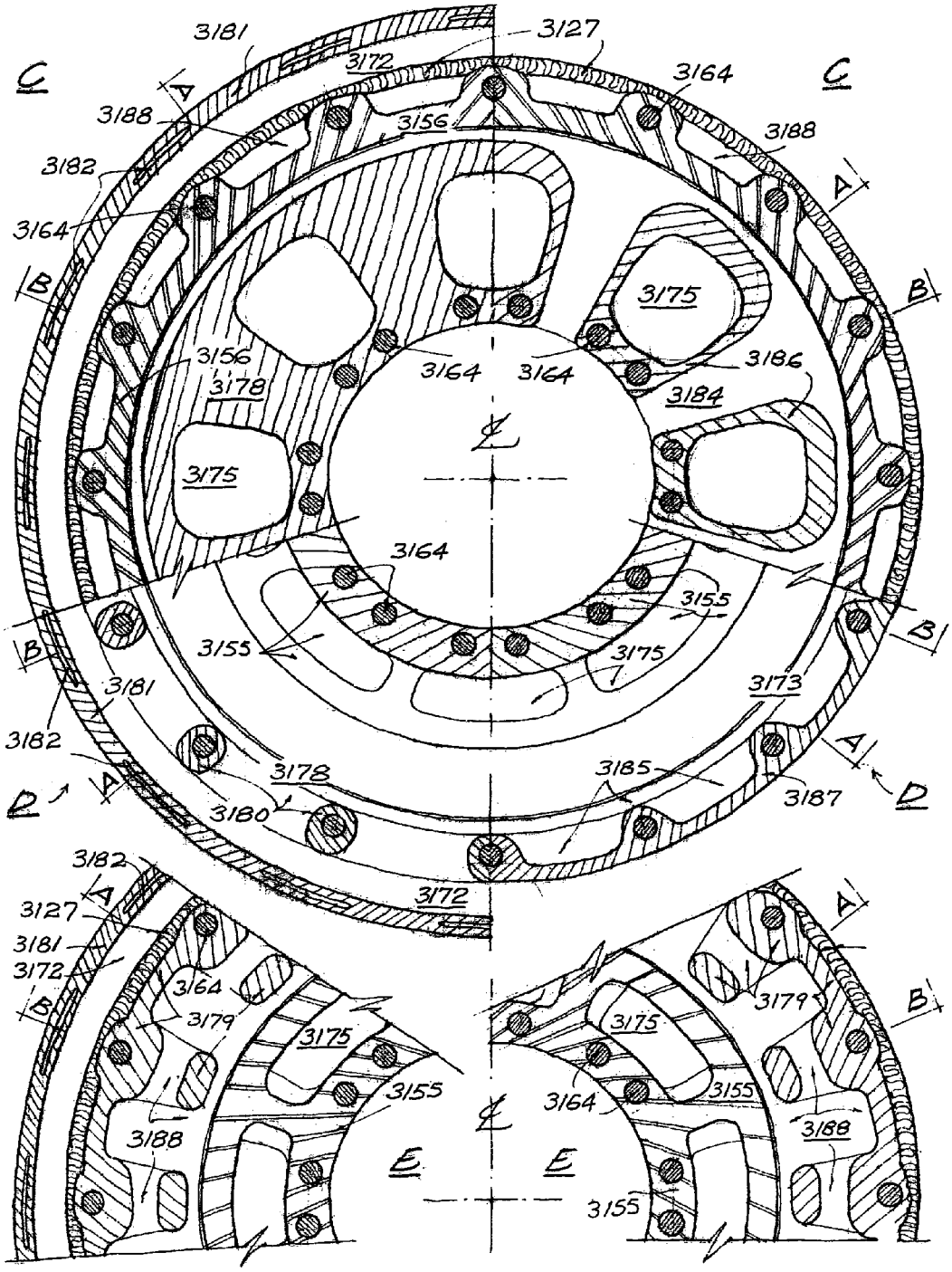
Figure 140:
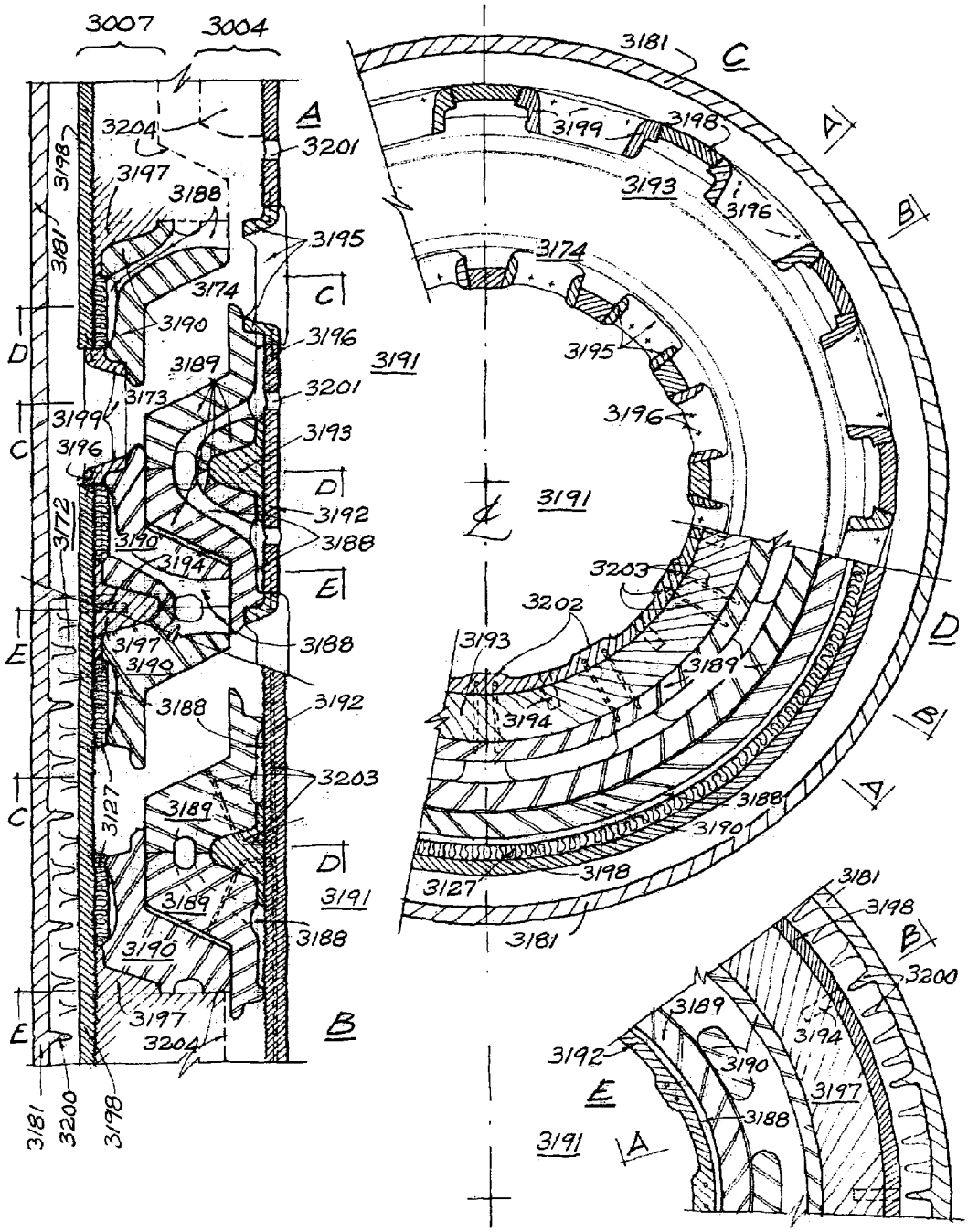

FIGS. 138, 139 and 140 show further examples of engines having combustion chambers of modular construction. The method of illustration is similar to that of FIG. 136 (FIGS. 138, 139 and 140 each show a different engine), and both the size/configuration of the combustion chambers and the basic configuration of toroidal components 3155 and 3156 are similar in all four engines. Variations occur mainly in the gas flows and the methods by which loads to and from components 3155 and 3156 are transmitted. Because FIGS. 138 and 139 illustrate how two substantially different engines can be assembled using the same combustion chamber components, the details A, B, C, D and E of each figure are presented side by side, for purposes of comparison. Combustion chamber components 3155 and 3156, as well as the cross section of fasteners 3164 (but not necessarily their length) are identical in both engines. Thermal insulation 3127 is deployed as indicated in both engines, as are load distributor elements 3166, 3167, 3168, 3169.

In the engine of FIG. 138, charge air circulates in tubular volume 3172, enters the combustion chambers via inlet port 3173, exits via exhaust port 3174 into high temperature/pressure exhaust gas circulation volume 3175. The exhaust gas passes to a turbo-charger (not shown; the layout of FIG. 132 would be suitable), and from there low temperature/pressure exhaust gas passes down the central volume 3176. Components 3155 are separated from each other and the load distributor elements by spacer rings 3177 and spacer plates 3178 having holes to accommodate volume 3175. Components 3156 are separated from each other and the load distributor elements by spacer rings 3179, each having a series of internal projections (see illustrations), and by inlet port rings 3180, each ring having a series of holes permitting the passage of charge air (see illustrations). Here the ring comprises an integral element having an upper rail and a lower rail separated by a series of posts (which accommodate the fasteners 3164), the transitions between them being rounded and smoothed. The tubular charge volume 3172 is enclosed by a casing 3181, here having within it passages 3182 containing circulating liquid, for the purpose of cooling the casing and therefore indirectly the charge. Casing 3181 forms part of the structure enclosing volume 3172.

The engine of FIG. 139 has the same combustion chamber components 3155 and 3156 as that of FIG. 138, and is therefore presumed to have the same stroke and similar inlet and exhaust port openings, ports shown at 3173 and 3174, respectively. However, the gas flow is different, charge flowing in central volume 3183 to the inlet port via passages 3184 and transfer port 3185, thereafter leaving the combustion chambers via exhaust port 3174 into essentially tubular exhaust processing volume 3175. The difference from the engine of FIG. 138 has been achieved only by substituting spacer plate(s) 3178 with a series of eight smaller but taller ring-shaped spacer plate(s) 3186, each also able to accommodate volume 3175, and by substituting the inlet port ring(s) 3180 with taller transfer port ring(s) 3187. Note that spacer elements 3177 and 3179 remain unchanged. Since the gas flows are different, outer casing 3181 can be eliminated. In both engines there are located within or adjacent to components 3156 special volumes 3188 which communicate with volume 3175 and will therefore also contain exhaust gas. As previously, the objective of volumes 3188 is to reduce combustion chamber heat loss through components 3156. Portions of components 3155 and 3186 are part of the structure enclosing volume 3155.

Figures 141, 142:
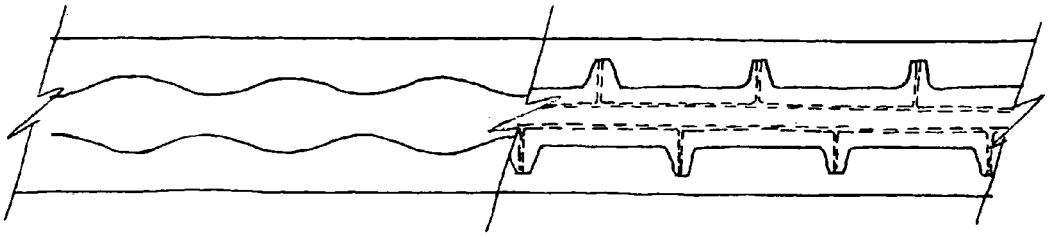

The engine of FIG. 140 illustrates alternate ways of assembling/fastening/mounting modular combustion chamber components. Components 3189 and 3190 are similar to those illustrated previously, as are volumes 3188 housing or permitting the passage of exhaust gas. Here charge travels within tubular volume 3172 via inlet port 3173 to the combustion chamber; exhaust exits via exhaust port 3174 to central tubular exhaust gas volume 3191. Outer casing 3181 comprises part of the structure enclosing volume 3172. Instead of using conventional tensile fasteners (such as 3164 in FIGS. 138 and 19, this engine is assembled by means of pierced tubes. Inner tube 3192 is continuously threaded on its outer surface. Load distribution rings(s) 3193 are threaded onto the inner tube 3192, and once in final position secured by means of locator pins or keys 3194. The rings support components 3189, which are further restrained by sleeves 3195 of rectangular form with rounded corners, inserted into pre-formed holes in tube 3192, and restrained by means of pins 3196. Exhaust gas passes from port 3174 through this sleeve 3195 to volume 3191. In a similar manner, components 3190 are supported by means of load distribution ring(s) 3197 threaded within outer tube 3198, and when in final position secured by means of locator pins or keys 3194. Components 3190 are further restrained by circular sleeves 3199 threaded into pre-formed holes in outer tube 3198 and restrained by means of pins 3196. Inlet charge passes from volume 3172 through this sleeve 3199 to inlet port 3173. Insulation 3127 within and against outer tube 3198 prevents heat loss from exhaust gas in volumes 3188. An outer casing 3181 defines volume 3172. In an alternative embodiment, illustrated only in details B and E, the casing has a multiplicity of projections 3200 located in the charge air flow, and is made of material having good thermal conductivity, for the purpose of transferring heat from the charge to beyond the casing 3181 (a form of after-cooling). This device is particularly useful in situations where the fluid surrounding the casings is at low temperature, say under water in marine applications or at high altitude in aircraft applications. The projections 3200 are shown schematically only; they can be of any configuration and integral with the casing or attached to it in any way. Exhaust gas reaches volumes 3188 associated with components 3189 from volume 3191 via holes 3201 in inner tube 3192, which is of varying thickness in cross section, stiffening ribs 3202 running vertically or longitudinally on the inside of the tube between the exhaust sleeves 3195. Within each rib are two capillary fuel tube systems 3203 (one to supply all the chambers moving 3004 in one direction, the other for the chambers moving 3004 in the other direction), which communicate with the combustion chamber via load distribution ring(s) 3193. Here, two tubes 3203 are shown in each longitudinal rib, however any twin system of tubes and/or galleries may be used, supplying the chambers via ring(s) 3193 and/or directly. The fuel supply need not be within the tube, but could be in fuel lines within volume 3191 to pierce 3192 via connectors, couplings, etc. Fuel delivery is here shown associated with the inner tube; it could be equally associated with the outer tube 3198. A similar system of tubes/passages/fuel lines could be used to provide fluid used for tribological purposes to any desired location within the engine. In FIGS. 138 and 139, the fasteners were attached to load distributor elements 3166 to 3169. Here, the outermost rings 3197 could be identical to an inner ring 3197, or they could be integral with a component 3204 having another function, such as bearing, gas-seal, guide system element, as indicated in the diagram. To prevent differential rotation between components 3189/3190 and their respective support rings 3193/3197, the support surfaces of the rings may have projections and/or undulations matching indentations or undulations on the corresponding support surfaces of the combustion chamber components. In schematic illustration, FIG. 141 shows elevationally part of a ring having support surface undulations, while FIG. 142 similarly shows part of a ring having projections or nipples which also have fuel delivery tubes.

Figure 143:
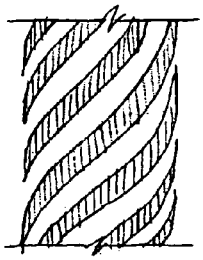
Figure 144:
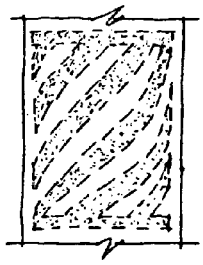

The engines of FIGS. 138, 139 and 140 all show tensile fasteners of circular cross-section arranged parallel to the axis of reciprocation. The fasteners could have any appropriate cross-section, including that of straps or thin strips of sheet, arranged at any angle to the axis of reciprocation. FIG. 143 shows very schematically a system of strap-like fasteners arranged at angle to and constant radius from the axis of reciprocation. In most applications there would have to be a second and corresponding system of fasteners angled either in the opposite direction or parallel to the axis of rotation (not shown). In the case of a housing or casing of cylindrical shape having internal passages, say for cooling fluid, these passages could also run mainly diagonally, as shown very schematically in FIG. 144, and implied by the details and sections of FIG. 138. Similarly, where tubes are used structurally (as in 3192, 3198 in FIG. 420), any apertures in such tubes could be of any shape and/or direction, including diagonally. In the case of straps running on a curve (as illustrated in FIG. 143), or in the case of either thin-wall tubes, or tubes with cut-outs whose primary dimension is not parallel to the axis of reciprocation, then such straps and/or tubes will probably have to be restrained. Usually the most practical form of restraint will be the toroidal combustion chamber components likely to be within them. In acting as such restraint, the combustion chamber components would be loaded in compression radially inwardly toward and more or less perpendicularly to the axis of reciprocation. Therefore, the provision of the straps or the thin-wall or other tubes mentioned immediately above could be used as a design tool to distribute or create desired loadings in the combustion chamber components.

Figure 145:
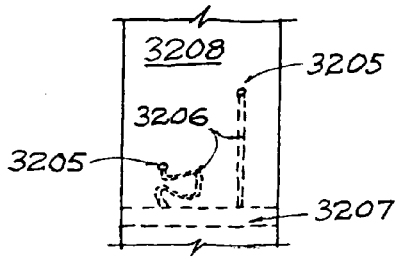

Fuel delivery passages have been generally shown equal to each other and travailing in a series of straight lines. They need not be equal nor be linear. In the case of several fuel delivery points being supplied from a common fuel delivery reservoir or gallery, it may be desirable to have equal delivery path lengths although the delivery points are unequally spaced from the reservoir or gallery. In such case the arrangement of FIG. 145 can be considered, wherein 3205 are fuel delivery points, 3206 equal length passages, 3207 a gallery all arranged within a tube 3208.

The modular combustion chamber layouts of FIGS. 131 through 140 have been designed to be used for engines wherein component assembly 3004 only reciprocates, or it both reciprocates and rotates. According to which, the function of the components such as 3166 to 3169, 3204 attached to the structural elements (such as fasteners, tubes) will vary, either being linked to guide systems or some kind of crankshaft. The combustion chambers are assumed to be of regular toroidal configuration, but the concepts and sections could be applied equally to sinusoidal toroidal combustion chambers, should both compound motion of 3004 and a relatively lightly stressed guide system be desired.

All the components shown in FIGS. 136 through 140 can be constructed of any suitable material. Generally it will be preferred that the combustion chamber components 3155, 3156, 3189, 3190 be of ceramic material, while the fastening or structural components 3164, 3165, 3192, 3198 be of metallic material. Components 3180 (inlet port ring) and 3187 (transfer port ring) could be suitably constructed of ceramic or metal (as well as other material). It will perhaps be preferable for other spacer components to be of ceramic material. For the sake of simplification, the components have been shown abutting each other. In fact, any kind of suitable interlayers or materials could be used (the interlayers are not illustrated generally in FIGS. 136 to 410), including gaskets, ceramic wool, etc. In a selected embodiment, components are coated with a powder, say by electrostatic deposition, prior to assembly, which remains as a very thin spacer between components after final assembly. The composition of the powder may be such as to cause it to slowly bond to one or another of the components with increased engine use, and exposure to heat and cooling.

Figure 134:
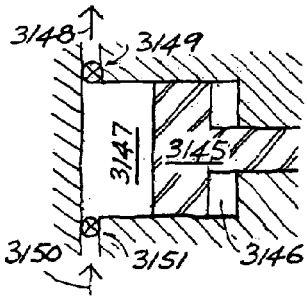
FIG. 134 shows schematically an engine with one toroidal and one conventional chamber.

The different concepts in this disclosure can be combined in any way. For example, any single combustion chamber can be deployed each side of a guide system or a conventional crankshaft. Any combination of combustion chambers can be arranged each side of the above mentioned drive or guide devices, the numbers of the chambers and their configuration not necessarily being the same on each side. In a further example, the combustion chamber grouping of FIG. 94 can be arranged on one side or either side of a different drive system, or a power take-off (FIG. 128). Separate retractable guide systems can be associated with each of the differently sized chambers, either the largest or smallest chamber closest to the drive, to provide engines having three or six toroidal combustion chambers of three different sizes. In a further example, the combustion chamber and pumping chamber combination of FIG. 113 can be arranged on one or both sides of a crankshaft. Generally, it will be sensible to group combustion chambers in coaxial pairs, with each of a pair on opposite sides of a central flange forming part of a reciprocating system, and/or each side of a more or less centrally located guide system(s) or crankshaft(s). However, multiple chambers need not be either equal or coaxial, and could be deployed in any fashion about a crankshaft or other drive or guide system. Where appropriate, "sinusoidal" toroidal chambers may be used (such as are shown in FIGS. 109 through 115, for example), instead of the "regular" toroidal chambers generally illustrated. The "regular" toroidal chambers may be defined as surrounding or containing within them a component which just reciprocates, or which both reciprocates and is caused to rotate by a guide system "Sinusoidal" toroidal chambers may be defined as having opposing surfaces, each of which is not on a straight plane but has a three dimensional form of regular configuration. By regular, it is meant that an entire surface has a form consisting of a sub-form which repeats (but the sub-form may also comprise the whole form in special cases), this sub-form (or whole form) having a wave-like configuration, the wave being defined by the sine curve or any other mathematical formula. Here, wave form is meant to include a series of apexes linked by straight lines or planes. Crankshafts can be used singly in any location or they can be used in multiples, as shown schematically in FIGS. 20 to 32. Toroidal combustion chambers or pumping volumes can be used in combination with non-toroidal combustion or pumping chambers. There need be no crank or guide or any drive system. FIG. 134 shows an arrangement wherein a toroidal combustion chamber 3146 drives a piston 3145 which works a pumping volume 3147. In operation, combustion chamber expansion causes pumped fluid to exit volume 3147 in direction 3148 via non-return valve 3149, and combustion chamber compression is effected by pressure from fluid entering volume 3147 from direction 3150 via non-return valve 3151. (Such a machine could be used to give pressure boost in pipe flows.) Generally in this disclosure, like numbered parts have similar characteristics and/or functions.

Figure 135:
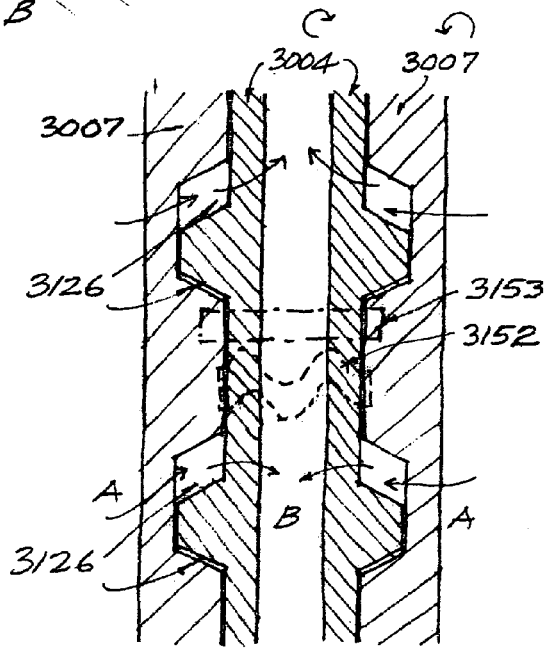

Combustion chambers may be separated (singly or in groups) by mechanical systems other than those described herein. They could include pumps, compressors (both of either toroidal or other configuration), counting devices, speedometer drives, power take-off points, transmissions, clutches, fuel delivery machines or pumps, lubrication machines or pumps, machines or pumps associated with inter-cooling, engines employed to extract additional work out of the exhaust gas (that is, for compounding), etc. FIG. 135 shows schematically, by way of example, two pairs of combustion chambers 3126 separated by both a guide system 3152 and an electric generator/starter motor 3153.

It is well known that the art of cleaning exhaust gases (as opposed to the art of minimizing the formation of pollutants at the point of combustion) is centered around the technique of speeding up chemical reactions normally tending to continue in the exhaust gases at a slow rate, and that this speeding of chemical reaction is achieved by some combination of two basic means, namely the provision of catalytic agents and the encouragement of reactions under conditions of heat and/or pressure. An internal combustion engine generates great heat which is substantially contained in the exhaust gases leaving the combustion chamber. The best way to use this heat to clean the exhaust gases is to either place the exhaust gas treatment volume in the engine or as close to it as possible.

Figure 146:
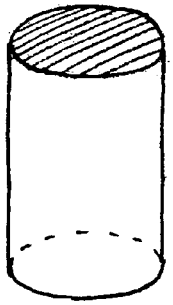
FIGS. 146 to 148 show forms of gas treatment volumes.
Figure 147:
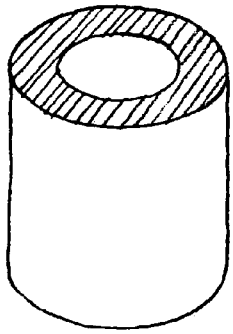
Figure 148:
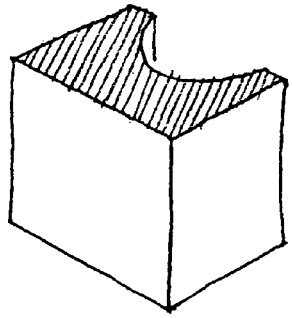

So far in this disclosure, exhaust gas processing volumes of various forms have been shown inside an engine or engine casing. Included are the cylindrical volumes B in FIG. 129 and volume C in FIG. 132—form summarized in FIG. 146 the tubular volumes B in FIGS. 130 and 132 as well as volumes 1008 in FIG. 20 and 1290 in FIG. 21—form summarized in FIG. 147, and the semi-rectangular volumes similar to 1310 in FIG. 75—base form summarized in FIG. 148. These semi-rectangular forms are usually associated with an engine with a rectangular casing or housing, which defines part of the exhaust processing volume. In some applications, the exhaust gas processing volumes, also known as reactors, can be outside the engine or engine casing, in much the same manner as exhaust manifolds are presently attached to engine blocks or cylinder heads. In the disclosure of exhaust gas treatments that follows, many examples illustrated will show externally applied reactors, but the features and principles disclosed may also be applied to reactors or volumes within an engine.

An embodiment are shown by way of example in FIGS. 149 to 151, where the reactor assembly comprises an outer metal casing or chamber 10, an inner casing or chamber 11 of solid ceramic material conforming in shape to the inner surface of the outer casing 10 and a layer of fibrous material 12 interposed between the inner and outer casings. The periphery of both the outer casing 10 and layer of fibrous material 12 are provided, respectively, with flanges 13, having a plurality of aligned apertures through which bolts 15 pass to mount the reactor assembly on an engine 16 so that all the exhaust openings 17 of the engine communicate with the interior of the inner ceramic casing 11. Filamentary material such as nickel chrome alloy is accommodated in the inner casing 11 in two forms, first randomly disposed wire 18, and second a spiral coil 19 of thicker wire mounted adjacent each exhaust opening 17, in order to reduce the velocity of the exhaust gases beyond the opening.

In operation, due to the positioning of the reactor in relation to the engine and the insulation of the reactor's inner surface, the contents of the chamber, ie gases and filamentary material, are maintained at a high temperature, so that the exhaust gases discharged from the engine cylinders continue to react as quickly as possible after entering the ceramic casing 11, thus substantially eliminating unburned hydrocarbons, carbon monoxide, and the oxides of nitrogen of the exhaust gases. In addition, the filamentary material 18 acts as a filter to trap any solid particles in the exhaust gas and induces localized turbulence which pushes the maximum quantity of gas into contact with the hot surfaces of the filamentary material in the shortest possible time.

In order to ensure rapid warm-up of the filamentary material 18 and 19 during cold starting, a valve member 20 is pivotally mounted on a spindle 21 adjacent the discharge end of the reactor assembly. The metal casing 10 and layer of fibrous material 23 of which are provided, respectively, with flanges 22 and 23 which, as shown in FIG. 151, are connected by bolts 24 and retaining nuts 25 to the flange 26 of an exhaust pipe 27 forming part of the exhaust system, say of a vehicle. Under cold starting conditions, the valve 20 is closed either manually or automatically (generally a few cycles after firing commences) by linkage 28, so that the newly fired exhaust gases are retained in the chamber 11 to ensure a rapid temperature rise therein, until a predetermined pressure is reached, whereupon the valve member 20 is opened, at least partially. Conveniently, this may be effected by having the valve 20 biased to a closed position by a torsion spring (not shown), operative only during the cold start procedure, and mounted on a spindle 21 which is diametrically displaced so that the increased pressure in the reactor assembly applies a turning moment to the valve member 20, which commences to open when the moment exceeds the closing force exerted by the spring. A pressure relief valve 40 and passage 41, shown diagrammatically in FIG. 149, may be provided in the chamber anterior to the valve member 20.

The valve at the discharge end of the reactor retains the exhaust gases in the chamber with a consequent rapid rise in the temperature of the filamentary material, which in turn assists in the continued reaction of the trapped gases. A similar, although less intensive, effect is achieved by the partial closure of the valve member, which by the build up of pressure delays the normal passage of the exhaust gases, which thereby remain longer in contact with the filamentary material and heated surfaces and react more completely.

The modified arrangement shown in FIG. 152 is suitable for use with an engine where maximum insulation may not be desired and the firm mounting of filamentary material may be important. In this embodiment, one end of the spiral coil 29 which has a thickened externally threaded base is screwed directly into the exhaust processing volume opening(s) 17. The chamber housing shown partly in section at 42 illustrates an alternative construction comprising an integral ceramic shell, held in position by "L" clamps 43 and bolts 15.

In the modification shown in FIG. 153, if it is necessary to reduce heat transfer from the outgoing exhaust gases to the surrounding engine 16, each opening 17 is provided with a sleeve 30 of ceramic material which has a layer of fibrous material 31 interposed between its outer surface and engine 16. A skin 32 of metal or other material is shown placed within the insulation in order to assist in the reaction process. In FIG. 153 it is shown diagrammatically, but in a selected embodiment, this skin of metal or other material is of no significant thickness and constitutes a film which has been applied by a deposition process, or a leaf (say of similar configuration to gold leaf) applied by pressure and/or adhesive. The film may further be applied to a say ceramic structure by means of depositing the material in powder form on the surface of a mold during the process of manufacturing such ceramic structure. Where this process entails forming under heat and/or pressure, the foreign material will be bonded to the ceramic to substantially form a film.

Catalysts may be associated with the reactor assembly to assist in the removal or transformation of the undesirable constituents in the exhaust gases. The embodiment relating to metal or other films described above shows how a catalyst may be associated with the internal surface of the reactor, but to be properly effective the catalyst should be present throughout the chamber, so that all the gases may be exposed to catalytic action. Catalysts may be incorporated in or with the filamentary material disposed within the chamber. By catalyst is often meant materials with very strong catalytic action such as noble metals like platinum palladium, etc. However, in this disclosure catalyst is meant to be any material having a significant, measurable catalytic effect and thereby is certainly included materials having only moderate catalytic effect, such as nickel, chrome, nickel/chrome alloys, etc. The conventional approach to the provision of catalytic action within exhaust reactor systems involves the placing of strong catalysts such as noble metals in small quantities on a supportive material, such as a ceramic substrate. In a similar manner, the filamentary material may have deposited on it small quantities of another material having catalytic properties. Alternatively, the filamentary material may be constructed of a material which itself has a moderate to good catalytic effect, such as nickel/chrome alloy.

The filamentary material may consist of high temperature metal alloy, such as stainless steel, Iconel, or ceramic material, or polymers, hydrocarbons, resins, silicons, etc. By the term "filamentary material" is meant portions of interconnected material which allow the passage of the gases therethrough and induce turbulence and mixing by changing the directions of travel of portions of the gas relative to each other. Such material conveniently takes the form of random or regularly disposed fibers, strands or wires, but may also take the form of multi-apertured sheet or slab, cast, pressed or stamped three dimensional members having extended surfaces.

The chamber housing may be constructed as already described, ie either from solid ceramic or a multiple layered construction comprising an internal skin of ceramic, an interlayer of fibrous material such as ceramic wool, and an external structural casing of metal. Any suitable high temperature material having good structural and/or insulation characteristics may be employed. The housing may be of composite construction, eg with one layer manufactured inside or outside of another already manufactured layer. In this way, a layer of high temperature resin, having very good insulation qualities but not very resistant to abrasion or corrosion, may be formed outside of a ceramic shell which, because of its hardness and greater temperature tolerance, will be less resistant to attack by the exhaust gases, as more fully described subsequently.

In operation, the device described above will act as a thermal/catalytic exhaust gas reactor, that is to say, it is capable of achieving its objective of hastening the process of reaction by the provision of both a high temperature environment and a catalytic action in the same reactor assembly. For reasons which will be more fully explained later, it is the temperature aspect which is in general more important, ie more effective, and the catalytic action can be said to be, in some applications, an assistance to the temperature-oriented process. It is possible, with basically very clean engines, to envisage depolluting the exhaust gases to the highest standards with negligible or coincident catalytic action. By coincidental is meant that materials having some catalytic effect may be present in contact with the gases for reasons unconnected with catalytic action, that is, they may be the most suitable materials to meet certain design parameters, such as high temperature resistance, etc.

The invention will constitute a very effective thermal reactor. High working temperatures will be attained because of the reactor's close proximity to the exhaust openings, which discharge directly into the reaction volume, and its shape which entails a small external surface in relation to volume, so keeping heat loss to a minimum. The shape of the housing, which can broadly be described as a form of inverted megaphone, and the presence of filamentary material (perhaps of a wool-like configuration) internally, it will act to a significant degree as a muffler. It is known that a muffling effect involves dissipation of sound waves, whose energy is converted to heat, which remains residual in the muffling agent. In this manner, a significant additional build up of heat will occur in the filamentary material and on the walls of the chamber, due to the dissipation of sound waves and also of physical vibration. The main chemical processes, which will be described later, all involve oxidation in part of the reactions, and this generally produces further considerable heat. It is estimated that because of a combination of all or some of the above factors, ambient temperatures in the invention will be higher than at the exhaust opening of an untreated engine. Temperatures drop during idle or low-load conditions, and here the invention will be at an advantage over some other systems, in that a relatively thick ceramic shell will act as a heat sink (as do ceramic linings in many industrial processes) and cause some heat to be radiated inward if the exhaust temperature drops below that of the inside of the housing. This radiation will be directed to maximum advantage because of the rounded or radial cross-sectional form of the housing. Most of the benefits described above will be greater, if the reactor is all or part of an exhaust processing volume contained within an engine.

The beneficial effects of the high ambient temperature are most efficiently exploited in the present invention principally through the provision of filamentary material, which exposes the exhaust gas to a multiplicity of hot surfaces. It is known that for some reason, apparently still not fully understood by thermodynamicists, chemical action more readily takes place in the presence of a heated surface. This phenomenon is distinct from catalytic action, which relates to the nature of materials. Therefore the provision of multiple, closely spaced heated surfaces in the form of filamentary material ensures that every portion of the continuously reacting exhaust gases is in close proximity to a heated surface. Further, the exhaust gases are immediately exposed to such surfaces on leaving the port, when they are at their hottest and most ready to react. The filamentary material has the additional advantage of inducing minor turbulence, causing the various portions of the gases to mix properly with each other, thus helping the reaction process and also causing some heat to be generated by the kinetic energy of gas movement. This turbulence is important for another reason, in that it allows the composition of the gases more readily to "average out." During the process of combustion, different products are formed in the various portions of the cylinder, due to differences in temperature, the variable nature of flame spread, locality of fuel entry and of any spark plug, presence of fuel or carbon on the cylinder walls, etc. Usually these differing products of combustion are mixed to some degree in their passage through the port, but nevertheless pockets of a particular "non-average" gas may persist, and these will not have the proper composition to interact in the desired way. This can occasionally present difficulties, for instance in the long unconnected capillary passages of the honeycomb structures currently used for catalysts, if these are mounted too near the exhaust ports. The nature of the filamentary material of the invention ensures that this proper "averaging out" or intermixing of gas composition takes place.

Catalytic agents of whatever nature and strength are desired can be used, depending on such factors as the efficiency of the thermally assisted reactions, the type and quantity of pollutants that are needed to be removed, durability, the particular additives of the fuel, etc. There has already been described how coatings of catalytic materials may be applied to the various surfaces of the reactor interior. In a selected embodiment the filamentary material itself is manufactured from material having catalytic effects, such as nickel, nickel/chrome, copper, stainless steel, etc. Nickel/chrome alloy is a most suitable material, since it is not too expensive and is relatively resistant to corrosion, abrasion and high temperatures, having a moderate to good catalytic rating. However, at the high ambient temperatures of the invention, nickel/chrome will have formed on its surface films of nickel chrome oxide, which has a catalytic rating considerably better than that of its base. Such material, disposed in filamentary form, will have a strong catalytic effect.

Most catalytic activity has involved placing the catalyst relatively far from the exhaust ports where temperatures have been in roughly the 200° C. to 500° C. range, because the noble metal catalysts, or their method of fixing to base material, or the form of the base material (often honeycomb ceramic) has not been reliable or durable at higher temperatures. It is known that catalytic effectiveness can increase logarithmically with temperature increase, in roughly squared proportion. In other words, doubling the temperature can give around four times the effectiveness, tripling the temperature nine times the effectiveness, etc. Of course, this is an extremely rough guide, there being no such clear cut mathematical progression, much depending on materials and circumstances of reaction. For example, certain catalysts become effective within a relatively small temperature increase and then do not greatly increase effectiveness with further substantial rise in temperature. But in general, catalytic effectiveness increases substantially with increase in temperature, as shown in work of G. L. Bauerle, and K. Nobe (among others) in their paper of September 1970 for Project Clean Air, associated with the University of California. The present invention offers scope for using known catalysts more effectively than ever before, since they will operate in temperatures significantly higher than those currently employed in catalytic practice.

The filamentary material, together with the high ambient temperatures, will ensure that the invention will be exceptionally tolerant of particulate matter and impurities or trace materials. The filamentary material, especially if at least partly of fibrous or wool-like configuration, will to a great extent act as a trap for particulate matter, without the lodging of such matter in the reactor significantly affecting the latter's performance. Certain other systems, such as catalytic honeycomb structures are sensitive to particulate clogging, damage by impurities originating in the fuel or by operator misuse. The vast majority of any particulate matter lodged in the present reactor system, with its exceptionally high ambient temperatures, would decompose, oxidize or otherwise react, especially if deposited on surfaces having catalytic characteristics.

Both in its thermal and catalytic operating modes—which in practice merge to form a homogenous encouragement for matter to combine—the reactor is intended to function in the tri-component or three constituent mode, that is the three principal pollutants are all reduced during their passage through the single device. A broad description of the chemical processes can be found in my U.S. Pat. No. 5,031,401.

The first attempts to solve the emission problems used a thermal approach, because of its many inherent advantages. Work was gradually abandoned because of the great difficulties of the cold-start situation. To be effective the reactors had to be hot; warm up took a considerable time, during which an unacceptable level of pollutants were emitted.

It was to overcome this traditional problem that the cold-start procedure of this disclosure was evolved. A reactor inevitably has a considerable mass, so efforts were made by the applicant to devise a system whereby at least the effective working parts of the reactor attained the desired temperature, rather than the whole assembly, including parts not affected in the reaction process. The surfaces of the present invention are its effective working parts, and almost wholly comprise the internal lining of the housing, consisting of insulating material, and the internally disposed filamentary matter. The insulating material, such as ceramic, may have a low conductivity and therefore will not significantly transmit heat from the interior of the chamber, nor will it need much heat input to heat the surface molecules to the internal ambient temperature. (Because of low conductivity, the surface molecules do not readily conduct heat to adjacent more inwardly disposed molecules). It is for this important reason that the invention has its reaction volume directly enclosed by insulating material. The interior filamentary material essentially has low mass and extended surface area (unlike the heavier baffles or internal chambers of some traditional early reactors). As will be described more fully later, the filamentary matter may be of a wide range of materials, including for example metals and ceramics. If metals are used, their conductivity ensures that heat will be absorbed in heating their entire mass, while in the case of ceramics, for the reasons mentioned in connection with the housing, very little heat would be absorbed in bringing surface temperatures to the required levels. It is important to emphasize that the heated surfaces of the reactor are its effective working parts and that therefore only their surfaces need warm up rapidly.

It is in order to use heat already available from the process of combustion (rather than purposely provided for initial cold start) that the gas exit from the chamber is at least in part closed after firing commences. Calculations have shown that, provided all the newly fired gases can be retained by the chamber, its working surfaces will attain temperatures of roughly 700 C. within between about five and fifty cycles after firing commences, depending on engine type, degree of conductivity of the filamentary material, whether exhaust port insulation is fitted, etc. It has been assumed that the total reaction volume is approximately double the engine capacity and that roughly 500 grams of filamentary material are employed for every two liters engine capacity. At idling speeds of 1 200 rpm, a four-stroke engine would have, according to the above, a warm up period between half a second and five seconds. A contributing factor to the temperature rise is the fact that the gases are maintained under pressure, this pressure soon contributing some load to the pistons, and thereby enabling the engine and especially the combustion volumes to warm up more rapidly.

In a selected embodiment, the reactor gas exit is closed in cold start by mechanical or automatic means after firing has commenced and just prior to the newly fired exhaust gases reaching the closure means, which in the case of four-stroke engines will be somewhere between two and five cycles after firing commences, depending on reactor volume, etc. This allows the residual gases to be expelled, and ensures that all the thermal energy produced by the combustion process and contained in the exhaust gases at the ports is entirely used to heat the working surfaces of the invention, and accounts for its rapid warm up. The newly fired trapped gases are reacting in the desired fashion, but more slowly than they would at normal working temperatures. The fact that they remain much longer in contact with reactor surfaces than they do under normal running high temperature situations compensates for their slow reaction rate and ensures that the first gases are largely pollutant free when they leave the reactor, an important advantage when having to comply with cold-start emissions regulations. The present invention has the unique advantage of producing zero emissions, in fact no exhaust gas whatever, during cold start.

The minimum number of cycles (ie firings) needed to reach reactor operating temperature, and the maximum number of cycles which may elapse before the exit need be closed, are sufficiently near overlap to ensure that the newly fired exhaust gases can be totally contained (ie the closure member be totally closed) for at least a substantial, very possibly the whole part of the cold start procedure, depending on such parameters as engine and reaction construction, volume relationships, etc. In a selected embodiment, the closure member remains wholly closed until a pressure is reached inside the reactor, which is just below that which would cause the engine, which is pumping against reactor pressure, to stall on idling. In use, it is preferred that an engine be not usable during the few seconds of the cold start procedure, since pressure below optimum for warm-up procedure must be adopted if allowance is to be made for possible engine engagement. The reactor pressure limit may be increased by the provision of either manual or automatic special engine setting, such as altered ignition or valve timing, special fuel mixtures, alteration of compression ratio, etc., during the cold start procedure. Once the maximum allowable pressure in the reactor has been reached, the gas exit closure member may either (a) wholly open to release pressure and bring the system to normal running, (b) part open to maintain the pressure, allowing gases to leave the reactor at approximately the same rate as on entry, (c) remain closed while a second closure member wholly or partly opens to relieve or maintain pressure and conduct exhaust gases through a passage other than the normal exhaust system. This alternative is discussed more fully later. Alternative (b) allows the cold start procedure effectively to continue, since the maintenance of reactor volume pressure ensures that the gases spend longer in their passage through the chamber than under normal running conditions, this lengthening of passage time enabling the gases better to transfer heat to the colder reactor surfaces, and to remain in a reacting environment for a more extended period to compensate for colder temperatures, so enabling the anti-pollution reactions substantially to take place. In a similar manner, alternative (c) also allows the cold start procedure to be maintained. In the selected embodiment, the first closure member is fully opened when the desired operational temperature is reached. The resultant pressure drop as normal gas flow rates commence will normally cause an initial surge in engine idling revolutions, giving the operator an audible indication that the engine is ready for work.

It is intended that the features described herein may be used in any convenient combinations.

A basic embodiment involves the placing of an open-sided chamber against the engine block or casing, so eliminating the conventional exhaust manifold. The block therewith forms part of the reactor housing, and as such may play as important a role in the reduction of pollutants as the portions of the reactor assembly so far described, namely the applied housing and the filamentary material. It has been shown how the housing fits directly onto the engine, whether or not this has other features, such as port liners or filamentary spirals. In alternative embodiments, an inter-member may be applied between engine and reactor housing proper, this inter-member either wholly or partly completing the definition of reactor volume. Where a section ceases to be an inter-member and becomes an appendage to the engine is not strictly definable, but in general an inter-member is considered making contact with the periphery of the housing. The various features described, whether in relation to inter-members or attachments to the engine, are intended to be applicable to both, and also where suitable to the periphery of the housing.

The arrangement of the reactor assembly in the manner described affects an art not strictly the subject of the present invention, namely that of exhaust gas flow. This art has for long been associated almost exclusively with the movement of columns or pistons of gas, and in particular with the kinetic energy and pulsing effects which are built up in the regular dimensioned columns of gas. The present invention dispenses entirely with regular tubular configurations in the exhaust system's initial and most important section, with the result that the exhaust gases will flow in a manner previously little explored. Initial research has indicated that the gas flows of the invention present possible benefits. Firstly, the relatively great increase in cross-sectional area of the reaction volume over the total cross-sectional area of the exhaust openings ensures a considerable decrease in the velocity of the gases. The reduced velocity will greatly lengthen the durability factor of at least parts of the reactor assembly, since much wear is caused by the abrasive effect of the fast moving gases and their particulate content. Secondly, the gases from each cylinder or opening meet and merge in the reactor volume, eliminating exhaust pipe branching. Branching is one of the problem areas of conventional exhaust flow art, since it is here that considerable power losses often occur. It is possible by careful design of branches to eliminate much power loss, but usually only within an optimum flow range. When engine speed varies above or below this, power losses increase. Thirdly, the reaction volume will, to a valuable degree, absorb vibration and, as has been mentioned earlier, also sound. Conventional exhaust pipes, with their regular, tubular configuration and metallic construction, may transmit and be the cause of, usually thorough magnification, of much vibration in their own right. The vibrations originating with engine combustion and carried by the exhaust gases will tend to become dissipated by the large volume of gas and filamentary material in the reactor. Although it is useful to place the reactor over a conventional exhaust port opening having a cylindrical shape, it is felt that the sudden transformation of the gas from a columnar configuration to the amorphous flows of the reactor volume, plus the sharp edge of the junction between opening and engine face, will together contribute to an unnecessarily inefficient gas flow and consequent power loss. For this reason, in a selected embodiment the neck of the exhaust opening bells out, that is progressively increases its diameter in some manner, and has been so shown in the sections of FIGS. 151 and 153. This has the beneficial effect of decelerating the rate of gas flow progressively.

In FIG. 154 is shown diagrammatically a housing 51 enclosing a reaction volume 52, both having interposed between them and engine 53 with exhaust opening 54, an inter-member 55 of substantially flat configuration. FIG. 155 shows a similar arrangement, but with the inter-member 55 in association on one side with both engine 53 and an exhaust opening liner 56, which in the embodiment illustrated is restrained in position by the inter-member 55. FIG. 156 shows a similar arrangement to that of FIG. 154, but with the substantially flat inter-member 55 recessed into a corresponding depression 59 in the engine 53, being restrained against the block in the embodiment shown by the enclosed housing 51. In FIG. 157 is shown an arrangement similar to that of FIG. 154 but where the inter-member 58 is of enclosing configuration, that is when viewed in elevation from the reaction volume side it is seen to have a depression 59 defined by a peripheral lip 60, the outline of which corresponds with that of the lip 61 of the enclosed housing 51. A notional plane drawn across the lips will define two sections of the working volume of the reactor, one within the housing at 62, the other within the depression 59, of the inter-member. FIG. 158 shows a broadly similar arrangement, but where the mounting between housing and inter-member is used to support filamentary material 63, which is also shown at 63 in FIG. 155. FIG. 159 shows an arrangement similar to that of FIG. 157, but where the enclosing inter-member 64 has an integral projection 65 on its engine side, in this embodiment of approximately ring or hollow cone like configuration, to act as exhaust opening lining. FIG. 160 illustrates the fixing detail at (A) in FIG. 154, where an L clamp 66 and bolt 67 press the housing 51 to inter-plate 55 and thence to engine 53. Compressible heat resistant material 68 is interposed between the joints to allow for proper sealing, possible differential expansion of the various components, and more even load distribution between possibly marginally mismatched surfaces. FIG. 161 is a detail at (B) of FIG. 156 showing a similar fixing technique, and an alternative embodiment where the inter-plate 55 retains in position an exhaust opening liner 56. FIG. 162 shows a fixing detail suitable for use at (C) in FIG. 158, but retaining a different type of inter-member 69, one which does not substantially mask the engine, but which is part of an effective division of the enclosing housing, the advantages of which are explained below. Here the two portions are shown separately fixed to the block, although in some embodiments only the outer housing need be fixed, depending on detail design. By example, the housing 51 is retained against the inter-member 69, by means of strapping band 70 pivotally attached to winged extensions 71 of a collar 72 mounted on un-threaded portion 73 of a stepped diameter stud 74, by means of nut 75 and washer 76 shown dotted. The inter-member 69 is fixed to the engine 53 by means of the same stud 74, an L clamp 66 and a washer 77 and nut 78 of larger internal diameter than the set 75, 76. Compressible heat resistant sealing material 68 is disposed within the joints between mating surfaces.

The provision of an inter-member may have at least three principal advantages. Most importantly, it offers an opportunity to prevent heat loss from the reaction volume to the engine, since the inter-member can be made of insulating materials such as ceramic, similar to those of the main housing. Secondly, the additional and more conveniently disposed joints between various pieces may be used also to act as supports for additional matter, such as the filamentary material 63 between inter-member and housing in FIG. 158 and between inter-member 55 and block 53 in FIG. 155. Thirdly, the inter-member offers the opportunity of splitting a reaction volume housing whose internal (or external) surface describes a curve of more than 180 degrees in cross-section, so that the portions may be manufactured on a male (or female) mold, a possibly cheap and structurally desirable way of producing the housings. It can be seen, for example that the reactor assembly of FIG. 158 might not be manufactured by molding if it were of integral construction in cross-section. Although in each case only one inter-member has been illustrated, a plurality of inter-members may be used in association with one enclosing housing, or multiple inter-members may be combined to form such a housing.

FIGS. 163 and 164 show diagrammatically by way of examples sectional plan views of reactor housings 79 mounted over the exhaust openings 54 of an engine 53, where depressions 80 have been formed in volume usually occupied by the engine assembly, the space gained by the depression becoming an integral part of the reaction volume 52. In FIG. 163 there is a continuous depression, and in FIG. 164 a series of depressions have been formed about provisions for other features at 81. Apart from the two above examples, space normally occupied by engine may be given over to the reaction volume in any configuration. It is generally desirable to have reaction volumes as large as possible for purposes of exhaust emission treatment, the limiting factors often being lack of under-hood space in vehicles and the cost of providing greater and stronger reactor housings. In the case of the present invention, reaction volumes may be increased without any sacrifice of under-hood space or increase of housing size and cost, by the procedure of "hollowing" into the engine. The degree to which this will be possible will depend on such factors as whether an engine is especially designed to accommodate the invention or not. Hollowing into the engine is a means to allow more progressively shaped reaction volumes and more efficient and smooth gas flows to be achieved.

Figure 165:
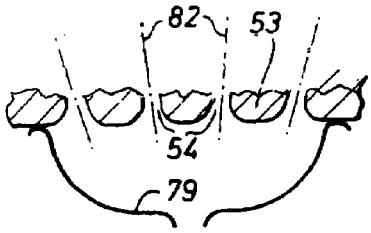
FIGS. 165 and 166 show arrangements of the axes of exhaust port openings.
Figure 166:
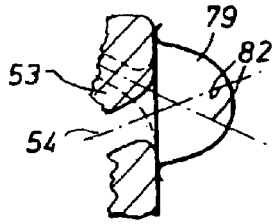

FIG. 165 shows by way of example a diagrammatic sectional plan view of a reactor housing 79 mounted on an engine 53, having exhaust openings 54 whose axes 82 are not parallel to one another and/or not perpendicular to the engine face, while FIG. 166 shows a similar arrangement in vertical cross-section. It is important that the exhaust gases distribute themselves as evenly as possible within the chamber so that the factor of time, multiplied by the area of surface exposed is as equal as possible for the gases from differing openings, and that such wear and/or loading caused by abrasion, corrosion and gas velocity is as evenly distributed within the reactor as possible. This optimum equaling out effect may be achieved, among other means, by angling the flow from each opening in the most suitable directions, which will often involve opening axis layouts along the lines of the example described by FIGS. 165 and 166. In a selected embodiment, the end opening axes are furthest angled from the perpendicular to engine axis in plan view and the central opening axes furthest from the perpendicular in vertical cross-sectional view, which will enable the gases to more readily travel the same distance to the reactor gas exit. Below is mentioned an alternative or complimentary means of better distributing gas flow.

It has been seen in the basic embodiment, described above, that filamentary material may be introduced in the exhaust opening area, both to assist in the process of reaction and/or to properly direct the flow of exhaust gases. The control of gas flow may be achieved by providing members of substantially vaned, honeycombed or flanged configuration within the opening, such members being manufactured of any suitable material such as metal or ceramic, but according to current technology are preferably made of metals having catalytic effect such as nickel/chrome alloy, if the gas flow directors are desired to significantly assist in the reaction process. The particular embodiments of filamentary material suitable for exhaust opening areas, with their relatively restricted cross-sectional areas and high gas flow rates (compared to those of the reaction chamber itself), are those where the material does not have significantly great cross-sectional area, which would cause obstruction to the gas flow past the material. However, any configuration of filamentary material may be employed in the opening area, including the various embodiments described subsequently, especially if it is intended to utilize the material to assist in the reaction process.

Figure 167:
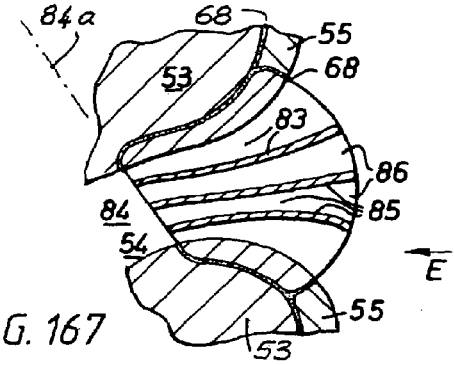
FIGS. 167 to 172 describe means of directing exhaust gas flow.
Figure 168:
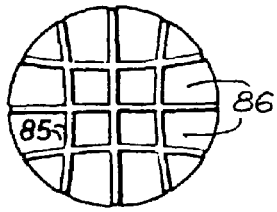
Figure 169:
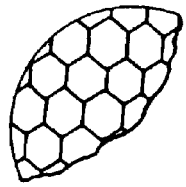
Figure 170:
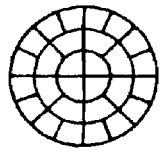
Figure 171:
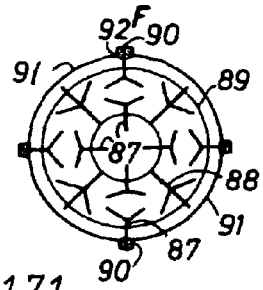
Figure 172:
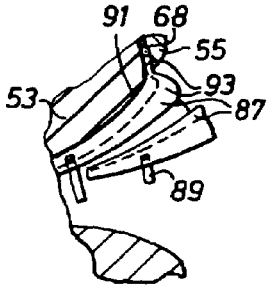

By way of example, there is shown in FIG. 167 in cross-sectional view and in FIG. 168 which is a front elevational view as seen from E, an exhaust opening liner combined with honeycomb configuration gas flow director 83 held in position against engine 53 by inter-member 55. There is a heat resistant compressible material 68 between the joints. Inside the opening 54, the greater mass of gas will be concentrated toward the outside of the curve at 84, and therefore the honeycomb structure has at the end facing the gases a diagonal face 84*a* across the opening as shown, so that whatever frontal area the honeycomb vanes 85 have will cause the gases by deflection to pass through the structure more evenly distributed. With progression of gas flow the vanes become more mutually further spaced, so reducing gas velocity, and curve away from each other, so that the mouths 86 of the structure will direct the gases in a multiplicity of directions. The honeycomb structure may be of any suitable cross-sectional configuration, including by way of example, that of FIG. 169, where the passages have six faces, or that of FIG. 170, where the passages are formed by the intersection of radial and coaxial membranes. In an alternative embodiment, gas flow is directed by flanged members running part of the length of the exhaust opening, as shown by way of example in an embodiment illustrated in sectional plan view FIG. 171 and in partial cross-section in FIG. 172. The flanged members are alternatively "Y" shaped configuration at 87 and of roughly cruciform configuration at 88, and are spaced and held from each other by spacer rings 89 disposed at intervals along the length of the assembly. The flanged assembly of the illustrated embodiment is retained by fitment into grooves 90 in the opening surround 91, such grooves optionally containing a compressible bed 92 at F in FIG. 171 and are held against 53 by inter-member 55 sandwiching the bent extension of flanges as at 93 through compressible material 68.

It may be desired to impart a rotating motion or swirl to the exhaust gases during their passage through the openings, so as to assist in the proper mixing of gases within the reactor volume.

Figure 173:
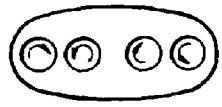
FIGS. 173 to 176 describe means of imparting swirl to exhaust gases.
Figure 175:
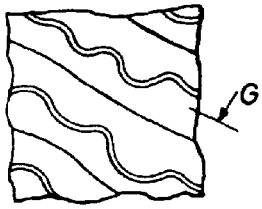
Figure 176:
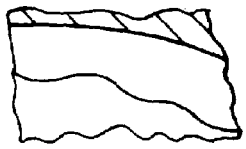
Figure 174:
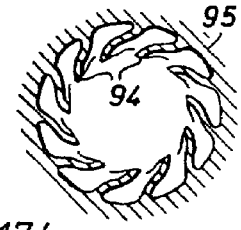

To this end, successive openings may have alternating directions of swirl, as indicated diagrammatically in FIG. 173. The swirl may be imparted by vaned members disposed diagonally across the axis of gas flow. The vanes may be placed anywhere within the opening area but in a selected embodiment illustrated diagrammatically in FIG. 174, the vanes 94 project from and are integral with the exhaust opening wall or lining 95. If it is desired to introduce some turbulence as well as swirl to the gases, the individual vanes may be of waving configuration, as shown by way of example elevationally in FIG. 175, and in FIG. 176 in a sectional plan view through G of FIG. 175.

Figure 177:
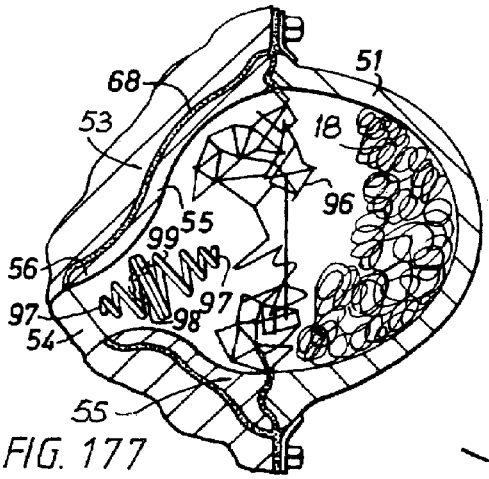
FIG. 177 illustrates a selected embodiment.

All the features described herein may be combined in any convenient or desired way. By way of example, FIG. 177 shows a selected embodiment in cross-section. The reaction volume is enclosed by an inter-member 55 of ceramic material having projections comprising exhaust opening liners 56 and spaced from engine by compressible heat resistant material 68 such as ceramic wool, together with an enclosing housing 51 of integral ceramic construction. The joint between the two principal enclosing members supports a filamentary space frame 96 that is a construction of short straight metal rods connected to each other at different angles, which substantially fills the foremost part of the reaction volume, the rearmost portion of which is occupied by filamentary material 18 of wool-like configuration, of say a ceramic based compound. Within the exhaust port area are two metal cone shaped spirals mounted back to back with projecting bayonet fixings shown dotted at 98, which locate in grooves 99 running from initial entry away from the direction of the exhaust valve, so that the pressure of gas flow will cause the spring projections or bayonets to seat at the end of the grooves.

Filamentary material is defined as portions of interconnected material which allow the passage of gases therethrough and induce turbulence and mixing by changing the directions of travel of portions of gas relative to each other. By interconnected is meant not only integral or continuous, but also intermeshing or inter-fitting while not necessarily touching. The above definition is applied to material within the reactor as a whole, not necessarily to the individual portions of that material. It is especially envisaged that in its most effective form the filamentary material in one reactor will consist of sections of varying composition. The three main classes of filamentary material may be said to comprise slab or sheet material, wire, and wool, listed in order of progressively less resistance to abrasion and shock, provided of the same material. Therefore it is logical to place the more robust forms nearer the exhaust openings, with the more fragile embodiments toward the rear of the reactor. If catalytic effect is desired, then the most suitable materials may be best incorporated in a particular form, this form being such that it is most suited to be placed in a particular portion of the reactor. It is possible that more than one catalyst is desired and these may be incorporated in positions most suitable to their differing forms. The main chemical reactions tend to take place in a certain sequence and, if special catalytic assistance is desired for a particular reaction, that catalyst in combination with the most suited form of filamentary material may be placed in that area of the chamber where the reaction is most likely to occur. For example, if the reaction in question is expected to be the last to take place, then the appropriate catalyst/filamentary matter will be disposed in the rear half of the reactor, furthest from the exhaust openings. The definition of filamentary material is meant to apply to that within the reactor as a whole, and not necessarily to each of the possibly many varied components that may make up one reactor filamentary assembly. The various embodiments of filamentary material described may be combined in any convenient manner within a single reactor assembly.

Figure 178:
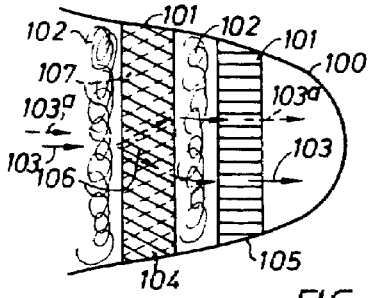
FIGS. 178 and 179 describe honeycomb and wool filamentary construction.
Figure 179:
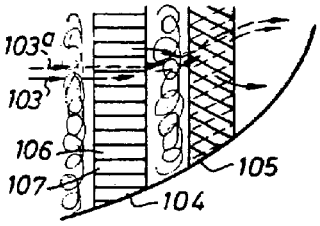

By way of example, an embodiment is shown cross-sectionally in FIG. 178 and in part sectional plan view in FIG. 179, wherein alternate slabs of honeycomb structure 101 and wool-like layers 102 make up at least the rear portion of a reactor 100. The path of a certain pocket of gas through the system is indicated in each view by the arrows 103. It will be noted that the honeycomb is not of conventional form, since it consists of passages with each stack or row of passages running in a different direction from the adjacent row. In the first honeycomb slab 104, the passages shown in section 106 run "downwards" while the passage immediately behind, shown dotted at 107, are running "upwards," with the separation of direction and therefore of gas flow taking place substantially in the vertical plane. The next honeycomb slab, 105 is of the same construction but placed turned through ninety degrees, so that the separation of gas flow is substantially in the horizontal plane. In this way the different portions of gas are properly intermixed, as can be shown by the path 103*a*, shown by dotted arrows, of a gas pocket starting adjacent to the first pocket and, in its path through the assembly, becoming widely separated from it. Although an individual honeycomb passage does not induce turbulence, the disposition of passages relative to each other can do so within one honeycomb structure, as may the provision of a succession of honeycomb configurations placed one behind the other.

Figure 180:
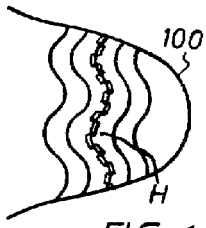
FIGS. 180 and 181 describe expanded metal or metal mesh construction.
Figure 181:
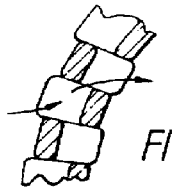

A form of filamentary material, not strictly wire or slab, which may be successfully employed in the invention is expanded metal or metal mesh. By way of example FIG. 180 shows in diagrammatic sectional view how sheets of metal mesh formed into wavelike configuration are placed one behind another inside a reactor 100, while FIG. 181 is a detail enlargement at H showing construction of the mesh. Mesh is usually formed by a combination of pressing and tearing sheet, processes which tend to leave sharp edges. Because materials are less resistant to heat, abrasion and corrosion when they are not smooth and rounded, the mesh used should preferably be subjected to sandblasting or other smoothing process after forming. Metal mesh is a known product and could readily be manufactured of catalytically active metals. The particular forms described may also, because of their inherent suitability to the invention, be manufactured of non-metallic materials such as ceramic, possibly by alternative forming means.

Filamentary material in wool-like or fibrous configuration is especially advantageous, because of its ratio of high surface area to mass and because it will more readily act as a particulate trap. Catalytic agents may be deposited on surfaces, for example by precipitation or deposition processes including those involving immersion in solutions or other fluids. If the material itself is to have catalytic effect, it will most readily be manufactured of metal, to which the considerations above will apply. It should in the interest of durability be as smooth and rounded as possible, the wool preferably consisting of multiple fine regulation wire, woven, knitted, layered or randomly disposed. If the wool is composed of say fibers or strands of such materials as ceramic glass, this will be more temperature, abrasion and corrosion resistant than metals, but will be more susceptible to "flaking," that is particles or whiskers becoming detached from the general mass by the force of the gas flow, to perhaps lodge in a sensitive area downstream, such as a valve. For this reason it is preferred that wools are placed in the sections of the reactor most suitable to them, in the case of metals rearward away from the full heat and force of the gases, and in the case of ceramic fibers distanced from the gas exit. Alternatively and preferably, wools should be sandwiched or contained by other forms of filamentary material, for example as in FIG. 178.

Figure 182:
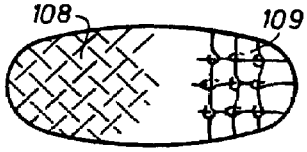
FIG. 182 describes woven and kiiitted wire.
Figure 183:
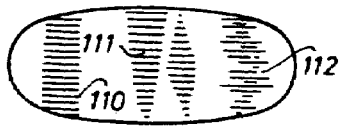
FIGS. 183 to 185 describe wire spiral construction.
Figure 184:
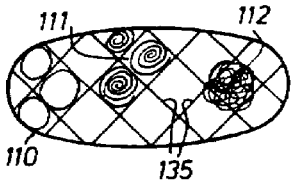
Figure 185:
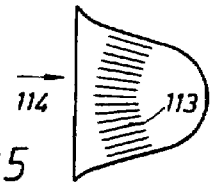
Figure 188:
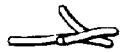
Figure 186:
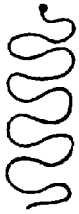
Figure 187:
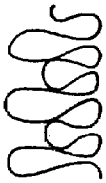
Figure 190:
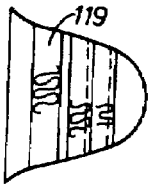
Figure 191:
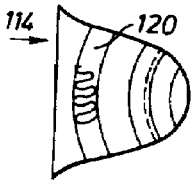
Figure 192:
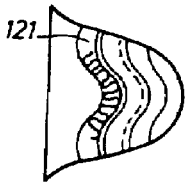
Figures 189, 193, 194, 195, 196, 197, 198, 199, 200, 201, 202, 203, 204, 205, 206, 207, 208, 209, 210, 211, 212, 213, 214:
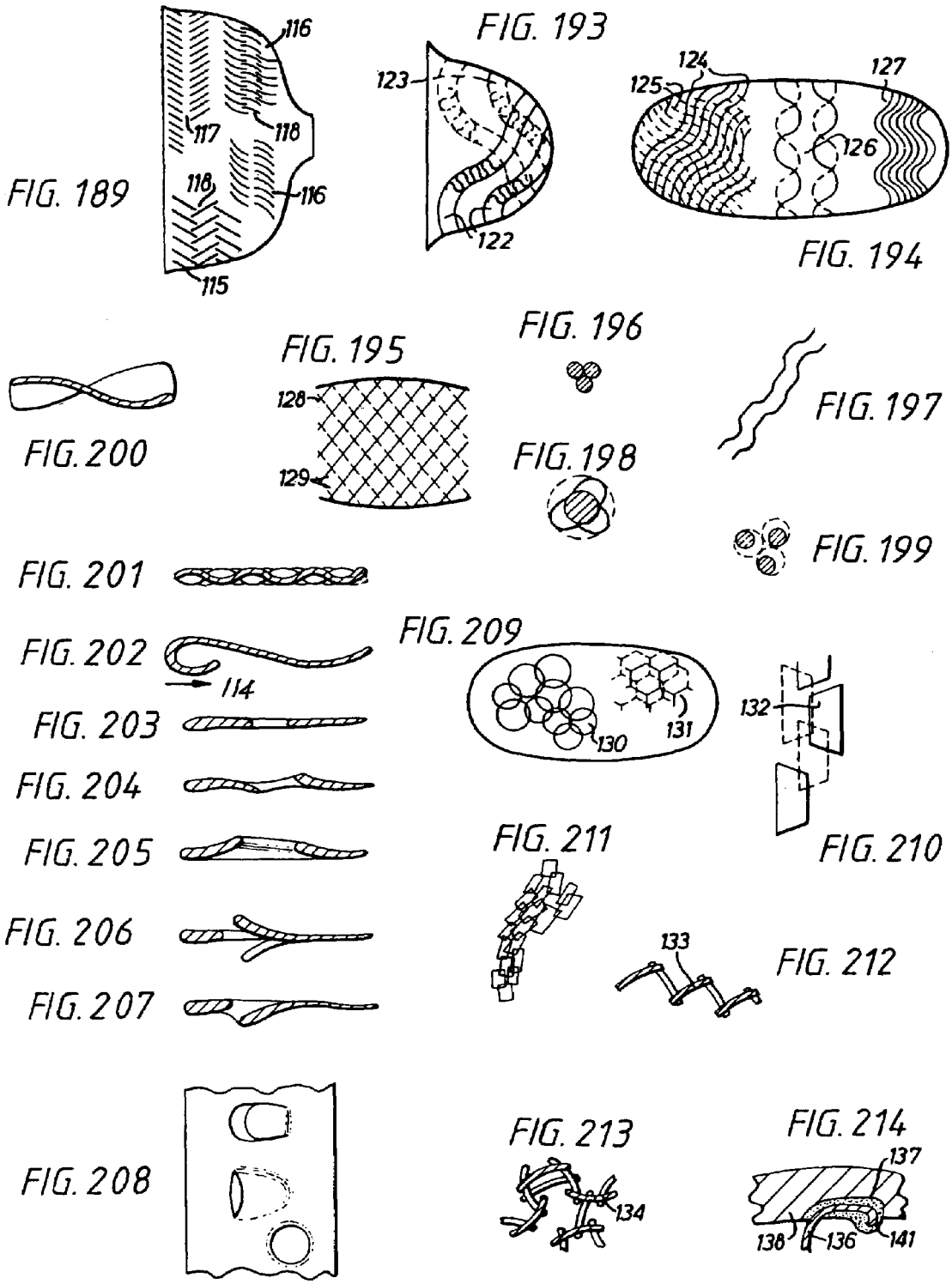

Another appropriate form of filamentary material is wire, especially since in the case of metals it is almost always readily available in that form and need only be bent or otherwise formed to any desired shape. For reasons of durability, the wire deployed generally needs to be thicker nearer the exhaust gas source than elsewhere in the reactor. The wire may be woven 108 or knitted 109 into a mesh as illustrated diagrammatically in elevational section in FIG. 182. It is preferable to devise a deployment of wire which avoids normal contact between strands, because the vibration of some internal combustion engines will tend to cause attrition at the point of connection, perhaps resulting in premature failure. Therefore the wire should preferably be arranged in forms to enable a relatively great length (ie surface area which is assisting reaction) to be incorporated in the overall restricted area of the housing, with the various portions of wire having minimum contact. It is expected that some contact will take place between wires spaced close together but not touching, but this contact should preferably not be regular, although its occurrence during freak vibration period or operating modes should not materially affect durability. An obviously suitable way of deploying the wire is in the form of spirals or coils, shown diagrammatically in elevation with axis disposed perpendicular to the flow of gas in FIG. 183, and disposed coaxially with the flow of gas in FIG. 184. By way of example, spirals having regular coils of equal diameter are shown at 110, while those having regular coils of progressively varying diameter are shown at 111, and spirals having irregular coils, that is of non-circular configuration and/or random diameter at 112. The three configurations comprise spirals having axes of substantially straight line configuration. FIG. 185 shows in diagrammatic cross-section spirals 113 having curved axes, here arched to better withstand force of gas flow from direction 114. Any of the spiral types mentioned previously may have curved axes. The wire may also be disposed in two or three dimensional snake-like configuration. Such a two dimensional form is shown by way of example diagrammatically in elevation in FIG. 186, while a three dimensional form is similarly shown in elevation in FIG. 187 and plan view in FIG. 188. Such forms may be disposed within a reactor in any number of ways, as for example shown in diagrammatic sectional plan view in FIG. 189, where flat "snakes" 115 and curved "snakes" 116 (each snake comprising wire looped in the plane indicated) are stacked next to each other and behind each other, either spaced as at 117 or intermeshing as at 118. These stacks of loops or curves may also be randomly placed (not illustrated). FIG. 190 shows diagrammatically how the plane of curves 119 may be straight, or as in FIG. 191, curved as at 120, to withstand gas flow from 114, or as in FIG. 192 curved as at 121 to provide a more ready and natural path for the gas flow. FIG. 193 shows in similar view how the planes of snake-like loops or curves, whether curved as shown or straight, may themselves intermesh past each other in any one or more dimensions, where the planes in solid line 122 are in the foreground and planes shown in dotted line 123 in the background. FIG. 194 shows in diagrammatic sectional elevation how the planes of curves, as viewed head on, may intermesh in other ways, where 124 are planes shown solid in end elevation (here curved in a third dimension, although they may be straight) slanting across the path of planes behind shown dotted 125 running in other directions. Alternatively, their curvature in the third dimension may be non-coincidental, as shown at 126, while at 127 is shown how the curves in the third dimension allow for the close stacking of these planes. Conveniently, the planes span the shorter dimensions as shown, but they may also span the longer dimension. Alternatively, the wire may simply be disposed in strands across the reactor, as shown by way of example in diagrammatic elevation in FIG. 195, where wires in the foreground are shown solid 128 and those behind dotted at 129. To assist in the elimination of sympathetic vibration, the various strands may be not quite parallel, that is they could be at a slight angle to one another (not illustrated). Generally, because the strands of the latter configurations may be arranged to be in tension, they need be of thinner configuration than the largely self-supporting structures such as spirals or snake-like loops. Wherever wire is herein described it is meant to comprise either a single strand, or multiple strands, as for example in diagrammatic section FIG. 196. Because the material preferably exposes the maximum surface to the flowing gases, it may be desired to separate the individual strands of the wires to allow gas to flow through and past each strand, but to simultaneously still allow the separate strands to a degree support each other. Conventional separators may be employed, eg of ceramic, but in another embodiment the individual wire is crimped, that is minutely and closely bent in all directions, as shown elevationally in FIG. 197. As can be seen in cross-section FIG. 198, the wire effectively occupies a greater diameter, shown dotted, than its real thickness, resulting in the composite wire of FIG. 199. Fixing of wire and other filamentary material to reactor housing will be described later.

The filamentary material may further comprise sheet or slab, and in a simple form may be described as a plane having some thickness, in the same way as did the series of snaked wire loops. These planes may be disposed within the reactor in much the same way as were those of the wire loops as described above. For example, the planes may comprise long sheets, straight or curved and be disposed as illustrated diagrammatically in FIGS. 189 to 194. Such sheets may further have a form of simple alternate wave as shown in diagrammatic cross-section in FIG. 200, or a more complex waved or dimpled form as in FIG. 201. Alternatively, the sheet may have a sharply curved or crooked cross-section, as in FIG. 202, to present a greater frontal area to gas flow 114. The sheet may further be in the form of holed fins or vanes as in cross-sectional FIG. 203 preferably having a thicker, more rounded section toward the side facing the gas flow 114. The holes in the sheet may have pressed projecting lip or lips, as shown in FIGS. 204 and 205, or the holes may comprise apertures formed by punching, pressing and/or tearing, without significant removal of material, as shown for instance in cross-sectional view in FIGS. 206 and 207. FIG. 208, showing a part elevation of such a sheet, illustrates diagrammatically examples of forms of holes or pressed/torn apertures. Again, preferably sharp edges are removed after forming by blasting or other means. The sheet or slab may be formed into three dimensional interlocking or intermeshing forms, as shown by way of example in sectional elevation FIG. 209, where 130 describes a series of interlocking rings and 131*a* series of interlocking hexagons. FIG. 210 is a diagrammatic cross-section showing by way of example a pattern of interlocking here using conical rings 132. FIG. 211 similarly shows interlocking means, but here the overall form is curved rather than linear. FIG. 212 shows in diagrammatic cross-section how individual sheets 133 interlock to make up a three dimensional form, while FIG. 213 similarly shows the employment to this end of curved sheets 134.

The filamentary material may be fitted to the housing in a number of ways. Both sheet or slab 139 and wire 136, whether part of looped or spiral forms, or as in FIG. 184, wires 135 acting as structure supports, may lodge in recesses 137 in the housing 138 as in detail section FIG. 214, or may be gripped by protrusions 140 as shown in detail section FIG. 215 and plan FIG. 216. Compressible material 141 may be interposed between filamentary matter and housing to prevent attrition through vibration. Alternatively, sectional plan FIG. 217 and elevation FIG. 218 shows how sheet 139 may be connected by linking members 142 which in turn affix to housing 138 along the lines illustrated in FIGS. 214 and 215. However, if the sheet is of suitable material such as ceramic, it may be incorporated into the housing during the manufacturing process of the latter. By way of example, sectional plan FIG. 219 and elevation FIG. 220 show how slab 139 having appropriate, preferably holed, linking members 142 is integrated with housing 138, by means of the shrinking during formation of the housing in still malleable form upon the pre-formed prior-positioned interlinked slab assembly. Such a technique is considered especially viable where both filamentary material and housing are to be formed of ceramic.

The filamentary material may further be in the form of pellets, preferably in spherical form, or occupying a theoretically spherical form Pellets are known in the art, comprising small regularly surfaced globes. In alternative embodiments the pellets may be of irregular semi-ovaloid form as in FIG. 221, or of roughly kidney or bean-like configuration as in FIG. 222. However, it is preferred, so that most advantageous ratio of surface area to mass may be obtained, that the pellet comprises a form consisting of a series of projections and depressions, this form most conveniently having an overall spherical aspect, and configured so that preferably the projection of one pellet may not too easily fit into the depression of another pellet. If such inter-fitment is kept to minimum, it will ensure that the pellets are not tightly against one another, and so ensure a proper easy gas flow about and between the pellets. FIG. 223 shows in sectional elevation by way of example such a form, having four equally spaced projections 390 radiating from a central core of roughly mushroom or bulb-like configuration. (Forms similar to this are used in concrete blocks for breakwater construction.) The same principles might be applied to a pellet having a greater number of projections as shown diagrammatically in FIG. 224, or having a multiplicity of projecting vanes, preferably disposed at angles to one another to better space adjacent pellets from one another, as shown in FIG. 225. In FIG. 226, the pellet may consist in a sphere having substantial snake-like depressions of rounded cross-section disposed in its surface. An embodiment similar to that of FIG. 223 is shown in FIG. 227, where the projections 391 are of more pronounced mushroom-like shape. Such pellet-like material will assume its most possibly compacted form under vibration, rather than when being fitted. To ensure that the pellets remain, after initial settlement, in a basically constant physical relationship to each other (rather than excessively move about and so wear more rapidly) the pellets are best subjected to some continuous pressure. This can, for example, be achieved by mounting pellets between filamentary material of wool and/or wire configuration. For example in cross-section FIG. 228, a housing 392 encloses pellets 393 adjacent to wool 394, in turn adjacent to wire 395.

The filamentary material may further have an ablative effect, that is its decomposition may be desired and controlled, in this case to contribute therewith to the desired reaction process. A material may be used resulting in the filamentary matter having a deliberately limited life span and providing within the reactor a compound which will react with the pollutants and/or gases under certain conditions.

It has been seen earlier that, for the cold start operation to be effective, the gas exit valve must be closed for as long a period as possible, the so far limiting factor being the amount of pressure attainable in the reactor without stalling the engine. In some cases, when the reactor has exceptionally rapid warm up characteristics, it will not be difficult to keep the valve closed until the threshold of operating temperature is reached. With other systems it will be more difficult, if not impossible. In such cases, it may not be advantageous to partly open the gas exit thereby maintaining the pressure, since the gases emerging will only be partly de-polluted. As an optional alternative, it is proposed that there be fitted to the reactor a passage communicating with an exhaust gas reservoir, and that there, optionally, be a second independent closure means between reactor and reservoir, preferably near the junction of passage and reactor. In operation, when the acceptable level of pressure in the reactor is reached (including a pressure no greater than atmospheric), the gases pass through the passage, either because there is no obstruction or because the obstruction to the reservoir has been removed. Once reactor warm up temperature is attained the flow of exhaust gas to reservoir would substantially cease. The gases are then expelled from the reservoir by any means, but preferably during the operation of the engine while warm, either to the engine intake system and be recirculated through the combustion process, or to the reactor which, being warm, would satisfactorily process them. Because the gases are always continually reacting, however slowly, it is likely that they would become significantly pollutant-free during their sojourn in passages and reservoir. The period of this sojourn is likely to be many times greater, perhaps more than a hundredfold, than the duration of gas passage through the reactor during normal operation.

By way of example, FIG. 229 shows in diagrammatic sectional elevation, the engine compartment 152 of a motor vehicle 153 fitted with the reactor 151 of the invention, to which is coupled an expansible exhaust gas reservoir 150. FIG. 230 comprises a frontal sectional elevation, wherein the left half shows the reservoir expanded and filled with exhaust gas, and the right half the reservoir reduced and relatively empty. Above the reactor 151 is an inlet manifold 154. The reservoir 150 comprises a folding bellows member 158 mounted on a base 159, the bellows having at the end opposite the base (the lower end) an integral T-shaped stiffening member 160, which communicates at each end rigidly by means of triangulation members 161 to a slidable guide 162 mounted on a vertical rail 163. The bottom of each guide communicates with a compression spring 164, in turn communicating with the lower part of the vehicle structure 165. From a junction 167 upstream of the main reactor gas exit valve 166, a passage 168 communicates with the reservoir base 159, and from this base a second passage 169 in turn communicates with the inlet manifold 154. The reservoir is in the position shown so that in normal use, that is when retracted and empty, it occupies a relatively protected position, as shown in the right half of FIG. 230.

In operation, after the main valve 166 has closed and junction valve 167 has opened, exhaust gas will travel down the passage 168 to fill the reservoir 150. A build up of pressure will be caused because the reservoir can only expand against the force of springs 164. The communication between the reservoir and inlet manifold being unobstructed, the gas will escape into the manifold at a rate in proportion to the size of opening and pressure in the reservoir. When the reservoir reaches a point near the limit of its downward expansion (allowance being made for safety margins) the main valve 166 opens, either partly, to maintain pressure if full operating temperature has not been reached, or fully. In the embodiment the aperture between passage 169 and inlet manifold is made very small so that, even under the maximum designed pressure of the exhaust reservoir system 170, the rate of gas flow into the manifold is very low in proportion to flow produced through the exhaust ports, thereby giving a very reduced rate of exhaust gas re-circulation. After the reservoir has been filled and gases diverted down the normal exhaust system, the loading of the springs 164 will ensure the slow collapse of the bellows 158 and the continuing bleeding of gas into the inlet system until the reservoir has been emptied. The provision of a second valve communicating with passage 168 may in some configurations be omitted by the provision of a relatively small opening between reactor and passage at junction 167, the opening being of many times smaller cross-sectional area than the main exhaust pipe 170. The smallness of opening will restrict gas flow from reactor during the initial stages of warm-up and main valve 166 closure, until the higher pressure in the reactor accelerates the rate of gas flow along passage 168 to more rapidly fill up the reservoir. The non-closure of the small opening at 167 will ensure that the exhaust gases will effectively be re-circulated to the reactor once normal warm operation commences. Depending on the strength of reservoir springs 164, the gas flow rates back through the opening will be lower than those into the reservoir, since the pumping action of the engine must necessarily have considerable greater force than spring action. If it is considered that the gases diverted to the reservoir system have not sufficiently reacted by the time they re-enter the reactor, then catalytic material may be associated with the reservoir, or its internally faced components and/or those of passages 168, 169, or they may be fabricated of a material having catalytic action, such as copper or nickel. Alternatively or additionally, junction 167 may be placed as closely as possible to the exhaust openings, so that the returning gases travel through a substantial portion of the now warm and fully operative reactor. The reservoir assembly may be made of any suitable materials, which to a degree will need to be heat tolerant. If the chosen materials have low heat tolerance, then optional heat dispersal means may be affixed to passage or pipe 168, as shown diagrammatically at 171. If materials are heat resistant, as for example would be a bellows assembly made in silicone rubber, then insulating means may be incorporated on the passages, as shown diagrammatically at 172, with the advantage that the gases may be maintained in the reservoir at warmer temperatures, thereby speeding up reaction processes. The warmth of the gases may be used to advantage in another configuration, where the gases are re-circulated to the intake system. The provisions of this flow of warm gas during cold start—as has been shown above, the reactor may be operative to a degree already from a few cycles after firing commences—will assist in vaporization of fuel during engine warm up. In normal usage, the gases will not at inlet entry point be hot enough to present risk of premature fuel combustion. Optionally, a valve 155 may be provided between reservoir and inlet system to regulate circulation.

The valve construction presents possible problems, since it needs to be tolerant of the very high temperatures and abrasive qualities of exhaust gas, preferably for the full life of the engine. A range of suitable high temperature materials, including ceramics or nickel alloys, are described in more detail subsequently. Described here, by way of example, are certain methods of valve construction which entail easy service in the event of need for replacement or maintenance, and which are capable of providing proper sealing, optional diversion of gases to storage or re-circulation, and some tolerance of particles or whiskers from any filamentary material. The principal feature of the major embodiments described, is that the joint or flange between two principal components coincides with the valve axis, enabling valve and spindle to be manufactured as an integral unit and fitted when the two components are mated up, this configuration being particularly suited to butterfly valves.

FIG. 231 shows by way of example in diagrammatic plan view a reactor component 180 having at its junction with exhaust pipe 181 the main gas exit valve 182, while FIG. 232 similarly shows a reactor component 180 having between exhaust pipe 181 and main valve 182 an intermediate section 183 having, at its junction with passage 184 communicating with re-circulation system, an optional secondary valve 185. FIGS. 233 to 237 show details of the valve 182 of FIG. 231, where FIG. 233 is a sectional view along K, FIG. 234 an enlarged plan view, FIG. 235 an elevation at L, FIGS. 236 and 237 details at the joint between sections. Manufactured integrally with spindle 186 and actuating lever 187*a* is a butterfly diaphragm 187 of biased oval configuration, having one section 188 of greater surface area than the other 189, so that the valve will tend to fail-safe in the open position. The cross section of the exhaust pipe 181 and reactor component near the joint is substantially of similar oval configuration to valve. Both major sections have their jointing at integral flanges 190, which are linked with coincident hollow load distributor ridges 191, through which pass the bolts 192, washers 193 and nuts 194 holding the two components together under compression, separated by compressible material 195 preferably in two separate layers passing each side of the spindle 186. This is shown in detail cross-section FIG. 237 through spindle at its passage between the two major components 180 and 181. Preferably the components and spindle should have mating curves of non-coincident centers when assembled, so as to provide a stronger pinching effect in the area of joint 196 where the seal can be expected to be weakest. The slight internal projection of the twin layered compressible material 195, as shown in part section FIG. 236, will assist in the proper location and sealing effect of the diaphragm 187 when in the closed position.

FIG. 238 shows by way of example a diagrammatic sectional plan of the arrangement of FIG. 232 where the optional secondary valve is in the form of a pressure sensitive plug 197 and compression spring 198 assembly, and where a honeycomb structure 199 is located by the junction of intermediate section 183 to reactor 180, in order to act substantially as a fiber or strand trap. FIG. 239 shows a similar detail elevational plan view, wherein the passage 184 is joined to intermediate member 183 by at least two assemblies comprising two coincident hollow load-distributor ridges 191 and bolts 192, washers 193 and nuts 194, while the exhaust pipe 181 is connected to reactor 180 through the intermediate section 183 by means of assemblies 200 comprising three coincident load distributor ridges and associated fasteners. FIG. 240 shows diagrammatically in longitudinal cross-section a hollow ball valve in the open position fitted in the joint between two components, where 201 comprises the "ball" with its integral spindle 202 and actuating lever 203, with 204 the main exhaust passage, 205 the seals, 206 an optional secondary passage allowing exhaust re-circulation means during cold start, 180 the reactor housing and 181 the exhaust pipe, with the joint between the two shown dotted at 207. FIG. 241 shows in similar sectional plan view the above arrangements with the valve in the closed position, allowing the secondary passage 206 to communicate into the main passage 204, which in turn communicates with an aperture 208 leading to exhaust gas re-circulation means.

It is desirable to make the valve actuating means as simple and as fail-safe as possible. To this end, the valve should be spring loaded (not locked by mechanical action) in the closed position in such a way that reactor pressure over the designed limit will overcome the force of the spring sufficiently to allow some gas to escape, thereby again lowering pressure to below that required to actuate the spring and maintaining a balance of loading to keep the valve slightly open, to sustain constant pressure in the reactor. The spring loading is such to also bias the valve to the fully open position. Such an arrangement is illustrated by example diagrammatically in FIG. 242, where 210 shows a valve actuating lever in heavy line, butterfly valve 211 and internal face of passage 212 in light line, spring 213, spring axis 214 and spring anchorage 215 on housing and anchorage 216 on lever, with pivotal valve axis at 217. The valve assembly is shown in slightly open position in dotted line and fully open in chain dotted line, with dashed line 211*a* indicating the arc of valve travel. The same system of loadings may be employed and the valve actuated by making the previously fixed spring anchorage point 215 movable as in the path indicated by dashed line 218 between extremities 219 and 220, dashed line 214 indicating spring axes at each extremity. This movement of spring anchorage may be actuated in any way, and in a selected embodiment is moved by a member driven by the expansion of heat sensitive material, such as a trapped pocket of gas or as is shown in FIG. 243, where a piston 221 communicates with a container of high conductivity 222 exposed to the passage of hot exhaust gas 223 through a volume 224 of trapped readily expansible material such as gas or wax. The piston 221 is connected to rod 225 and linkage 226. FIG. 244 shows schematically how the piston rod 225 actuates the operation of the valve by means of its actuating lever 210, spring 213, and an intermediate arm-shaped lever 227, mounted on pivot 228. The actuation of the valve indirectly, by means of a spring, ensures that fail-safe characteristics are embodied. If this is not considered necessary, then the heat actuated piston 221 may by direct linkage open and close the valve, as for instance if the end 229 of the intermediate lever 227 were connected directly to the valve actuating arm (embodiment not illustrated). In both cases, but especially in the latter, it will be possible to closely relate valve opening to exhaust temperature, and therefore reactor pressure in relation to temperature.

It has been shown that the warm up of the assembly has been hastened by the whole or partial closing of the exhaust gas exit by valves, in effect damming the gases inside the reactor. Such damming may be achieved by any suitable means including, in a selected embodiment, the provision of a fan or turbine in the exhaust system adjacent to the reactor gas exit. Because the fan is inert on cold start and constitutes a barrier or dam in the system, pressure would build up behind it during the early cycles of engine operation. The fan preferably would not constitute a total barrier, some air passing either between the blades or their junction with housing, enabling the engine to be turned over on the starter motor with relative ease. Once firing commences, the rapid increase in engine speed and gas flow would ensure a considerable damming effect, which would only be relieved when the reactor pressure against fan blades overcomes the fan's inertia. Optionally the fan spindle and its bearing may have differential coefficients of expansion, so that when cold a tighter bearing fit would ensure greater resistance to rotation than when warm.

The above features may be used in any suitable combination with each other and also, where appropriate to fulfill functions not related to cold start. Gas circulation to inlet system may be associated with a gas reservoir, or alternatively it may be direct, that is eliminating the reservoir. Further, the exhaust gas recirculation (ERG) system described previously could for example be used after warm up had been achieved to provide EGR to the engine under normal running, either continuously or under certain operating modes. To facilitate the use of EGR, and so thereby possibly to eliminate the use of pumps, a scoop may be placed in the reactor about the junction with recirculation passage, as illustrated diagrammatically in FIG. 245, where the scoop 230 projects into the exhaust gas flow 231, so creating a higher pressure area at 232, which assists the flow of gas along the EGR system 233. Preferably, the scoop is placed in a "weak" area of the reactor, that is where the reactions are taking place at below average rates, so that the least pollutant free gases are recirculated, permitting the reactions partly to continue during their second passage through the reactor. The scoop arrangement would entail that EGR employed continuously is in roughly constant proportion, after a build up of proportion between very low and medium speeds, since gas circulated depends on speed and therefore volume of gas issuing from the engine.

An optional valve at junction of EGR system to intake manifold could, as shown by way of example in diagrammatic section FIG. 246, be intake vacuum dependent, where 234 is the exhaust supply passage, 233 the EGR system, 235 the manifold, 236 a plug shown in open position against pressure provided by curved leaf spring 237, but which when closed seals passage 238 provided with progressively sized vent 239, operative when plug is wholly or partly in open position. The plug cap when closed seals against seats 240, where internal volume at 241 is pressure balanced with EGR system by weep passage shown dashed at 242. The degree of EGR in proportion to inlet vacuum will be regulated by the sizing of vent 239, which may be of linear, logarithmic or other progressively increasing dimension. The adoption of an operating mode may involve the need for a sudden supply of re-circulated gas. With a direct system, once the initial demand has been met, a partial vacuum will be created in the EGR system, thereby slowing down rate of gas supply to below that ideally required. This may largely be obviated by incorporating an exhaust gas reservoir into the system, which may or may not be expansible. If an expansible reservoir, such as may be used in the cold start procedure is incorporated, then its expansible action may be progressively spring loaded. During normal running, re-circulation pressures, say assisted by damming, are in the low range causing the first soft section of the springing to allow the reservoir to expand and contract within a range of say one quarter of its full expansion, this reservoir movement ensuring more consistent EGR rates at the sudden introduction of certain operating modes. During cold start the greater pressures will overcome the resistance of the second stronger section of the springing (as well as the first stage) allowing the reservoir to expand to its maximum capacity.

In situations where EGR may desirable at moderate to higher engine speed, an inlet gas velocity actuated valve, as shown in section plan FIG. 247 and elevation FIG. 248, may be incorporated at the junction of EGR system to inlet manifold. The valve, shown open in FIG. 247 comprises a shaft 243 slidable in a passage 244 communicating with EGR system, exposing a progressively sized vent 245, said shaft terminating in a head 246 having attached to it scoops or vanes 247 projecting into the gas stream 248 against the action of looped leaf spring 249. FIG. 248 shows the same arrangements with the valve, which is accommodated in a housing 250 projecting clear of inlet manifold wall 251, in the closed position. Preferably a properly balanced EGR system will comprise a series of valves, say actuated by vacuum and/or velocity or other means, disposed in different parts of the inlet system and all communicating with the EGR system, preferably having a gas reservoir. By careful positioning of these valves, regulation of their spring bias and selection of passage diameter, the right amount of EGR could be provided for the various driving modes.

The above system of valving and supply, described in connection with the supply of EGR, may also be employed to provide extra air to the inlet system, so as to assist in the provision of a precisely controlled air/fuel mixture ratio, especially desirable in the case of tri-component exhaust emission system. The air may be supplied from a reservoir which has been fed through the air cleaner, as shown diagrammatically in FIG. 249 where a coaxial chamber 252 surrounds the main inlet pipe and is adjacent the air cleaner 253, it being supplied with air through opening 254, having optional dams or scoop 255 to maintain air in the reservoir under low pressure. The same system of valves actuated by engine modes (and therefore charge air pressure) could be used to supply recirculated exhaust gas or air to the reactor, by means of a passage leading from source to reactor via valve positioned say in air inlet system. The operation of such a valve is shown schematically in FIG. 250, where a shaft 256 and head 257 in the inlet system 258 open against spring 259 loading to free passage 260. It is preferred that there is incorporated in any EGR system a filter to trap particulate matter in the exhaust, this matter having been known to lead to increased engine wear and likelihood of mechanical failure in many previous improperly filtered systems. It is felt that with the invention, substantial air supply to the reactor will not be necessary. However, it may be desirable to supply small quantities of air, preferably by means described above, only under certain running conditions to assist in the accurate balancing out of any tri-component process. The air reservoir may be expansible, say by the provision of elastomeric sides, to provide air under more constant pressure with sudden change of operating mode. Alternatively, the reservoir may consist of a series of slidably-mounted housings capable of collapsing into one another, for example as shown in diagrammatic perspective in FIG. 251, wherein 600 is the base housing having sides and bottom, 601 an intermediate housing having sides only, 602 top housing having sides and top, with 603 pressed projections acting as guides. The spring loading arrangements and guides disclosed previously may be associated with this reservoir.

Where applicable, the principles of the invention may also be applied to the exhaust gases from any other source of combustion, including an external combustion engine, such as the Stirling engine or the Rankine cycle engine, or to certain types of industrial combustion processes.

It is proposed to provide an additional or alternative means for the regulation of engine combustion process, by allowing for the provision of two separate substances to the charge of ingoing gas, such as air. The first substance is the fuel, while the second substance may be a second fuel, a non-combustible agent or the latter mixed with fuel. The introduction of a second substance, continuously or otherwise, could measurably contribute toward engine power and/or improved exhaust emission and/or fuel economy. The second substance may be introduced under, and assist in the effectiveness of, certain running conditions such as sharp acceleration, high load or maximum power output. At such operating modes fuel consumption is greatly increased, but if the main fuel could be maintained at normal flow and the increased needs met by a second substance which is obtainable from non-fossil fuel sources, then a considerable saving of the main fuel is likely. The second substance employed may be another fuel, such as alcohol or methanol which may be manufactured from such substances as waste paper, or it may be water in the form of liquid, vapor or gas, known since the turn of the century to give improved performance under certain conditions and tending to have an anti-knock effect, or in a selected embodiment may consist of a mixture of the two. Water introduced as a liquid in the cylinder expanding to steam, or steam introduced under pressure, may greatly improve the volumetric efficiency of an engine. Below are disclosed means for the introduction of two substances, possibly simultaneously, to an engine charge. In alternative embodiments more than two separate substances may be introduced. In addition to methanol, any other suitable hydrocarbon, for example ethanol, may be mixed with water. The introduction of water may be related to atmospheric humidity and regulated by a sensor.

Described below are means of introducing substances to an intake charge which do not involve the vaporization of fuel by gas velocity. Any of these means may be employed for the introduction of both the secondary substance and/or the main fuel to the charge. In the case of compression ignition engines or other engines having cylinder primary fuel injection, the other sub-stances may be supplied by means of additional injectors, or they may be introduced by compound injectors, that is by different passage systems in the same injector. The injection may be linked, that is injection of one substance will automatically cause the introduction of another, or the systems may operate independently of one another. FIG. 252 shows by way of example a diagrammatic section of the lower portion of an injector where the primary fuel 272 is injected in the normal way at 273 by the lifting of nozzle 274, which has a hollow central passage 275 linking with a secondary fuel gallery at 276 only when nozzle lift and consequently normal fuel injection is taking place. The secondary fuel is under continuous pressure and will therefore inject at 277 only when nozzle lift occurs. The proportion of normal to secondary fuel is determined by their respective pressures and the duration of degree of overlap between gallery and hollow passage. FIG. 253 shows diagrammatically a compound injector having an inner nozzle 278 coaxial and within an outer nozzle 279, both operating in the conventional mode with independent lift and injection capacity. This has the possible disadvantage of the long fuel travel down the hollow passage of the central nozzle. By way of example, a design involving a shorter central nozzle fuel travel from pressure reservoir to tip is shown schematically in cross-section in FIG. 254 and in plan in FIG. 255, where the nozzle assembly is viewed from the combustion volume. The central nozzle 280 operates in the conventional manner, moving vertically on its axis in the release of fuel, while the outer nozzle 281 moves coaxially on the first and in its seating in a rotational mode during the release of fuel. The rotational movement is imparted against the resistance of friction seals 282 by means of jets 283 terminating tangentially to diameter of nozzle, so imparting to it a twisting motion due to the force of, and for the duration of, fuel injection. This will result in a slinging of fuel across the combustion volume in the manner indicated at 284, in a similar manner to the action of some garden hoses. The injection of the outer nozzle is effected by means of a pressure wave in the coaxial and surrounding fuel chamber 285, which will depress one or more plungers 286 against spring 287 loading, and so by inward movement mate up fuel galleries to make connection and allow for fuel travel between the chamber 285 and jet 283 tip. The jet 283 has been called such to distinguish it from nozzles proper as at 280 and 281. This slinging action imparted by rotational nozzle movement, the latter in turn imparted by the tangential direction of fuel spray, has considerable benefits over conventional injection systems. The latter operate in straight line distribution of fuel, while the snakelike shape formed by the spray of invention is of greater length, thereby lessening the chance of liquid deposition or combustion in chamber walls before atomization has taken place. The slinging action also tends to distribute the droplets of fuel through a greater volume of charge than the conventional unidirectional injection.

The rotary injector has been described in a composite embodiment, but in an alternative embodiment the rotary principle may be embodied in an injector handling a single substance. The rotatable member projecting into engine working volume may be of any configuration, and head configurations suited to rotatable injectors may also be embodied in fixed or non-rotatable head injectors. Rotation may be achieved by fuel injection velocity only, or by electrical action such as performable by solenoid or electric motor or magnet, or by flexible or fixed mechanical drive to injector. Rotation may be intermittent, continuous, or returnable, for example as when the head rotates during injection and is wholly or partly returned to its former position by spring or other action. Rotation may be achieved by any combination of the above means, as for example in an injector where a small electrical motor imparts rotational impetus insufficient normally to rotate head against bearing/seal friction loading, rotation only being achievable during substantially tangential injection, which provides additional rotational movement to overcome bearing friction. Mechanical or electrical rotation may be transmitted by means of a solid or hollow needle or tube or injector nozzle seal, which may be integral with rotating head or communicating with and/or driving it by means of splines, teeth, friction surfaces, etc. The needle/shaft/tube may simultaneously function as rotational drive and fuel release means by lift-off seat. In such case vertical movement may be actuated by conventional fluid pressure valve or by solenoid. If rotary motion is also solenoid actuated, one solenoid assembly may be employed to effect both motions simultaneously by means of suitable angling of solenoid action, as shown diagrammatically in FIG. 256. Activation of electrical circuit causes shaft 800 to be pulled through one motion extent and direction indicated by arrow 801. Cessation of electrical circuit causes shaft to travel extent and direction shown by dotted arrow 802.

The injector heads of the invention include configurations wherein fuel delivery means project into combustion volume at substantial angle to vertical injector axis, whether these rotate or not. The heads in a majority of configurations will be of solid material, having formed within them passages for transmission of fuel. In alternative embodiments the heads have flexible elastomeric or spring action walls, so that initial increase in fuel pressure or arrival of fuel will cause head internal fuel transmission volume to expand or distend, remain distended during injection and, following pressure cut off, returned to normal position and cause residual fuel to be "wept" or expelled from head. In this or other embodiment of injection heads, part or all of head may be of thin walled construction, and/or manufactured of thermally conductive material so that, after pressure-actuated injection, residual fluid in head is caused to evaporate or boil off. Such a feature will be useful in certain combustion engines to ensure continuation of combustion through a greater part of stroke, providing a more constant pressure type of engine operation. One projecting head assembly or multiple projecting head assemblies may be provided in association with one injection unit. The axis of rotation of injection head may be aligned in any relationship with the volume to which injection is provided. For example, although injection and therefore axis of rotation will generally be envisaged as being in rough alignment with reciprocating motion of any engine piston, the axis of rotation may be substantially at right angles to reciprocal action of piston. As has been indicated, the rotational motion of head may be continuous, sporadic, jerk action, reciprocating (ie turning first in one direction, then in the opposite) and, if continuous, of constant or variable speed in the course of injection period and/or revolution. Any of these motions may be of a speed or degree which varies in relation to different modes of engine operation.

The invention further comprises reciprocating, retractable and projectable and/or telescopic action injection heads. The reciprocating injection heads may move to and fro in fixed relationships to engine cycle or portion of it, such as compression and/or expansion stroke. These entail the slidable mounting of a hollow member inside or outside of a hollow guide member of similar configuration, or of a multiplicity of such slidable members mounted about one another in nesting fashion, and may be fixed or movable (eg rotatable) in other planes. The sidable members may be straight or curved in elevational profile, and be of any convenient cross-section including circular, blade-like, cruciform, star-shaped, etc. The general retractable action may be incorporated in an injector for one or both of two significant reasons; to provide controlled fluid supply to working area far removed from injector base when cyclical motion of engine body portion permits (eg when piston is before say two-thirds of way up compression stroke), or to provide better fluid mixing or atomization generally. Fluid may be delivered through holes in end and/or other portion of slidable members communicating with interior hollow portion, and/or delivery may be effected by disposing holes of differing cross-sectional area, location, quantity, and/or alignment in adjacent members slidable about each other, so that in operation a controlled sequence of multiple fluid delivery is effected from hollow core of member(s) to working volume. The slidable or otherwise reciprocally moving member may have mounted in association with it a projecting or head portion, including those disclosed previously.

Reciprocal-type motion and rotational-type motion may be imparted to injector head by any means, movements being independent or linked. For example, as illustrated in FIG. 257, member 803 communicating with injector head may be rotatably mounted on fixed sleeve or cam 804 of "hill and valley" profile, to impart the combined motion referred to. Alternative solenoid assemblies operating in any manner, including similarly to principles shown in FIG. 256, may be employed to impart combined motion. Reciprocating and/or projecting/retracting motions may be imparted to injector head by any means, including those mentioned above, and/or by means of injection pressure effecting an extension or projection of head portion against say spring loading. In selected embodiments, pre-injection pressure build-up will cause injector head portion to extend with some issue of fluid through injection apertures, with major injection taking place at considerably higher pressures, once extension had been initiated, reduction of pressure causing cessation of injection and retraction of head portion. Alternatively, extension of head portion, say against spring loading, may be achieved by the combustion process itself, for example where portion of injector head defines a pre-combustion area or chamber of combustion engine. In such configurations the pressure of gases expanding in the pre-combustion chamber when firing commences causes the injector head portion to be "blown" or forced to a different portion, say against spring action, and to return at any later period, including when pressures in main and pre-combustion chambers equalize.

To the knowledge of the applicant, other injectors involve fluid supply from a fixed point. As will be seen from later description, the movement of injectors leads to improved control of combustion process and/or flame spread in combustion engines. It also leads to a more uniform distribution of fluid in the charge, which in combustion engines normally entails increase in efficiency and/or reduction in fuel consumption. It may not be readily apparent what a difference slewing the fluid through working volume will make. To illustrate this point better, one may consider a garden hose with a given rate of water flow which one holds for a given period in a fixed position. Soon a large puddle will form in one place with surrounding area relatively dry. If one held the hose with same flow-rate for same period but gave the hose light oscillating, flicking or stirring agitation, then the area of garden under consideration would receive an even spray of water, with no formation of puddles. In a similar manner, the slewing of fuel into a combustion charge would result in reduced fuel deposition on chamber walls, improved atomization, mixture standardization and evenness of burning and would result in significant increases in engine efficiency.

A further feature of the invention is an injector assembly which partly defines volume suitable for commencement of combustion, or which causes such volume to be defined, by the manner of injector assembly fitment to engine. The pre-combustion chamber may only be properly defined by fitment of the injector, portion of which forms part of pre-combustion chamber wall.

Alternatively, the injector may have wall or shrouding assembly positioned adjacently on the head, which partly encloses pre-combustion chamber volume.

It is a further feature of the invention to provide a combined ignition and injector unit. Spark or arc ignition may be instigated by electrical bridge across terminals on the combined unit, or between one terminal mounted on the unit and another terminal mounted on or formed by other engine member, including chamber or pre-combustion chamber wall or valve, piston or rotor head, etc. The terminal(s) on the combined injector or injection unit may be of any configuration, including dome, L-shaped member, ring, including ring coaxial with unit axis, and be of any convenient electrically conductive material, including metal and carbon. Ignition may be along current "cold" spark principles or along principles now under development which involve using a "hot" arc, including those systems referred to as plasma ignition, wherein the arc causes a jet of super-heated gas to be expelled rapidly through an aperture to ignite a combustible mixture. In the case of the latter ignition system being incorporated in a combined ignition and injector unit, the ignition means, whether in singular or plural form may be mounted adjacent to injection means, or the ignition means could be mounted coaxially with at least portion of injection means such as needle. In a selected embodiment, the small chamber in which arcing and superheating of gas occurs to provide plasma ignition is additionally provided with fuel supply means, so that the same chamber acts as source of plasma ignition and pre-combustion chamber. In another selected embodiment, portion of injection system such as needle acts as one terminal of an ignition system, including arc of plasma ignition system.

The following descriptions, read with reference to the diagrams where appropriate, show by way of example how features of the invention may be embodied. FIG. 258 shows in elevational plan view an injector head capable of rotation, having three cranked hollow tubes 811 permitting fluid 810 issue through end hole. FIG. 259 shows a similar arrangement, wherein multiple straight hollow tubes 812 each have multiple holes to permit fluid 810 issue. FIG. 260 shows in elevational plan view a hollow disc 813 capable of rotation, having one internal volume communicating with circumferential holes 814 permitting fluid 810 issue, the arrangement of holes being shown in detail in part end elevation FIG. 261, the disc having, coaxial with rotational axis, another internal volume 815 capable of admitting passage of second fluid and which is closable by stem 816 mounted poppet valve 817. FIG. 262 shows, in cross-section during non-ignition period, a split disc 818 suitable for fixed as well as rotational applications, wherein the disc has flexible walls so that under pressure it assumes outline shown dotted at 819. Holes 820 permitting fluid issue 810 are provided in communication with volume 821 located between halves of disc, to which fluid can be supplied from passageways 822 in stem 823 or the central axial passage 824 closable by needle valve 825. In a selected embodiment the split disc 818 is of thermally conductive material to cause fluid present in volume 821 during compression and/or combustion to tend to atomize, evaporate or boil. In a selected embodiment in an internal combustion engine, the injector provides a short burst of superheated steam via passage 824 during compression stroke, fuel is supplied under pressure via passages 822 about top dead center of stroke, flushing out residual steam/water from volume 821, and an optional second short burst of pressurized superheated steam is admitted substantially during expansion stroke, to flush out residual fuel and/or carbon and to provide additional pressure on the piston. The flushing actions will assist in the prevention of deposits about the ends of holes 820. FIG. 263 shows in elevational plan a view of an injector head having a looped hollow tube 826 of semi-spiral configuration, suitable for rotational and non-rotational application, with fluid issue 810, shown opposite injection holes. Although reciprocating, rotatable or otherwise movable members have been described in association with injector head assembly, the entire body portion of the injector including head may be so movable.

The art of mounting rotatable, reciprocal or slidable members is well known, these known 4 techniques being readily employable in the construction and embodiments of the invention. In nearly all varieties of construction, the fluid to be injected can be partly used as lubricant. By way of illustration, there is shown in cross-section in FIG. 264 a rotatable head 827, screw fixed to rotatable drive member 828, both being located by fixed injector body 829, with bearing surfaces 830 being lubricated by seepage from injection fluid volume 831, via a pressure-wave inhibiting ring 832, manufactured for example of ceramic fiber material.

FIG. 265 shows elevationally and FIG. 266 shows in sectional plan view, a telescopic reciprocal or "lizard-tongue" action, three-part injector head assembly, of blade-like cross-section. In FIG. 265 it is shown solid in non-injecting position and dotted in fully extended position. The majority of holes for fluid issue 810 are in the long ends or sides of the blade-like sections 835, the latter extending against tension of wishbone configuration leaf springs 833. Further holes 836 are provided to align with each other at certain stages during extension of the assembly.

FIG. 267 shows lower portion of injector fitted to engine head or block 840 in such a way that a pre-combustion chamber 841 is formed to give access to main combustion chamber 842. Injector head 843 is movable rotationally and reciprocally, say by means of the device of FIG. 257, from the position shown solid to that shown dotted at 844, and is mounted in a fixed body portion 843*a* of the injector, which is made of non-conductive material such as ceramic. Conventional type spark terminals are shown at 845, with an alternative single terminal shown at 846 for providing spark to engine wall portion 847 made of conductive material. FIG. 268 shows a combined injector/ignitor having ceramic body portion 843*a* forming shroud 848 defining pre-combustion volume 850, containing extensible needle injector head 849, having central end hole and controlled bearing weep to provide fluid 810 injection, plasma ignition means being provided at 851 to provide jet of superheated gas 852 during ignition. The entire injector of FIG. 268 may be rotatable. FIG. 269 shows a similar arrangement, where electrically conductive shroud 848 is insulated from electrically conductive telescopic action injector needle head 853 by means of ceramic material 854, with ignition taking place by arc or spark between projecting terminal 855 and needle head 853. FIG. 270 shows a rotatable disc configuration injector head 856 in retracted position to partly mask pre-combustion chamber 841 from main combustion chamber 842. Ignition means are provided at 857, so that firing in chamber 841 will cause injector head to be blown to position 858 against spring loading (not shown).

It is a further aspect of the invention that the injector head portion be capable of reciprocal movement, effectively to comprise a piston member. In a selected embodiment, this feature is used to provide a variable capacity pre-combustion chamber volume, as illustrated for example in FIG. 267, where 860 shows in dotted outline an alternative position of injector head assembly. Optional sealing rings are provided at 861. Optionally, the movement of injector head and therefore variation of pre-combustion volume size may be variable while the engine is in operation, either manually or automatically, and be dependent on such factors as temperature, starting condition, engine speed and/or load, intake charge pressure, atmospheric pressure, charge composition, fuel employed, etc. Such variable position piston or head assembly constructions are known in association with other devices and may be embodied in any appropriate manner. One way of carrying the invention into effect would be to bias, by spring loading, the injector toward its most retracted position against a rotatable cam operative against injector assembly base. Injector movement may be directed by any system of guides, channels, grooves, projections, depressions, ledges, cams, etc. Injector components may be of any suitable material, including ceramics, ceramic glasses, etc. Any injector head assembly of the invention may have reciprocal motion during each injection (to effect a slewing of injected fluid), and the degree of this reciprocation be made variable according to engine operation mode, say by means of cams capable of rotational and axial movement.

Generally in the previous embodiments, internal face of the reactor housing exposed to the exhaust gases has been regular. This may have the disadvantage, according to the nature of filamentary material deployed within the reactor, of tending to define a path of lesser resistance to the gas flow 300, as shown diagrammatically in FIG. 271, where 301 is the housing, 302 the engine, 303 say filamentary wool and 304 the less obstructive section between wool and housing. This will result in too great a proportion of the gases travelling this path of lesser resistance rather than passing as intended properly through the filamentary material, with a result that some of the gases will not as fully inter-react as the system allows for. In order to mitigate this usually undesirable effect, the interior face of the housing may incorporate a series of depressions and/or projections, designed to break up gas flow adjacent to housing face and to direct as much of the gas inward towards the core of filamentary material proper. FIG. 272 shows in diagrammatic elevation part of the inside face of a reactor housing, having a series of possibly alternative projections, with FIG. 273 a corresponding section. By way of example, at 305 are shown a series of spaced straight ridges, while at 306 are curved intermeshing ridges and at 308 interconnecting ridges. At 309 are shown dimples or nipples, while at 310 are irregular projections of star-like or cruciform configurations. FIG. 274 shows examples of how filamentary material fastening means may break up gas flow, with 311*a* trench-like depression, 312 a projecting collar and 313 the ridges and troughs of earlier description. The internal face of the housing may further be waved, as shown in diagrammatic part elevation in FIG. 275 and in part section in FIG. 276, showing a similar configuration where the waves are not continuous but form a succession of dune-like shapes. Both waves and dunes may be of regular cross-sectional configuration as at 314, or may have a shallow slope facing the oncoming exhaust gases 300, and a sharp slope on the leeward side of the gas as at 315, or vice versa. In FIG. 277 is shown how a ridge 316, optionally acting as filamentary retaining means, directs the flow of gas away from the junction between housing 301 and filamentary core 317, say of honeycomb configuration. Since the housing comprises at least partly insulating material there will be a large temperature drop between the inside face of the housing assembly and its outside face. Because of the high internal temperature of the reactor, perhaps in the 1100 to 1200 C. range, the temperature drop may not be sufficient to result in a surface temperature sufficiently low to prevent accidental burning by operating or service personnel. Largely to obviate this danger, the surface of the housing may be provided with protective ridges as at 318 in FIG. 276 or nipples as at 319 in FIG. 277. There will be further temperature drop between surface proper and extremity of projection, but a much smaller hot surface is presented to accidental contact, thereby limiting heat absorption and degree of possibly burning.

The forms, contents and constructions of housing described herein may all be employed in any combination and embodiment to provide a housing to treat, control or process in any manner incoming engine charge. Previously most internal combustion engines have had charge supplied in the form of tubular columns passing through tubular manifold pipes. By passing charge through the housings of the invention, much of the pulsing effect and critical tuning associated with conventional manifolding will be eliminated, providing a smoother charge flow, especially during changes of operating mode. The provision of filamentary material inside a charge housing can assist in improving turbulence, heat exchange, elimination of condensations, etc. The charge housing may be formed similarly to the reactor housing disclosed earlier, with portion of charge treatment volume intruding into area normally taken up by engine. Inlet ports may be formed of progressively varying cross-section to ensure smooth fluid flow between volume and main portion of port. Filamentary material may be provided anywhere in the charge treatment volume, but in selected embodiments is in or adjacent to inlet opening. The inlet opening area, including adjacent to and projecting into charge treatment volume, may have fluid distribution or flow controlling members such as or similar to those described in FIGS. 167 to 176. The fluid may proceed from charge treatment volume by non-parallel paths, for example similarly to the disclosure of FIGS. 165 and 166. Inter-members may be provided between charge treatment housing and engine body, along lines disclosed in FIGS. 154 and 162, these being optionally of insulating material to maintain charge at ambient temperature. In the case of combustion engines, the housings, constructions, port arrangements, and contents of the invention may be applied only to process charge, or to process exhaust, or to both. In the latter case, charge housing may be opposite exhaust housing (as for example in "cross-flow" engines), or both housings may be mounted adjacently on the same engine side, either separately or in combination. In selected embodiments, the housing will communicate with a plurality of inlet openings. A further advantage of the invention is that it will provide improved inlet silencing.

This disclosure relates principally to combustion engines, but where relevant may be applied to any type of engine or pump.

A feature of the invention is the provision of a variable diameter charge intake throat. This may be used with any type of engine, but preferably forms charge entry point to the housing of the invention. Essentially the variable throat comprises a stretched elastomeric tube about which is wound one or more tension members, whose free ends once pulled effect a reduction in tube diameter. Section plan view FIG. 278, cross-sectional view FIG. 279 and detail FIG. 280 show diagrammatically a stretched rubber throat shown solid in open position at 739, fixed within charge housing 740 by means of expandable clamp rings 741. Wound externally about the elastic throat 739 and mounted in lubricant 743 in guide channels 742 are multiple tension members 744 of nylon (shown in detail section FIG. 280), whose ends are taken via pulleys 745 and wound about variable diameter cylinder 746 mounted adjacent to throat. In operation, rotation of cylinder causes the tension members to effect a partial strangulation of throat, so reducing its diameter, as shown dashed in FIGS. 278 and 279. It is desirable that throat or membrane 739 when in the open position should be in significantly greater tension due to stretching in direction 747 than in direction 748, this differential ensuring throat remains open.

It is proposed to describe those materials which are in general suitable for the high temperature and mechanical requirements of the invention, and then to describe materials particularly suitable to the filamentary matter in particular. The invention in any of its embodiments may be made of any suitable material, including those not mentioned here and those which will be devised, discovered or developed in the future.

The more suitable materials for general use fall into three categories: metals, ceramics and glasses, and giant molecules generally known as polymers. Broadly, metals are ductile, resistant to thermal and mechanical shock, strong with progressive weakening with increase in temperature, tolerably resistant to abrasion and corrosion, in their refined and alloyed forms fairly resistant to temperature, and substantially in their elemental form. The other two categories do not have the same broad spectrum of advantageous qualities; ceramics and glasses, which are generally oxides or compounds of the half-way elements, have superior qualities in all respects except ductility, resistance to shock and ease of working. However, because they are often very strong, more temperature resistant and generally much harder and abrasion/corrosion resistant than metals, great efforts have been made over the last decades to overcome their disadvantages. New manufacturing processes have been devised, the mixes have been blended to increase resistance to shock and means of reinforcement developed. Concerning the polymers, these do not yet have the resistance to wear and temperature, or the hardness and strength of the materials, but they are beginning to be used as reinforcements and are also very suitable as insulating materials. They are capable of being the most elastomeric of the three groups and are useful for the manufacture of say the exhaust reservoir bellows of the invention, where temperatures are not as high as in the reactor. Polymers are being developed continuously; they are man-made and almost never occur freely in nature, and it is suspected that new super materials will be developed in the future by the polymerization of such metals as aluminum (next to silicon on the atomic scale) and some of the ceramic oxides. Many compounds do not fit clearly into one of these categories but lie in the area between.

The most suitable metals are the so called "super alloys," alloys based on nickel, chrome and/or cobalt, with the addition of hardening elements including titanium, aluminum and refractory metals such as tantalum, tungsten, niobium and molybdenum. These super alloys tend to form stable oxide films at temperatures of over 700° C., giving good corrosion protection at ambient temperatures of around 1100° C. Examples include the Nimonic and Iconel range of alloys, with melting temperatures in the 1300° to 1500° C. range. At colder temperatures of up to 900° C. certain special stainless steels may also be used. All may be reinforced with ceramic, carbon or metal fibers such as molybdenum, beryllium, tungsten or tungsten plated cobalt, optionally surface activated with palladium chloride. In addition, and especially where reinforcement capable of oxidizing is not properly protected by the matrix, the metal may be face hardened. Non metal fibers or whiskers (often fibers grown as single crystals) such as sapphire-aluminum oxide, alumina, asbestos, graphite, boron or borides and other ceramics or glasses may also act as reinforcing materials, as can certain flexible ceramic fibers. Materials, including those used as filamentary matter, may be coated with ceramic by vapor deposition techniques.

Ceramics materials are especially suited to the manufacture of the engine components generally, including of the housings, inter-members and opening linings, because of their generally low thermal conductivity and ability to withstand high temperatures. Suitable material include ceramics such as alumina, alumina-silicate, magnetite, cordierite, olivine, fosterite, graphite, silicon nitride; glass ceramics including such as lithium aluminum silicate, cordierite glass ceramic, "shrunken" glasses such as borosilicate and composites such as sialones, refractory borides, boron carbide, boron silicide, boron intride, etc. If thermal conductivity is desired, beryllium oxide and silicon carbide may be considered. These ceramics or glasses may be fiber or whisker reinforced with much the same material as metals, including carbon fiber, boron fiber, with alumina fibers constituting a practical reinforcement, especially in a high-alumina matrix (the expansion coefficients are the same). It is the very high alumina content ceramics which today might be considered overall the most suited and most available to be used in the invention generally. The ceramic or glass used in the invention may be surface hardened or treated in certain applications, as can metals and often using the same or similar materials, including the metal borides such as of titanium, zirconium and chromium, silicon, etc.

The filamentary material may be made of metals, preferably smoothed and rounded to avoid undue corrosion, or of ceramics or glasses. Other materials which may be particularly suitable once they are in full commercial production are boron filaments, either of pure boron or compounds or composites such as boron-silica, boron carbide, boron-tungsten, titanium diboride tungsten, etc. The material, especially if ceramic, may easily and conveniently be in the form of wool or fibers, and many ceramic wool or blanket type materials are today manufactured commercially, usually of alumina-silicate, and could readily be adapted to the invention. Such ceramic wool could also be used as a jointing material either alone or as a matrix for a more elastomeric material such as a polymer resin. The material may either be such to have catalytic effect, as in the case of many metals, or have a catalyst mounted or coated on the basic material, such as ceramic.

High temperature lubricants will probably be necessary for moving parts, either as a liquid or as material coated onto or doped into the surface of a component. They may comprise boron nitride, graphite, silicone fluids and greases, molybdenum compounds, etc. For perhaps the less direct mechanical applications, polymers may be employed. Silicones have already been mentioned as being suitable in rubber form for the expansible bellows of the reservoirs, and may also be used structurally in harder, resinous form. Resins suitable include those of the phenolic family (eg polytetrafluoroethelyne) and boron containing epoxy resins. Other polymers suitable are for example the boranes, such as decaborane silicones containing un-carborane and other silicon-boron groups. These polymers may be reinforced with any whisker or fiber, including those mentioned above.

Wool, especially if of ceramic material, is often made by extruding or extracting fine jets of molten matter in a bath of cold fluid, usually liquid, a process which has been referred to previously as a fluid collision technique because of the force required and the rapid cooling on contact with the fluid. In a preferred embodiment, hot liquid filamentary material is injected through fine apertures, possibly arranged in the disposement of exhaust port layouts, into a restricted volume containing cold fluid which is of corresponding shape to reactor housing, the liquid on cooling forming into a wool mass of generally the shape to fit into reactor housing. If the wool or fibers are too linear in configuration, then the cooling liquid may be agitated say in a twisting irregular motion preferably by impeller forced into a cooling reservoir through an aperture corresponding to the exhaust gas exit.

The complex shapes that the filamentary material may comprise may be manufactured by a reversal process, whereby the forms of the intended passages are made up in material A, about which the filamentary material B is formed. Subsequently material A is dissolved or leached out in a suitable substance such as acid or water, leaving the material B only in the intended form. Such methods are known and suited to ceramic manufacture.

The materials may be formed by any of the current techniques now known, including slip forming, molding, pressing, stamping, sintering, extruding, etc. The isostatic pressing of powders is one of the more suitable means of manufacturing in ceramic the possibly complex shapes of the reactor housings, providing sufficient hydraulic pressure is available for the relatively large sizes of the objects. Pressing usually takes place on a male mandrel, which can accurately be made to the desired form. If the internal form entails difficulty of removal of product, then the male mandrel may be an elastomeric housing filled with an incompressible effectively fluid material such as liquid or powder or grains, these being removed after forming so that the mandrel may be collapsed inwardly.

The above features illustrate by way of example the many ways an un-cooled engine may be constructed. Any type of piston or valve may be used in an un-cooled engine and the engine portions may be assembled in any manner. The features of the un-cooled engine have been described mainly in relation to internal combustion engines, although they are suited to and may be applied to any type of combustion engine, including for example steam and Stirling engines.

The features relating to heat exchangers may be embodied in any type of engine, including conventionally cooled engines. Where appropriate, features described herein may be applied to pumps. By "un-cooled" is meant engines having restricted or no cooling, compared to general current production engine practice and includes engines with partial cooling. Where diagram or embodiments are described, these are always by way of example and/or illustration of the principles of the invention. Further, it is considered that any of the separate features of this complete disclosure comprise independent inventions.

In conclusion it is to be emphasized that the various features and embodiments of the invention may be used in any appropriate combination or arrangement.

What is claimed is:

1. A device for the working of fluids, said device substantially defined by a casing having an exterior surface, said casing at least partly supporting and enclosing a cylinder assembly comprising a cylinder with two heads or ends and at least one internal circumferential depression, said assembly containing a component with at least one external circumferential projection, said projection reciprocatable in said depression, said cylinder heads and said component having working surfaces partly defining at least one pair of toroidal fluid working chambers which in operation have cyclically variable capacity, said casing including insulating material for the purpose of restricting heat transfer from said assembly.

2. The device of claim 1, including means to mount said cylinder assembly in said casing to enable said cylinder assembly to rotate while said component is reciprocating in said cylinder assembly.

3. The device of claim 1, including means between said assembly and said component so as to cause said component to rotate relative to said assembly while reciprocating in said assembly.

4. The device of claim 3, wherein said means comprise a guide and an endless track, said guide movable in said endless track, said track having a multiple wave-form configuration.

5. The device of claim 4, wherein said guide is disengagable from said track during operation of said device.

6. The device of claim 3, wherein said means comprise said component and said cylinder assembly defining complementary surfaces at least partly of an endless wave-like configuration.

7. The device of claim 3, including a rotatable shaft and a load transfer mechanism between said shaft and said rotatable and reciprocatable component, wherein said mechanism comprises a hollow shaft with interior splines slidable on a shaft with external splines.

8. The device of claim 3, including a rotatable shaft and a load transfer mechanism between said shaft and said component, wherein said mechanism includes a bellows device.

9. The device of claim 3, including a rotatable shaft and a load transfer mechanism between said shaft and said component, wherein said mechanism includes at least one hinged element.

10. The device of claim 3, including a rotatable shaft and a load transfer mechanism between said shaft and said component, wherein said mechanism includes at least one pair of substantially parallel flanges separated by at least one roller, the flanges in operation moving laterally relatively to one another.

11. The device of claim 1, wherein at least one of said cylinder assembly and said component is at least partly composed of ceramic material.

12. The device of claim 11, including at least one electrical circuit within said ceramic material.

13. The device of claim 1, including at least one fastener, wherein at least one of said component and said cylinder assembly includes a multiplicity of elements held in assembled condition by said fastener loaded under tension.

14. The device of claim 13, wherein said fastener is of tubular form.

15. The device of claim 1, wherein said assembly comprises at least one pair of substantially identical components arranged in mirror image about one another.

16. The device of claim 15, including at least one port located in said cylinder assembly for passage of fluid to or from said working chambers, wherein said port is positioned between said pair of components.

17. The device of claim 1, wherein said component defines a passage for fluids worked by said device.

18. The device of claim 1, including cylinder assembly surfaces and component surfaces at least partly defining said working chambers, at least one of said surfaces having at least one relatively small deliberately manufactured depression, said depression wholly fillable by fluids worked by said device.

19. The device of claim 1, including structure located at least in part outside said cylinder assembly and within said surface, said structure at least partly defining at least one volume for passage of fluids to or from at least one of said working chambers, said volume being adjacent to and at least partly surrounding portion of said cylinder assembly.

20. The device of claim 19, wherein said structure is at least partly of insulating material for the purpose of restricting heat transfer from said volume.

21. The device of claim 1, wherein said device is a reciprocating internal combustion engine and said working chambers are combustion chambers, said engine having a charge gas supply system, a fuel delivery apparatus and an emission control system for hot exhaust gas emitted from said engine when operative.

22. The device of claim 21, wherein said fuel delivery apparatus includes at least one injector assembly for delivery of at least two distinct fluids independently of one another.

23. The device of claim 21, wherein said emission control system includes at least one valve for restricting flow of said exhaust gas during selected operating periods of said reciprocating internal combustion engine.

24. The device of claim 21, wherein said engine has no purposely designed means for transferring heat from said combustion chamber, such means including fluid circulating in a jacket adjacent to said assembly or cooling fins radiating from said assembly.

25. A device for the working of fluids, said device having an operating cycle and being substantially defined by a casing having an exterior surface, said casing at least partly supporting and enclosing a cylinder assembly, said assembly having a cylinder portion and at least one cylinder head portion and a component reciprocally movable within said assembly, said head portion and said component partly defining a cyclically variable working chamber therebetween, said component having an internal passage for transfer of fluids to or from said working chamber, said head portion being separated from and pierced by said passage during at least part of said cycle, said casing including insulating material for the purpose of restricting heat transfer from said assembly, said device having no purposely designed means for transferring heat from said assembly, such means including fluid circulating in a jacket adjacent to said assembly or cooling fins radiating from said assembly.

26. The device of claim 25, including means to mount said cylinder assembly in said casing to enable said cylinder assembly to rotate while said component is reciprocating in said cylinder assembly.

27. The device of claim 25, including means between said cylinder assembly and said component so as to cause said component to rotate relative to said cylinder while reciprocating in said cylinder assembly.

28. The device of claim 27, wherein said means comprise a guide and an endless track, said guide movable in said endless track, said track having a multiple wave-form configuration.

29. The device of claim 28, wherein said guide is disengagable from said track during operation of said device.

30. The device of claim 27, wherein said means comprise said component and said cylinder assembly define complementary surfaces at least partly of an endless wave-like configuration.

31. The device of claim 27, including a rotatable shaft and a load transfer mechanism between said shaft and said rotatable and reciprocatable component, wherein said mechanism comprises a hollow shaft with interior splines slidable on a shaft with external splines.

32. The device of claim 27, including a rotatable shaft and a load transfer mechanism between said shaft and said component, wherein said mechanism includes at least one pair of substantially parallel flanges separated by at least one roller, the flanges in operation moving laterally relatively to one another.

33. The device of claim 25, wherein at least one of said component and said cylinder assembly is substantially made of ceramic material.

34. The device of claim 33, including at least one electrical circuit within said ceramic material.

35. The device of claim 25, including at least one fastener, wherein at least one of said component and said cylinder assembly includes a multiplicity of elements held in assembled condition by said at least one fastener loaded under tension.

36. The device of claim 35, wherein said fastener is of tubular form.

37. The device of claim 25, wherein said assembly comprises at least one pair of substantially identical components arranged in mirror image about one another.

38. The device of claim 37, including at least one port located in said cylinder assembly for passage of fluid to or from said working chamber, wherein said port is positioned between said pair of components.

39. The device of claim 25, including cylinder assembly surfaces and component surfaces at least partly defining said working chambers, at least one of said surfaces having at least one relatively small deliberately manufactured depression, said depression wholly fillable by fluids worked by said device.

40. The device of claim 25, including structure located at least in part outside said cylinder assembly and within said exterior surface, said structure at least partly defining at least one volume for passage of fluids to or from said working chamber, said volume being adjacent to and at least partly surrounding portion of said cylinder assembly.

41. The device of claim 40, wherein said structure is at least partly of insulating material for the purpose of restricting heat transfer from said volume.

42. The device of claim 25, wherein said device is a reciprocating internal combustion engine and said working chamber is a combustion chamber, said engine having a charge gas supply system, a fuel delivery apparatus and an emission control system for hot exhaust gas emitted from said engine when operative.

43. The device of claim 42, wherein said fuel delivery apparatus includes at least one injector assembly for delivery of at least two distinct fluids independently of one another.

44. The device of claim 42, wherein said emission control system includes at least one valve for restricting flow of said exhaust gas during selected operating periods of said reciprocating internal combustion engine.

45. A device for the working of fluids comprising at least one cylinder assembly containing a component reciprocatable therein, said component having two longitudinal extremities and at least one circumferential projection, said cylinder assembly having at least one internal circumferential depression in which said projection is positioned to reciprocate, said projection and depression forming a pair of toroidal fluid working chambers of cyclically variable capacity, said component having at least one internal passage for movement of fluids to or from said working chambers, said assembly including a multiplicity of elements of ceramic material held in assembled and abutted condition by at least one fastener loaded in tension, said device having no purposely designed means for transferring heat from said assembly, such means including fluid circulating in a jacket adjacent to said assembly or cooling fins radiating from said assembly.

46. The device of claim 45, including a casing in which said cylinder assembly is mounted.

47. The device of claim 46, wherein said casing is at least partially composed of thermally insulating material.

48. The device of claim 46, including means to mount said cylinder assembly in said casing to enable said cylinder assembly to rotate while said component is reciprocating in said cylinder assembly.

49. The device of claim 45, including means between said assembly and said component so as to cause said component to rotate relative to said assembly while reciprocating in said assembly.

50. The device of claim 49, including a rotatable shaft and a load transfer mechanism, said component being linked to said rotatable shaft by said load transfer mechanism.

51. The device of claim 50, wherein said mechanism comprises a hollow shaft with interior splines slidable on a shaft with external splines.

52. The device of claim 50, wherein said mechanism comprises a bellows device.

53. The device of claim 50, wherein said mechanism includes at least one hinged element.

54. The device of claim 50, wherein said mechanism includes at least one pair of substantially parallel flanges separated by at least one roller, the flanges in operation moving laterally relatively to one another.

55. The device of claim 49, wherein said means comprise a guide and an endless track, said a guide movable in said endless track, said track having a multiple waveform configuration.

56. The device of claim 55, wherein said guide is disengagable from said track.

57. The device of claim 49, wherein said means comprise said component and said cylinder assembly define complementary surfaces at least partly of endless wave-like configurations.

58. The device of claim 45, including a crankshaft and a connecting rod, to which crankshaft an extremity is linked by said connecting rod.

59. The device of claim 45, wherein at least one of said extremities in normal operation transfers loads associated with said working chambers, said loads in operation being principally in tension.

60. The device of claim 45, wherein said component is at least partly composed of ceramic material.

61. The device of claim 60, including at least one electrical circuit within said ceramic material.

62. The device of claim 45, wherein said assembly comprises at least one pair of substantially identical components arranged in mirror image about one another.

63. The device of claim 62, wherein said pair of components define a port therebetween for passage of fluid to or from said working chambers.

64. The device of claim 45, including at least one second fastener, said reciprocatable component comprising a multiplicity of elements, said elements being held in assembled condition by said second fastener loaded in tension.

65. The device of claim 64, wherein said second fastener is of tubular form.

66. The device of claim 45, including filamentary material contained in said internal passage.

67. The device of claim 66, wherein said filamentary material includes substance having catalytic effect to hasten chemical reaction in said working fluid.

68. The device of claim 45, wherein at least one of said cylinder assembly and said component has at least one surface at least partly defining at least one of said working chambers, said surface having at least one relatively small manufactured depression wholly fillable by fluids worked by said device.

69. The device of claim 45, wherein said fastener is of tubular form.

70. The device of claim 45, including at least one electrical circuit within said ceramic material.

71. The device of claim 45, including structure located at least in part outside and in proximity to said cylinder assembly, said structure at least partly defining at least one volume for passage of fluids to or from at least one of said working chambers, said volume being adjacent to and at least partly surrounding portion of said cylinder assembly.

72. The device of claim 71, including filamentary material contained in said volume.

73. The device of claim 72, wherein said filamentary material includes substance having catalytic effect to hasten chemical reaction in said working fluid.

74. The device of claim 45, wherein said device is a reciprocating internal combustion engine and said working chambers are combustion chambers, said engine having a charge gas supply system, a fuel delivery apparatus and an emission control system for hot exhaust gas emitted from said engine when operative.

75. The device of claim 74, wherein said device is part of a compound engine including said internal combustion engine and a second engine.

76. The device of claim 73, wherein said second engine is a turbine engine, in operation said hot exhaust gas being used to power said turbine engine.

77. The device of claim 73, wherein said second engine is a steam engine, in operation energy from said hot exhaust gas being used to power said steam engine.

78. The device of claim 73, wherein said second engine is a Stirling engine, in operation energy from said hot exhaust gas being used to power said Stirling engine.

79. The device of claim 74, wherein said fuel delivery apparatus includes at least one injector assembly for delivery of at least two distinct fluids independently of one another.

80. The device of claim 74, wherein said emission control system includes at least one valve for restricting flow of said exhaust gas during selected operating periods of said reciprocating internal combustion engine.

81. A device for the working of fluids defined by an exterior surface, said device including a structure and a cylinder assembly having at least one internal circumferential depression all substantially located within said surface, said assembly containing a component having two cylindrical ends each with at least one opening, said component having at least one circumferential external projection reciprocatable in said depression, in operation said projection and depression forming at least one pair of toroidal fluid working chambers of cyclically variable capacity, said component having at least one internal passage communicating with said openings for transfer of fluids to or from said working chambers, said structure being in proximity to and at least partially surrounding portion of said cylinder assembly and including insulating material to restrict heat transfer from said assembly.

82. The device of claim 81, including a casing, wherein said exterior surface is substantially that of said casing.

83. The device of claim 82, including means to mount said cylinder assembly in said casing to enable said cylinder assembly to rotate while said component is reciprocating in said cylinder assembly.

84. The device of claim 82, wherein said casing is at least partially composed of thermally insulating material.

85. The device of claim 81, including means between said assembly and said component so as to cause said component to rotate relative to said assembly while reciprocating in said assembly.

86. The device of claim 82, wherein said means comprise a guide and an endless track, said guide movable in said endless track, said track having a multiple wave form configuration.

87. The device of claim 86, wherein said guide is disengagable from said track during operation of said device.

88. The device of claim 85, wherein said means comprise said component and said cylinder assembly define complementary surfaces at least partly of endless wave-like configurations.

89. The device of claim 85, including a rotatable shaft and a load transfer mechanism between said shaft and said rotatable and reciprocatable component, wherein said mechanism comprises a hollow shaft with interior splines slidable on a shaft with external splines.

90. The device of claim 85, including a rotatable shaft and a load transfer mechanism between said shaft and said component, wherein said mechanism includes at least one pair of substantially parallel flanges separated by at least one roller, the flanges in operation moving laterally relatively to one another.

91. The device of claim 81, wherein at least one of said cylinder assembly and said component is at least partly composed of ceramic material.

92. The device of claim 91, including at least one electrical circuit within said ceramic material.

93. The device of claim 81, including at least one fastener, wherein at least one of said component and said cylinder assembly includes a multiplicity of elements held in assembled condition by said at least one fastener loaded under tension.

94. The device of claim 93, wherein said fastener is of tubular form.

95. The device of claim 81, wherein said assembly comprises at least one pair of substantially identical components arranged in mirror image about one another.

96. The device of claim 95, including at least one port located in said cylinder assembly for passage of fluid to or from said working chambers, wherein said port is positioned between said pair of components.

97. The device of claim 81, including cylinder assembly surfaces and component surfaces at least partly defining said working chambers, at least one of said surfaces having at least one relatively small deliberately manufactured depression, said depression wholly fillable by fluids worked by said device.

98. The device of claim 81, including at least one volume for passage of fluids to or from at least one of said working chambers, said volume being located substantially between said structure and said cylinder assembly, said volume being adjacent to and at least partly surrounding portion of said cylinder assembly.

99. The device of claim 81, wherein said device is a reciprocating internal combustion engine and said working chambers are combustion chambers, said engine having a charge gas supply system, a fuel delivery apparatus and an emission control system for hot exhaust gas emitted from said engine when operative.

100. The device of claim 99, wherein said fuel delivery apparatus includes at least one injector assembly for delivery of at least two distinct fluids independently of one another.

101. The device of claim 99, wherein said emission control system includes at least one valve for restricting flow of said exhaust gas during selected operating periods of said reciprocating internal combustion engine.

102. The device of claim 99, wherein said engine has no purposely designed means for transferring heat from said combustion chamber, such means including fluid circulating in a jacket adjacent to said assembly or cooling fins radiating from said assembly.

103. A device for the working of fluids, said device having a cylinder assembly comprising a cylinder with at least one internal circumferential depression, said assembly containing a component with at least one external circumferential projection, said external circumferential projection reciprocating in said circumferential depression and both having working surfaces defining at least one pair of toroidal fluid working chambers which in operation have cyclically variable capacity, said assembly including a multiplicity of elements of ceramic material held in assembled and abutted condition by at least one fastener loaded in tension.

104. The device of claim 103, including a casing, wherein said casing at least partly encloses said cylinder assembly.

105. The device of claim 104, including means to mount said cylinder assembly in said casing to enable said cylinder assembly to rotate while said component is reciprocating in said cylinder assembly.

106. The device of claim 104, wherein said casing is at least partially composed of thermally insulating material.

107. The device of claim 106, wherein said guide is disengagable from said track.

108. The device of claim 103, including means between said assembly and said component so as to cause said component to rotate relative to said assembly while reciprocating in said assembly, wherein said device is an internal combustion engine and at least one of said fluid working chambers functions as a combustion chamber, said engine having no purposely designed means for transferring heat from said combustion chamber, such means including fluid circulating in a jacket adjacent to said assembly or cooling fins radiating from said assembly.

109. The device of claim 108, wherein said means comprise a guide and an endless track, said guide movable in said endless track, said track having a multiple wave-form configuration.

110. The device of claim 108, wherein said means comprise said component and said cylinder assembly define complementary surfaces at least partly of an endless wave-like configuration.

111. The device of claim 108, including a rotatable shaft and a load transfer mechanism between said shaft and said rotatable and reciprocatable component, wherein said mechanism comprises a hollow shaft with interior splines slidable on a shaft with external splines.

112. The device of claim 108, including a rotatable shaft and a load transfer mechanism between said shaft and said component, wherein said mechanism includes a bellows device.

113. The device of claim 108, including a rotatable shaft and a load transfer mechanism between said shaft and said component, wherein said mechanism includes at least one hinged element.

114. The device of claim 108, including a rotatable shaft and a load transfer mechanism between said shaft and said component, wherein said mechanism includes at least one pair of substantially parallel flanges separated by at least one roller, the flanges in operation moving laterally relatively to one another.

115. The device of claim 103, wherein said component is at least partly composed of ceramic material.

116. The device of claim 115, including at least one electrical circuit within said ceramic material.

117. The device of claim 103, including at least one second fastener, said reciprocatable component comprising a multiplicity of elements, said elements being held in assembled condition by said fastener loaded in tension.

118. The device of claim 117, wherein said second fastener is of tubular form.

119. The device of claim 103, wherein said assembly comprises at least one pair of substantially identical components arranged in mirror image about one another.

120. The device of claim 119, including at least one port located in said cylinder assembly for passage of fluid to or from said working chambers, wherein said port is positioned between said pair of components.

121. The device of claim 103, wherein said component defines a passage for fluids worked by said device.

122. The device of claim 103, including cylinder assembly surfaces and component surfaces at least partly defining said working chambers, at least one of said surfaces having at least one relatively small manufactured depression, said depression wholly fillable by fluids worked by said device.

123. The device of claim 103, wherein said fastener is of tubular form.

124. The device of claim 103, including at least one electrical circuit within said ceramic material.

125. The device of claim 103, including structure located at least in part outside said cylinder assembly, said structure at least partly defining at least one volume for passage of fluids to or from at least one of said working chambers, said volume being adjacent to and at least partly surrounding portion of said cylinder assembly.

126. The device of claim 103, wherein said device is a reciprocating internal combustion engine and said working chambers are combustion chambers, said engine having a charge gas supply system, a fuel delivery apparatus and an emission control system for hot exhaust gas emitted from said engine when operative.

127. The device of claim 126, wherein said fuel delivery apparatus includes at least one injector assembly for delivery of at least two distinct fluids independently of one another.

128. The device of claim 126, wherein said emission control system includes at least one valve for restricting flow of said exhaust gas during selected operating periods of said reciprocating internal combustion engine.

129. The device of claim 126, wherein said engine has no purposely designed means for transferring heat from said combustion chamber, such means including fluid circulating in a jacket adjacent to said assembly or cooling fins radiating from said assembly.

130. A device for the working of fluids defined by an exterior surface, said device including substantially within said surface a structure, a cylinder assembly, a component reciprocatable within said assembly and filamentary material, said component having at least one external circumferential projection, said cylinder assembly having at least one internal circumferential depression in which said projection is positioned to reciprocate, in operation said projection and depression defining a pair of toroidal fluid working chambers of cyclically variable capacity, said structure located outside said cylinder assembly and within said exterior surface, said structure together with said assembly at least partly defining a volume for passage of fluids to or from said working chambers, said volume containing said filamentary material and at least partly surrounding portion of said cylinder assembly.

131. The device of claim 130, including a casing, wherein said exterior surface is substantially that of said casing.

132. The device of claim 131, including means to mount said cylinder assembly in said casing to enable said cylinder assembly to rotate while said component is reciprocating in said cylinder assembly.

133. The device of claim 131, wherein said casing is at least partly of thermally insulating material.

134. The device of claim 130, including means between said assembly and said component so as to cause said component to rotate relative to said assembly while reciprocating in said assembly.

135. The device of claim 134, wherein said means comprise a guide and an endless track, said guide movable in said endless track, said track having a multiple waveform configuration.

136. The device of claim 135, wherein said guide is disengagable from said track during operation of said device.

137. The device of claim 134, wherein said means comprise said component and said cylinder assembly define complementary surfaces at least partly of endless wave-like configuration.

138. The device of claim 134, including a rotatable shaft and a load transfer mechanism between said shaft and said rotatable and reciprocatable component, wherein said mechanism comprises a hollow shaft with interior splines slidable on a shaft with external splines.

139. The device of claim 132, including a rotatable shaft and a load transfer mechanism between said shaft and said component, wherein said mechanism includes at least one pair of substantially parallel flanges separated by at least one roller, the flanges in operation moving laterally relatively to one another.

140. The device of claim 130, wherein at least one of said cylinder assembly and said component is at least partly composed of ceramic material.

141. The device of claim 140, including at least one electrical circuit within said ceramic material.

142. The device of any one of claims 1, 3, 11, 85, 91, 103, 105, 132 or 140, wherein said device is an internal combustion engine and at least one said fluid working chamber functions as a combustion chamber, said engine having a charge gas supply system, a fuel delivery apparatus and an emission control system for hot exhaust gas emitted from said engine when operative, said engine having no purposely designed means for transferring heat from said combustion chamber, such means including fluid circulating in a jacket adjacent to said assembly or cooling fins radiating from said assembly.

143. The device of claim 142, wherein said device is part of a compound engine including a turbine engine stage, in operation said hot exhaust gas being used to at least partly power said turbine engine stage.

144. The device of claim 130, including at least one fastener, wherein at least one of said component and said cylinder assembly includes a multiplicity of elements held in assembled condition by said at least one fastener loaded under tension.

145. The device of claim 144, wherein said fastener is of tubular form.

146. The device of claim 130, wherein said assembly comprises at least one pair of substantially identical components arranged in mirror image about one another.

147. The device of claim 146, including at least one port located in said cylinder assembly for passage of fluid to or from said working chambers, wherein said port is positioned between said pair of components.

148. The device of claim 130, wherein said component defines a passage for fluids worked by said device.

149. The device of claim 148, including filamentary material contained in said passage, wherein said filamentary material includes substance having catalytic effect to hasten chemical reaction in said working fluid.

150. The device of claim 130, including cylinder assembly surfaces and component surfaces at least partly defining said working chambers, at least one of said surfaces having at least one relatively small deliberately manufactured depression, said depression wholly fillable by fluids worked by said device.

151. The device of claim 130, wherein said filamentary material includes substance having catalytic effect to hasten chemical reaction in said working fluid.

152. The device of claim 130, wherein said structure is at least partly composed of thermally insulating material.

153. The device of claim 130, wherein said device is a reciprocating internal combustion engine and said working chambers are combustion chambers, said engine having a charge gas supply system, a fuel delivery apparatus and an emission control system for hot exhaust gas emitted from said engine when operative.

154. The device of claim 153, wherein said fuel delivery apparatus includes at least one injector assembly for delivery of at least two distinct fluids independently of one another.

155. The device of claim 153, wherein said emission control system includes at least one valve for restricting flow of said exhaust gas during selected operating periods of said reciprocating internal combustion engine.

156. The device of claim 153, wherein said engine has no purposely designed means for transferring heat from said combustion chamber, such means including fluid circulating in a jacket adjacent to said assembly or cooling fins radiating from said assembly.

157. A device for processing fluids, said device substantially defined by a casing having an exterior surface and thermal insulation, said casing at least partly supporting and enclosing at least one cylinder assembly including a cylinder and at least one cylinder head, said assembly containing a component reciprocatable therein to define at least one working chamber of cyclically varying capacity located between said component said cylinder and said cylinder head, wherein said device is an un-cooled reciprocating internal combustion engine and said working chamber functions as a combustion chamber, said engine having a charge gas supply system, a fuel delivery apparatus and an emission control system for hot exhaust gas emitted from said engine when operative, said engine having no purposely designed means for transferring heat from said assembly nor any circulating liquid lubrication between said component and said cylinder.

158. The device of claim 157, wherein at least one of said cylinder, said cylinder head and said component is substantially of ceramic material.

159. The device of claim 158, including at least one electrical circuit within said ceramic material.

160. The device of claim 157, including at least one fastener, wherein at least one of said component and said cylinder assembly includes a multiplicity of elements held in assembled condition by said fastener loaded under tension.

161. The device of claim 157, including cylinder assembly surfaces and component surfaces at least partly defining said working chambers, at least one of said surfaces having at least one relatively small deliberately manufactured depression, said depression wholly fillable by fluids worked by said device.

162. The device of claim 157, including structure located substantially within said surface and outside and proximate to said cylinder assembly, said structure at least partly defining at least one volume for passage of fluids to or from said working chamber, said volume being adjacent to and at least partly surrounding portion of said cylinder assembly.

163. The device of claim 157, wherein said device is part of a compound engine including a turbine engine stage, in operation said hot exhaust gas being used to at least partly power said turbine engine stage.

164. The device of claim 157, wherein said fuel delivery apparatus includes at least one injector assembly for delivery of at least two distinct fluids independently of one another.

165. The device of claim 157, wherein said emission control system includes at least one valve for restricting flow of said exhaust gas during selected operating periods of said reciprocating internal combustion engine.

166. The device of claim 157, wherein said assembly comprises at least one pair of substantially identical components arranged in mirror image about one another.

167. The device of claim 157, wherein said component defines a passage for fluids worked by said device.

168. The device of claim 157, including means to mount said cylinder assembly in said casing to enable said cylinder assembly to rotate while said component is reciprocating in said cylinder assembly.

169. The device of claim 157, said cylinder assembly having two heads and said cylinder having at least one internal circumferential depression, said component having at least one external circumferential projection, said projection reciprocatable in said depression to form two said chambers of toroidal configuration.

170. The device of claim 157, including means between said assembly and said component so as to cause said component to rotate relative to said assembly while reciprocating in said assembly.

171. The device of claim 170, wherein said means comprise a guide and an endless track, said guide movable in said endless track, said track having a multiple wave-form configuration.

172. The device of claim 170, wherein said means comprise said component and said cylinder assembly defining complementary surfaces at least partly of an endless wave-like configuration.

173. The device of claim 170, including a rotatable shaft and a load transfer mechanism between said shaft and said rotatable and reciprocatable component, wherein said mechanism comprises a hollow shaft with interior splines slidable on a shaft with external splines.

174. The device of claim 170, including a rotatable shaft and a load transfer mechanism between said shaft and said component, wherein said mechanism includes a bellows device.

175. The device of claim 170, including a rotatable shaft and a load transfer mechanism between said shaft and said component, wherein said mechanism includes at least one hinged element.

176. The device of claim 170, including a rotatable shaft and a load transfer mechanism between said shaft and said component, wherein said mechanism includes at least one pair of substantially parallel flanges separated by at least one roller, the flanges in operation moving laterally relatively to one another.

177. The device of claim 157, wherein said device is part of a compound engine including a steam engine stage, in operation said hot exhaust gas being used to at least partly power said steam engine stage.

178. The device of claim 157, wherein said device is part of a compound engine including a Stirling engine stage, in operation said hot exhaust gas being used to at least partly power said Stirling engine stage.

179. The device of any one of claims 1, 21, 25, 42, 74, 81, 99, 103, 126, 130, 153 or 157 including a crankshaft and a connecting element for transfer of loads associated with said working chambers, said element mechanically linking said component to said crankshaft.

180. the device of claim 179, wherein in normal operation said loads are substantially tensile, said element transferring said loads to or from said crankshaft primarily by a pulling action rather than a pushing action.

181. The device of any one of claims 21, 42, 74, 99, 126 or 157, including a first space for transfer of fluid to at least one said working chamber, at least one additional space for transfer of fluid from said working chamber, wherein at least one of said spaces contains filamentary material, said filamentary material including at least some substance having catalytic effect to hasten chemical reaction in said fluid.

* * * * *